US008378939B2

(12) United States Patent
Kimura

(10) Patent No.: US 8,378,939 B2
(45) Date of Patent: Feb. 19, 2013

(54) SEMICONDUCTOR DEVICE

(75) Inventor: Hajime Kimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 911 days.

(21) Appl. No.: 10/886,374

(22) Filed: Jul. 8, 2004

(65) Prior Publication Data

US 2005/0083272 A1 Apr. 21, 2005

(30) Foreign Application Priority Data

Jul. 11, 2003 (JP) ..... 2003-273765

(51) Int. Cl.
*G09G 3/32* (2006.01)

(52) U.S. Cl. ..... 345/82; 345/100; 315/169.1

(58) Field of Classification Search .... 315/169.1–169.4; 345/74–83

See application file for complete search history.

(56) References Cited

U.S. PATENT DOCUMENTS

| | | | | |
|---|---|---|---|---|
| 5,686,936 | A | 11/1997 | Maekawa et al. | |
| 5,723,950 | A | 3/1998 | Wei et al. | |
| 6,069,674 | A * | 5/2000 | Aomori et al. | 349/12 |
| 6,229,506 | B1 | 5/2001 | Dawson et al. | |
| 6,369,515 | B1 * | 4/2002 | Okuda | 315/169.3 |
| 6,373,454 | B1 | 4/2002 | Knapp et al. | |
| 6,501,466 | B1 * | 12/2002 | Yamagishi et al. | 345/204 |
| 6,774,577 | B2 * | 8/2004 | Choi | 315/169.3 |
| 6,909,243 | B2 * | 6/2005 | Inukai | 315/169.3 |
| 6,943,500 | B2 * | 9/2005 | LeChevalier | 315/169.3 |
| 6,960,889 | B2 * | 11/2005 | Park et al. | 315/169.2 |
| 6,985,124 | B1 * | 1/2006 | Nogawa | 345/55 |
| 6,989,826 | B2 | 1/2006 | Kasai | |
| 6,999,048 | B2 | 2/2006 | Sun et al. | |
| 7,015,882 | B2 * | 3/2006 | Yumoto | 345/76 |
| 7,034,787 | B2 | 4/2006 | Date et al. | |
| 7,057,589 | B2 * | 6/2006 | Shin et al. | 345/82 |

(Continued)

FOREIGN PATENT DOCUMENTS

| | | | |
|---|---|---|---|
| EP | 0 678 848 | A1 | 10/1995 |
| EP | 1 130 565 | A1 | 9/2001 |

(Continued)

OTHER PUBLICATIONS

Reiji Hattori et al; "Circuit Simulation of Poly-Si TFT Based Current-writing Active-Matrix Organic LED Display"; *Technical Report of IEICE*; pp. 7-14; 2001 (English Abstract).

(Continued)

*Primary Examiner* — Michael Pervan
(74) *Attorney, Agent, or Firm* — Fish & Richardson P.C.

(57) ABSTRACT

A semiconductor device which can supply an accurate current without being affected by the variation of transistors for supplying currents to EL pixels even when the signal current is small is provided. A video signal voltage is inputted to each signal line dot-sequentially. This operation corresponds to a precharge operation to a video signal current which is inputted subsequently. After the input of the video signal voltage, a video signal current is inputted to each signal line. Accordingly, an effect of variation of a transistor in each pixel can be reduced. In addition, since a video signal voltage is inputted prior to the input of a video signal current, signal writing speed can be increased even when the signal current is small. Further, as a video signal voltage is inputted dot-sequentially, simple configuration can be realized.

11 Claims, 89 Drawing Sheets

U.S. PATENT DOCUMENTS

| | | | |
|---|---|---|---|
| 7,180,513 | B2 | 2/2007 | Tsuge |
| 7,256,756 | B2 | 8/2007 | Abe |
| 7,304,621 | B2 | 12/2007 | Oomori et al. |
| 7,515,121 | B2 | 4/2009 | Sato et al. |
| 7,864,171 | B2 | 1/2011 | Oomori et al. |
| 8,085,226 | B2 | 12/2011 | Kimura |
| 2002/0167478 | A1 | 11/2002 | LeChevalier |
| 2003/0001828 | A1 | 1/2003 | Asano |
| 2003/0006713 | A1 | 1/2003 | Kim et al. |
| 2003/0030602 | A1 | 2/2003 | Kasai |
| 2003/0043131 | A1 | 3/2003 | Iguchi |
| 2003/0048669 | A1 | 3/2003 | Abe |
| 2003/0122745 | A1 | 7/2003 | Miyazawa |
| 2003/0128200 | A1 | 7/2003 | Yumoto |
| 2003/0160744 | A1 | 8/2003 | Yoshida et al. |
| 2003/0214245 | A1 | 11/2003 | Yamazaki et al. |
| 2005/0030264 | A1 | 2/2005 | Tsuge et al. |
| 2005/0041002 | A1 | 2/2005 | Takahara et al. |
| 2005/0057189 | A1 | 3/2005 | Kimura |
| 2005/0057580 | A1 | 3/2005 | Yamano et al. |
| 2006/0119552 | A1 | 6/2006 | Yumoto |
| 2006/0139279 | A1 | 6/2006 | Yamazaki et al. |
| 2006/0284800 | A1 | 12/2006 | Kimura |
| 2007/0217275 | A1 | 9/2007 | Abe |
| 2012/0086061 | A1 | 4/2012 | Kimura |

FOREIGN PATENT DOCUMENTS

| | | | |
|---|---|---|---|
| EP | 1274065 | | 1/2003 |
| EP | 1 282 104 | A1 | 2/2003 |
| EP | 1 288 901 | A2 | 3/2003 |
| EP | 1 291 839 | A2 | 3/2003 |
| EP | 1 321 922 | A2 | 6/2003 |
| EP | 1 333 422 | A1 | 8/2003 |
| EP | 1341147 | | 9/2003 |
| EP | 1 494 203 | A2 | 1/2005 |
| JP | 07-295520 | A | 11/1995 |
| JP | 11-003067 | | 1/1999 |
| JP | 2002-514320 | | 5/2002 |
| JP | 2002-517806 | | 6/2002 |
| JP | 2003-050564 | | 2/2003 |
| JP | 2003-66908 | | 3/2003 |
| JP | 2003-066908 | | 3/2003 |
| JP | 2003-076327 | | 3/2003 |
| JP | 2003-099001 | | 4/2003 |
| JP | 2003-108065 | | 4/2003 |
| JP | 2003-114645 | | 4/2003 |
| JP | 2003-150082 | | 5/2003 |
| JP | 2003-150116 | | 5/2003 |
| JP | 2003-157049 | | 5/2003 |
| JP | 2003-177709 | | 6/2003 |
| JP | 2003-195812 | | 7/2003 |
| JP | 2003-195815 | A | 7/2003 |
| JP | 2004-021219 | A | 1/2004 |
| JP | 2004-309924 | A | 11/2004 |
| JP | 2004-354758 | | 12/2004 |
| JP | 2005-099745 | A | 4/2005 |
| WO | WO 98/48403 | A1 | 10/1998 |
| WO | WO 01/06484 | A1 | 1/2001 |
| WO | WO 02/39420 | A1 | 5/2002 |
| WO | WO-03/023750 | | 3/2003 |
| WO | WO-03/023752 | | 3/2003 |
| WO | WO-03/027998 | | 4/2003 |
| WO | WO 03/038793 | A1 | 5/2003 |
| WO | WO 03/038794 | A1 | 5/2003 |
| WO | WO 03/038795 | A1 | 5/2003 |
| WO | WO 03/038796 | A1 | 5/2003 |
| WO | WO 03/038797 | A1 | 5/2003 |
| WO | WO-03/092165 | | 11/2003 |
| WO | 2004/001714 | A1 | 12/2003 |

OTHER PUBLICATIONS

Han-Sang Lee et al.; "An Improved Driving Method Using Precharge for Active Matrix OLED Displays"; *IDRC 03*; pp. 285-287; 2003.

M. Shimoda et al.; "New Pixel-Driving Scheme with Data-Line Pre-Charge Function for Active Matrix Organic Light Emitting Diode Displays"; AMD3-3, *IDW '02*; pp. 239-242; 2002.

Reiji Hattori et al; "Circuit Simulation of Poly-Si TFT Based Current-writing Active-Matrix Organic LED Display"; *Technical Report of IEICE*; vol. 101, No. 15, pp. 7-14; 2001 (English Abstract).

Han-Sang Lee et al.; "An Improved Driving Method Using Precharge for Active Matrix OLED Displays"; *Conference Record of the 2003 IDRC*(*International Display Research Conference*); pp. 285-287; 2003.

* cited by examiner

SEMICONDUCTOR DEVICE

TECHNICAL FIELD

The present invention relates to a semiconductor device equipped with a function to control a current supplied to a load with a transistor, and more particularly to a semiconductor device comprising pixels each including a current-driven type light emitting element whose luminance varies with current and a circuit for supplying signals to the pixels.

BACKGROUND ART

Among driving methods of a display device using self-luminous light emitting elements typified by organic light emitting diodes (OLEDs) (also referred to as organic EL elements, electro luminescence (EL) elements and the like), there are known a passive matrix method and an active matrix method. The former has a simple structure, but has a problem that a large and high-luminance display cannot be realized easily. Therefore, the active matrix method has been recently developed which controls a current flowing to a light emitting element with a thin film transistor (TFT) provided in a pixel circuit.

In the case of a display device using the active matrix method, a problem is recognized that currents flowing to light emitting elements vary due to the variation in the current characteristics of driving TFTs, leading to luminance variation. That is, driving TFTs for driving currents flowing to light emitting elements are employed in pixel circuits. When the characteristics of these driving TFTs vary, currents flowing to the light emitting elements also vary, leading to luminance variation. In view of this, various circuits for suppressing luminance variation are proposed in which currents flowing to light emitting elements do not vary even when the characteristics of driving TFTs in pixel circuits vary (see Patent Documents 1 to 4, for example).

[Patent Document 1]

Published Japanese Translation of PCT International Publication for Patent Application No. 2002-517806.

[Patent Document 2]

International Publication WO01/06484.

[Patent Document 3]

Published Japanese Translation of PCI International Publication for Patent Application No. 2002-514320.

[Patent Document 4]

International Publication WO02/39420.

Patent Documents 1 to 3 each discloses a circuit configuration for preventing variation in current values flowing to light emitting elements due to the variation in the characteristics of driving TFTs disposed in pixel circuits. This configuration is referred to as a current write type pixel or a current input type pixel. Patent Document 4 discloses a circuit configuration for suppressing variation in signal currents due to the variation of TFTs in a source driver circuit.

FIG. 6 shows a first exemplary configuration of a conventional active matrix display device disclosed in Patent Document 1. The pixel in FIG. 6 comprises a source signal line 601, first to third gate signal lines 602 to 604, a current supply line 605, TFTs 606 to 609, a storage capacitor 610, an EL element 611 and a current source for video signal current input 612.

Operations from signal current writing to light emission are described now with reference to FIG. 7. Reference numerals given to each portion are based upon those in FIG. 6. FIGS. 7A to 7C schematically show current flows. FIG. 7D shows a relationship of a current flow through each path when signal currents are written. FIG. 7E shows a voltage accumulated in the storage capacitor 610, namely a gate-source voltage of the TFT 608 when signal currents are written as well.

First, pulses are inputted to the first gate signal line 602 and the second gate signal line 603, thereby the TFTs 606 and 607 are turned ON. At this time, a current flow through the source signal line, namely a signal current is referred to as Idata.

Since the current Idata flows through the source signal line, current paths in the pixel branches into $I_1$ and $I_2$ as shown in FIG. 7A. FIG. 7D shows their relationship. It is needless to say that $Idata=I_1+I_2$ is satisfied.

At the moment at which the TFT 606 is turned ON, the storage capacitor 610 has not yet held charges, therefore, the TFT 608 is OFF. Accordingly, $I_2=0$ and $Idata=I_1$ are satisfied. That is, a current only flows in accordance with the charge accumulation in the storage capacitor 610.

After that, charges are gradually accumulated in the storage capacitor 610, and a potential difference starts to be generated between opposite electrodes thereof (FIG. 7E). When the potential difference between the opposite electrodes reaches Vth (point A in FIG. 7E), the TFT 608 is turned ON, generating $I_2$. Since $Idata=I_1+I_2$ is satisfied as set forth above, $I_1$ decreases gradually, however, current still flows, and thus the storage capacitor further accumulates charges.

The storage capacitor 610 keeps on accumulating charges until the potential difference between the opposite electrodes thereof, namely the gate-source voltage of the TFT 608 reaches a voltage (VGS) required for the TFT 608 to flow current Idata. When the charge accumulation terminates point B in FIG. 7E) in the meantime, the current $I_1$ does not flow any more, and a current corresponding to VGS at this time flows into the TFT 608, thereby $Idata=I_2$ is satisfied (FIG. 7B). Accordingly, a steady state is obtained. The signal writing operation is completed in this manner. At the end, selection of the first gate signal line 602 and the second gate signal line 603 terminates, and thus the TFTs 606 and 607 are turned OFF.

Subsequently, the operation proceeds to a light emitting operation. A pulse is inputted to the third gate signal line 604, thereby the TFT 609 is turned ON. The storage capacitor 610 holds the previously written VGS, therefore, the TFT 608 is ON and the current Idata flows therethrough from the current supply line 605. Accordingly, the EL element 611 emits light. At this time, if the TFT 608 is set to operate in the saturation region, Idata can flow constantly even when the source-drain voltage of the TFT 608 changes.

In this manner, the operation of outputting a set current is hereinafter referred to as an output operation. Such current write type pixel has an advantage that even in the case where the TFT 608 has variation in the characteristics and the like, the storage capacitor 610 can hold the gate-source voltage which is required to flow the current Idata, therefore, a predetermined current can be supplied to an EL element accurately, which makes it possible to suppress luminance variation due to the variation in the characteristics of TFTs.

The aforementioned examples are related to a technique of correcting variation in currents due to the variation of driving TFTs in pixel circuits. The same problem occurs in a source driver circuit. Patent Document 4 discloses a circuit configuration for preventing variation in signal currents due to the manufacturing tolerance of TFTs in a source driver circuit. [Patent Document 5] Japanese Patent Laid-Open No. 2003-66908.

Patent Document 5 discloses a configuration comprising a voltage source as well as a current source for controlling gray scales, wherein a charge of a floating capacitor is instantaneously changed by the voltage source at the beginning of the row selection period by using a power source switching means for switching the two power sources inputted to a source signal line, and gray scales are displayed by a current source 10 to obtain a predetermined luminance.

DISCLOSURE OF THE INVENTION

Problems to be Solved by the Invention

However, since the parasitic capacitance of a wiring used for supplying signal currents to a driving TFT and a light emitting element is quite large, a time constant for charging the parasitic capacitance of the wiring becomes inevitably large, according to this, there is a problem that signal writing speed becomes slow when a signal current is small. That is, a problem is posed that signal writing speed becomes slow even if signal currents are supplied to a transistor since time required to generate a voltage at the gate terminal to flow the current becomes longer.

Patent Document 5 discloses a configuration for instantaneously changing a charge of a source signal line, however, a voltage supplied at the beginning of the row selection period is not an optimal level. Further, the configuration is complex.

In view of the foregoing problems, it is an object of the invention to provide a semiconductor device which can reduce an effect of the characteristic variation of transistors while supplying a predetermined current, whereby signal writing speed can be improved sufficiently even when the signal current is small.

Means for Solving the Problems

The aforementioned object of the invention is achieved by supplying a voltage at an optimal level in advance at an input thereof to a pixel.

A semiconductor device of the invention is characterized by comprising a circuit for controlling a current supplied to a load with a transistor whose source or drain is connected to a current source circuit, and an amplifier circuit is provided for controlling the gate-source voltage and the drain-source voltage of the transistor when a current is supplied to the transistor from the current source circuit.

A semiconductor device of the invention is characterized by comprising a video voltage signal line, a plurality of signal lines, a plurality of voltage control switches, a plurality of current source circuits and a plurality of current control switches, wherein the signal lines are connected to the video voltage signal line through the voltage control switches respectively, and the current source circuits are connected to the signal lines through the current control switches respectively.

The invention having the aforementioned configuration is further characterized by comprising a video current signal line for supplying a current to the current source circuits.

The invention having the aforementioned configuration is further characterized by comprising a driver circuit for sequentially selecting the voltage control switches.

The invention having the aforementioned configuration is further characterized by comprising a driver circuit for sequentially supplying a current from the video current signal line to the current source circuits.

The invention having the aforementioned configuration is further characterized by comprising a voltage/current supply circuit for supplying a signal current to the video current signal line and supplying a signal voltage to the video voltage signal line.

According to the invention having the aforementioned configuration, it is characterized that the signal voltage is a precharge voltage for a pixel which is connected to the signal lines.

Transistors applicable to the invention are not limited to a certain type, and such transistors can be employed as a thin film transistor (TFT) which uses a non-single crystalline semiconductor film typified by amorphous silicon and polycrystalline silicon, a MOS transistor formed by using a semiconductor substrate or an SOI (Silicon On Insulator) substrate, a junction transistor, a transistor using an organic semiconductor or a carbon nanotube and other transistors. In addition, a substrate over which is formed the transistor is not limited to a certain type, and a single crystalline substrate, an SOI substrate, a glass substrate and the like can be employed.

Note that connection means electrical connection in the invention. Accordingly, in the structure disclosed in the invention, other elements (such as other elements or switches, for example) which enable electrical connection may be disposed between a predetermined connection.

Effect of the Invention

According to the invention, an effect of the characteristic variation of transistors can be reduced while a predetermined current can be supplied, whereby signal writing speed can be improved sufficiently even when the signal current is small. Further, by controlling the size of each transistor and the amount of current, a precharge voltage at an optimal level can be supplied.

BEST MODE FOR CARRYING OUT THE INVENTION

Embodiment Mode 1

Although the invention will be fully described by way of Embodiment Modes and Embodiments with reference to the accompanying drawings, it is to be understood that various changes and modifications will be apparent to those skilled in the art. Therefore, unless otherwise such changes and modifications depart from the scope of the invention, they should be construed as being included therein.

In the invention, a pixel is formed by an element whose emission luminance can be controlled by a current value flowing to a light emitting element. Typically, an EL element can be employed. There are known various structures of EL elements, any of which can be applied to the invention as long as an emission luminance thereof can be controlled by a current value. That is, an EL element is formed by appropriately combining a light emitting layer, a charge transporting layer or a charge injection layer. As for the material, low molecular weight organic materials, medium molecular weight organic materials (organic light-emitting materials having no sublimation property and monomer unit of 20 or less or chain molecules with a length of 10 ì m or *less*) and high molecular weight organic materials can be *used*. A*lternatively*, these *materials* may be mixed with or dispersed into inorganic *materials*.

FIG. 1 shows an overall exemplary configuration. A signal line 102*a* is connected to a plurality of pixels 109*aa* to 109*ad*. Similarly, a signal line 102*b* is connected to a plurality of pixels 109*ba* to 109*bd*, and a signal line 102*c* is connected to a plurality of pixels 109*ca* to 109*cd*.

The signal line 102*a* is connected to a video voltage signal line 101 through a voltage control switch 104*a*, and also connected to a current source circuit 107*a* through a current control switch 105*a*. Similarly, the signal line 102*b* is connected to the video voltage signal line 101 through a voltage control switch 104*b*, and also connected to a current source circuit 107*b* through a current control switch 105*b*. The same applies to the signal line 102*c*. The voltage control switches 104*a* to 104*c* are controlled by a voltage control shift register 103 through sampling selection lines 106*a*, 106*b* and 106*c* respectively.

The operation of FIG. 1 is described now. First, as shown in FIG. 2, the voltage control switch 104*a* is turned ON by the voltage control shift register 103, and a video signal voltage is inputted from the video voltage signal line 101 to the pixel 109*aa*. The video signal voltage at this time is at a corresponding level to the display of the pixel 109*aa*.

However, the video signal voltage is not necessarily inputted to the pixel 109*aa* at this time. It is only required that a potential of the signal line 104*a* is charged up to the video signal voltage.

Next, as shown in FIG. 3, the voltage control switch 104*b* is turned ON by the voltage control shift register 103, and a video signal voltage is inputted to the pixel 109*ba* from the video voltage signal line 101. The video signal voltage at this time is at a corresponding level to the display of the pixel 109*ba*.

Similarly, as shown in FIG. 4, the voltage control switch 104*c* is turned ON by the voltage control shift register 103, and a video signal voltage is inputted from the video voltage signal line 101 to the pixel 109*ca*.

Then, as shown in FIG. 5, the current control switches 105*a* to 105*c* are turned ON, and video signal currents are inputted from the current source circuits 107*a* to 107*c* to the pixels 109*aa* to 109*ca*. The video signal currents at this time have a corresponding amount to the display of the respective pixels.

At this time, the video signal voltages have been inputted prior to the input of the video signal currents as shown in FIGS. 2 to 4. Therefore, potentials of the signal lines 102*a* to 102*c* at the point at which the video signal voltages are inputted are roughly equal to those when a steady state is obtained by inputting video signal currents in FIG. 5 (namely, when a signal input is complete). However, current characteristics of transistors in the pixels 109*aa* to 109*ca* vary in some cases. In such a case, each of the signal lines 102*a* to 102*c* has a potential difference between the point at which a video signal voltage is inputted and the point at which a steady point is obtained by inputting a video signal current (namely, when a signal input is complete). Hereupon, by inputting video signal currents as shown in FIG. 5, an effect of the variation in current characteristics of the transistors in the pixels 109*aa* to 109*ca* is reduced. Accordingly, luminance variation among each pixel can be reduced, leading to a display at an accurate luminance.

That is, it can be considered that the operations from FIGS. 2 to 4 correspond to a precharge operation prior to the input of a video signal current in FIG. 5. The reason why a video signal voltage is not necessarily required to be inputted to each pixel in FIGS. 2 to 4 is that the aforementioned operations correspond to the precharge operation. Needless to say, a video signal voltage may be inputted to each pixel in FIGS. 2 to 4.

According to the operations as set forth above, a steady state (completion of an signal input) can be promptly obtained even when a video signal current is small.

In addition, the amount of the video signal current changes according to luminance. Therefore, it is not easy to control the level of the video signal voltage (precharge voltage) according to the aforementioned change in current. In order to realize this, a number of circuits are required. Accordingly, a layout area is increased, power consumption is increased or manufacturing yields are declined which leads to an increased cost. However, the invention makes it possible to control a level of the video signal voltage (precharge voltage) easily since the video signal voltage (precharge voltage) is supplied from the video voltage signal line 101 to each pixel with a dot sequential drive. Further, as the circuit configuration is simple, such problems can be avoided as an increased layout area, increased power consumption, declined manufacturing yields and increased cost.

According to the operations as set forth above, a video signal input to the pixels 109*aa* to 109*ca* in the first row is completed. Then, signals are inputted to the pixels 109*ab* to 109*cb* in the second row as in FIGS. 2 to 5. Similarly, video signals are inputted to the third and subsequent rows.

In this manner, in FIGS. 2 to 5, one horizontal period is divided into two, and a video signal voltage (precharge voltage) is inputted in the former half while a video signal current is inputted in the latter half. However, the invention is not limited to this.

For example, such operation flow can be employed as FIG. 2 FIG. 8→FIG. 9 FIG. 5. That is, one horizontal period is not divided into the former half and the latter half corresponding to an input period of video signal voltages (precharge voltages) and an input period of video signal currents as shown in FIGS. 2 to 5, but instead, video signal currents may be sequentially inputted after the completion of an input of video signal voltages (precharge voltages) as shown in FIGS. 2, 8, 9 and 5. Accordingly, long period can be provided for inputting video signal currents. When a long period is provided for inputting video signal currents, signal current writing can be performed with enough time, therefore, an effect of variation of transistors can be further reduced.

However, in that case, periods for inputting video signal currents differ between the case of inputting video signal currents from the earlier stages (the signal line 102*a*, for example) and the case of inputting video signal currents from the latter stages (the signal line 102*c*, for example). As a result, there might be a case where a sufficient steady state is not obtained with the short input period of video signal currents (the signal line 102*c*, for example). Hereupon, video signal voltages or video signal currents may be inputted from the signal line 102*c* in order, instead of constantly inputting them from the signal line 102*a* in order. Such change of orders may be carried out per row or per fame period.

Note that FIG. 1 shows a configuration having only one video voltage signal line 101, however, the invention is not limited to this. As shown in FIG. 10, a plurality of video voltage signal lines 101*a* and 101*b* may be disposed, and video signal voltages (precharge voltages) may be inputted to the signal lines (102*a*, 102*b*, 102*c* and the like) in a plurality of columns at the same time.

Note that FIG. 1 shows a configuration in which the video voltage signal line 101 is connected to the signal lines 102*a*, 102*b* and 102*c* through the voltage control switches 104*a*, 104*b* and 104*c* respectively, however, the invention is not limited to this. For example, as shown in FIG. 11, voltage memory circuits 1101*a* and 1101*b* may be respectively disposed between the voltage control switch 104*a* and the signal line 102*a* and between the voltage control switch 104*b* and the signal line 102*b*. The voltage memory circuits 1101*a* and 1101*b* each has a function to output an inputted voltage. It may also output a previously inputted voltage simultaneously with an input of a voltage at a certain level. By disposing such circuits, signal input timing can be made flexible.

Note that FIG. 1 shows a configuration having 4 rows×3 columns of pixels, however, the invention is not limited to this and an arbitrary number of pixels may be disposed.

Note also that FIG. 1 shows a configuration having three signal lines (the signal lines 102*a* to 102*c*), however, the invention is not limited to this and an arbitrary number of signal lines may be disposed.

Note also that FIG. 1 shows a configuration where a current flows in the direction from each pixel to the current source circuit 107*a* and the like, however, the invention is not limited to this. The current flow direction may be changed in accordance with the circuit configuration of the pixel and the like.

Embodiment Mode 2

Embodiment Mode 1 showed the case where one signal line is disposed per column of pixels. This embodiment mode shows the case where a plurality of signal lines are disposed per column of pixels.

Note that for sake of simplicity, shown here is the case where two signal lines are disposed per column of pixels, and 4 rows×2 columns of pixels are disposed. However, the invention is not limited to this. It is also possible that an arbitrary number of signal lines are disposed per column of pixels and an arbitrary number of pixels is disposed.

As described in Embodiment Mode 1, in the case where one signal line is disposed per column of pixels, signals for one column is required to be inputted during one horizontal period. Therefore, for example, video signal voltages (precharge voltages) are inputted in the former half of one horizontal period while video signal currents are inputted in the latter half thereof. In such a case, a period for inputting video signal currents to pixels is not sufficiently long, therefore, it cannot be avoided in some cases that a signal input has to terminate before the steady state (completion of a signal input) is obtained.

Hereupon, by providing a plurality of signal lines per column of pixels, the period for inputting video signal currents to pixels can be made longer.

FIG. 12 shows a configuration diagram for the case where two signal lines are disposed per column of pixels, and 4 rows×2 columns of pixels are disposed. The pixels in the first column are connected to signal lines 1202*aa* and 1202*ab* such that pixels in the even-numbered rows are connected to the signal line 1202*aa* while pixels in the odd-numbered rows are connected to the signal line 1202*ab*. Accordingly, signals can be inputted to pixels in two rows at the same time. Note that the signal lines 1202*aa*, 1202*ab*, 1202*ba* and 1202*bb* are connected to the video voltage signal line 101 through voltage control switches 1204*aa*, 1204*ab*, 1204*ba* and 1204*bb* respectively. The signal lines 1202*aa* and 1202*ab* are also connected to the current source circuit 107*a* through current control switches 1205*ab* and 1205*aa* respectively. Similarly, the signal lines 1202*ba* and 1202*bb* are connected to the current source circuit 107*b* through current control switches 1205*bb* and 1205*ba* respectively.

In the case of FIG. 12, two signal lines are disposed per column of pixels, therefore, signal input to one row of pixels may be completed in 2× horizontal period, namely in a period twice longer than one horizontal period. First, video signal voltages (precharge voltages) are inputted in one horizontal period. Then, video signal currents may be inputted in another horizontal period. Further, as two signal lines are disposed, video signal currents can be inputted to pixels in a certain row while video signal voltages (precharge voltages) are inputted to pixels in another row.

FIGS. 13 to 16 show the operation thereof. In FIGS. 13 and 14, video signal currents are inputted to the pixels in the first row while video signal voltages (precharge voltages) are inputted to the pixels in the second row. It is assumed that video signal voltages (precharge voltages) have been already inputted to the signal lines 1202*ab* and 1202*bb* prior to FIG. 13. Then, as shown in FIGS. 15 and 16, video signal currents are inputted to the pixels in the second row while video signal voltages (precharge voltages) are inputted to the pixels in the third row. At this time, as the pixels in the second row have already been inputted with video signal voltages (precharge voltages), a steady state can be obtained promptly at an input of the video signal currents.

Through the repetition of such operations, video signal currents can be written with accuracy.

Note that in FIGS. 13 and 15, video signal voltages (precharge voltages) are inputted to the pixels 1209*ab* and 1209*bb* while the video signal voltages (precharge voltages) are not inputted to the pixels 1209*ab* and 1209*bb* by turning OFF switches 1210*ab* and 1210*bb* disposed in the pixels 1209*ab* and 1209*bb* respectively, however, the invention is not limited to this. The primary object of the input of the video signal voltages (precharge voltages) is to control potentials of the respective signal lines 1202*aa*, 1202*ab*, 1202*ba* and 1202*bb*. Therefore, the video signal voltages (precharge voltages) may be either inputted to the pixels 1209*ab* and 1209*bb* or not inputted. In the case where video signal currents are inputted after the input of the video signal voltages (precharge voltages), the video signal voltages (precharge voltages) may not be necessarily inputted. In the case where video signal currents are not inputted after the input of the video signal voltages (precharge voltages), it is desirable that the video signal voltages (precharge voltages) be inputted to the pixels 1209*ab* and 1209*bb*.

Note that video signal currents may be sequentially inputted after the completion of an input of video signal voltages (precharge voltages) as shown in FIGS. 2, 8, 9 and 5 in Embodiment Mode 1. However, in this case, currents are required to be supplied to two rows at a time, therefore, a plurality of current source circuits are required to be disposed for one column.

Note that description of this embodiment mode corresponds to a partial modification of the configuration described in Embodiment Mode 1. Accordingly, the description of Embodiment Mode 1 can be applied to this embodiment mode as well.

Therefore, even though the video voltage signal line 101 is connected to the signal lines 1202*aa* to 1202*bb* through the voltage control switches 1204*aa* to 1204*bb* respectively, the invention is not limited to this configuration. For example, voltage memory circuits 1702*aa* to 1702*bb* may be disposed therebetween as shown in FIG. 17. By disposing such circuits, signal input timing can be made flexible.

In addition, the invention is not limited to this configuration, and various modifications and changes may be made thereto without departing from the gist of the invention.

Note that the configuration shown in this embodiment mode can be implemented in combination with that of Embodiment Mode 1.

Embodiment Mode 3

In the invention, video signal currents are required to be inputted to pixels. That is, the amount of the current is required to be controlled in an analog or a digital manner according to image data so as to be inputted to the pixels. The video signal currents are outputted from current source circuits, and this embodiment shows an exemplary configuration of a current source circuit.

FIG. 18 shows a configuration diagram of the diagram in FIG. 1, which illustrates portions related to the current source circuits in detail. Similarly, FIG. 19 shows a configuration diagram of the diagram in FIG. 11, which illustrates portions related to current source circuits in detail. Note that FIG. 1 shows the case where 4 rows×3 columns of pixels are disposed while FIGS. 18 and 19 each shows the case where 4 rows×2 columns of pixels are disposed for sake of simplicity, however, the invention is not limited to this.

In FIGS. 18 and 19, current source circuits 1807*a* and 1807*b* are connected to a video current signal line 1801. Video current signals are inputted to the current source circuits 1807*a* and 1807*b* through the video current signal line 1801. As a result, the current source circuits 1807*a* and 1807*b* can output the video current signals to the signal lines 102*a* and 102*b* without being affected by the variation of transistors.

In the case of FIG. 18, the current source circuits 1807*a* and 1807*b* are controlled by a current control shift register 1803 through a current control line 1806*a* and 1806*b*. Accordingly, input timing of video current signals to the current source circuits 1807*a* and 1807*b* is controlled.

As shown in FIG. 18, when disposing the voltage control shift register 103 for controlling the voltage control switches 104*a* to 104*b* separately from the current control shift register 1803 for controlling the current source circuits 1807*a* and 1807*b*, each timing can be controlled independently. In particular, when video current signals are inputted to the current source circuits 1807*a* and 1807*b* through the video current signal line 1801, it takes a long time to complete an input of the signals (obtain the steady state) in some cases. In such a case, timing can be optimized by disposing the voltage control shift register 103 separately from the current control shift register 1803.

Note that FIG. 10 shows a configuration in which the video voltage signal lines 101*a* and 101*b* are disposed. As shown in the figure, a plurality of video voltage signal lines and video current signal lines may be disposed. The number of the video voltage signal lines and the number of the video current signal lines are not necessarily required to be identical as shown in FIG. 88 where one video voltage signal line (101) and two video current signal lines (1801*i* and 1801*j*) are disposed. In such a case, by disposing the voltage control shift register 103 separately from the current control shift register 1803, timing can be optimized.

In this manner, FIG. 18 shows a configuration in which the voltage control shift register 103 and the current control shift register 1803 are disposed separately, however, the invention is not limited to this configuration. For example, as shown in FIG. 20, the voltage control shift register 103 and the current control shift register 1803 may be combined. In the case of FIG. 20, for example, the voltage control shift register 103 is used for controlling each of the current source circuits 1807*a* and 1807*b* as well as the voltage control switches 104*a* to 104*b*.

Description is heretofore made on a current source circuit with reference to schematic diagrams but without detailed description of the internal configuration thereof. Now, an exemplary configuration of an internal circuit of the current source circuit 1807 is shown. First, FIG. 21 shows a partial diagram of the current source circuit portion in FIGS. 18 and 10. As shown in FIG. 21, the current source circuit 1807 comprises at least a current input terminal 2102, a timing control terminal 2103 and a current output terminal 2101. In the case of FIG. 18, the current input terminal 2102 is connected to the video current signal line 1801, from which currents are inputted. In the case of FIG. 18 also, the timing control terminal 2103 is connected to the voltage control shift register 103 and the current control shift register 1803, from which timing signals are inputted. Further, in the case of FIG. 18, the current output terminal 2101 is connected to the signal lines 104*a* and 104*b* through the current control switches 105*a* and 105*b* respectively.

FIG. 22 shows a specific exemplary configuration of the current source circuit 1807 shown in FIG. 21. By turning ON switches 2203 and 2204 while turning OFF a switch 2205, currents are inputted to a current source transistor 2201 and a storage capacitor 2202 through the current input terminal 2102. When the current input is complete, that is when a steady state is obtained, a voltage at an appropriate level is held in the storage capacitor 2202. Accordingly, even when the current characteristics of the current source transistor vary, the effect thereof can be reduced. Subsequently, the switches 2203 and 2204 are turned OFF while the switch 2205 is turned ON. Then, a current can be outputted to the switch 105 through the current output terminal 2101.

Note that in the case of the current source circuit 1807 having a configuration as in FIG. 22, a video current signal inputted to the current source circuit 1807 through the video current signal line 1801 and a video current signal outputted from the current source circuit 1807 through the current output terminal 2101 have roughly the same amount. This is dependent on the circuit configuration. That is, since the transistor to which a current is inputted through the video current signal line 1801 and the transistor for outputting a current through the current output terminal 2101 are identical, the amount of currents are roughly the same.

Therefore, when the current source circuit 1807 has a configuration as in FIG. 23, the amount of current can be changed by changing the W/L (channel width-to-length) ratio of a current source transistor 2301 and a mirror transistor 2306. In this case, a video current signal inputted to the current source circuit 1807 through the video current signal line 1801 has a proportional amount to a video current signal outputted from the current source circuit 1807 through the current output terminal 2101. Note that reference numeral 2302 denotes a storage capacitor, 2303 and 2304 denote switches and 105 denotes a switch.

Similarly, when the current source circuit 1807 has a configuration as in FIG. 24, the amount of current can be changed between the case of turning ON switches 2403 and 2404 to input a current to a current source transistor 2401 and a storage capacitor 2402 through the current input terminal 2102 and the case of turning OFF the switches 2403 and 2404 to operate the current source transistor 2401 and a multi-gate transistor 2405 to jointly function as a multi-gate transistor so as to output a current through the current output terminal 2101. In this case also, a video current signal inputted to the current source circuit 1807 through the video current signal line 1801 has a proportional amount to a video current signal outputted from the current source circuit 1807 through the current output terminal 2101.

Similarly, when the current source circuit 1807 has a configuration as in FIG. 25, it can be controlled by controlling a switch 2507 whether a current source transistor 2501 and a multi-gate transistor 2506 jointly operate as a multi-gate transistor or not. In this case, a video current signal inputted to the current source circuit 1807 through the video current signal line 1801 may have a proportional or identical amount to a video current signal outputted from the current source circuit 1807 to the switch 105 through the current output terminal 2101 according to ON/OFF timing of the switch 2507.

Note that the operation of the current source circuit shown in FIG. 25 is disclosed in Japanese Patent Application No. 2002-380252, Japanese Patent Application No. 2003-055018 and the like, the content of which can be appropriately implemented in combination with the invention. Note that reference numerals 2503, 2504, 2505 and 105 all denote switches.

In FIGS. 22 to 25, a current flow through the current input terminal 2102 and a current flow through the current output terminal 2101 are both in the direction of the current source circuit, however, the invention is not limited to this. The current flow direction may be opposite between the current input terminal 2102 and the current output terminal 2101. FIG. 26 shows an example of that case. In FIG. 26, a current flow through the current output terminal 2101 is in the direction of the current source circuit, while a current flow through the current input terminal 2102 is in the direction from the current source circuit to another circuit. Note that reference numeral 2601 denotes a transistor, and 2203, 2605, 2606 and 2607 all denote switches.

In FIGS. 22 to 26, the transistor which operates as a current source has an N-channel polarity, however, the invention is not limited to this. As opposed to the configuration in FIG. 22, FIG. 27 shows the case where the transistor has a P-channel polarity. Note that reference numeral 2701 denotes a P-channel transistor, 2702 denotes a storage capacitor, and 2703, 2704 and 2705 denote switches. As for FIGS. 23 to 26 also, the polarity of the transistor can be changed by adopting the similar concept.

In FIGS. 22 to 27, a current flows in the direction of the current source circuit, however, the invention is not limited to this. The configuration can be easily modified even when the current flow direction is changed. As opposed to the configuration in FIG. 22, FIG. 28 shows the case where the current flow direction is opposite. Note that reference numeral 2801 denotes a P-channel transistor, 2802 denotes a storage capacitor, and 2803, 2804 and 2805 denote switches. In this manner, by inverting the polarity of the transistor which operates as a current source, the invention can be accomplished without changing the connection of circuits.

In FIGS. 22 to 28, when transistors jointly operate as a multi-gate transistor, the number of transistors to operate as a current source in the current source circuit is only one when considering them as one multi-gate transistor, however, the invention is not limited to this, and a plurality of transistors may be provided as well. FIG. 29 shows the case where two transistors are provided to operate as current sources as opposed to the configuration in FIG. 22. By controlling a control line 2901, the circuit can be switched between the case where a current is inputted to a current source transistor 2201*b* from the video current signal line 1801 to output a current from a current source transistor 2201*a* as shown in FIG. 30, and the case where a current is inputted to the current source transistor 2201*a* from the video current signal line 1801 to output a current from the current source transistor 2201*b* as shown in FIG. 31. In this manner, when disposing a plurality of current source transistors in a current source circuit, the operation of inputting a current from the video current signal line 1801 and the operation of outputting a current through the current output terminal 2101 can be performed at the same time.

Note that in the case of disposing a plurality of current source transistors in a current source circuit, the control line 2901 is used for switching operation in FIG. 29, however, the invention is not limited to this. For example, current source transistors which are selected arbitrarily from a plurality of current source transistors may be used to output the total current thereof through the current output terminal 2101.

FIG. 32 shows an example where two current source transistors are provided in the configuration of FIG. 22. In FIG. 32, a current source transistor 3201*a* is inputted with a current from a video current signal line 1801*j*. On the other hand, a current source transistor 3201*b* is inputted with a current from a video current signal line 1801*i*. Therefore, the current source transistor 3201*a* and the current source transistor 3201*b* can output different amounts of current. Whether the current is outputted through the current output terminal 2101 or not is controlled with switches 3202*a* and 3202*b* and the like. Further, when ON/OFF of the switches 3202*a* and 3202*b* is controlled by using video signals, the current outputted through the current output terminal 2101 can have a corresponding amount to the video signals. For example, when the current value outputted from the current source transistor 3201*a* and the current value outputted from the current source transistor 3201*b* are I0 and I0×2 respectively, 2-bit gray scale display can be achieved. When the number of the current source transistors is further increased, and the amount of each current is raised to the second power, multi-bit gray scale display can be achieved.

FIG. 29 shows the case where current source transistors are disposed in parallel, however, the invention is not limited to this. FIG. 33 shows an example in the case where current source transistors are disposed in series. Operation thereof controlled by a control line 3301 is classified into the case as shown in FIG. 34 where a current is inputted to a current source transistor 2201*c* from the video current signal line 1801 and the current is outputted from a current source transistor 2201*d*, and the case as shown in FIG. 35 where a current is inputted to the current source transistor 2201*d* from the current source transistor 2201*c*. By disposing the current source transistors in this manner, the operation of inputting a current from the video current signal line 1801 and the operation of outputting a current through the current output terminal 2101 can be performed at the same time.

Note that FIGS. 22 to 33 illustrate current source circuits of various configurations, however, the invention is not limited to them. Other configurations may be employed by combining each configuration or the concept of each configuration with regard to the basic configuration, the number, polarity and arrangement of the current source transistors, a current flow direction and the like. That is, an arbitrary configuration can be employed as long as an operation as a current source circuit is achieved.

Note that in the configurations of the current source circuits shown in FIGS. 22 to 33, the arrangement and number of switches in each portion, or the connection required therefor can easily be modified as well. That is, the arrangement and number of switches are not limited as long as a normal operation as a current source circuit is achieved. For example, a plurality of switches may be integrated into one, or connection may be modified by adding or removing switches and the like.

Note that configurations of the current source circuit are disclosed in International Publication No. WO03/038793, International Publication No. WO03/038794, International Publication No. WO03/038795, International Publication No. WO03/038796 and International Publication No. WO03/038797, the content of which can be adopted for or combined with the invention.

Note that description of this embodiment mode corresponds to a partial modification of the configurations described in Embodiment Modes 1 to 2. Accordingly, the description of Embodiment Modes 1 to 2 can be applied to this embodiment mode as well.

In addition, the invention is not limited to this configuration, and various modifications and changes may be made thereto without departing from the gist of the invention.

Note that the configuration shown in this embodiment mode can be implemented in combination with that in Embodiment Modes 1 to 2.

Embodiment Mode 4

As shown in FIG. 18, a video signal voltage of a corresponding value to the display of a pixel, and a video signal current of a corresponding value to the display of a pixel are required to be supplied. That is, the video signal voltage and the video signal current have corresponding values to each other. In this embodiment mode, a circuit for supplying a video signal voltage and a video signal current is described.

FIG. 36 shows an overall configuration. A signal is inputted to a voltage/current supply circuit 5011 from an original signal input terminal 5012. According to the signal, a current output terminal 5013 outputs a signal current while a voltage output terminal 5014 outputs a signal voltage. The current output terminal 5013 and the voltage output terminal 5014 are connected to an input terminal 5022 of a setting circuit 5021 through switches 5001 and 5002 respectively. Note that the setting circuit 5021 means a circuit whose current is set by the voltage/current supply circuit 5011.

The setting circuit 5021 is precharged by using a signal voltage supplied from the voltage output terminal 5014 of the voltage/current supply circuit 5011, and after that, a current is set therein by using a signal current supplied from the current output terminal 5013 of the voltage/current supply circuit 5011. As a result, the setting circuit 5021 is hardly effected by the variation in the current characteristics of transistors which configure the setting circuit 5021, thus an accurate current can be supplied.

Note that the signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. Therefore, by precharging with a signal voltage supplied from the voltage output terminal 5014, a steady state can be obtained promptly when a signal current is supplied thereafter from the current output terminal 5013 of the voltage/current supply circuit 5011.

That is, the signal voltage supplied from the voltage output terminal 5014 of the voltage/current supply circuit 5011 and the signal current supplied from the current output terminal 5013 of the voltage/current supply circuit 5011 have corresponding values to each other.

Note that in the case of supplying a current from the current output terminal 5013 of the voltage/current supply circuit 5011 to the input terminal 5022 of the setting circuit 5021, a current flow direction has to be considered. That is, when a current flows to outside of the voltage/current supply circuit 5011 (hereinafter referred to as a current delivery type), the setting circuit 5021 is required to be set so that a current flows thereinto (hereinafter referred to as a current inlet type). In this case, the potential of the voltage/current supply circuit 5011 is higher, therefore, a current flows in the direction from the voltage/current supply circuit 5011 to the setting circuit 5021. In the case where a current flows inside of the voltage/current supply circuit 5011 (in the case of the current inlet type), the setting circuit 5021 is required to be set so that a current flows outside thereof (in the case of the current delivery type). In this case, the potential of the voltage/current supply circuit 5011 is lower, therefore, a current flows in the direction from the setting circuit 5021 to the voltage/current supply circuit 5011.

In the case where the voltage/current supply circuit 5011 and the setting circuit 5021 are both the current inlet types or the current delivery types, a current does not flow normally, therefore, a normal operation is not obtained. Accordingly, each of the voltage/current supply circuit 5011 and the setting circuit 5021 is required to be adjusted to the current inlet type or the current delivery type.

First, a configuration of the setting circuit 5021 is described in brief. FIGS. 37 and 38 each shows an exemplary configuration of the setting circuit 5021 in the case of the current delivery type. FIG. 37 shows the case where a transistor 3701 to operate as a current source is a P-channel type while FIG. 38 shows the case where it is an N-channel type.

Note that capacitors 3703 and 3803 function to hold the gate-source voltage of the transistors 3701 and 3801 respectively. However, such capacitors may be omitted when the gate capacitance of the transistors 3701 and 3801 are utilized.

In FIG. 38, the source terminal of the transistor 3801 is connected to the input terminal 5022 of the setting circuit 5021 but not connected to a fixed potential line. Therefore, the source potential of the transistor 3801 may change in accordance with the operating state thereof. Thus, a terminal 3805 is desirably connected to the source terminal of the transistor 3801 in order that the gate-source voltage of the transistor 3801 does not change even when the source potential of the transistor 3801 changes. In addition, the gate terminal and the drain terminal of the transistor 3801 may be connected to each other.

Note that the transistor in the setting circuit 5021 is set so as to supply a predetermined current by using a signal supplied from the voltage/current supply circuit 5011, namely current setting is performed. In addition, the transistor in the setting circuit 5021 operates as a current source which supplies a predetermined current to other circuits or elements. However, for sake of simplicity, FIGS. 37 and 38 do not illustrate other circuits or elements to which currents from the transistors (transistors 3701 and 3801) in the setting circuit 5021 are supplied after the currents are set.

Further, although switches are frequently provided so as to hold charges of the capacitors 3703 and 3803, they are omitted in FIGS. 37 and 38 for sake of simplicity.

That is, FIGS. 37 and 38 simply show the configurations of the setting circuit 5021 in the condition where current setting is performed with a signal supply from the voltage/current supply circuit 5011.

FIGS. 39 and 40 each shows an exemplary configuration of the setting circuit 5021 in the case of the current inlet type. FIG. 40 shows the case where the transistor 4001 to operate as a current source is a P-channel type while FIG. 39 shows the case where the transistor 3901 is an N-channel type, which can thus be considered to be similar to FIGS. 37 and 38.

An example of the voltage/current supply circuit 5011 is shown in FIG. 36 now. In the case of the voltage/current supply circuit 5011 also, configuration of the current output portion differs depending on whether being the current inlet type or the current delivery type. The voltage output portion differs depending on the configuration of the setting circuit 5021. That is, a signal voltage supplied from the voltage output terminal 5014 of the voltage/current supply circuit 5011 is required to be at roughly the same level as the voltage at the point where a steady state is obtained with a signal current supplied from the current output terminal 5013 to the setting circuit 5021, namely when signal writing is complete. Therefore, the level of the signal voltage supplied from the voltage output terminal 5014 of the voltage/current supply circuit 5011 is required to be controlled in accordance with the setting circuit 5021 being the current inlet type or the current delivery type, the polarity of the transistor being an N-channel type or a P-channel type, the W/L (channel width-to-length) ratio and the like.

The original signal input terminal 5012 of the voltage/current supply circuit 5011 may be supplied with either a voltage or a current as a signal. Based on the supplied signal the current output terminal 5013 supplies a signal current while the voltage output terminal 5014 supplies a signal voltage.

Description is made on an example where the setting circuit 5021 is the current inlet type, the transistor 3091 is an N-channel type and the voltage/current supply circuit 5011 has the configuration in FIG. 39. Note that shown here is the case having the configuration in FIG. 39, however, the configuration in FIG. 40 may be employed as well. FIG. 41 shows the configuration.

A voltage is inputted from the original signal input terminal 5012. Since the original signal input terminal 5012 is connected to the gate terminal of a transistor 4101, the gate-source voltage of the transistor 4101 changes in accordance with the potential of the original signal input terminal 5012, and the amount of current flowing from a terminal 4102 to the transistor 4101 changes accordingly. A transistor 4103 is connected to the transistor 4101 in series, therefore, the same amount of current as that in the transistor 4101 flows therethrough. The gate terminal and the drain terminal of the transistor 4103 are connected to each other, and the connecting portion is connected to the gate terminal of a transistor 4105. In addition, as shown in FIG. 41, the source terminals or the drain terminals of the transistor 4103 and the transistor 4105 are connected in series through a terminal 4104. Accordingly, a current output terminal 5013 outputs a current according to the W/L ratio of the transistor 4105 (W11/L11) and the W/L ratio of the transistor 4103 (W12/L12). Now, it is assumed that (W12/L12)=á×(W11/L11). Then, the current output terminal 5013 outputs a current which is a times as large as that flowing through the transistor 4101 (transistor 4103).

The gate potential of the transistor 4101 is outputted to the voltage output terminal 5014. Note that an amplifier circuit such as a voltage follower circuit may be disposed between the original signal input terminal 5012 and the voltage output terminal 5014.

Accordingly, a current outputted from the current output terminal 5013 flows through the transistor 3901 of FIG. 39 in the setting circuit 5021. Here, when the W/L ratio of the transistor 4101 (W13/L13) and the W/L ratio of the transistor 3901 (W21/L21) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W21/L21)=á×(W13/L13) is only required to be satisfied. Then, the gate-source voltage of the transistor 4101 is at roughly the same level as that of the transistor 3901, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

In FIG. 41, the original signal input terminal 5012 is connected to the gate terminal of the N-channel transistor. Now, FIG. 42 shows an exemplary configuration in which the original signal input terminal 5012 is connected to the gate terminal of a P-channel transistor. The original signal input terminal 5012 is connected to the gate terminal of the transistor 5101, therefore, the gate-source voltage of the transistor 5101 changes in accordance with the potential of the original signal input terminal 5012, and the current amount flowing through the transistor 5101 changes accordingly, which is then supplied to the current output terminal 5013. On the other hand, the gate terminal of a transistor 6401 is connected to the gate terminal of the transistor 5101. Now, it is assumed that the W/L ratio of the transistor 5101 is W31/L31, the W/L ratio of the transistor 6401 is W32/132, and (W32/L32)=á×(W31/L31) is satisfied. Then, a current which is a times as large as that flowing through the transistor 5101 flows in the transistor 6401 and a transistor 6402.

Then, the gate potential of the transistor 6402 is outputted to the voltage output terminal 5014 through an amplifier circuit 5301. Note that the amplifier circuit 5301 is a circuit which outputs a potential at roughly the same level as the input potential, and a voltage follower circuit is desirably employed as such amplifier circuit. However, the invention is not limited to this, and such function as impedance transformation is only required to be implemented. Note that in the case where sufficiently a large charge is supplied from the gate terminal and the drain terminal of the transistor 6402, and impedance transformation is thus not required to be performed at all, the amplifier circuit 5301 may be omitted.

Here, when the W/L ratio of the transistor 6402 (W33/L33) and the W/L ratio of the transistor 3901 in FIG. 39 (W21/L21) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W21/L21)=(W33/L33)/â is only required to be satisfied. Then, the gate-source voltage of the transistor 6402 is at roughly the same level as that of the transistor 3901, and thus a signal voltage supplied from the voltage output terminal 5014 corresponds to, a precharge by and large. Accordingly, a steady state can be obtained promptly when a signal current is supplied from the current output terminal 5013 of the voltage/current supply circuit 5011 after the precharge.

In FIGS. 41 and 42, a voltage is inputted as a signal to the original signal input terminal 5012. A configuration in the case of inputting a current to the original signal input terminal 5012 is described now.

FIG. 43 shows the case where a current is inputted to a P-channel transistor 4301. FIG. 43 is the configuration in which the P-channel transistor 4301 is added to the configuration in FIG. 42. That is, the gate potential of the transistor 5101 is directly controlled through the original signal input terminal 5012 in FIG. 42. On the other hand, in FIG. 43, the gate potential of the transistor 5101 is controlled by flowing a current through the P-channel transistor 4301. Portions other than the above in FIG. 43 are similar to those in FIG. 42, therefore, description thereof is omitted herein.

FIG. 44 shows the case where a current is inputted to an N-channel transistor 4401. FIG. 44 is the configuration in which the N-channel transistor 4401 is added to the configuration in FIG. 41. In the configuration in FIG. 41, the gate potential of the transistor 4101 is directly controlled through the original signal input terminal 5012. On the other hand, in FIG. 44, the gate potential of the transistor 4101 is controlled by flowing a current through the N-channel transistor 4401. That is, the gate terminal of the transistor 4101 is connected to the gate terminal of the transistor 4401 while the gate terminal of the transistor 4103 is connected to the gate terminal of the transistor 4105. Accordingly, a current corresponding to the current flow through the transistor 4401 flows in the transistor 4101, the transistor 4103 and the transistor 4105.

Now, it is assumed that the W/L ratio of the transistor 4401 is W51/L51, the W/L ratio of the transistor 4101 is W52/L52, the W/L ratio of the transistor 4103 is W53/L53, the W/L ratio of the transistor 4105 is W54/L54, and (W51/L51)=(W52/L52)/å and (W53/53)=(W54/L54)/æ are satisfied. Then, a current which is å times as large as that flowing through the transistor 4401 flows in the transistors 4101 and 4103. Meanwhile, a current which is æ times as large as that flowing through the transistor 4103 flows in the transistor 4105.

Then, the gate potential of the transistor 4401 is outputted to the voltage output terminal 5014 through the amplifier circuit 5301. However, the invention is not limited to this, and the amplifier circuit 5301 may be omitted when there is no necessity of performing impedance transformation.

Here, when the W/L ratio of the transistor 4401 (W51/L51), the W/L ratio of the transistor 4101 (W52/L52), the W/L ratio of the transistor 4103 (W53/L53), the W/L ratio of the transistor 4105 (W54/L54) and the W/L ratio of the transistor 3901 in FIG. 39 (W21/L121) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W21/L21)=(W51/L51)×å×æ is only required to be satisfied. Then, the gate-source voltage of the transistor 4401 is at roughly the same level as that of the transistor 3901, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

Description is made now on the case where the setting circuit 5021 is a current inlet type, a transistor 4001 is a P-channel type and the voltage/current supply circuit 5011 has the configuration in FIG. 40. Note that for sake of simplicity, FIG. 40 shows the example where the terminals 3902 and 3904 are connected to each other, and the terminal 4005 is connected to the input terminal 5022 of the setting circuit 5021 (source terminal of the transistor 4001).

In this case, the source terminal of the transistor 4001 in the setting circuit 5021 is connected to the input terminal 5022 of the setting circuit 5021. Accordingly, the source potential of the transistor 4001 changes according to circumstances. That is, at the point where a steady state is obtained with a signal current supplied from the current output terminal 5013 of the voltage/current supply circuit 5011, namely when signal writing is complete, the potential of the input terminal 5022 of the setting circuit 5021 is at the potential when the source terminal of the transistor 4001 comes to the steady state. Accordingly, the signal voltage supplied from the voltage output terminal 5014 of the voltage/current supply circuit 5011 is required to be as large as the source potential of the transistor 4001 in the steady state.

FIG. 45 shows a configuration in the case where a voltage is inputted to the original signal input terminal 5012, and the original signal input terminal 5012 is connected to the gate terminal of the P-channel transistor 5101.

FIG. 45 corresponds to the configuration in which a P-channel transistor 4502 is substituted for the N-channel transistor 6402 in FIG. 42. That is, the gate terminal of the transistor 5101 is connected to the gate terminal of the transistor 6401. Accordingly, a current corresponding to the current flow through the transistor 5101 flows in the transistor 6401 and the transistor 4502. Now, it is assumed that the W/L ratio of the transistor 5101 is W61/L61, the W/L ratio of the transistor 6401 is W62/162, the W/L ratio of the transistor 4502 is W63/L63, and (W61/L61)=(W62/L62)/ç is satisfied. Then, a current which is ç times as large as that flowing through the transistor 5101 flows in the transistor 6401.

Then, the source potential of the transistor 4502 is outputted to the voltage output terminal 5014 through the amplifier circuit 5301. However, the invention is not limited to this, and the amplifier circuit 5301 may be omitted when there is no necessity of performing impedance transformation.

Here, when the W/L ratio of the transistor 5101 (W61/L61), the W/L ratio of the transistor 6401 (W62/L62), the W/L ratio of the transistor 4502 (W63/L63) and the W/L ratio of the transistor 4001 in FIG. 40 (W22/L22) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W22/L22)=(W63/L63)/ç is only required to be satisfied. Then, the gate-source voltage of the transistor 4502 is at roughly the same level as that of the transistor 4001, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

FIG. 46 shows a configuration in the case where a voltage is inputted to the original signal input terminal 5012, and the original signal input terminal 5012 is connected to the gate terminal of the N-channel transistor 4101.

FIG. 46 corresponds to the configuration in which transistors 4601 and 4602 are added to the configuration in FIG. 41. That is, the gate terminal of the transistor 4103 is connected to the gate terminal of the transistor 4601 and the gate terminal of the transistor 4105. Accordingly, a current corresponding to the current flow through the transistor 4101 flows in the transistor 4601 and the transistor 4805. Now, it is assumed that the W/L ratio of the transistor 4103 is W71/L71, the W/L ratio of the transistor 4601 is W72/L72, the W/L ratio of the transistor 4105 is W73/L73, and (W71/L71)=(W72/L72)/è=(W73/L73) é is satisfied. Then, a current which is è times as large as that flowing through the transistor 4103 flows in the transistor 4601, and a current which is é times as large as that flowing through the transistor 4103 flows in the transistor 4105.

Then, the source potential of the transistor 4602 is outputted to the voltage output terminal 5014 through the amplifier circuit 5301. However, the invention is not limited to this, and the amplifier circuit 5301 may be omitted when there is no necessity of performing impedance transformation.

Here, when the W/L ratio of the transistor 4103 (W71/L71), the W/L ratio of the transistor 4601 (W72/L72), the W/L ratio of the transistor 4105 (W73/L73), the W/L ratio of the transistor 4602 (W74/L74) and the W/L ratio of the transistor 4001 in FIG. 40 (W22/L22) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W22/L22)=(W74/L74)×é/è is only required to be satisfied. Then, the gate-source voltage of the transistor 4602 is at roughly the same level as that of the transistor 4001, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

FIGS. 47 and 48 each shows a configuration in the case where a current is inputted to the original signal input terminal 5012. FIG. 47 is the configuration in which a transistor 4701 is added to FIG. 45 so as to allow a current input while FIG. 48 is the configuration in which a transistor 4801 is added to FIG. 46 so as to allow a current input.

In this manner, FIGS. 41 to 48 each illustrates the case where the voltage/current supply circuit 5011 is a current delivery type. However, in the case where the setting circuit 5021 is a current delivery type as shown in FIG. 37 or FIG. 38, the voltage/current supply circuit 5011 is required to be a current inlet type. However, in the case where the current delivery type configuration is changed to a current inlet type configuration, the polarity of transistors is only required to be changed. For example, FIG. 49 shows a configuration in the case where FIG. 41 is changed to a current inlet type configuration. In this manner, potential of each wiring may be changed by inverting the polarity of each transistor.

Embodiment Mode 5

In Embodiment Mode 4, the voltage/current supply circuit 5011 is directly connected to the setting circuit 5021. In this embodiment mode, description is made on the case where a current memory circuit 5031 is interposed between the voltage/current supply circuit 5011 and the setting circuit 5021 as shown in FIG. 50.

As shown in FIG. 50, the current output terminal 5013 of the voltage/current supply circuit 5011 outputs a signal current to the current memory circuit 5031. Then, the current is set and the current value is stored in the current memory circuit 5031. At this time, the voltage output terminal 5014 of the voltage/current supply circuit 5011 outputs a signal voltage to the setting circuit 5021. Therefore, the setting circuit 5021 is precharged. Subsequently, the current memory circuit 5031 outputs the signal current to the setting circuit 5021, and the current is set in the setting circuit 5021. Note that the current outputted from the current memory circuit 5031 to the setting circuit 5021 has a proportional amount to the current outputted from the current output terminal 5013 of the voltage/current supply circuit 5011 to the current memory circuit 5031. Alternatively, they are about equal depending on the configuration of the current memory circuit 5031.

Note that in the case of using the circuit configuration in FIG. 36 which supplies both video signal voltages and video signal currents, one of the voltage/current supply circuit 5011 and the setting circuit 5021 is required to be a current inlet type while the other is required to be a current delivery type. In the case of the configuration in FIG. 50, the type of the current memory circuit 5031 is required to be considered as well as the types of the voltage/current supply circuit 5011 and the setting circuit 5021.

First, such case is considered where the current memory circuit 5031 is the same type in both cases where a current is inputted from the current output terminal 5013 of the voltage/current supply circuit 5011 to the current memory circuit 5031 and where a current is outputted from the current memory circuit 5031 to the setting circuit 5021. For example, in the case where the current memory circuit 5031 is a current delivery type, both of the voltage/current supply circuit 5011 and the setting circuit 5021 are required to be current inlet types. On the other hand, in the case where the current memory circuit 5031 is a current inlet type, both of the voltage/current supply circuit 5011 and the setting circuit 5021 are required to be current delivery types. That is, the voltage/current supply circuit 5011 and the setting circuit 5021 are required to be the same type.

Now, another case is considered where the current memory circuit 5031 is the opposite type in the case where a current is inputted from the current output terminal 5013 of the voltage/current supply circuit 5011 to the current memory circuit 5031 and the case where a current is outputted from the current memory circuit 5031 to the setting circuit 5021. For example, in the case where the current memory circuit 5031 is a current delivery type when a current is inputted from the voltage/current supply circuit 5011 to the current memory circuit 5031 while it is a current inlet type when a current is outputted from the current memory circuit 5031 to the setting circuit 5021, the voltage/current supply circuit 5011 is required to be a current inlet type while the setting circuit 5021 is required to be a current delivery type. On the other hand, in the case where the current memory circuit 5031 is a current inlet type when a current is inputted from the voltage/current supply circuit 5011 to the current memory circuit 5031 while it is a current delivery type when a current is outputted from the current memory circuit 5031 to the setting circuit 5021, the voltage/current supply circuit 5011 is required to be a current delivery type while the setting circuit 5021 is required to be a current inlet type. That is, the voltage/current supply circuit 5011 and the setting circuit 5021 are required to be the opposite type.

Description is made first on the configuration of the voltage/current supply circuit 5011 in the case where both of the voltage/current supply circuit 5011 and the setting circuit 5021 are the current delivery types. Assuming that the current amount inputted from the voltage/current supply circuit 5011 to the current memory circuit 5031 is $I_1$ while the current amount outputted from the current memory circuit 5031 to the setting circuit 5021 is $I_2$, $I_2=I_1\times\hat{e}$ is satisfied.

First, it is assumed that the setting circuit 5021 is a current delivery type and the P-channel transistor 3701 is employed as in the configuration in FIG. 37. FIG. 51 shows an exemplary configuration of the voltage/current supply circuit 5011 in that case.

In FIG. 51, a voltage is inputted from the original signal input terminal 5012. The original signal input terminal 5012 is connected to the gate terminal of the transistor 5101, therefore, the gate-source voltage of the transistor 5101 changes according to the potential of the original signal input terminal 5012, and the amount of a current flow through the transistor 5101 changes accordingly.

A current outputted from the current memory circuit 5031 flows through the transistor 3701 in the setting circuit 5021. The current outputted from the current memory circuit 5031 to the setting circuit 5021 is $\hat{e}$ times as large as the current inputted from the voltage/current supply circuit 5011 to the current memory circuit 5031.

Then, the gate potential of the transistor 5101 is outputted to the voltage output terminal 5014. Note that an amplifier circuit such as a voltage follower circuit may be disposed between the original signal input terminal 5012 and the voltage output terminal 5014.

Here, when the W/L ratio of the transistor 5101 (W81/L82) and the W/L ratio of the transistor 3701 (W23/L23) are controlled, a signal voltage supplied from the voltage output terminal 5014 of the voltage/current supply circuit 5011 is at roughly the same level as the voltage at the point when a steady state is obtained with a signal current supplied from the current memory circuit 5031 to the setting circuit 5021, namely when signal writing is complete. That is, (W23/L23) =ê×(W82/L82) is only required to be satisfied. Then, the gate-source voltage of the transistor 5101 is at roughly the same level as that of the transistor 3701, and thus a signal voltage supply from the voltage output terminal 5014 corresponds to a precharge by and large. Accordingly, a steady state can be obtained promptly when a signal current is supplied from a current output terminal 5033 of the current memory circuit 5031 after the precharge.

FIG. 51 shows the configuration in which the original signal input terminal 5012 is connected to the gate terminal of the P-channel transistor. FIG. 52 shows a configuration in the case where the original signal input terminal 5012 is connected to the gate terminal of an N-channel transistor.

In FIG. 52, the original signal input terminal 5012 is connected to the gate terminal of the transistor 4101, therefore, the gate-source voltage of the transistor 4101 changes according to the potential of the original signal input terminal 5012, and the amount of a current flow from the terminal 4102 to the transistor 4101 changes accordingly. Therefore, a current corresponding to the current flow through the transistor 4101 flows in the transistor 4103 and the transistor 4105. Meanwhile, the gate terminal of the transistor 4105 is connected to the gate terminal of the transistor 4103. The source terminals or the drain terminals of the transistor 4103 and the transistor 4105 are connected with the terminal 4104. Here, assuming that the W/L ratio of the transistor 4103 is W91/L91, the W/L ratio of the transistor is 4105 is W92/L92, and (W92/L92)=ë× (W92/L92) is satisfied, a current which is e times as large as that flowing through the transistor 4101 and the transistor 4103 flows in the transistor 4105.

Then, the gate potential of the transistor 4105 is outputted to the voltage output terminal 5014 through the amplifier circuit 5301. However, the invention is not limited to this, and the amplifier circuit 5301 may be omitted when there is no necessity of performing impedance transformation.

Here, when the W/L ratio of the transistor 4103 (W91/L91), the W/L ratio of the transistor 4105 (W92/L92) and the W/L ratio of the transistor 3901 in FIG. 37 (W23/L23) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W23/123)=ë×(W91/L91) is only required to be satisfied. Then, the gate-source voltage of the transistor 4105 is at roughly the same level as that of the transistor 3701, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

In FIGS. 51 and 52, a voltage is inputted as a signal to the original signal input terminal 5012. A configuration in the case of inputting a current to the original signal input terminal 5012 is described now.

FIG. 53 shows the case where a current is inputted to a P-channel transistor 5303. FIG. 53 is the configuration in which the P-channel transistor 5303 is added to the configuration in FIG. 51. That is, the gate potential of the transistor 5101 is directly controlled through the original signal input terminal 5012 in FIG. 51. On the other hand, in FIG. 53, the gate potential of the transistor 5101 is controlled by flowing a current through the P-channel transistor 5303. Portions other than the above in FIG. 53 are similar to those in FIG. 51, therefore, description thereof is omitted herein. Note that reference numeral 5102 is a wiring for connecting the transistor 5101 and the transistor 5303.

FIG. 53 shows the case where a current is inputted to the P-channel transistor 5303 form the original signal input terminal 5012. FIG. 54 shows the case where a current is inputted to an N-channel transistor 5401.

FIG. 54 is the configuration in which the N-channel transistor 5401 is added to the configuration in FIG. 52. The gate potential of the transistor 4101 is directly controlled through the original signal input terminal 5012 in FIG. 52. On the other hand, in FIG. 53, the gate potential of the transistor 4101 is controlled by flowing a current to the amplifier circuit 5301. That is, the gate terminal of the transistor 4101 is connected to the gate terminal of the transistor 5301. Accordingly, a current corresponding to the current flow through the transistor 5401 flows in the transistor 4101, the transistor 4103 and the transistor 4105. Portions other than the above in FIG. 54 are similar to those in FIG. 53, therefore, description thereof is omitted herein.

Description is made now on the case where the setting circuit 5021 is a current delivery type, the transistor 3801 is an N-channel type and the voltage/current supply circuit 5011 has the configuration in FIG. 38. Note that for sake of simplicity, FIG. 38 shows the case where the terminals 3702 and 3704 are connected to each other, and the terminal 3705 is connected to the input terminal 5022 of the setting circuit 5021 (source terminal of the transistor 3801).

In this case, the source terminal of the transistor 3801 in the setting circuit 5021 is connected to the input terminal 5022 of the setting circuit 5021. Accordingly, the source potential of the transistor 3801 changes according to circumstances. That is, at the point where a steady state is obtained with a signal current supplied from the current output terminal 5013 of the voltage/current supply circuit 5011, namely when signal writing is complete, the potential of the input terminal 5022 of the setting circuit 5021 is at the potential when the source terminal of the transistor 3801 comes to the steady state. Accordingly, the signal voltage supplied from the voltage output terminal 5014 of the voltage/current supply circuit 5011 is required to be as large as the source potential of the transistor 3801 in the steady state.

FIG. 55 shows a configuration in the case where a voltage is inputted to the original signal input terminal 5012, and the original signal input terminal 5012 is connected to the gate terminal of the P-channel transistor 5101.

In FIG. 55, the gate terminal of the transistor 5101 is connected to the gate terminal of a transistor 5503, and the gate terminal of a transistor 5506 is connected to the gate terminal of a transistor 5508. In addition, the transistors 5101, 5503 and 5509 are connected with a wiring 5504 as shown in FIG. 55 while the transistors 5508 and 5506 are connected with a wiring 5507 as shown in FIG. 55. Accordingly, a current corresponding to the current flow through the transistor 5101 flows in the transistors 5503, the transistor 5506 and the transistor 5508. Now, it is assumed that the W/L ratio of the transistor 5101 is W101/L101, the W/L ratio of the transistor 5503 is W102/L102, the W/L ratio of the transistor 5506 is W103/L103, the W/L ratio of the transistor 5508 is W104/L104, and (W101/L101)=(W102/L102)/ì as well as (W103/L103)=(W104/L104)/ì is satisfied. Then, a current which is (í×ì) times as large as that flowing through the transistor 5101 flows in the transistor 5509.

Then, the source potential of the transistor 5509 is outputted to the voltage output terminal 5014 through the amplifier circuit 5301. However, the invention is not limited to this, and the amplifier circuit 5301 may be omitted when there is no necessity of performing impedance transformation.

Here, the gate terminal of the transistor 5101 is connected to the gate terminal of the transistor 5503, and the gate terminal of the transistor 5506 is connected to the gate terminal of the transistor 5508. Accordingly, a current corresponding to the current flow through the transistor 5101 flows in the transistor 5503, the transistor 5506 and the transistor 5508. Here, when the W/L ratio of the transistor 5101 (W101/L101), the W/L ratio of the transistor 5503 (W102/L102), the W/L ratio of the transistor 5506 (W103/L103), the W/L ratio of the transistor 5508 (W104/L104), the W/L ratio of the transistor 5509 (W105/L105) and the W/L ratio of the transistor 3801 in FIG. 3 (W23/L23) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W23/L23)=(W105/L105)/(î×í) is only required to be satisfied. Then, the gate-source voltage of the transistor 5509 is at roughly the same level as that of the transistor 3801, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

FIG. 56 shows a configuration in the case where a voltage is inputted to the original signal input terminal 5012, and the original signal input terminal 5012 is connected to the gate terminal of the N-channel transistor 4101.

In FIG. 56, the gate terminal of the transistor 4103 is connected to the gate terminal of a transistor 4105 and the gate terminal of a transistor 5301 is connected to the gate terminal of a transistor 4101. In addition, the transistors 4103, 4105 and 5602 are connected with the terminal 4104 while the transistor 4101 and the transistor 5601 are connected with the terminal 4102. Accordingly, a current corresponding to the current flow through the transistor 4101 flows in the transistor 4103, the transistor 4805 and the transistor 5601. Now, it is assumed that the W/L ratio of the transistor 4101 is W111/L111, the W/L ratio of the transistor 4103 is W112/L112, the W/L ratio of the transistor 4105 is W113/L113, the W/L ratio of the transistor 5601 is W114/L114, and (W112/L112)=(W113/L113)/î as well as (W111/L111)=(W115/L115)/ŏ is satisfied. Then, a current which is î times as large as the that flowing through the transistor 4103 or the transistor 4101 flows in the transistor 4805, and a current which is ŏ times as large as the that flowing through the transistor 4103 flows in the transistor 5601 and the transistor 5602.

Then, the source potential of the transistor 5602 is outputted to the voltage output terminal 5014 through the amplifier circuit 5301. However, the invention is not limited to this, and the amplifier circuit 5301 may be omitted when there is no necessity of performing impedance transformation.

Here, when the W/L ratio of the transistor 4101 (W111/L111), the W/L ratio of the transistor 4103 (W112/L112), the W/L ratio of the transistor 4105 (W113/L113), the W/L ratio of the transistor 5601 (W114/L114), the W/L ratio of the transistor 5602 (W115/Li15) and the W/L ratio of the transistor 3801 in FIG. 38 (W23/L23) are controlled, a signal voltage supplied from the voltage output terminal 5014 of the voltage/current supply circuit 5011 is at roughly the same level as the voltage at the point when a steady state is obtained with a signal current supplied from the current output terminal 5013 of the voltage/current supply circuit 5011, namely when signal writing is complete. That is, (W23/L23)=(W115/L115)×ĩ/ŏ is only required to be satisfied. Then, the gate-source voltage of the transistor 5602 is at roughly the same level as that of the transistor 3801, and thus a signal voltage supplied from the voltage output terminal 5014 corresponds to a precharge by and large. Accordingly, a steady state can be obtained promptly when a signal current is supplied from the current output terminal 5013 of the voltage/current supply circuit 5011 after the precharge.

FIGS. 57 and 58 each shows a configuration in the case where a current is inputted to the original signal input terminal 5012. FIG. 57 is the configuration in which a transistor 5701 is added to FIG. 55 so as to allow a current input while FIG. 58 is the configuration in which a transistor 5801 is added to FIG. 56 so as to allow a current input. Note that in FIG. 57, the transistors 5101, 5701, 5503 and 5509 are connected with the terminal 5504 while the transistors 5506 and 5508 are connected with the terminal 5507. Note also that in FIG. 58, the transistors 4105, 4103 and 5602 are connected with the terminal 4104 while the transistors 4101, 5802 and 5601 are connected with the terminal 4102.

In this manner, FIGS. 51 to 58 each illustrates the case where the voltage/current supply circuit 5011 is a current delivery type. However, in the case where the setting circuit 5021 is a current inlet type as shown in FIG. 39 or FIG. 40, the voltage/current supply circuit 5011 is required to be a current inlet type. However, in the case where the current delivery type configuration is changed to a current inlet type configuration, the polarity of transistors is only required to be changed. For example, FIG. 59 shows the case where FIG. 52 is changed to a current inlet type configuration. In this manner, potential of each wiring may be changed by inversing the polarity of each transistor.

Now, a configuration of the current memory circuit 5031 in FIG. 50 is described. The current memory circuit 5031 may have any configuration as long as a current is inputted from a memory current input terminal 5032 and the current is outputted from the memory current output terminal 5033.

As an example, configurations illustrated in FIG. 21 or FIGS. 22 to 35 may be employed. That is, the current input terminal 2102 in FIG. 21 corresponds to the memory current input terminal 5032 of the current memory circuit 5031 in FIG. 50 while the current output terminal 2101 in FIG. 21 corresponds to the memory current output terminal 5033 of the current memory circuit 5031 in FIG. 50.

FIG. 60 shows an example of the current memory circuit 5031 in the case of the configuration in FIG. 22 being employed Similarly, FIG. 61 shows an example of the current memory circuit in the case of the configuration in FIG. 28 being employed. FIG. 62 shows an example of the current memory circuit in the case of the configuration in FIG. 26 being employed. FIG. 60 corresponds to a current inlet type, FIG. 61 corresponds to a current delivery type and FIG. 62 corresponds to the one having the opposite type in its current input portion and current output portion.

In this manner, the current memory circuit 5031 can be configured by appropriately selecting the current inlet type or the current delivery type.

Embodiment Mode 6

Embodiment Mode 5 described the case where the current memory circuit 5031 is interposed as shown in FIG. 50. That is, a signal current supplied from the voltage/current supply circuit 5011 to the current memory circuit 5031 is outputted from the current output terminal 5013 in FIG. 50. However, the invention is not limited to this, and a signal voltage and a signal current may be inputted as shown in FIG. 36.

FIG. 63 shows the case where a signal voltage and a signal current are inputted to the current memory circuit 5031.

As shown in FIG. 63, a signal voltage is outputted from a second voltage output terminal 6343 of a voltage/current supply circuit 5041 to the current memory circuit 5031 through a switch 6303. This operation corresponds to a precharge operation. Subsequently, a signal current is outputted from a current output terminal 5043 to the current memory circuit 5031 through a switch 5003, and the current is set and the current value is stored in the current memory circuit 5031. At this time, a signal voltage is outputted from a voltage output terminal 5044 of the voltage/current supply circuit 5041 to the setting circuit 5021 through the switch 5001 and the output terminal 5022. Therefore, the setting circuit 5021 is precharged. Subsequently, the signal current is outputted from the current memory circuit 5031 to the setting circuit 5021 through the switch 5002 and the output terminal 5022, and the current is set in the setting circuit 5021. Note that the current outputted from the current memory circuit 5031 to the setting circuit 5021 has a proportional amount to the current outputted from the current output terminal 5043 of the voltage/current supply circuit 5041 to the current memory circuit 5031. Alternatively, they are about equal depending on the configuration of the current memory circuit 5031.

Note that in FIG. 63, the voltage values outputted from the voltage output terminal 5044 and the second voltage output terminal 6343 of the voltage/current supply circuit 5041 are required to be controlled depending on whether each of the current memory circuit 5031 and the setting circuit 5021 is a current inlet type or a current delivery type, the polarity of the transistors which configure the circuit and the like.

That is, the voltage outputted from the voltage output terminal 5044 of the voltage/current supply circuit 5041 is set sufficiently high to perform a precharge operation of the setting circuit 5021, and the voltage outputted from the second voltage output terminal 6313 of the voltage/current supply circuit 5011 is set sufficiently high to perform a precharge operation of the current memory circuit 5031.

Each voltage level can be generated by controlling the current value flowing through each transistor, polarity and size of the transistor whether the transistor is a current inlet type or a current delivery type and the like.

Description is made first on the configuration of the voltage/current supply circuit 5041 in the case where both of the voltage/current supply circuit 5041 and the setting circuit 5021 are the current delivery types.

First, it is assumed that the setting circuit 5021 is a current delivery type and has the configuration in FIG. 37 in which the P-channel transistor 3701 is used. It is also assumed that the current memory circuit 5031 is a current inlet type and has the configuration in FIG. 60. FIG. 64 shows an exemplary configuration of the voltage/current supply circuit 5041 for that case. This configuration corresponds to the one in which transistors 6401 and 6402 are added to the configuration in FIG. 51 or the one in which the gate voltage of the transistor 6401 is outputted to the configuration in FIG. 42. Accordingly, an optimal signal voltage (precharge voltage) can be outputted by controlling the current value flowing through each transistor and the transistor size.

FIG. 65 shows a configuration in the case where an original signal input terminal 5042 is connected to the gate terminal of an N-channel transistor. This configuration corresponds to the one in which the gate voltage of the transistor 4101 is outputted to the configuration in FIG. 52. Accordingly, an optimal signal voltage (precharge voltage) can be outputted by controlling the current value flowing through each transistor and the transistor size.

Now, a configuration in the case of inputting a current to the original signal input terminal 5042 is shown. FIG. 66 shows the case where a current is inputted to the P-channel transistor 5303. FIG. 66 is the configuration in which the P-channel transistor 5303 is added to the configuration in FIG. 64. That is, the gate potential of the transistor 5101 is directly controlled through the original signal input terminal 5012 in FIG. 64. On the other hand, in FIG. 66, the gate potential of the transistor 5101 is controlled by flowing a current to the P-channel transistor 5303. Portions other than the above in FIG. 66 are similar to those in FIG. 64, therefore, description thereof is omitted herein.

Note that potentials are outputted to the voltage output terminal 5044 and the second voltage output terminal 6343 through amplifier circuits 5301*a* and 5301*b*, however, the invention is not limited to this and the amplifier circuits may be omitted when there is no necessity of performing impedance transformation.

FIG. 67 shows the case where a current is inputted to the N-channel transistor 5401. FIG. 67 is the configuration in which the N-channel transistor 5401 is added to the configuration in FIG. 65. Therefore, detailed description thereof is omitted.

Description is made now on the case where the setting circuit 5021 is a current delivery type, the transistor 3081 is an N-channel type and the voltage/current supply circuit 5041 has the configuration in FIG. 38. Note that for sake of simplicity, FIG. 38 shows the case where the terminals 3702 and 3704 are connected to each other, and the terminal 3705 is connected to the input terminal 5022 of the setting circuit 5021 (source terminal of the transistor 3801).

First, FIG. 68 shows a configuration in the case where a voltage is inputted to the original signal input terminal 5042, and the original signal input terminal 5042 is connected to the gate terminal of the P-channel transistor 5101. This configuration corresponds to the one in which the gate voltage of the transistor 5506 is outputted to the configuration in FIG. 55. Accordingly, an optimal signal voltage (precharge voltage) can be outputted by controlling the current value flowing through each transistor and the transistor size.

Note that potentials are outputted to the voltage output terminal 5044 and the second voltage output terminal 6343 through the amplifier circuits 5301*a* and 5301*b*, however, the invention is not limited to this and the amplifier circuits may be omitted when there is no necessity of performing impedance transformation.

FIG. 69 shows a configuration in the case where a voltage is inputted to the original signal input terminal 5042, and the original signal input terminal 5042 is connected to the gate terminal of the N-channel transistor 4101. This configuration corresponds to the one in which the gate voltage of the transistor 4101 is outputted to the configuration in FIG. 56. Accordingly, an optimal signal voltage (precharge voltage) can be outputted by controlling the current value flowing through each transistor and the transistor size.

FIGS. 70 and 71 each shows a configuration in the case where a current is inputted to the original signal input terminal 5042. FIG. 70 is the configuration in which the transistor 5701 is added to FIG. 68 so as to allow a current input while FIG. 71 is the configuration in which the transistor 5801 is added to FIG. 69 so as to allow a current input.

Note that FIG. 64 shows the case where a voltage at the gate terminal is outputted to the second voltage output terminal 6343, however, the invention is not limited to this. The polarity of the transistor 6402 in FIG. 64 may be changed in accordance with the polarity of the transistor in the current memory circuit 5031 to obtain the configuration like the transistor 7202 in FIG. 72, whereby a voltage at the source terminal may be outputted to the second voltage output terminal 6343. The same can be applied to FIGS. 65 to 71.

In this manner, FIGS. 64 to 72 each illustrates the case where both of the voltage/current supply circuit 5011 and the setting circuit 5021 are the current delivery types. However, in the case where the setting circuit 5021 is a current inlet type as shown in FIG. 39 or FIG. 40, the voltage/current supply circuit 5011 is required to be a current inlet type. However, in the case where the current delivery type configuration is changed to a current inlet type configuration, the polarity of transistors is only required to be changed. For example, FIG. 73 shows a configuration in the case where FIG. 65 is changed to a current inlet type configuration. In this manner, potential of each wiring may be changed by inverting the polarity of each transistor.

In this manner, various configurations may be provided by appropriately selecting the current inlet type, the current delivery type or the like.

Embodiment Mode 7

Embodiment Mode 5 described the case where the current memory circuit 5031 is interposed between the voltage/current supply circuit 5011 and the setting circuit 5021 as shown in FIG. 50. Accordingly, a signal current is once stored before the current input to the setting circuit 5021. Hereupon, a voltage memory circuit 5051 may be interposed similarly between the voltage/current supply circuit 5011 and the setting circuit 5021. FIG. 74 shows a configuration in the case where the voltage memory circuit 5051 is disposed in the configuration in FIG. 50.

However, the invention is not limited to this, and the voltage memory circuit 5051 may be disposed in the configuration in FIG. 63. Similarly, the voltage memory circuit 5051 may be disposed between the voltage/current supply circuit 5041 and the current memory circuit 5031 in FIG. 63.

FIG. 75 shows an exemplary configuration of the voltage memory circuit 5051. A capacitor 7501 is disposed as an element for storing a voltage value. In addition, an amplifier circuit 7051 is disposed. Note that the amplifier circuit 7501 is a circuit which outputs a potential at roughly the same level as the input potential, and a voltage follower circuit is desirably employed as such amplifier circuit. However, the invention is not limited to this, and such function as impedance transformation is only required to be implemented. Note that in the case where there is no necessity of performing impedance transformation, the amplifier circuit 7501 may be omitted.

Note also that a plurality of capacitors (7501*a* and 7501*b*) and amplifier circuits (7502*a* and 7502*b*) may be disposed as shown in FIG. 76. In that case, a voltage can be inputted from a memory voltage input terminal 5052 while a voltage at a different level is outputted from a memory voltage output terminal 5053 as shown in FIG. 77. Accordingly, an operation timing can be controlled flexibly.

Similarly, a plurality of capacitors (7501*a* and 7501*b*) may be disposed as shown in FIG. 78. Accordingly, an operation timing can be controlled flexibly.

Embodiment Mode 8

Embodiment Modes 4 to 7 each described the circuit for supplying a video signal voltage and a video signal current. In this embodiment mode, description is made on the relationship in the case where the circuit for supplying a video signal voltage and a video signal current described in Embodiment Mode 4 to 7 is applied to the configurations described in Embodiment Modes 1 to 3.

First, FIG. 79 shows a configuration in the case where the circuit for supplying a video signal voltage and a video signal current described in Embodiment Modes 4 to 7 is disposed in the portion to supply signals to the video current signal line 1801 and the video voltage signal line 101 in the configurations in FIGS. 18, 19, 10, 20 and the like.

This configuration corresponds to the case of adopting the configuration in FIG. 50. That is, the voltage/current supply circuit 5011 in FIG. 50 corresponds to the voltage/current supply circuit 5011 in FIG. 79. The setting circuit 5021 in FIG. 50 corresponds to the pixel in FIGS. 18, 19, 10, 20 and the like, The current memory circuit 5031 in FIG. 50 corresponds to the current source circuit 1807*a* in FIG. 79. According to such configuration, an appropriate signal can be supplied to the pixel or the current source circuit 1807*a*, and the steady state can be obtained promptly.

Note that in the case where the voltage memory circuits 1101*a* to 1101*b* are disposed as in FIG. 19 and FIG. 17, the configuration corresponds to the one adopting the configuration in FIG. 74. That is, the voltage memory circuit 5051 in FIG. 74 corresponds to the voltage memory circuits 1101*a* to 1101*b* in FIG. 19 and FIG. 17.

Note that in the case of the current source 1807*a* in FIG. 79 having the configuration as in FIG. 32, a plurality of video current signal lines 1801*i*, 1801*j* and the like are provided. The configuration diagram for that case is shown in FIG. 88 and FIG. 89. A voltage signal is inputted from an original voltage signal input terminal 8812*a* while a voltage signal is inputted from an original signal input terminal 8812*b* so as to supply currents. Then, currents are outputted from the video current signal line 1801*i* and the video current signal line 1801*j*. Note that FIG. 88 and FIG. 89 each shows the case where two video current signal lines are provided, however, the invention is not limited to this.

Note also that as for the W/L (channel width-to-length) ratio of a transistor 8901 and a transistor 8902 in a voltage/current supply circuit 8811, the sum of the W/L ratio of each transistor corresponds to the total sum of the current values outputted from the video current signal line 1801*i* and the video current signal line 1801*j*. Accordingly, the W/L ratio may be determined on the assumption that the total current flow through the respective video current signal lines is the largest. As a result, in the case where the total current flow through the respective video current signal lines is the largest, a voltage signal inputted from the original voltage signal input terminal 8812*a* can be at roughly the same level as the voltage signal inputted from the original signal input terminal 8812*b*. That is, when FIG. 88 and FIG. 89 are applied to the case of FIG. 79 and the like, the W/L ratio may be determined on the assumption that the total current flow through the respective video current signal lines is the largest.

Note that the transistors 8901 and 8902 each amplifies the output current value by the second power as set forth above. Accordingly, the transistors 8901 and 8902 and the like may be designed to have the same channel length L but have a different channel width W each increased by the second power. In addition, the channel width W and the channel length L of the transistors in the current source circuit 1807*a* and the pixel may be determined based on the total sum of the W/L ratio of each transistor. As a result, voltage signal inputted from the original voltage signal input terminal 8812*a* can be at roughly the same level as the voltage signal inputted from the original signal input terminal 8812*b* in the case where the total current flow through the respective video current signal lines is the largest.

FIG. 80 shows the case of adopting the configuration in FIG. 63. According to such configuration, an appropriate signal can be supplied to the pixel or the current source circuit 1807*a* and a steady state can be obtained promptly.

FIG. 81 shows the case of adopting the configuration in FIG. 36. According to such configuration, an appropriate signal can be supplied to the current source circuit 1807*a* and a steady state can be obtained promptly. Note that the original signal input terminal 5012 and the video voltage signal line 101 may be connected in FIG. 81 in order to apply a signal voltage at the same level.

In this manner, the circuit for supplying a video signal voltage and a video signal current described in Embodiment Modes 4 to 7 can be appropriately applied to the configurations described in Embodiment Modes 1 to 3.

Embodiment Mode 9

An exemplary configuration of a pixel is described in this embodiment mode. FIG. 82 shows an exemplary configuration in the case of a current delivery type and a P-channel transistor being employed. First, as shown in FIG. 83, a switch 1209*aa* is turned ON in the case of inputting a signal voltage. It may be turned OFF as well. Then, a signal current is inputted as shown in FIG. 84.

After that, by supplying a current to an EL element 8205*aa* as a load, light can be emitted. Note that the load is not limited to the EL element 8205*aa*. It may be an element such as a resistor, a transistor, an EL element, other light emitting elements, a current source circuit configured with a transistor, a capacitor and a switch, a wiring connected to an arbitrary circuit, a signal line or a pixel connected to the signal line. The pixel may include an EL element, an element used for an FED or other elements driven by a current flow therethrough.

Note that the pixel may have any configuration as long as a current is inputted thereto. For example, the configuration like FIG. 85 or FIG. 86 may be employed. Further, various configurations can be provided by changing to a current delivery type or an inlet type configuration or by changing the polarity of transistors. Alternatively, a similar configuration to those of the current source circuits in FIGS. 22 to 28 may be employed as well.

Note that various capacitors may be omitted by utilizing the gate capacitance of transistors and the like.

Note that a switch is disposed in each portion of the various configurations described heretofore, however, the position thereof is not limited to the aforementioned. The switch can be disposed in an arbitrary position as long as a normal operation is enabled.

Note that a switch may be an electrical switch or a mechanical switch. It may be anything as long as it can control a current flow. It may be a transistor, a diode or a logic circuit configured with them. Therefore, in the case of using a transistor as a switch, the polarity (conductivity) thereof is not particularly limited as it operates just as a switch. However, in the case where off-current is required to be small, a transistor of a polarity with smaller off-current is desirably employed. Such transistor with small off-current includes a transistor provided with an LDD region. In addition, in the case where a transistor as a switch operates in the condition where the potential of the source terminal thereof is closer to the low-potential-side power source (Vss, Vgnd, 0V and the like), an N-channel transistor is desirably employed. On the other hand, in the case where it operates in the condition where the potential of the source terminal thereof is closer to the high-potential-side power source (Vdd and the like), a P-channel transistor is desirably employed. This is because the transistor can operate as a switch effectively as the absolute value of the gate-source voltage can be increased. Note also that a CMOS switch may also be employed by combining an N-channel transistor and a P-channel transistor.

Note also that transistors used in the invention may be any type, and may be formed on any substrate. Therefore, a glass substrate such as barium borosilicate glass and alumino borosilicate glass, a quartz substrate, a ceramic substrate, a stainless substrate, a flexible substrate typified by plastic or acrylic, a single crystalline substrate and an SOI substrate may be employed to form all the circuits as shown in FIG. 1, 79 or 82 thereon. Alternatively, a part of the circuits as shown in FIG. 1, 79 or 82 may be formed on a certain substrate while another part thereof may be formed on the other substrate. That is, not all the circuits shown in FIG. 1, 79 or 82 are required to be formed on the same substrate. For example, a pixel and a gate line driver circuit may be formed on a glass substrate by using TFTs while a signal line driver circuit (or a part of it) may be formed on a single crystalline substrate, and the IC chip of which may be connected by COG (Chip On Glass) to be disposed on the glass substrate. Alternatively, the IC chip may be connected to the glass substrate by using TAB (Tape Auto Bonding) or a printed board.

Embodiment Mode 10

Embodiment Modes 1 to 3 described the operation of inputting a signal voltage as a precharge to a pixel, and subsequently inputting a signal current. However, the invention is not limited to this.

For example, such operation may be employed that no signal current is inputted and only a signal voltage is inputted to a pixel or a signal line. However in this case, luminance of each pixel varies. However, the luminance variation is not distinctive in the case of displaying moving images and the like. Accordingly, when no signal current is inputted and only a signal voltage is inputted to a pixel or a signal line, a current flow through each current source portion can be blocked, leading to the low power consumption.

In the case of displaying still images, on the other hand, luminance variation of each pixel is more easily recognized. Therefore, it is desirable that a signal current is inputted after the input of a signal voltage as described in Embodiment Modes 1 to 3 in order to reduce the effect of luminance variation.

In this manner, the operation of inputting only a signal voltage to a pixel or a signal line is hereinafter referred to as a voltage input mode while an the operation of inputting a signal current after the input of a signal voltage as a precharge is hereinafter referred to as a current input mode.

In the voltage input mode, operation of a current source or an amplifier circuit in each portion can be interrupted, therefore, power consumption can be reduced. However, luminance variation is recognized.

In the current input mode, on the other hand, power consumption cannot be easily reduced, however, an effect of luminance variation can be reduced.

Hereupon, the operation may be switched between the voltage input mode and the current input mode according to circumstances. For example, in the case of displaying a still image or the case of displaying a still image for over a predetermined period, the operation may be switched to the current input mode while the operation may be switched to the voltage input mode in other periods. For example, in the case of displaying a still image for one second or more, the current input mode operation may be employed.

Alternatively, such operation may be employed that the current input mode operation is employed in the case where an image of more than a predetermined area of the display region changes, while the voltage input mode operation is employed in other periods. For example, the current input mode operation may be employed in the case where an image of more than half of the display screen changes.

Alternatively, both can be combined such that the current input mode operation is employed in the case where an image changes in a predetermined period or a predetermined region while the voltage input mode operation is employed in other periods or areas.

Embodiment Mode 11

Examples of electronic appliances using the invention include a video camera, a digital camera, a goggle display (head mounted display), a navigation system, an audio reproducing device (car audio, audio component and the like), a personal computer, a game machine, a portable information terminal (mobile computer, portable phone, portable game machine, electronic book and the like) and an image reproducing device equipped with a recording medium (specifically, a device reproducing a recording medium such as a Digital Versatile Disc (DVD) and equipped with a display for displaying the reproduced image). Specific examples of such electronic appliances are shown in FIG. 87.

FIG. 87A is a light emitting device which includes a housing 13001, a supporting base 13002, a display portion 13003, a speaker portion 13004, a video input terminal 13005 and the like. The invention can be applied to an electric circuit configuring the display portion 13003. According to the invention, the light emitting device shown in FIG. 87A can be completed. Since a light emitting device is a self-luminous type, no backlight is required, and thus a thinner display portion than that of a liquid crystal display can be achieved. Note that the light emitting device includes all information display devices such as the one for personal computer, TV broadcasting and advertisement display.

FIG. 87B is a digital still camera which includes a main body 13101, a display portion 13102, an image receiving portion 13103, operating keys 13104, an external connecting portion 13105, a shutter 13106 and the like. The invention can be applied to an electric circuit configuring the display portion 13102. According to the invention, the digital still camera shown in FIG. 87B can be completed.

FIG. 87C is a personal computer which includes a main body 13201, a housing 13202, a display portion 13203, a keyboard 13204, an external connecting port 13205, a pointing mouse 13206 and the like. The invention can be applied to an electric circuit configuring the display portion 13203. According to the invention, the light emitting device shown in FIG. 87C can be completed.

FIG. 87D is a mobile computer which includes a main body 13301, a display portion 13302, a switch 13303, operating keys 13304, an IR port 13305 and the like. The invention can be applied to an electric circuit configuring the display portion 13302. According to the invention, the mobile computer shown in FIG. 87D can be completed.

FIG. 87E is a portable image reproducing device provided with a recording medium (specifically, a DVD reproducing device), which includes a main body 13401, a housing 13402, a display portion A13403, a display portion B13404, a recording medium (such as DVD) reading portion 13405, an operating key 13406, a speaker portion 13407 and the like. The display portion A13403 mainly displays image data while the display portion B13404 mainly displays text data. The invention can be applied to electric circuits configuring the display portions A13403 and B13404. Note that the image reproducing device provided with a recording medium includes a home game machine and the like. According to the invention, the DVD reproducing device shown in FIG. 87E can be completed.

FIG. 87F is a goggle display (head mounted display) which includes a main body 13501, a display portion 13502 and an arm portion 13503. The invention can be applied to an electric circuit configuring the display portion 13502. According to the invention, the goggle display device shown in FIG. 87F can be completed.

FIG. 87G is a video camera which includes a main body 13601, a display portion 13602, a housing 13603, an external connecting port 13604, a remote control receiving portion 13605, an image receiving portion 13606, a battery 13607, an audio input portion 13608, operating keys 13609 and the like. The invention can be applied to an electric circuit configuring the display portion 13602. According to the invention, the video camera shown in FIG. 87G can be completed.

FIG. 87H is a portable phone which includes a main body 13701, a housing 13702, a display portion 13703, an audio input portion 13704, an audio output portion 13705, an operating key 13706, an external connecting port 13707, an antenna 13708 and the like. The invention can be applied to an electric circuit configuring the display portion 13703. Note that power consumption of the portable phone can be suppressed by displaying white text on the black background in the display portion 13703. According to the invention, the portable phone shown in FIG. 87H can be completed.

If higher emission luminance of light emitting materials becomes available in future, the invention can be applied to a front or a rear projector by projecting the light including outputted image data through magnification with a lens and the like.

The aforementioned electronic appliances are more likely to be used for displaying data distributed through telecommunication paths such as Internet and CATV (cable TV) and, especially they have increased their chances of displaying information of moving image. Since light emitting materials show quite a high response speed, a light emitting device is suitable for displaying moving images.

In addition, since a light emitting device consumes power in its light emitting portion, data is desirably displayed with as small a light emitting portion as possible. Accordingly, in the case where a light emitting device is used in the display portion which mainly displays text data in a portable information terminal such as a portable phone and an audio reproducing device in particular, it is desirable that the text data is formed by light emitting region while utilizing a non-light emitting portion as a background.

As set forth above, an application range of the invention is quite wide, therefore, the invention can be applied to electronic appliances in various fields. A semiconductor device having any configurations illustrated in Embodiment Modes 1 to 10 can be adopted for the electronic appliances described in this embodiment mode.

Figure 1:
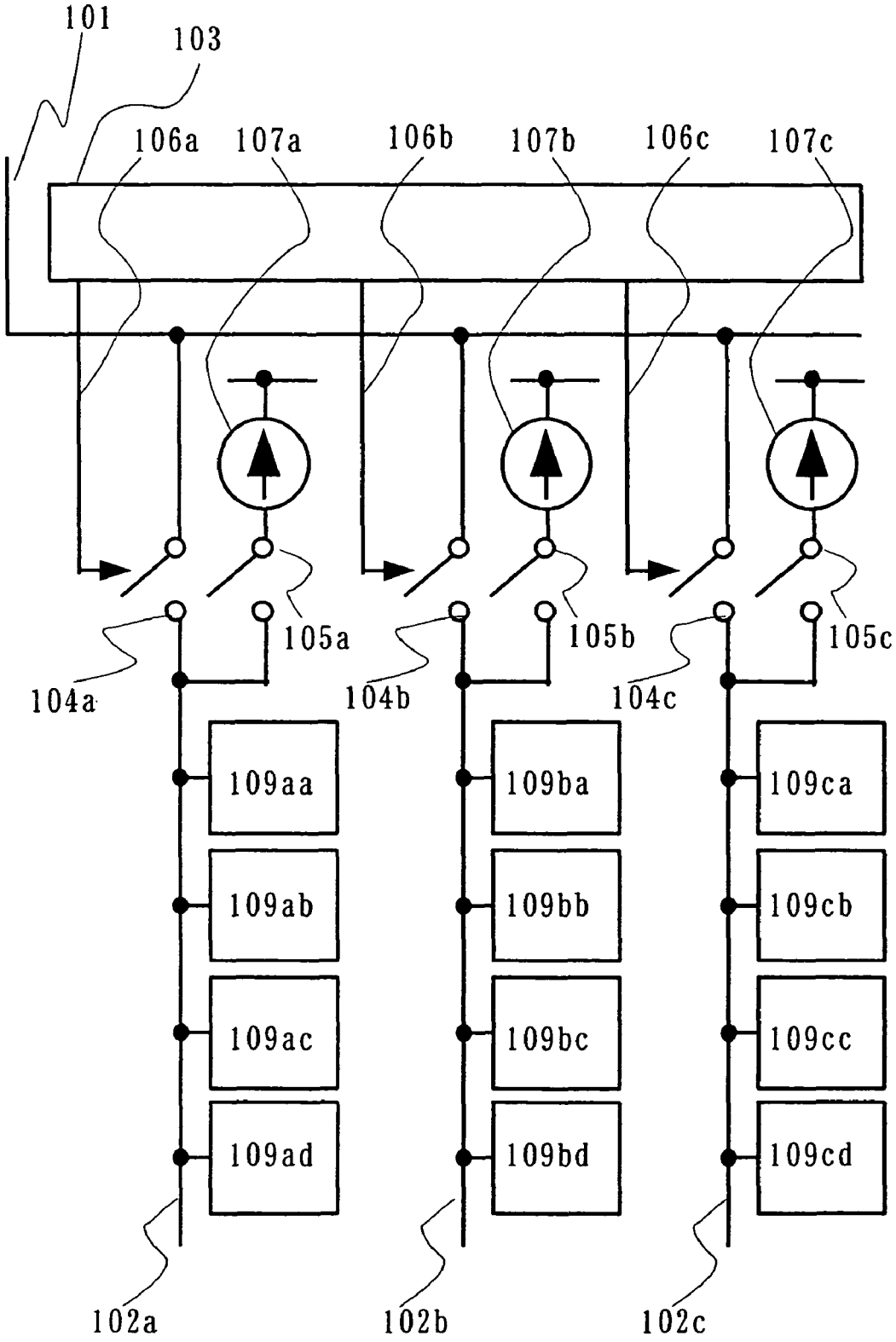
[FIG. 1] diagram illustrating a configuration of a semiconductor device in accordance with the invention
Figure 2:
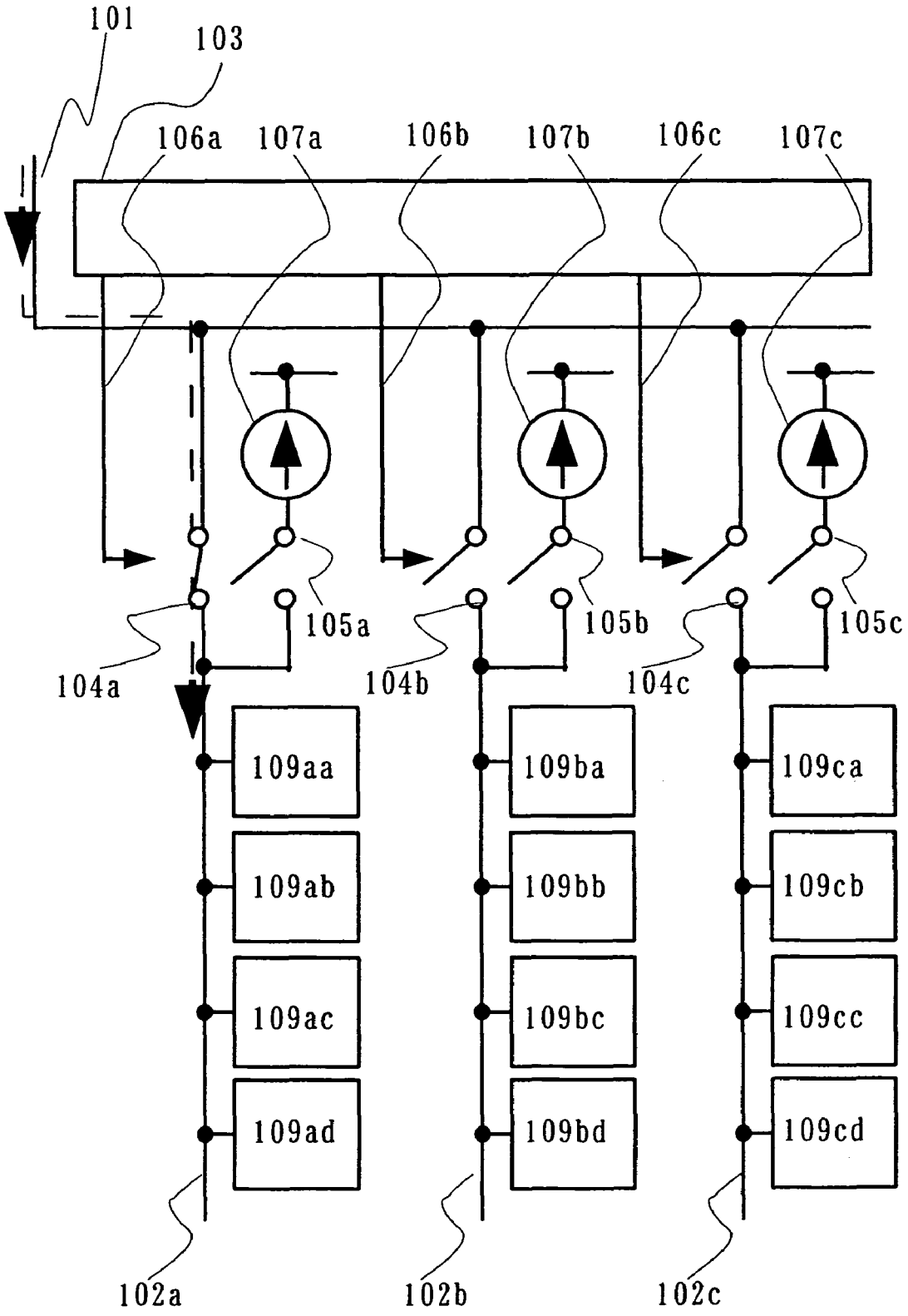
[FIG. 2] diagram illustrating an operation of a semiconductor device in accordance with the invention
Figure 3:
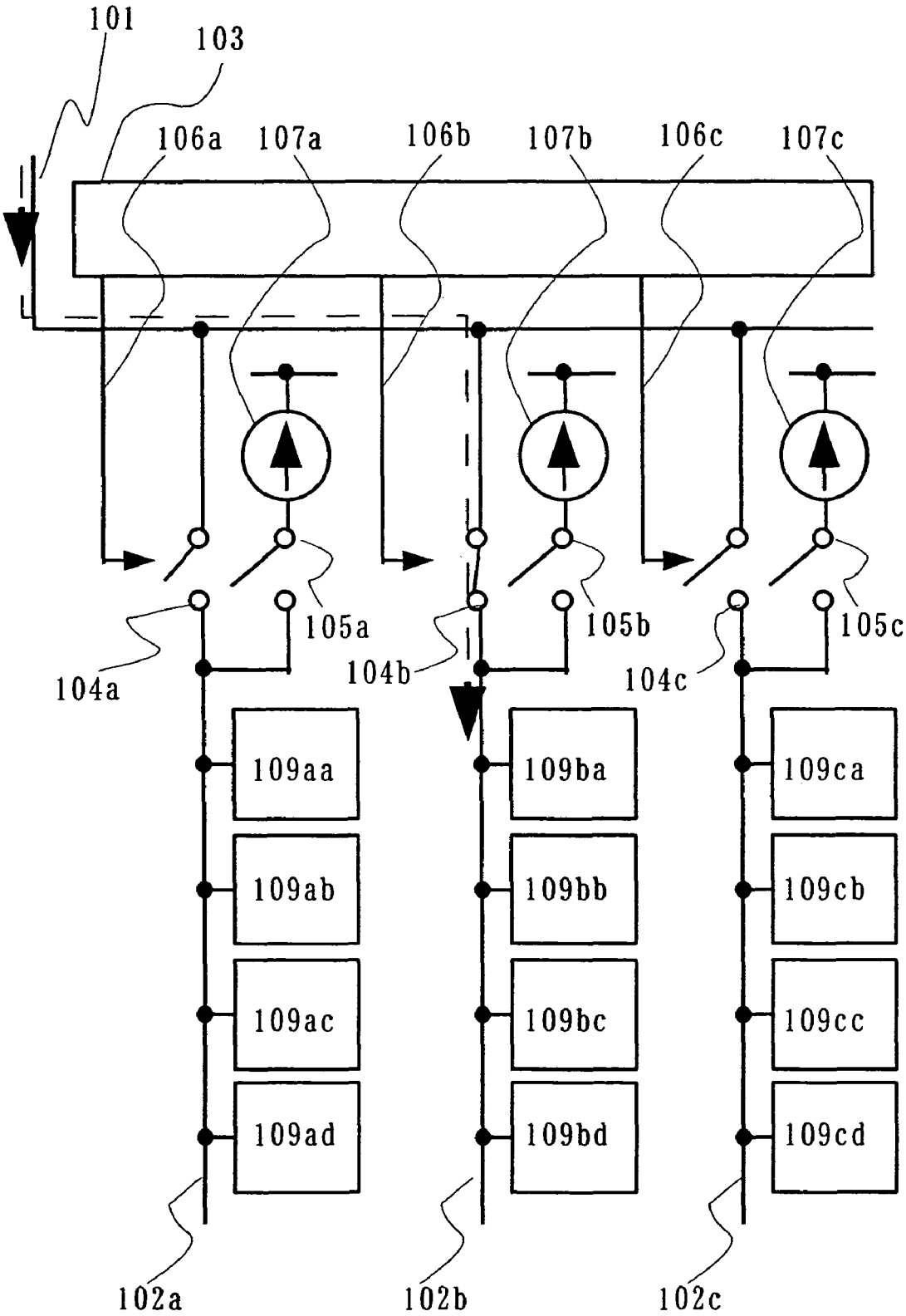
[FIG. 3] diagram illustrating an operation of a semiconductor device in accordance with the invention
Figure 4:
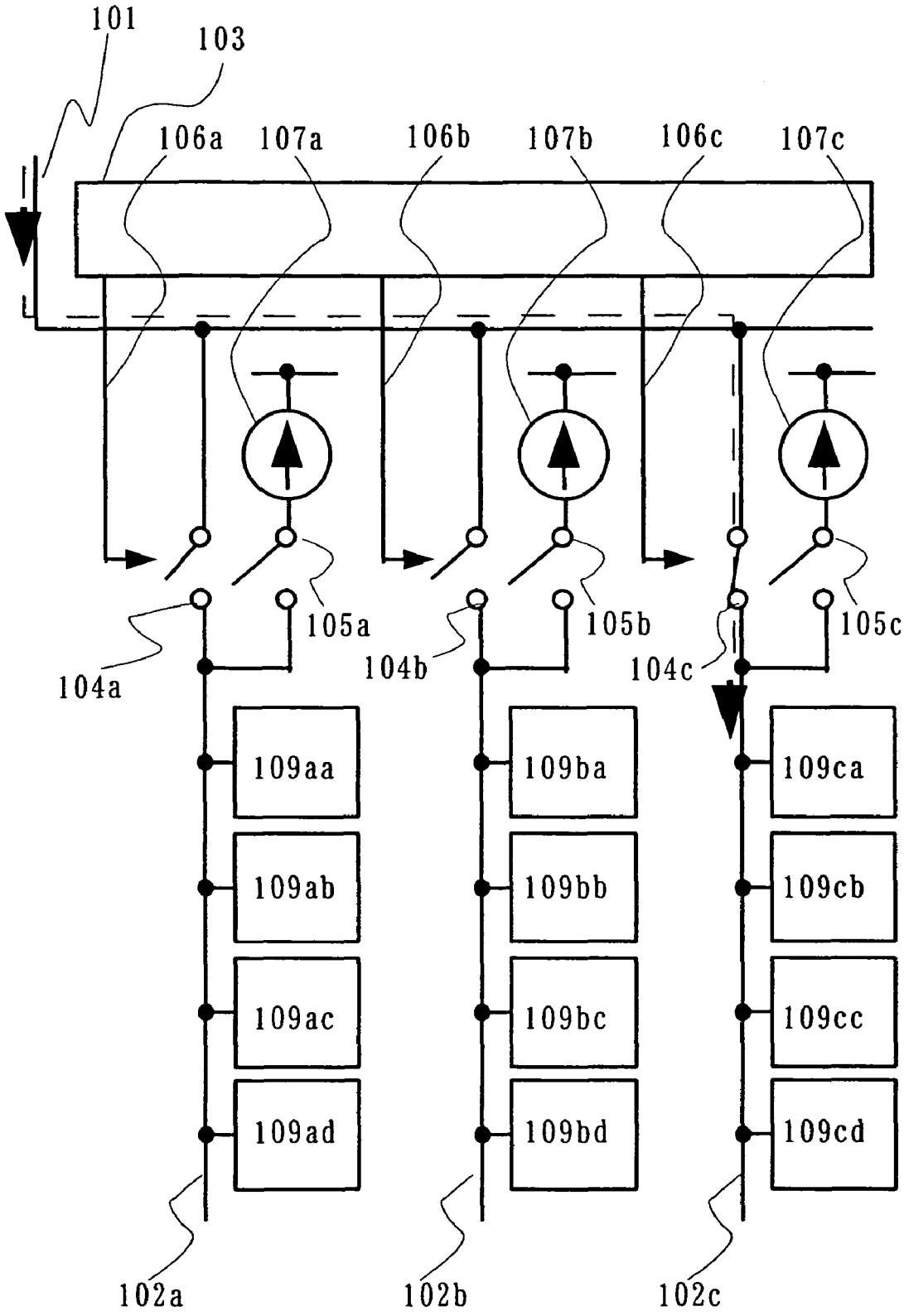
[FIG. 4] diagram illustrating an operation of a semiconductor device in accordance with the invention
Figure 5:
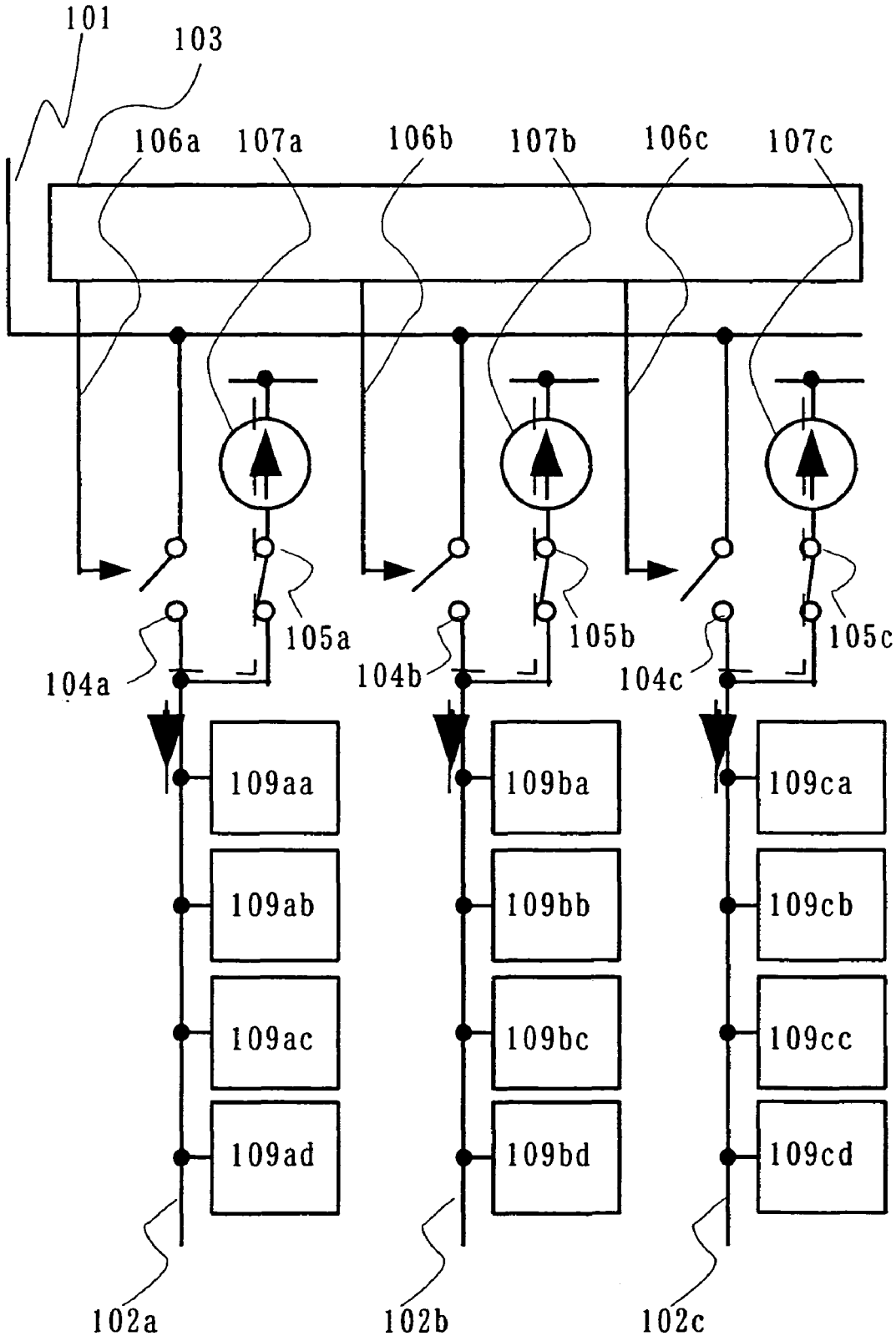
[FIG. 5] diagram illustrating an operation of a semiconductor device in accordance with the invention
Figure 6:
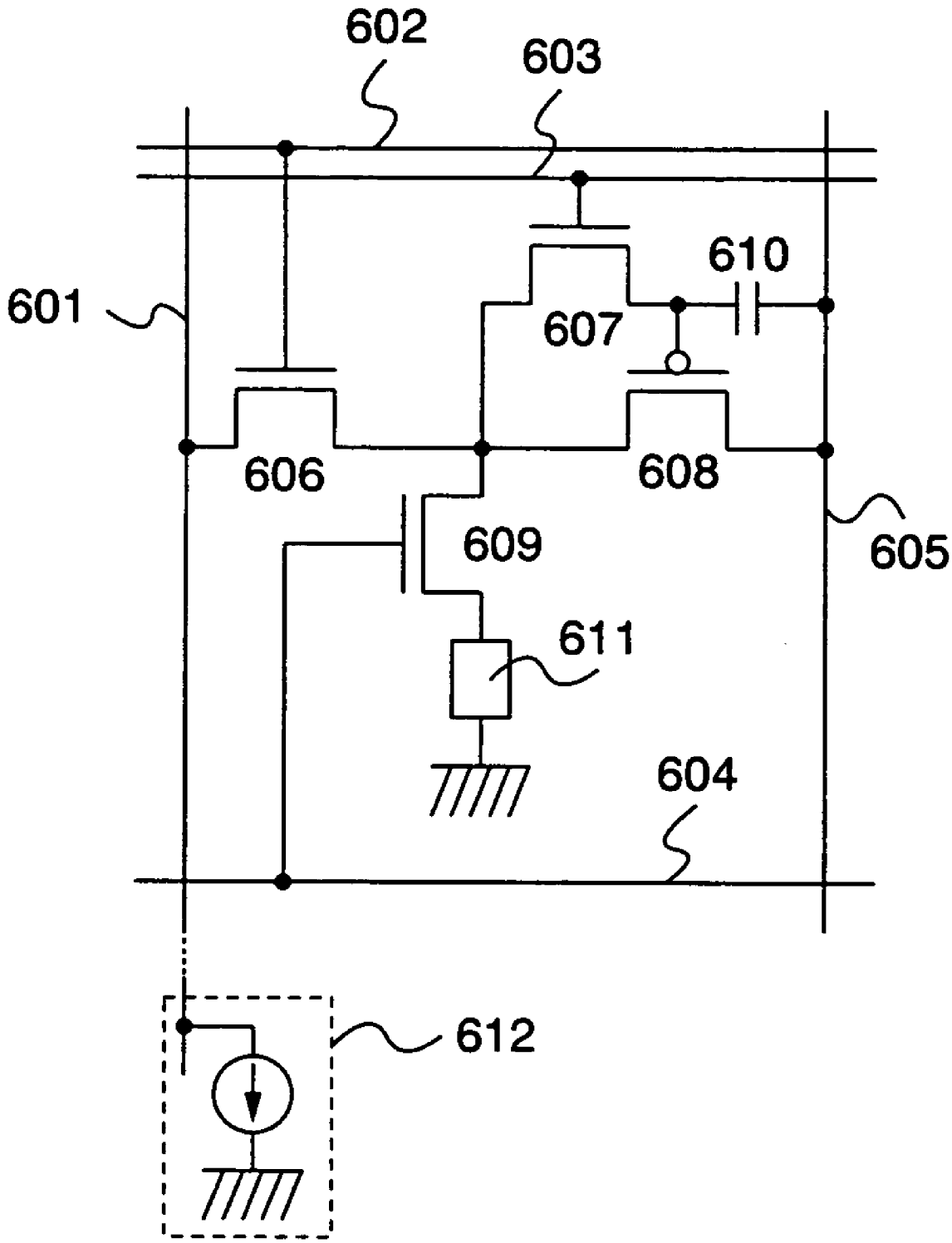
[FIG. 6] diagram illustrating a configuration of a conventional pixel
Figure 7A:
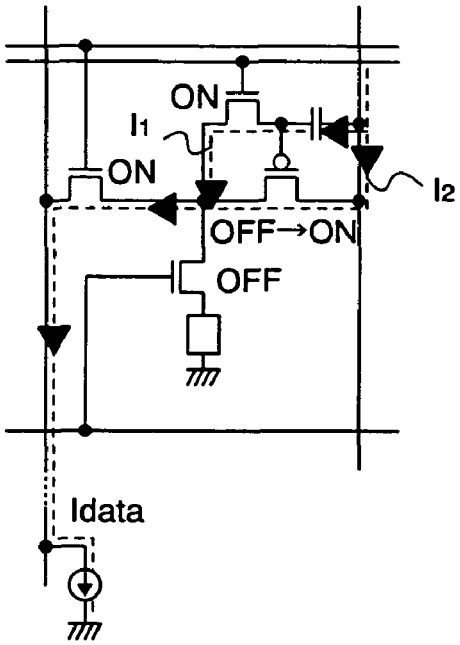
[FIG. 7] diagrams illustrating operations of a conventional pixel
Figure 7B:
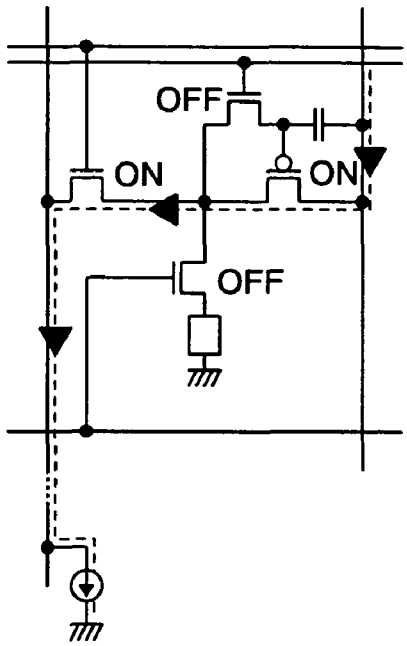
Figure 7C:
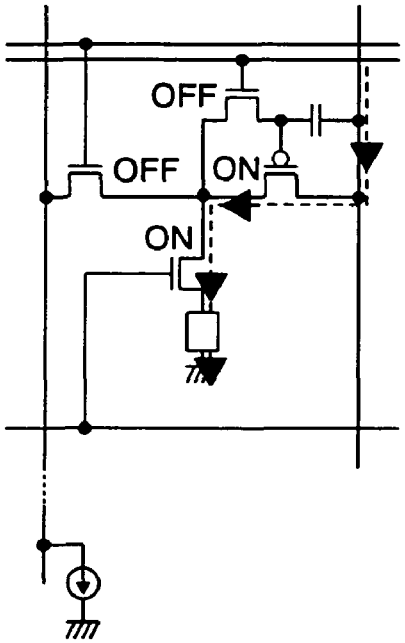
Figure 7D:
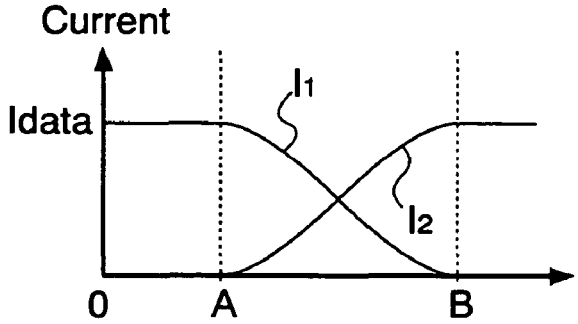
Figure 7E:
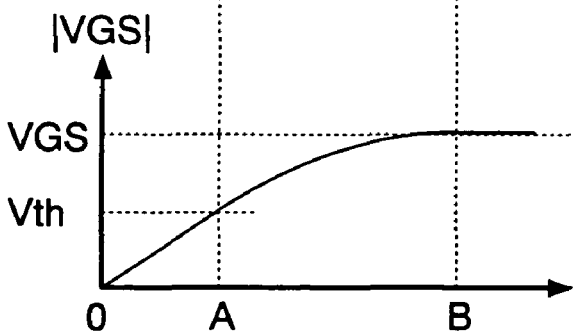
Figure 8:
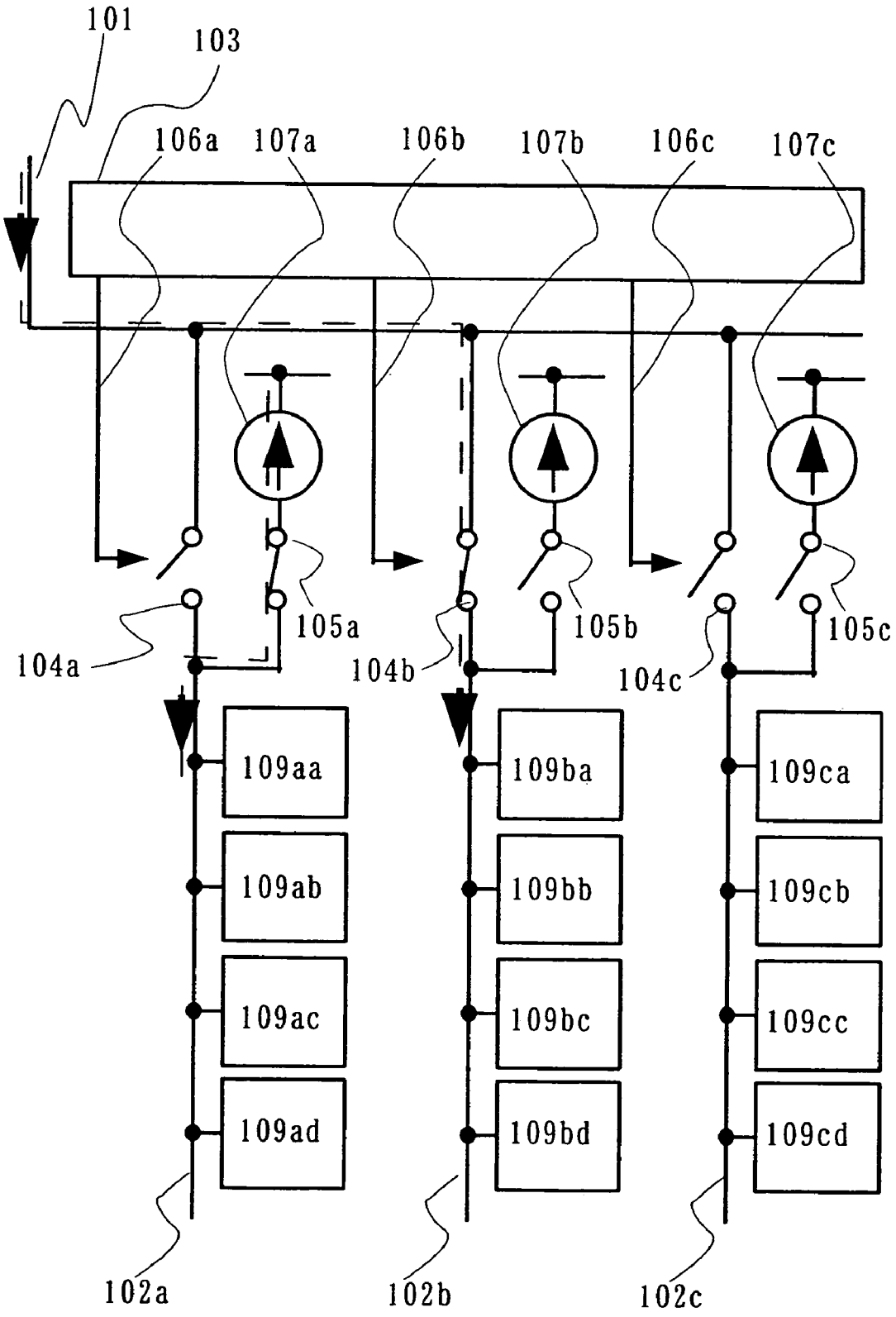
[FIG. 8] diagram illustrating an operation of a semiconductor device in accordance with the invention
Figure 9:
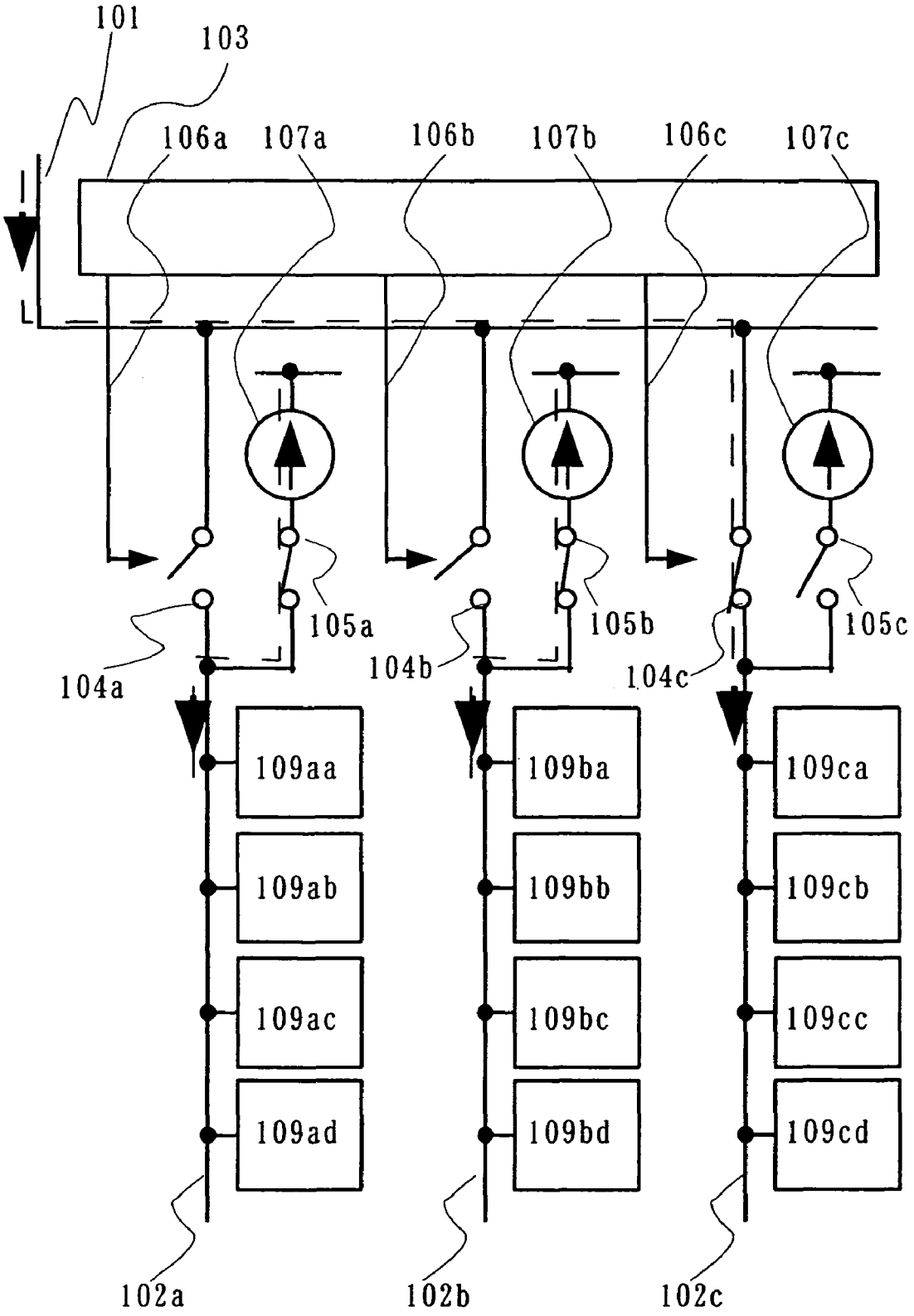
[FIG. 9] diagram illustrating an operation of a semiconductor device in accordance with the invention
Figure 10:
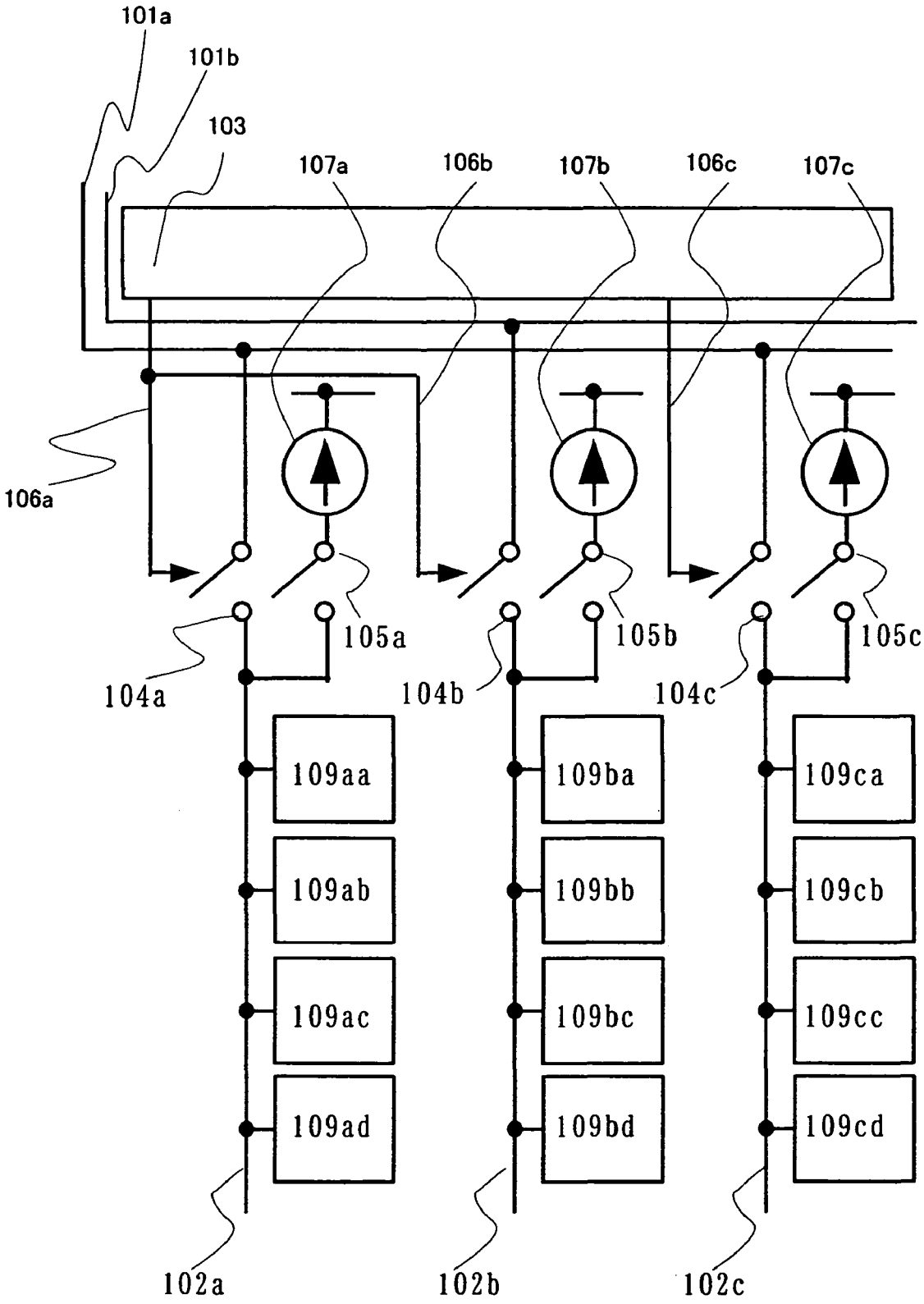
[FIG. 10] diagram illustrating a configuration of a semiconductor device in accordance with the invention
Figure 11:
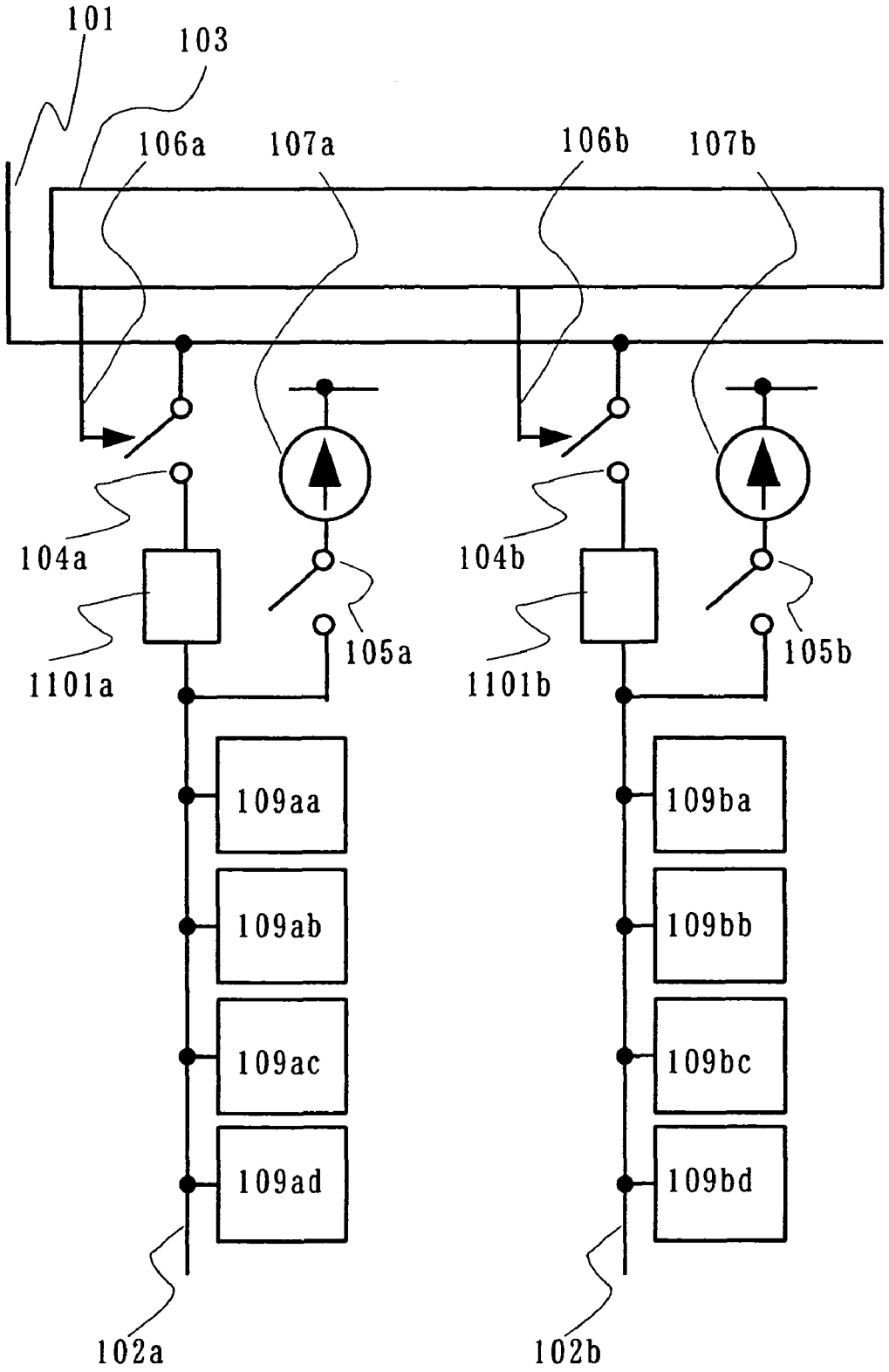
[FIG. 11] diagram illustrating a configuration of a semiconductor device in accordance with the invention
Figure 12:
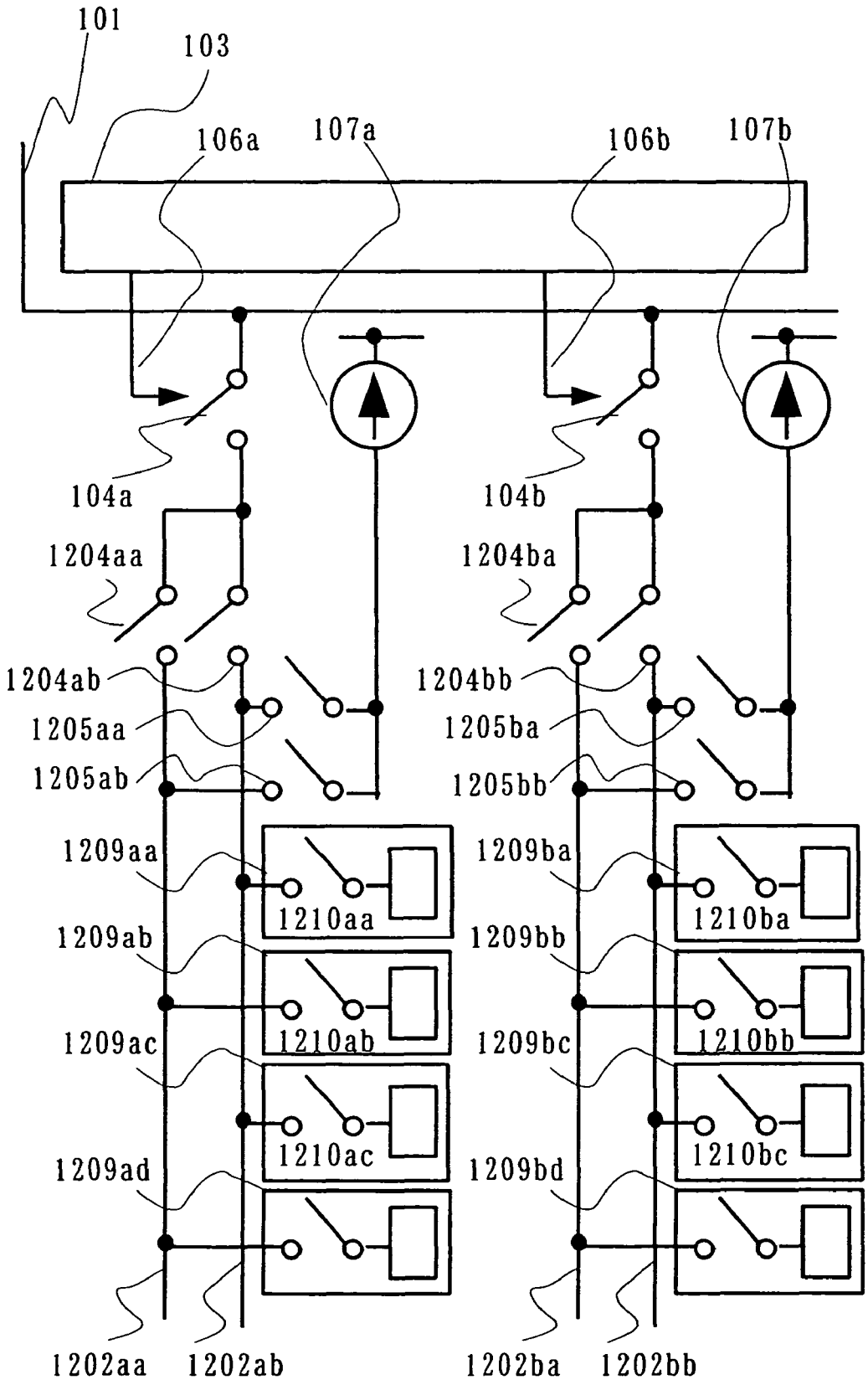
[FIG. 12] diagram illustrating a configuration of a semiconductor device in accordance with the invention
Figure 13:
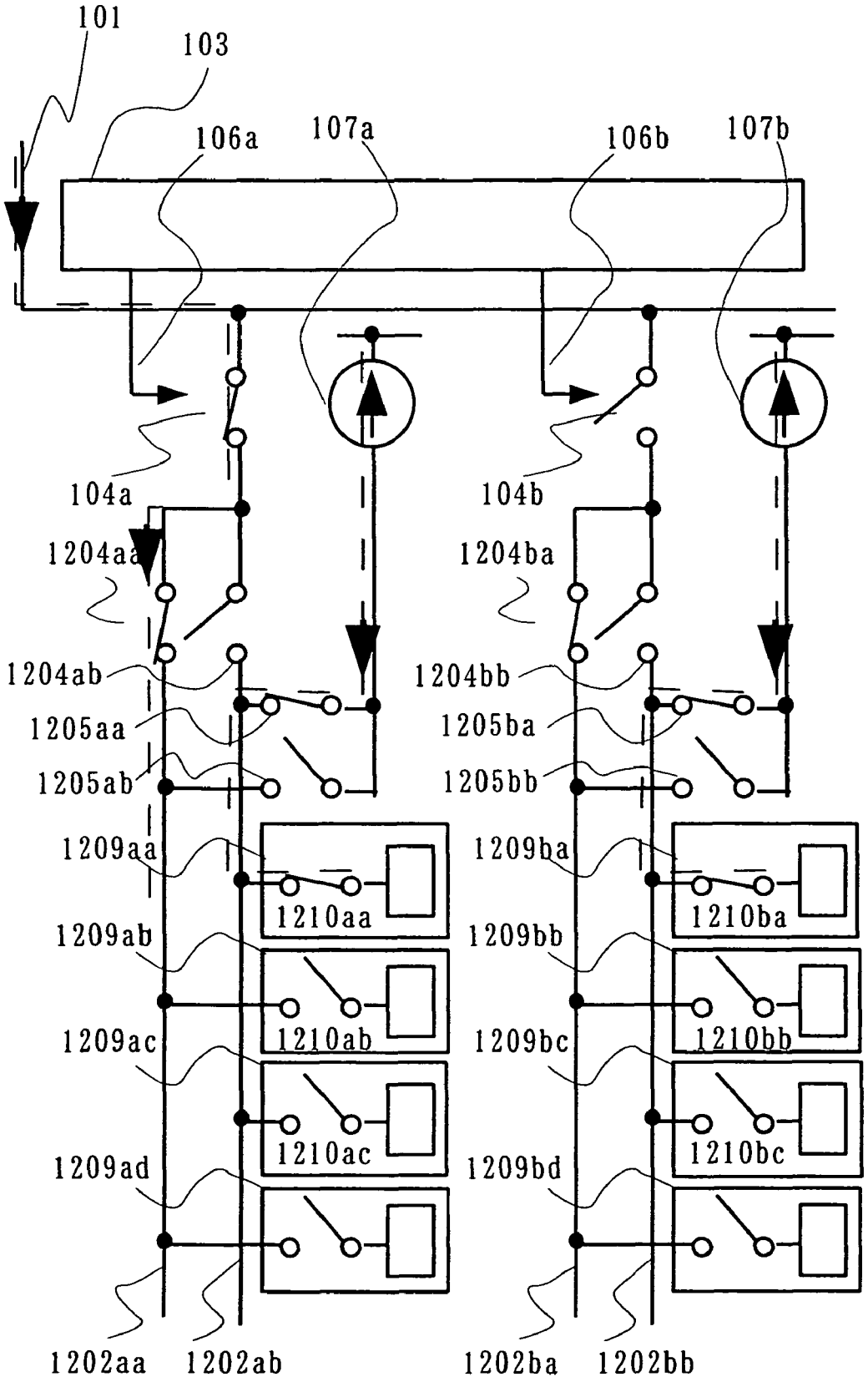
[FIG. 13] diagram illustrating an operation of a semiconductor device in accordance with the invention
Figure 14:
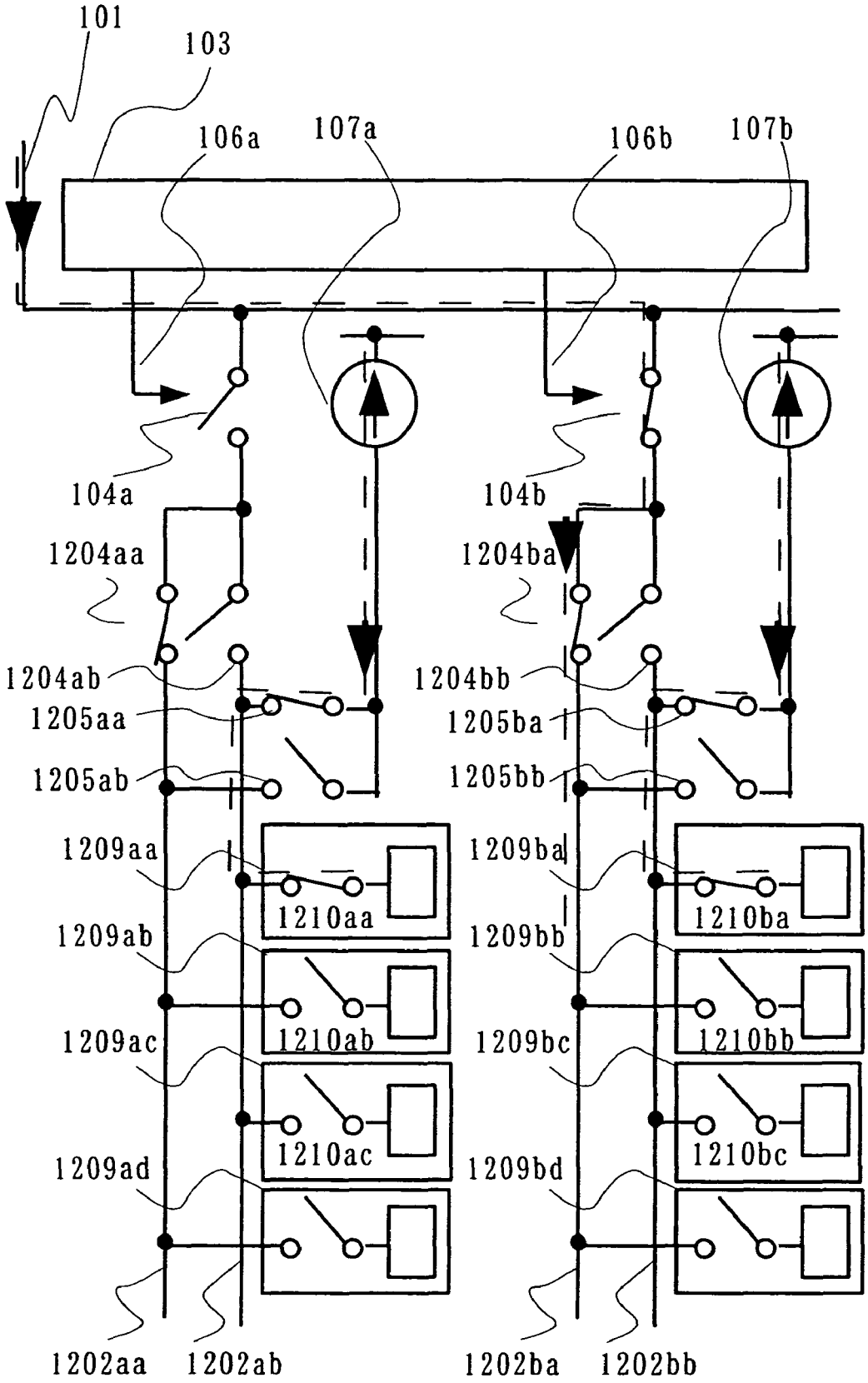
[FIG. 14] diagram illustrating an operation of a semiconductor device in accordance with the invention
Figure 15:
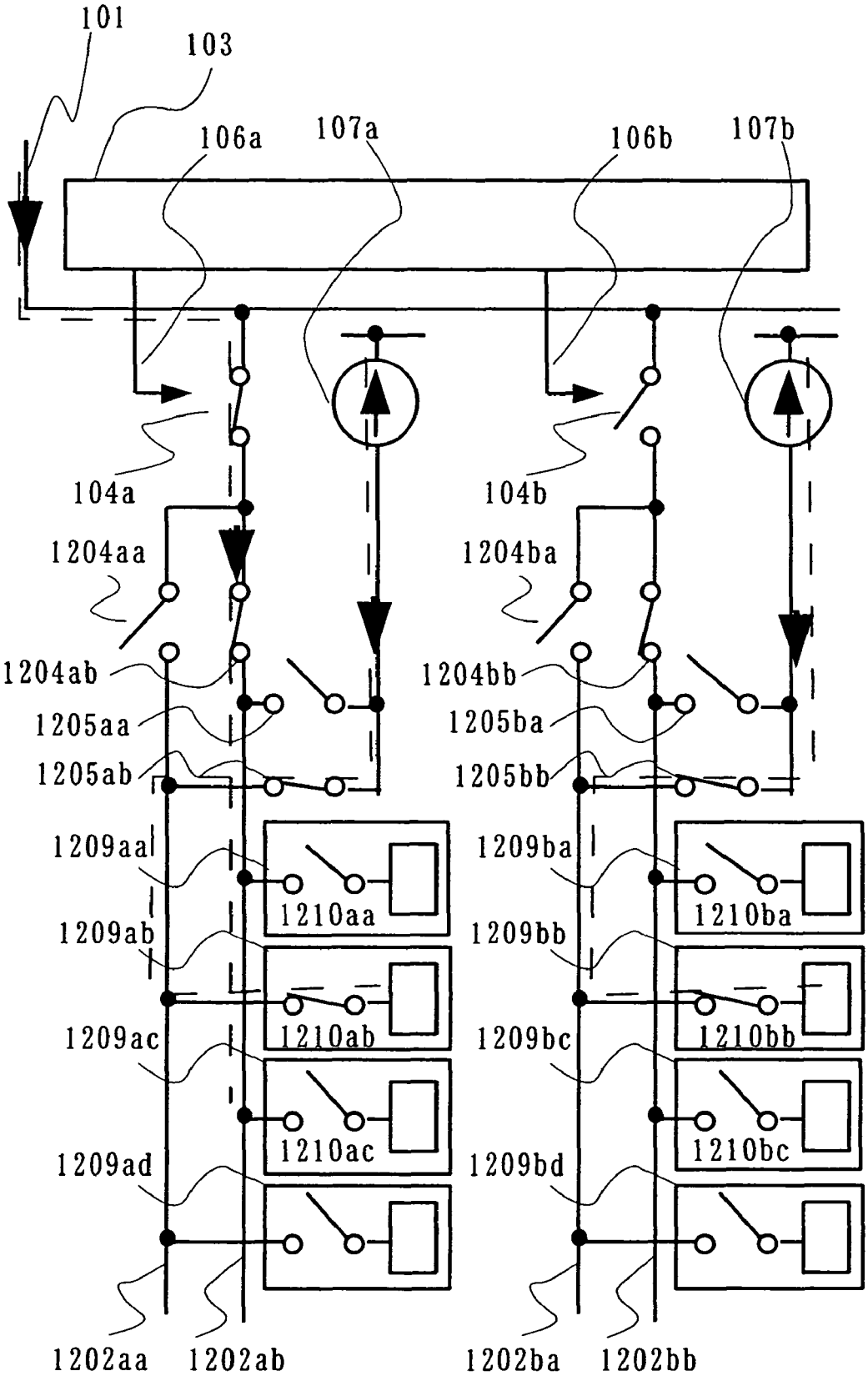
[FIG. 15] diagram illustrating an operation of a semiconductor device in accordance with the invention
Figure 16:
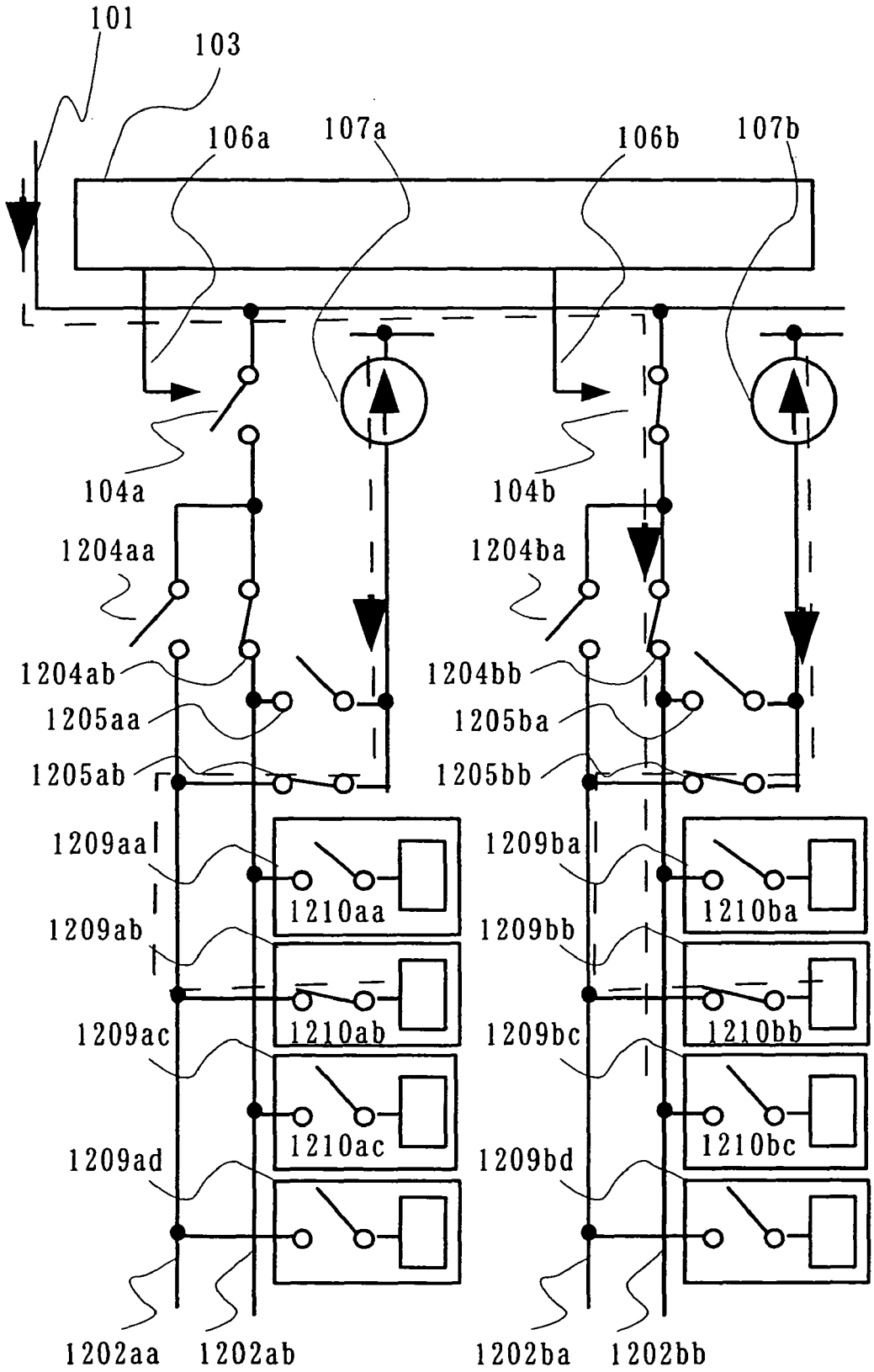
[FIG. 16] diagram illustrating an operation of a semiconductor device in accordance with the invention
Figure 17:
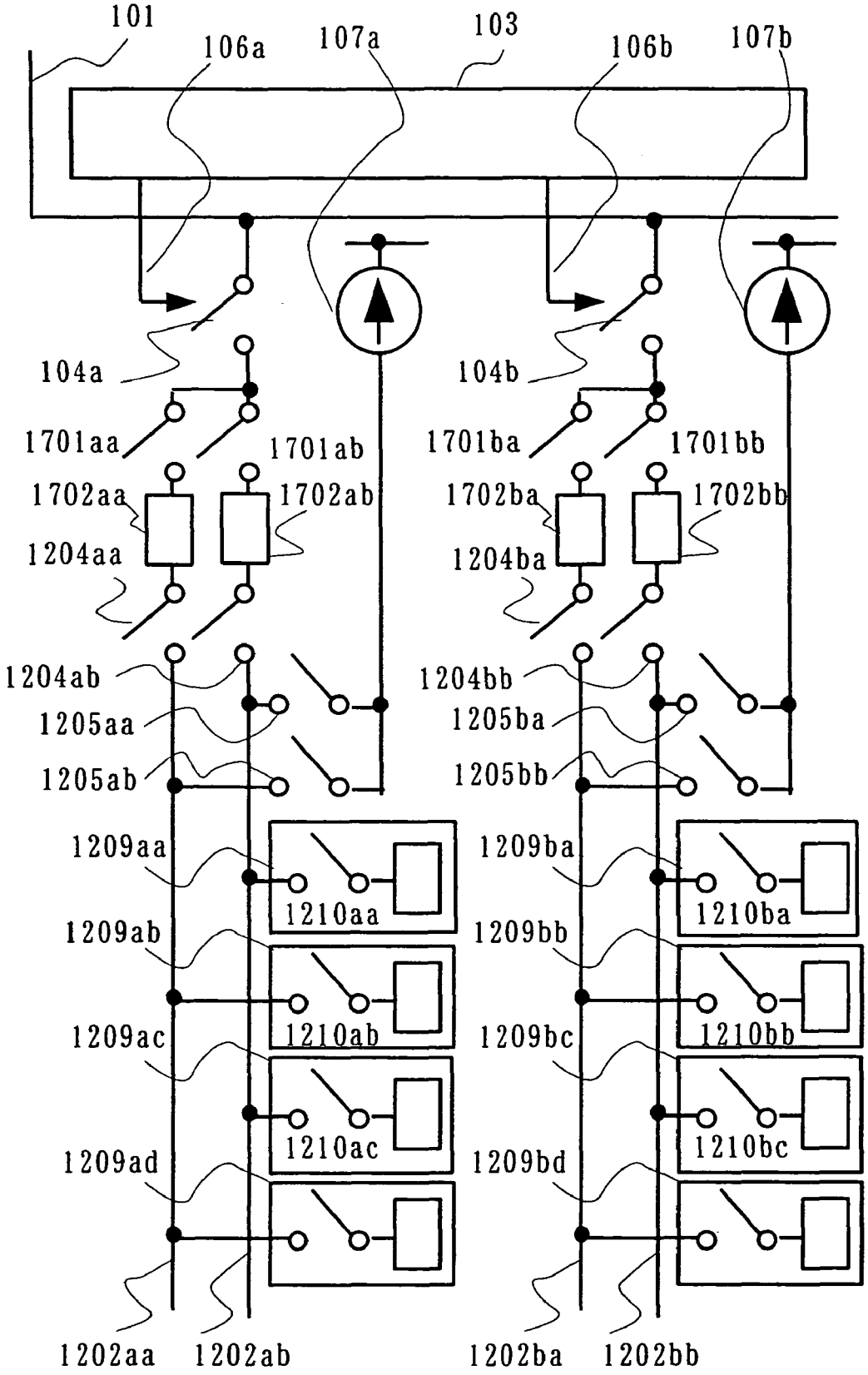
[FIG. 17] diagram illustrating a configuration of a semiconductor device in accordance with the invention
Figure 18:
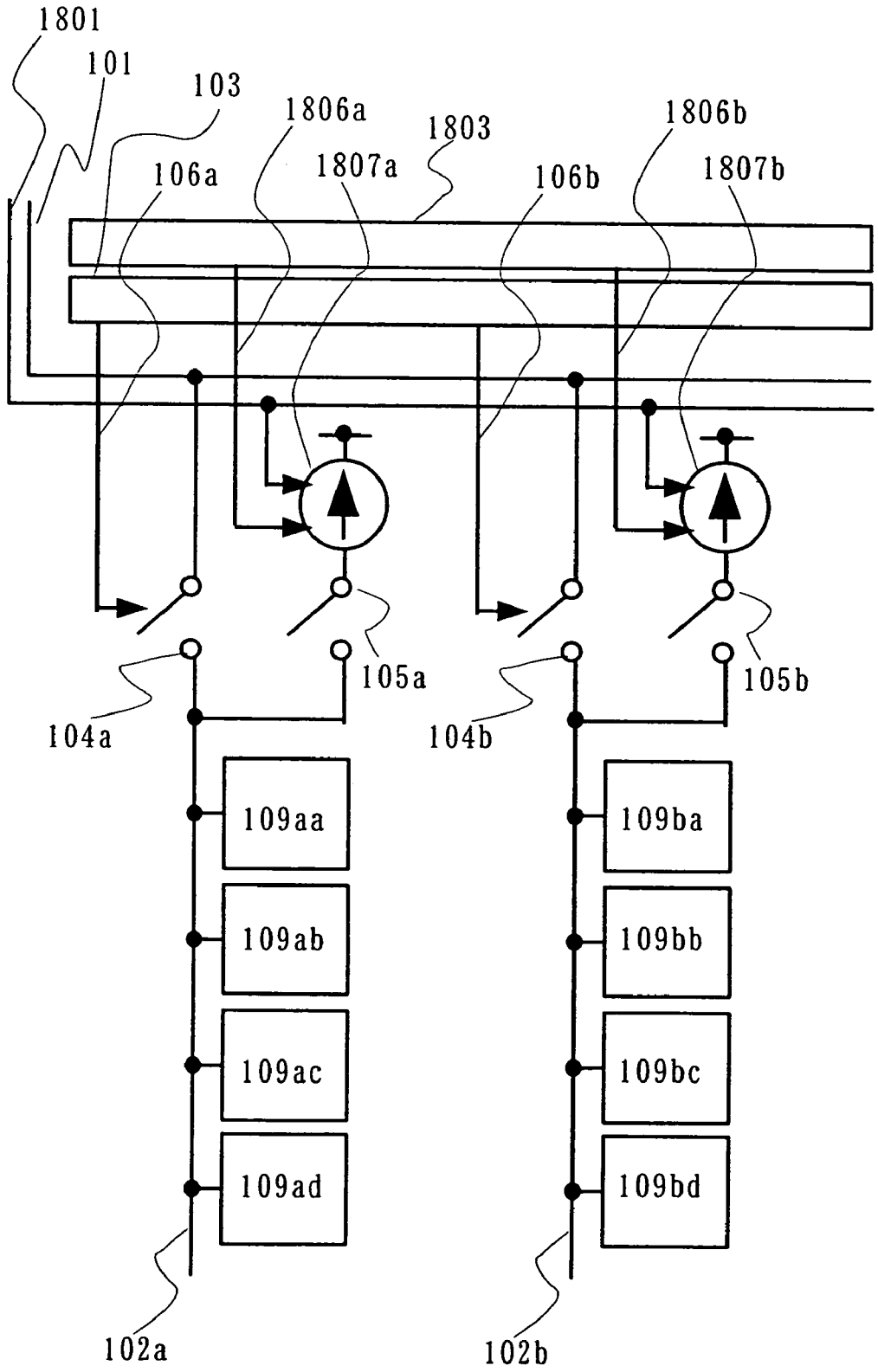
[FIG. 18] diagram illustrating a configuration of a semiconductor device in accordance with the invention
Figure 19:
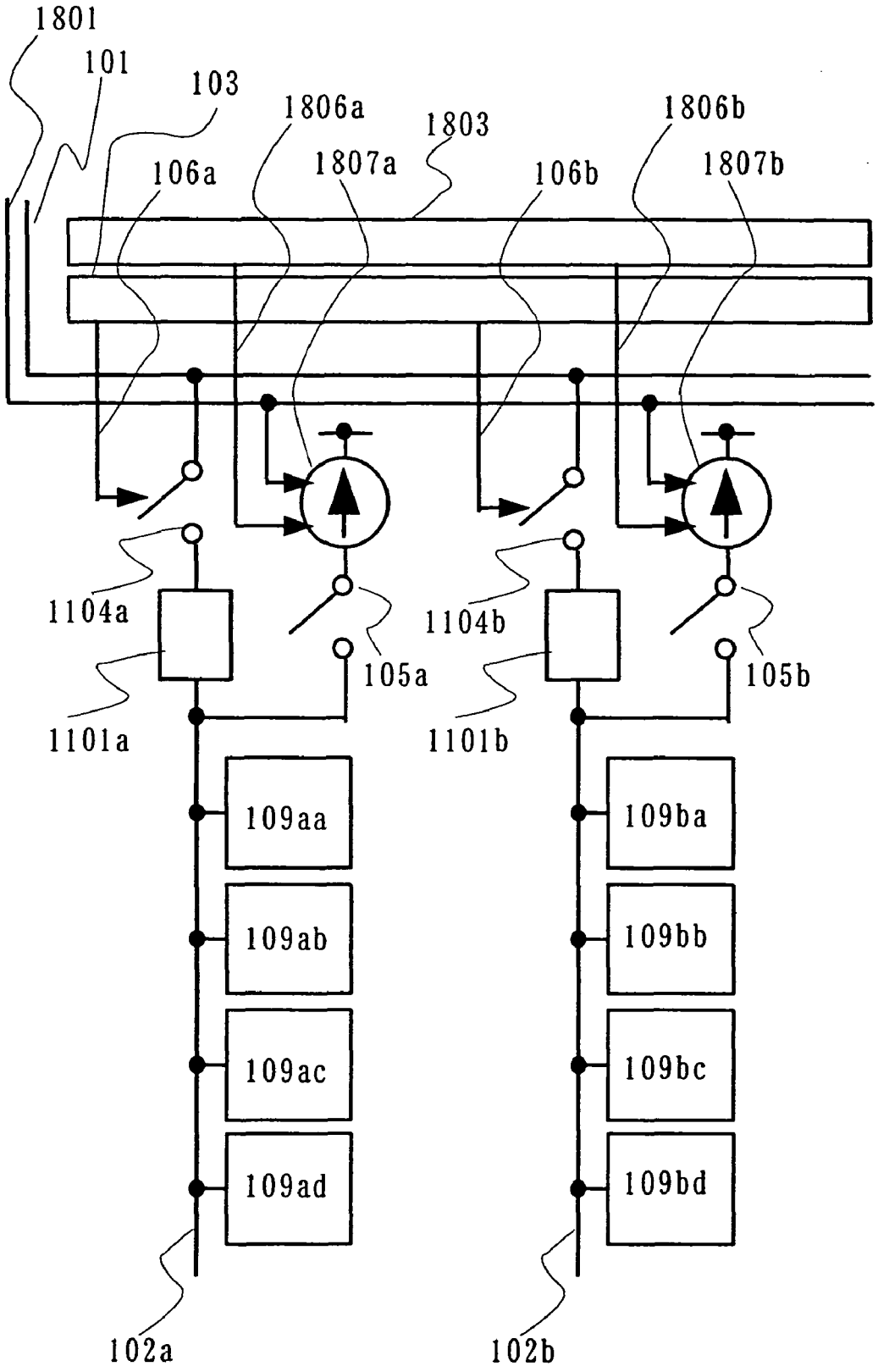
[FIG. 19] diagram illustrating a configuration of a semiconductor device in accordance with the invention
Figure 20:
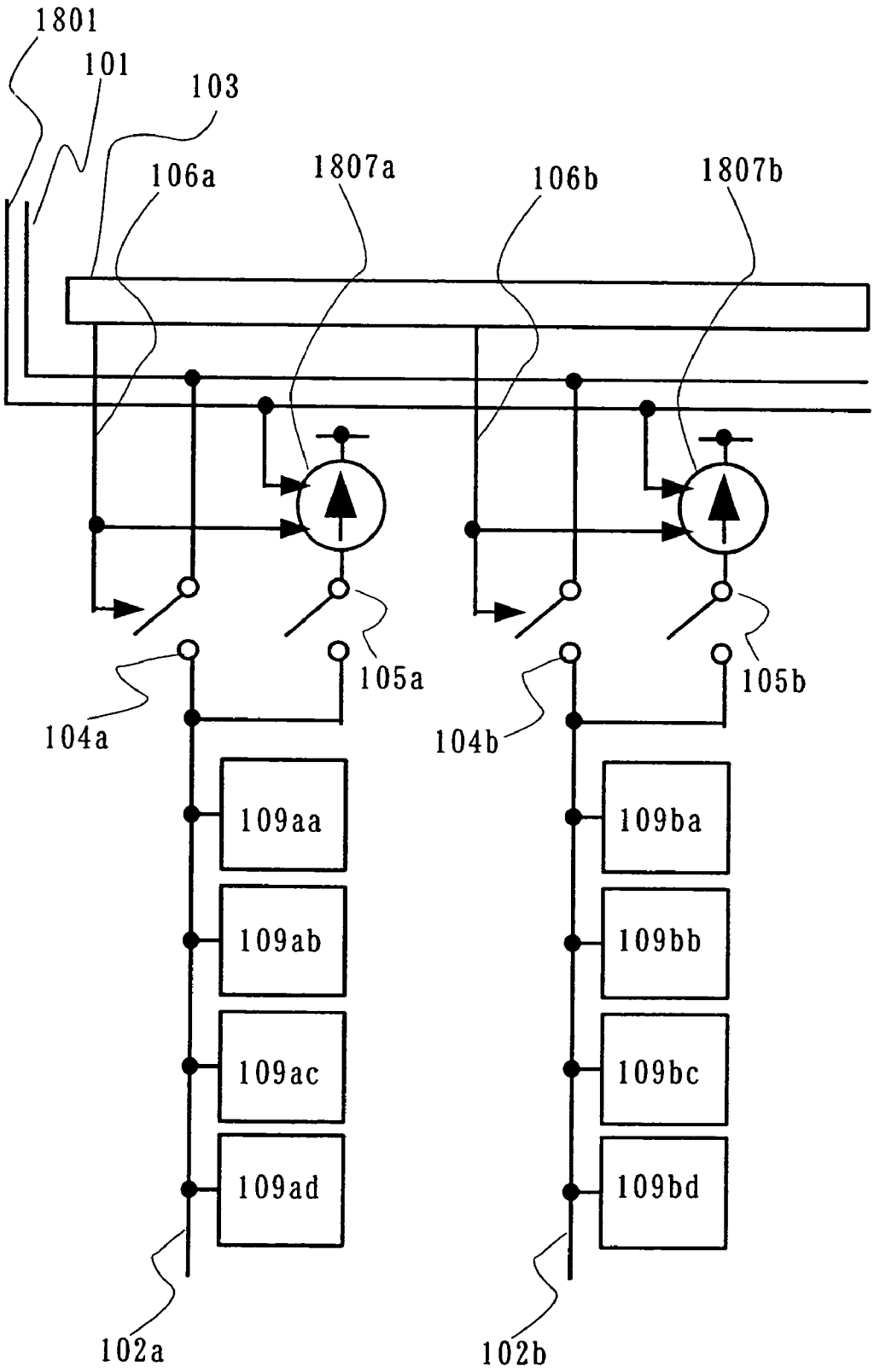
[FIG. 20] diagram illustrating a configuration of a semiconductor device in accordance with the invention
Figure 21:
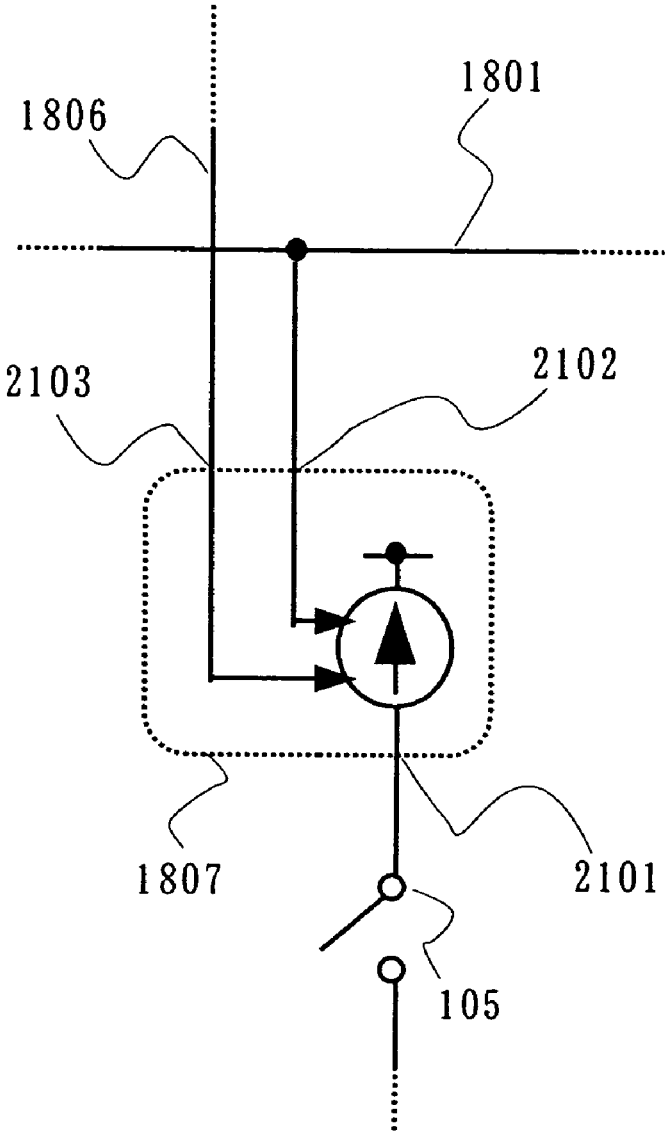
[FIG. 21] diagram illustrating a configuration of a semiconductor device in accordance with the invention
Figure 22:
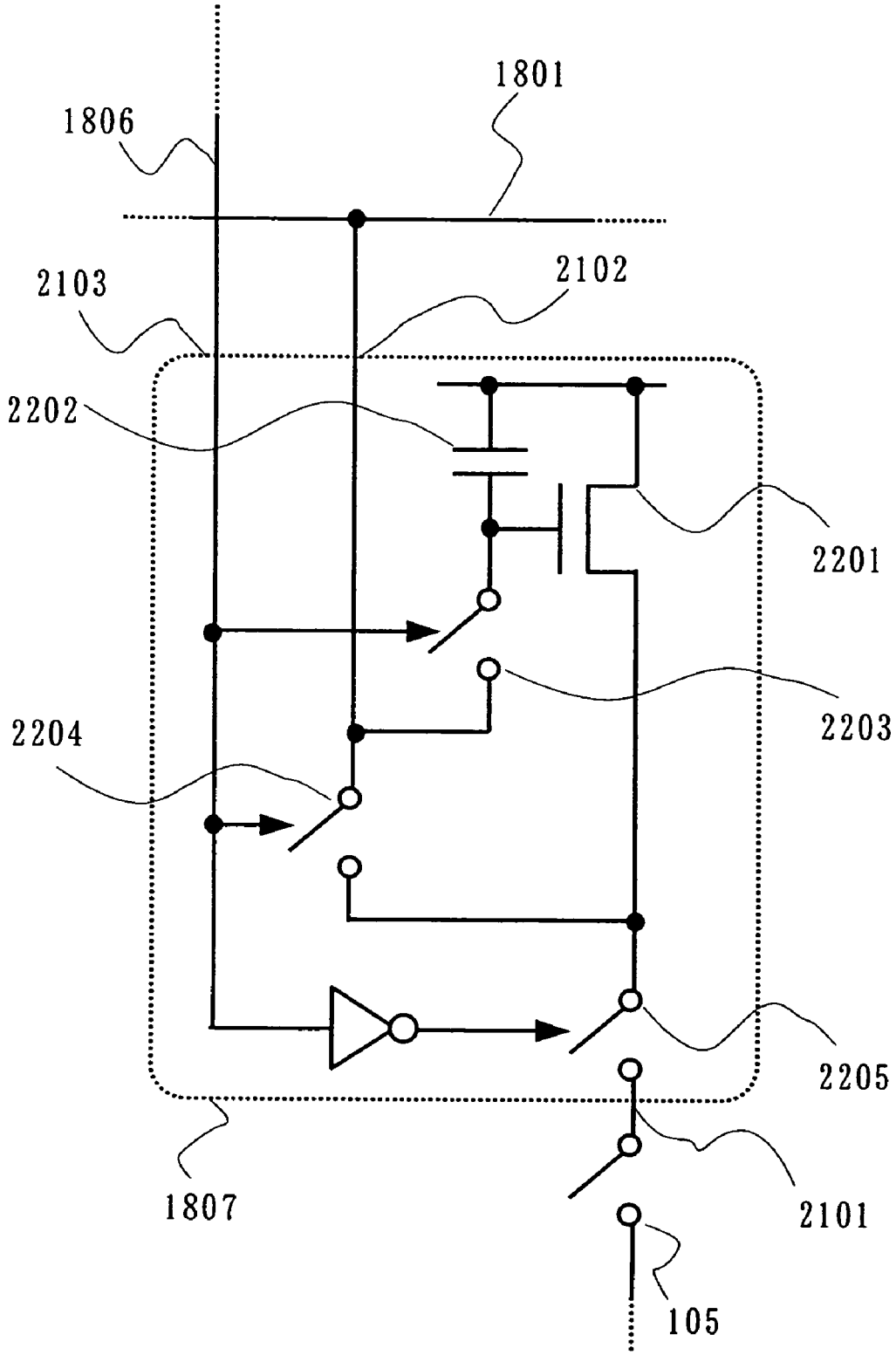
[FIG. 22] diagram illustrating a configuration of a semiconductor device in accordance with the invention
Figure 23:
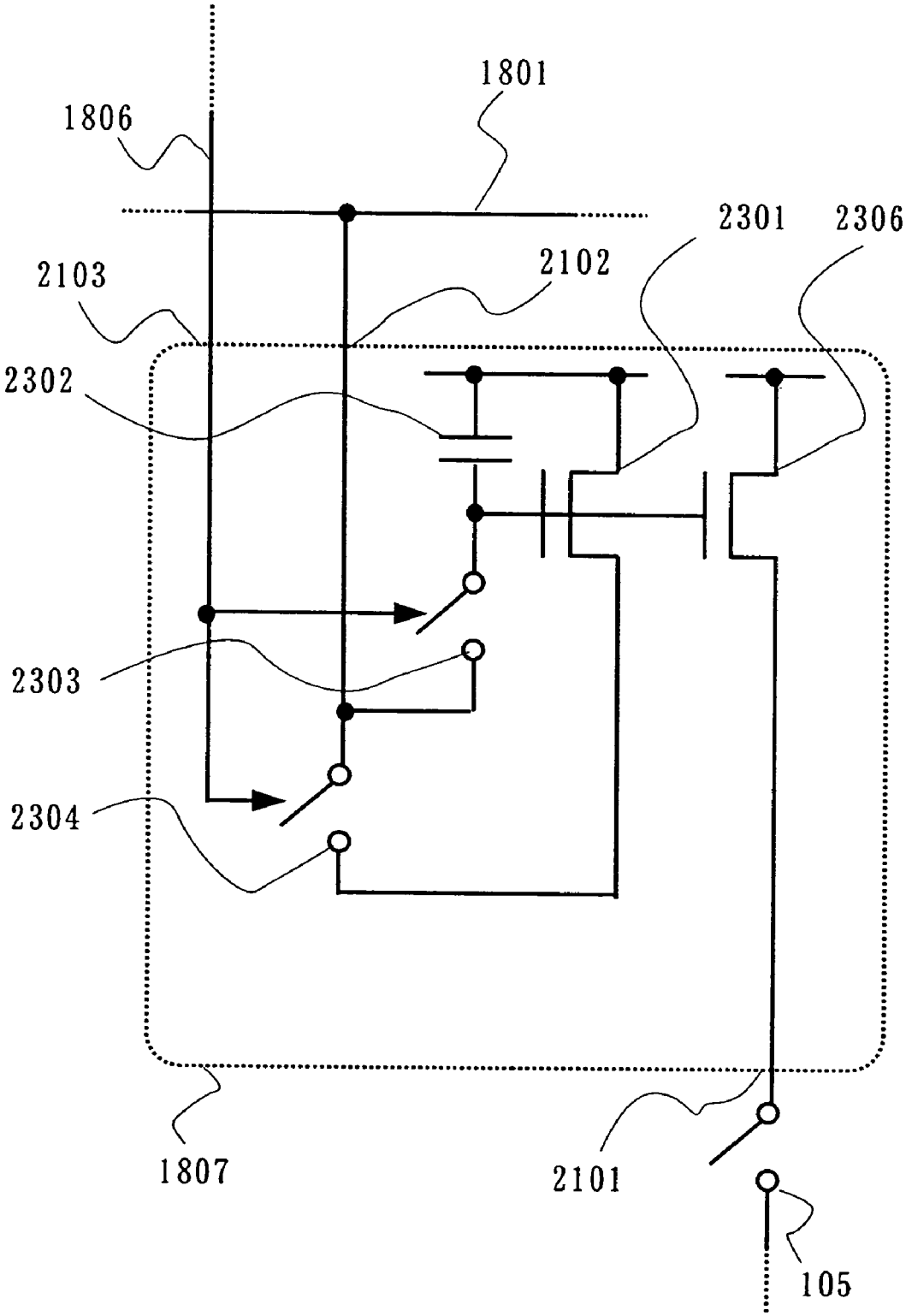
[FIG. 23] diagram illustrating a configuration of a semiconductor device in accordance with the invention
Figure 24:
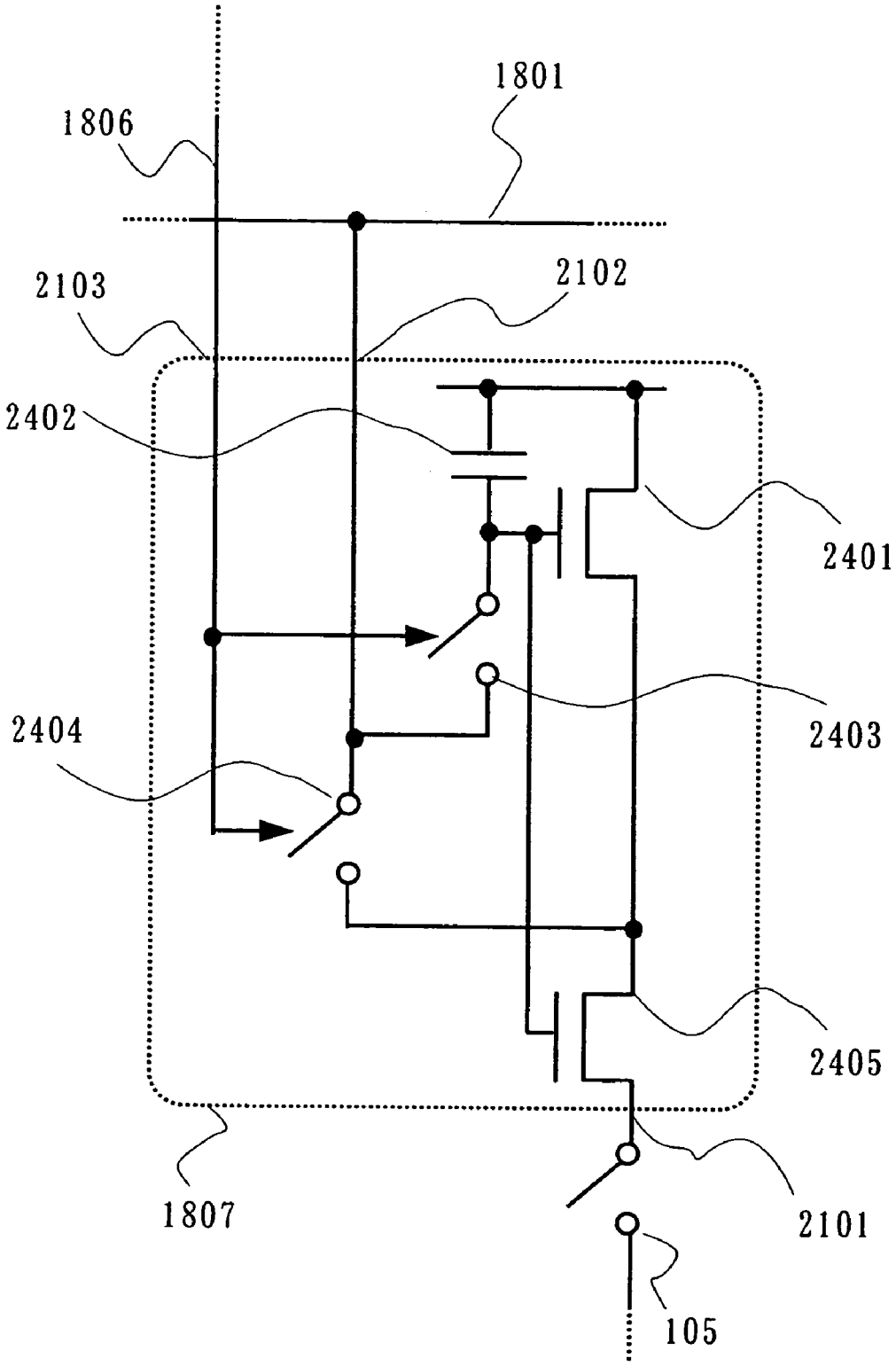
[FIG. 24] diagram illustrating a configuration of a semiconductor device in accordance with the invention
Figure 25:
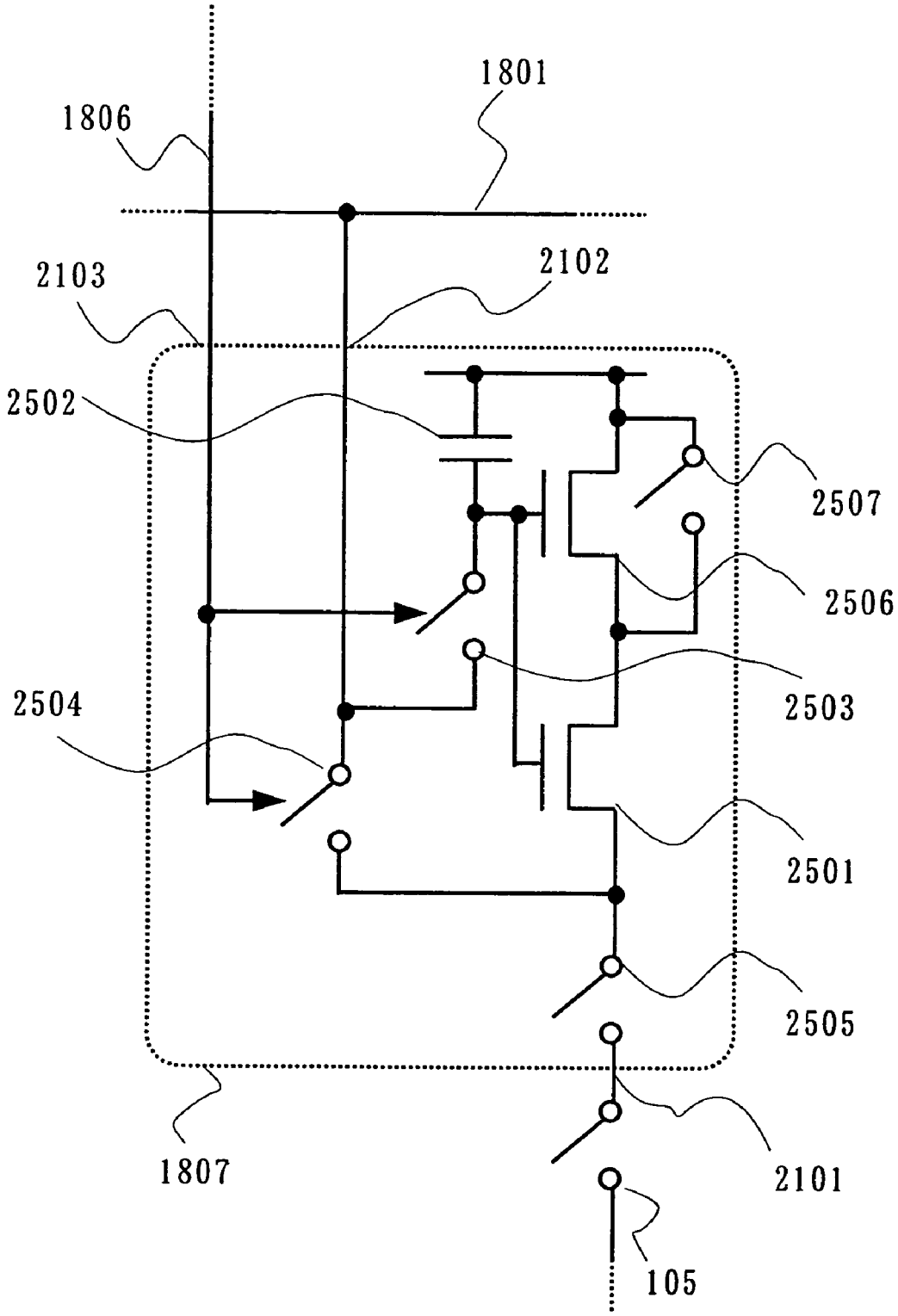
[FIG. 25] diagram illustrating a configuration of a semiconductor device in accordance with the invention
Figure 26:
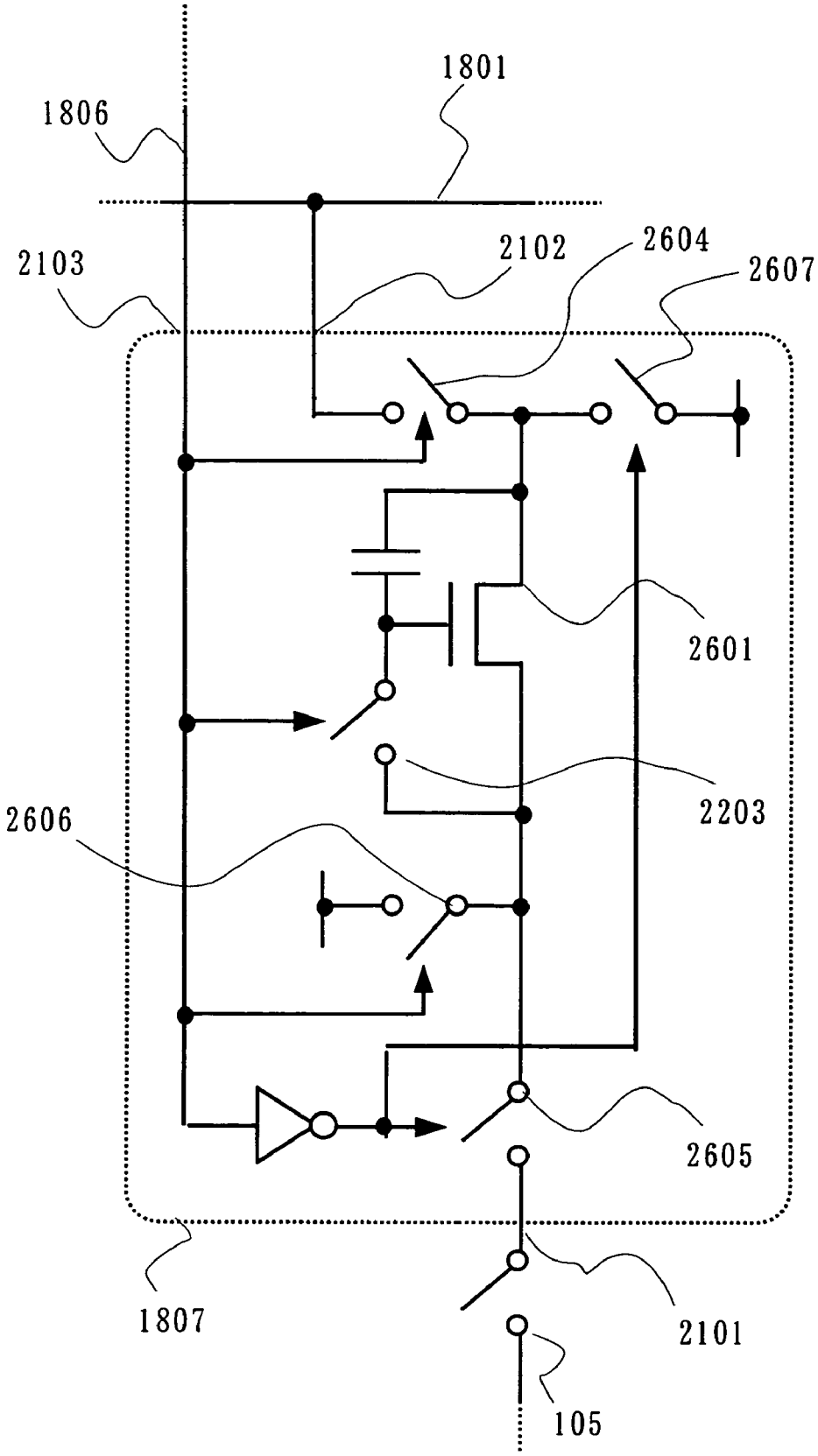
[FIG. 26] diagram illustrating a configuration of a semiconductor device in accordance with the invention
Figure 27:
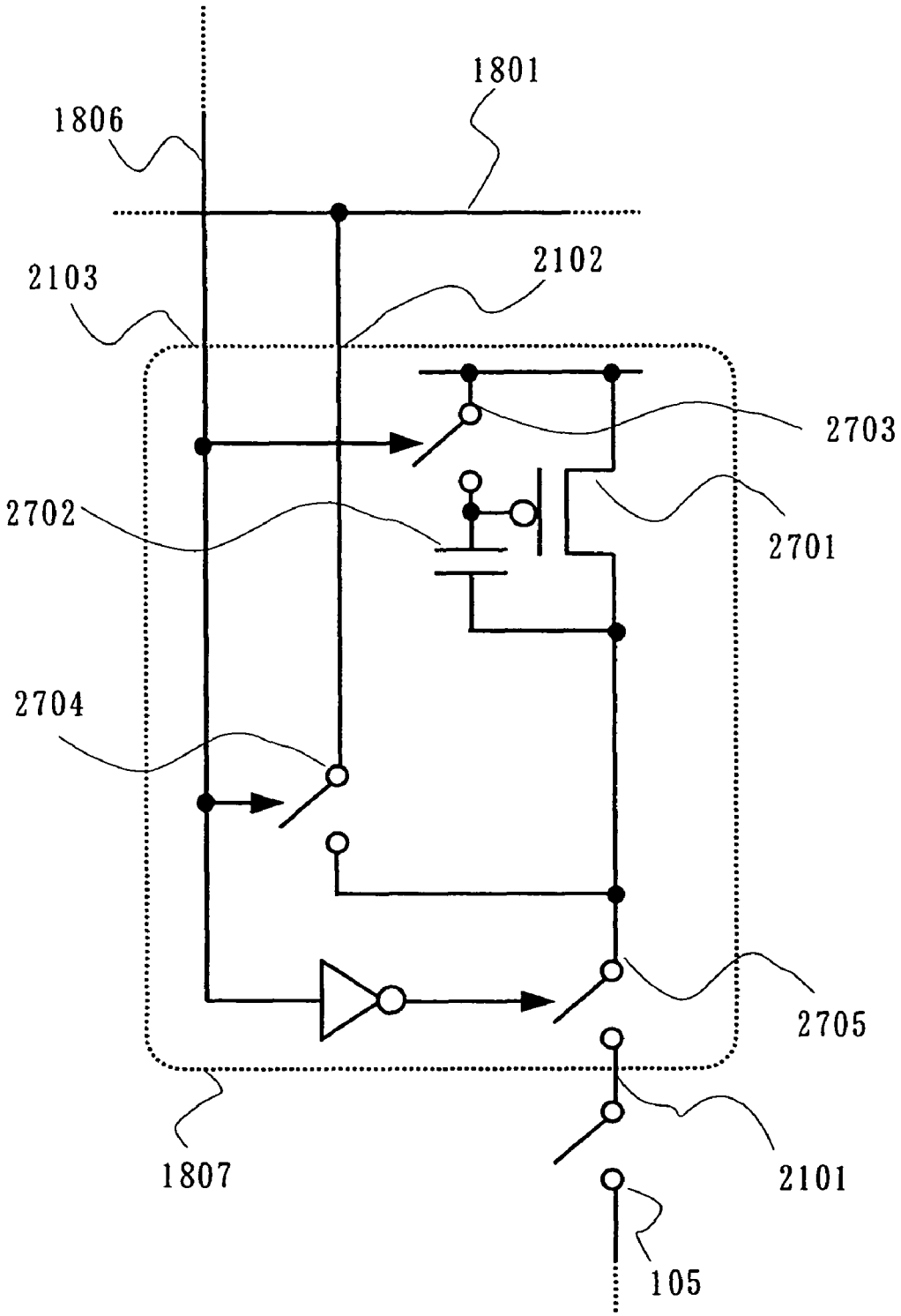
[FIG. 27] diagram illustrating a configuration of a semiconductor device in accordance with the invention
Figure 28:
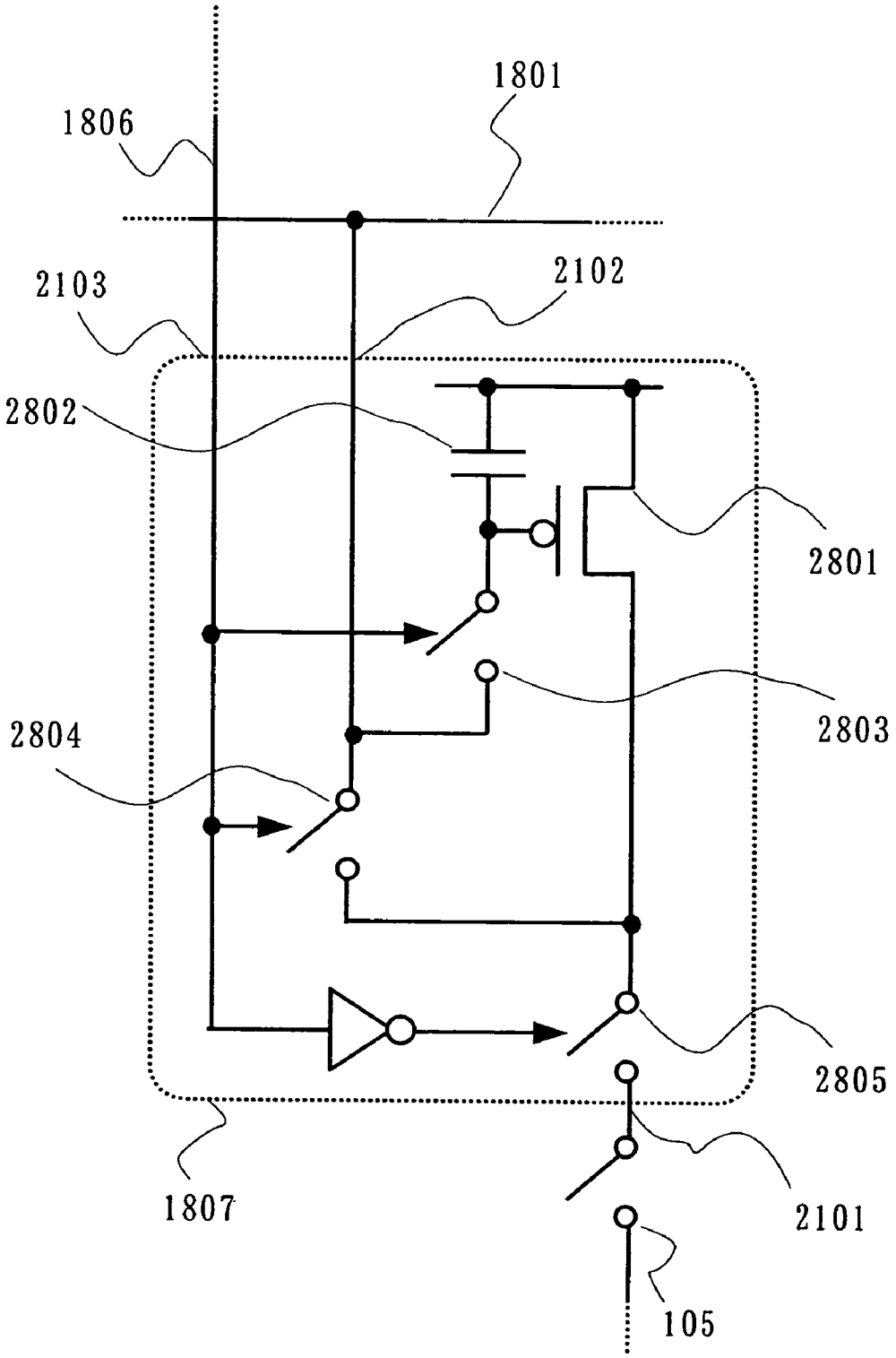
[FIG. 28] diagram illustrating a configuration of a semiconductor device in accordance with the invention
Figure 29:
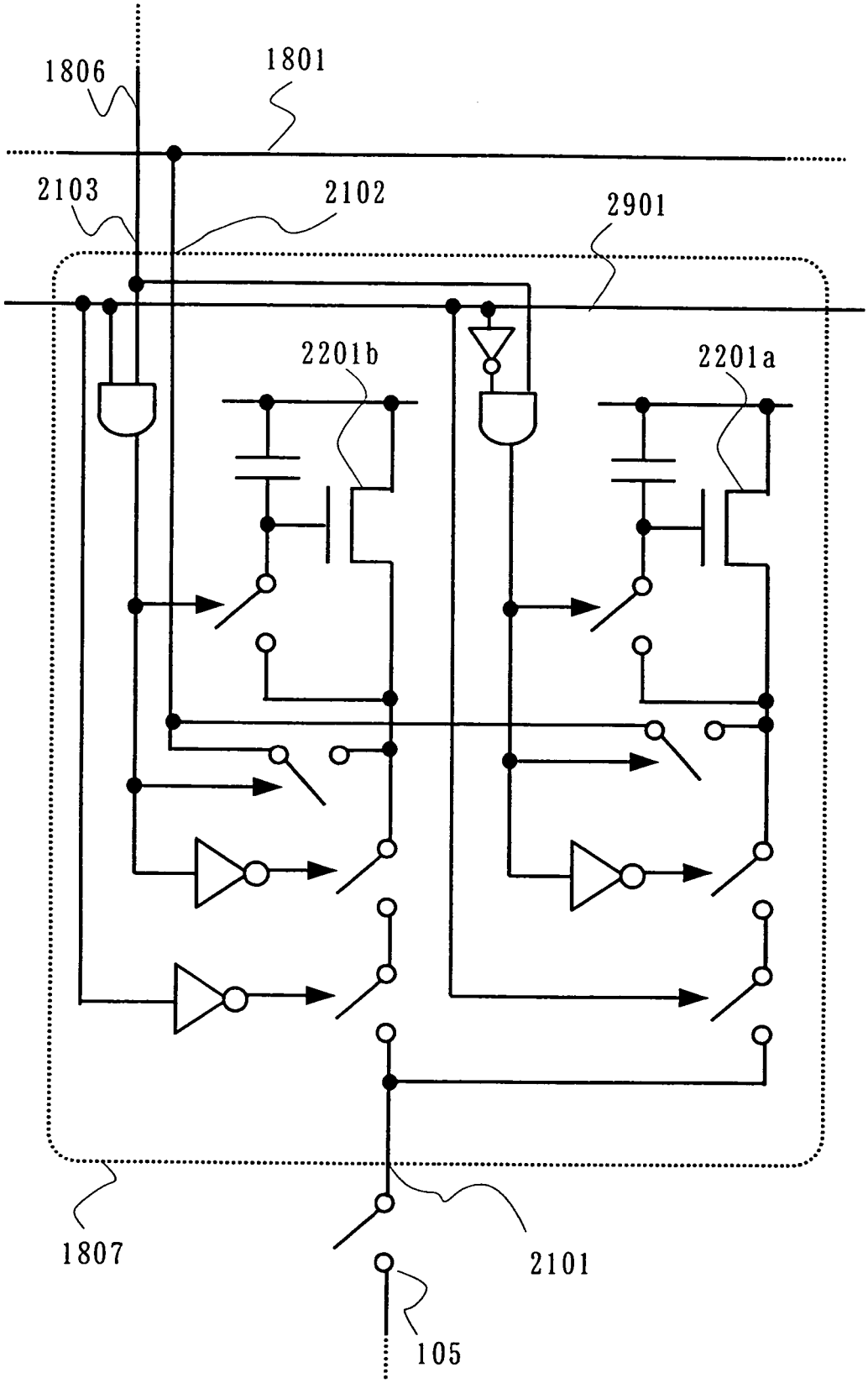
[FIG. 29] diagram illustrating a configuration of a semiconductor device in accordance with the invention
Figure 30:
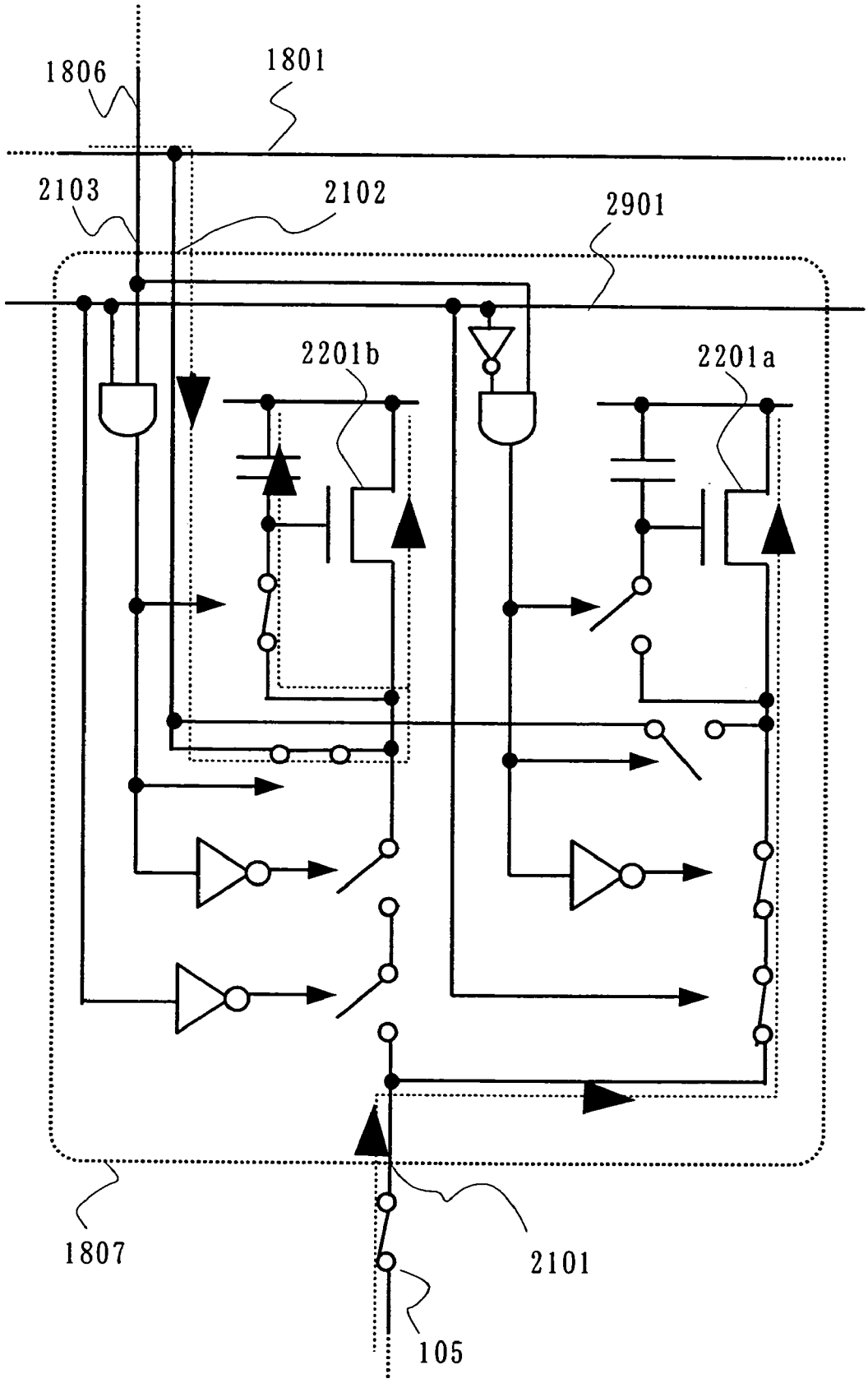
[FIG. 30] diagram illustrating an operation of a semiconductor device in accordance with the invention
Figure 31:
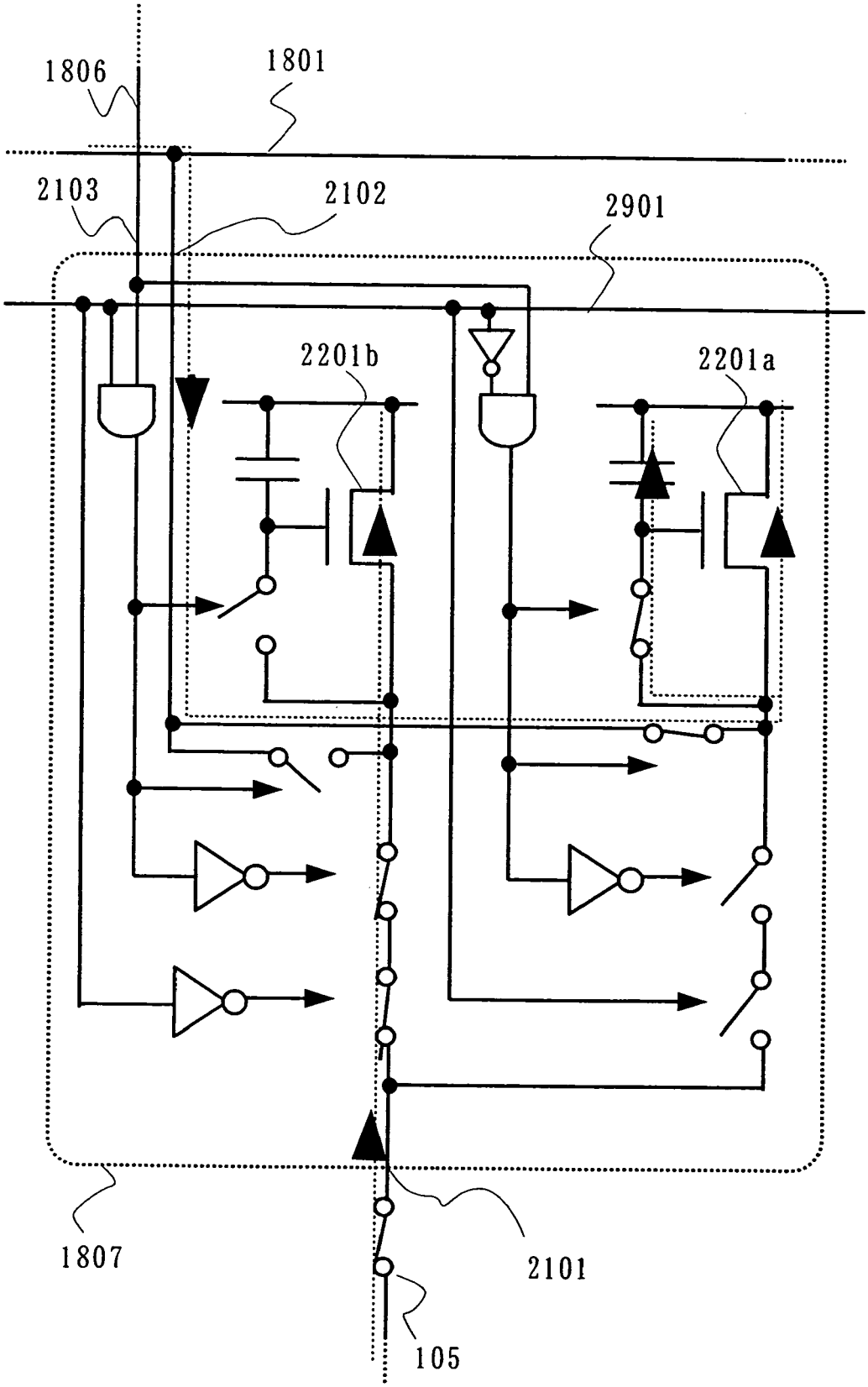
[FIG. 31] diagram illustrating an operation of a semiconductor device in accordance with the invention
Figure 32:
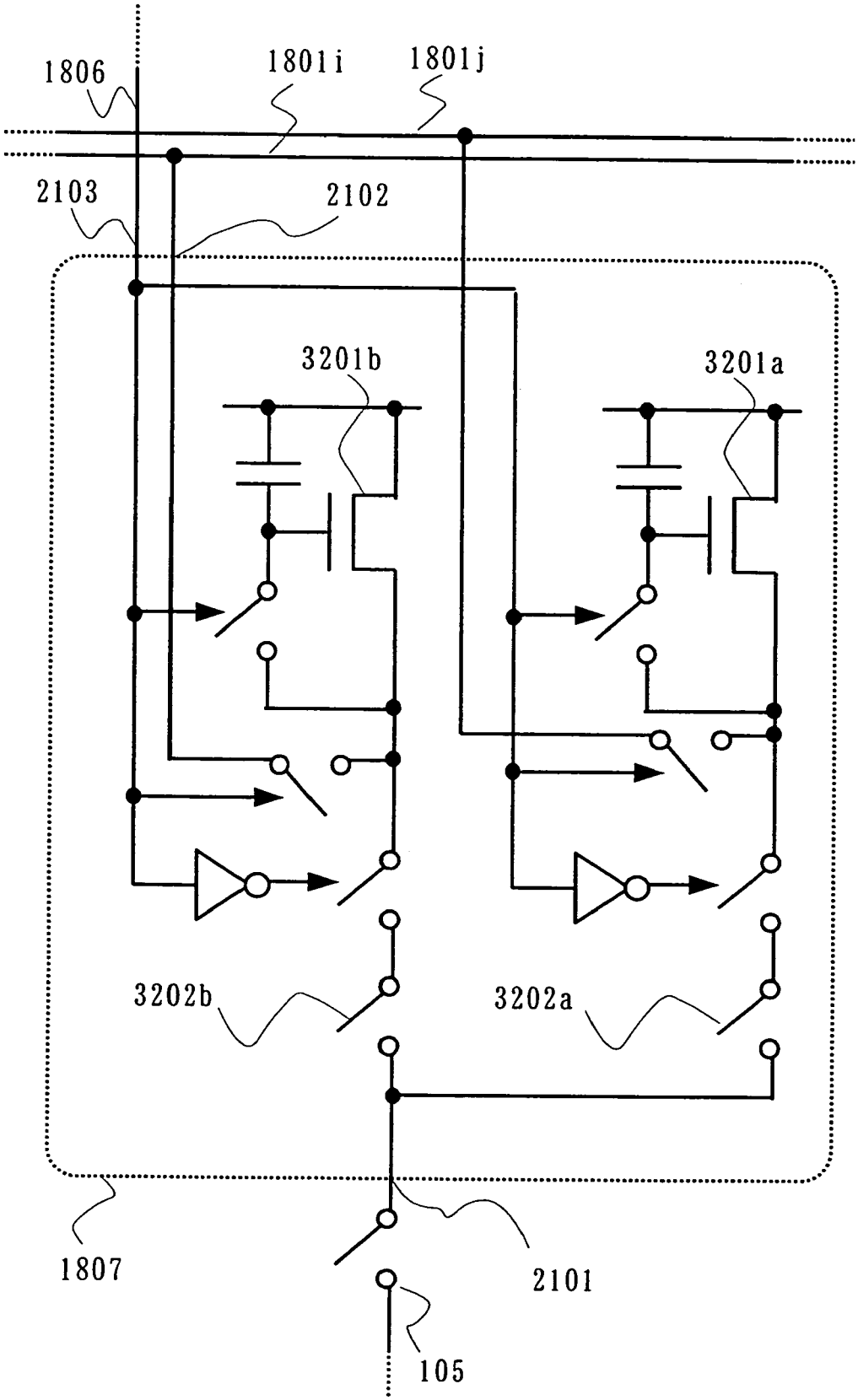
[FIG. 32] diagram illustrating a configuration of a semiconductor device in accordance with the invention
Figure 33:
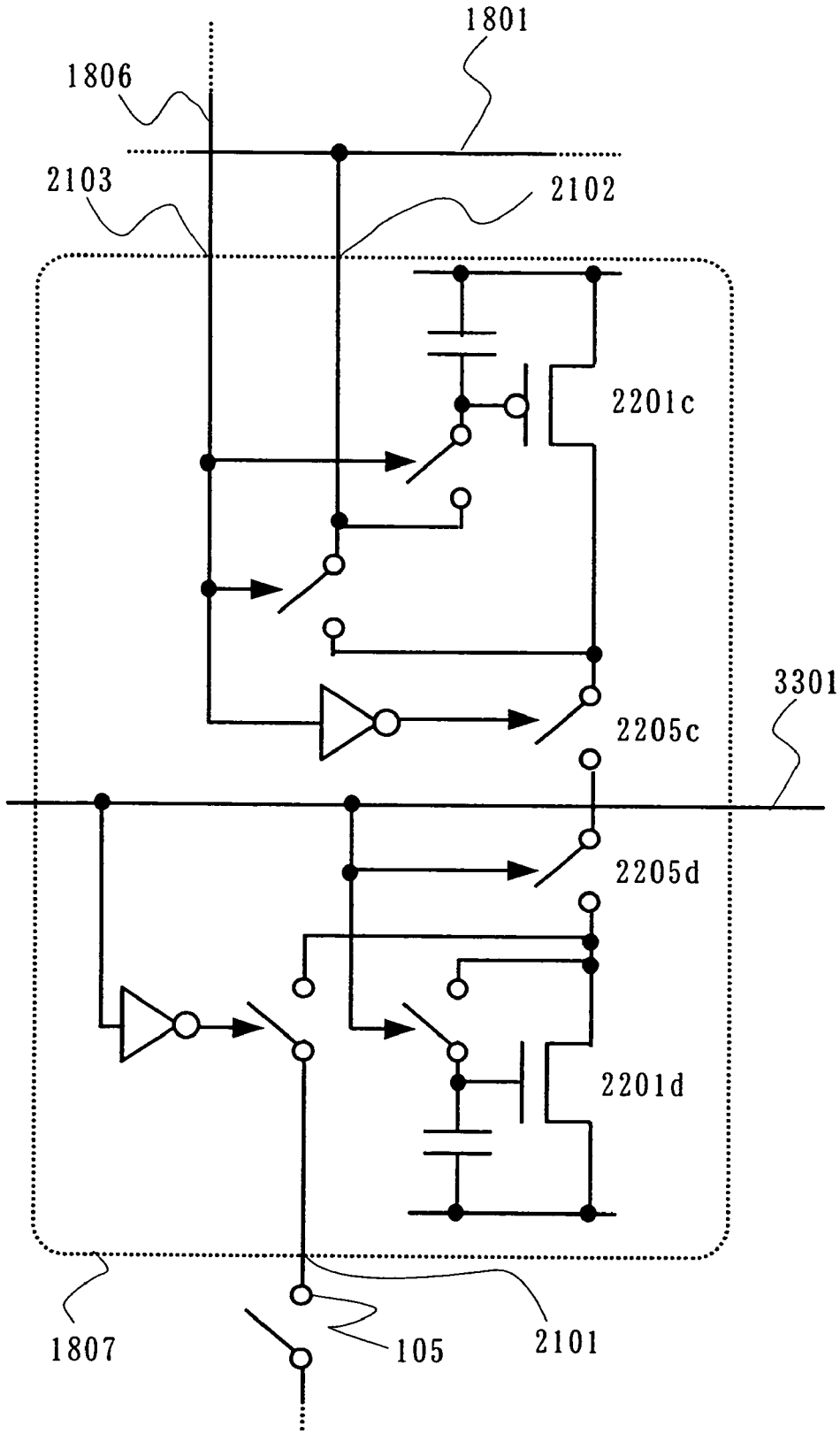
[FIG. 33] diagram illustrating a configuration of a semiconductor device in accordance with the invention
Figure 34:
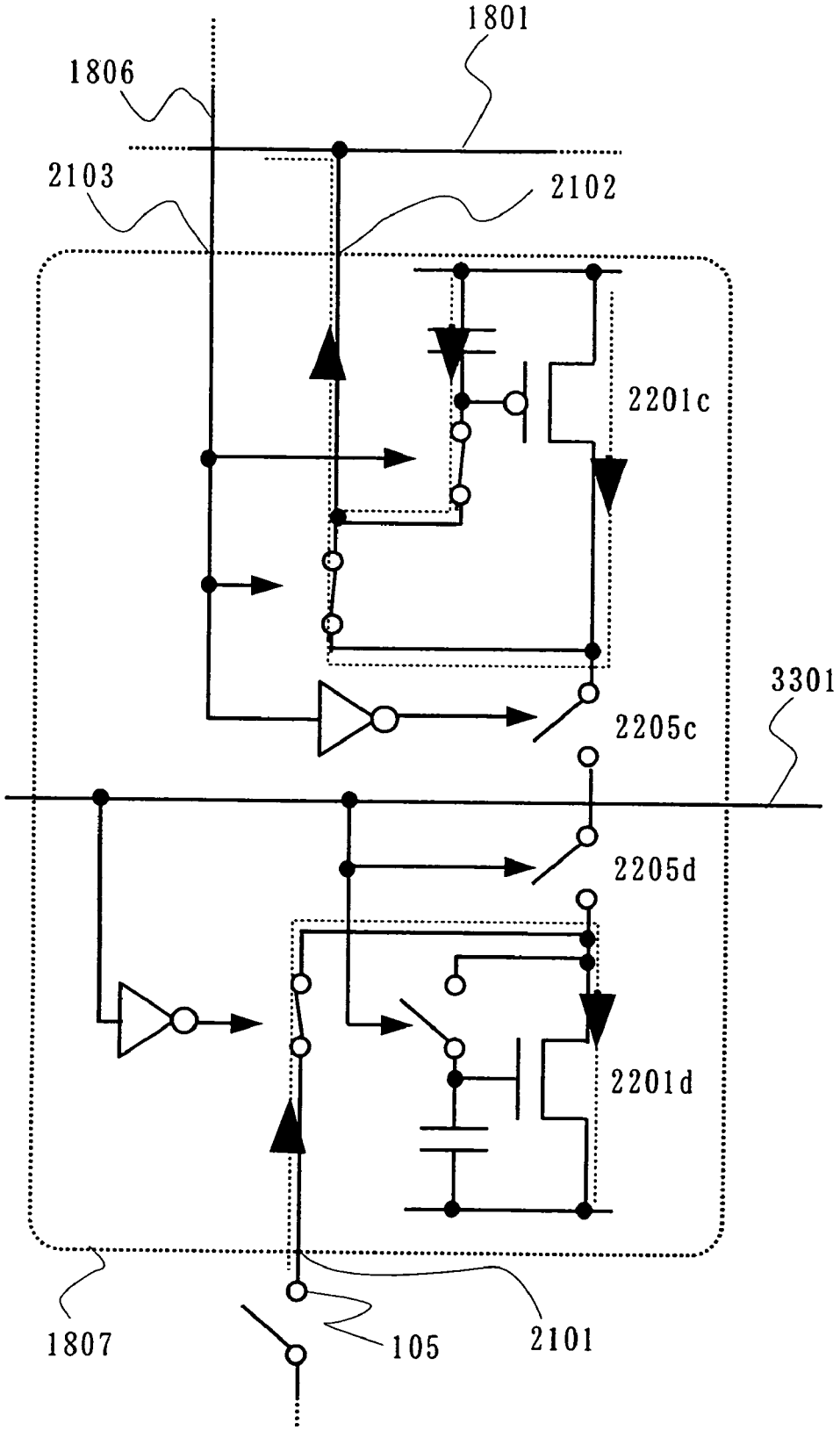
[FIG. 34] diagram illustrating an operation of a semiconductor device in accordance with the invention
Figure 35:
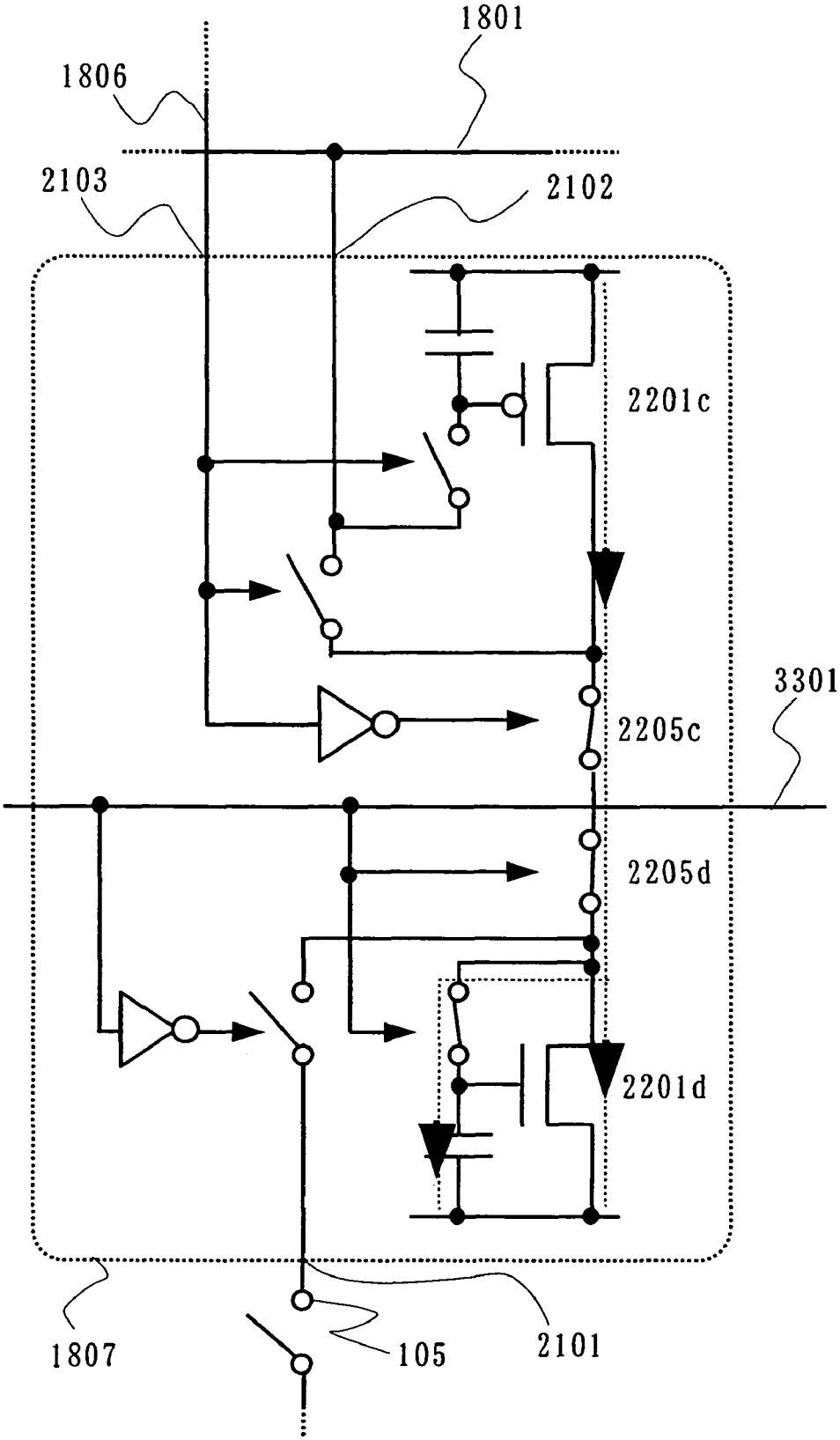
[FIG. 35] diagram illustrating an operation of a semiconductor device in accordance with the invention
Figure 36:
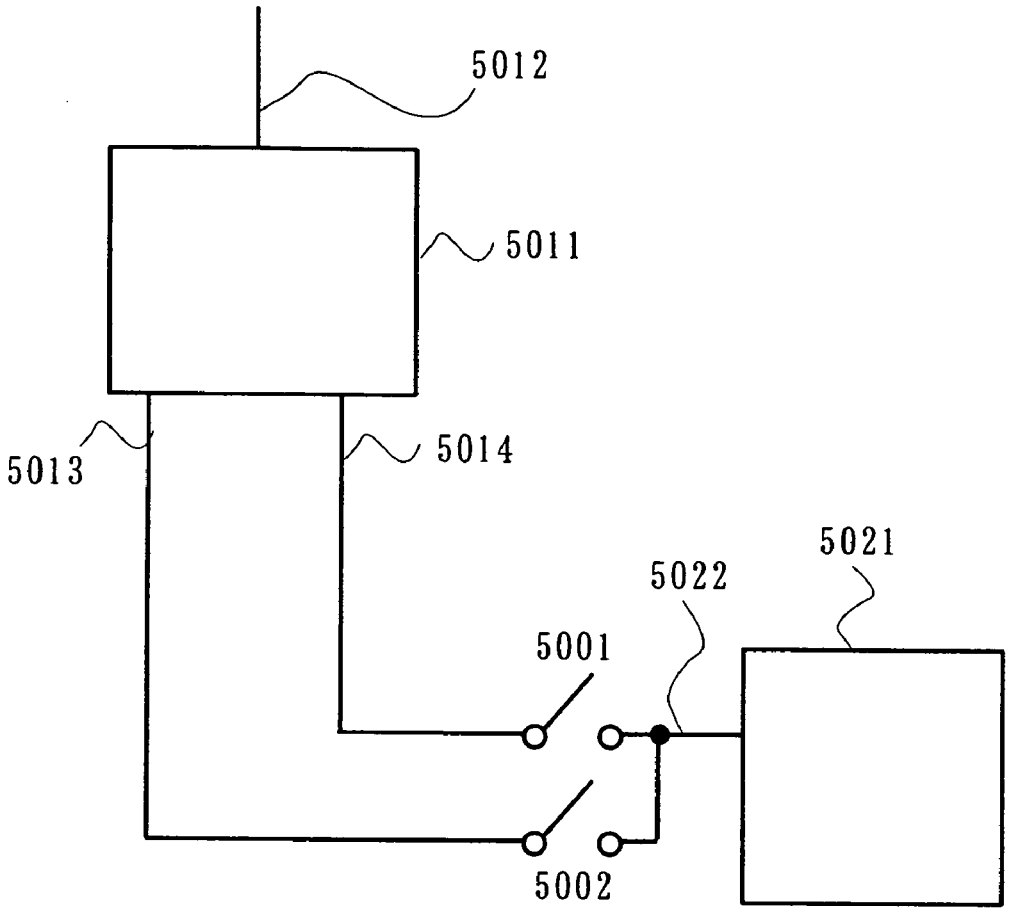
[FIG. 36] diagram illustrating a configuration of a semiconductor device in accordance with the invention
Figure 37:
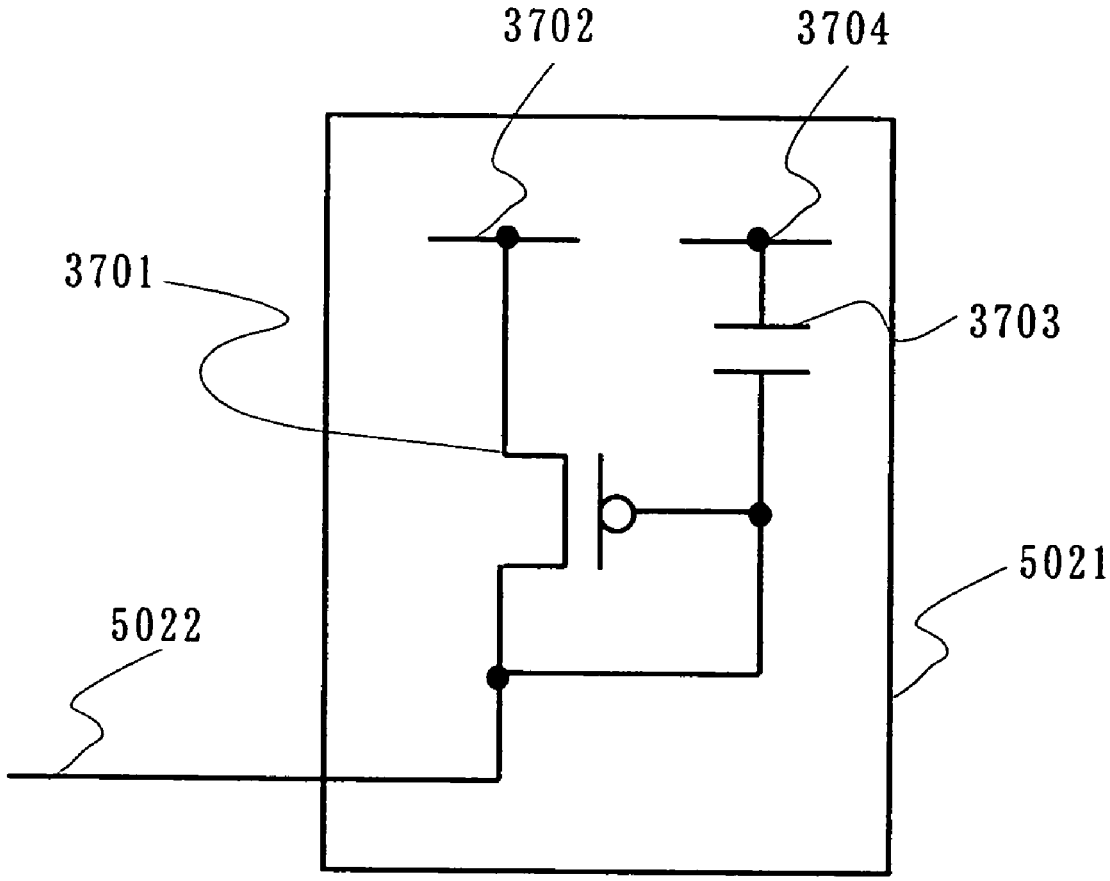
[FIG. 37] diagram illustrating a configuration of a semiconductor device in accordance with the invention
Figure 38:
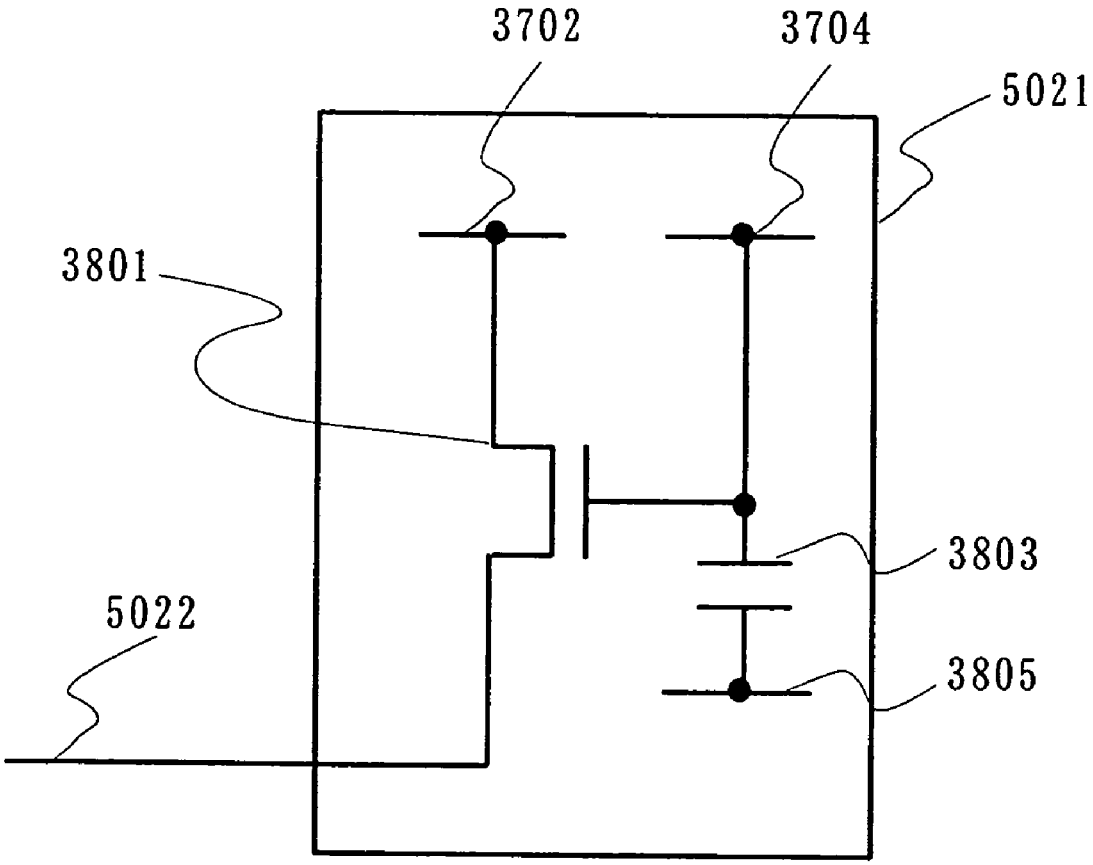
[FIG. 38] diagram illustrating a configuration of a semiconductor device in accordance with the invention.
Figure 39:
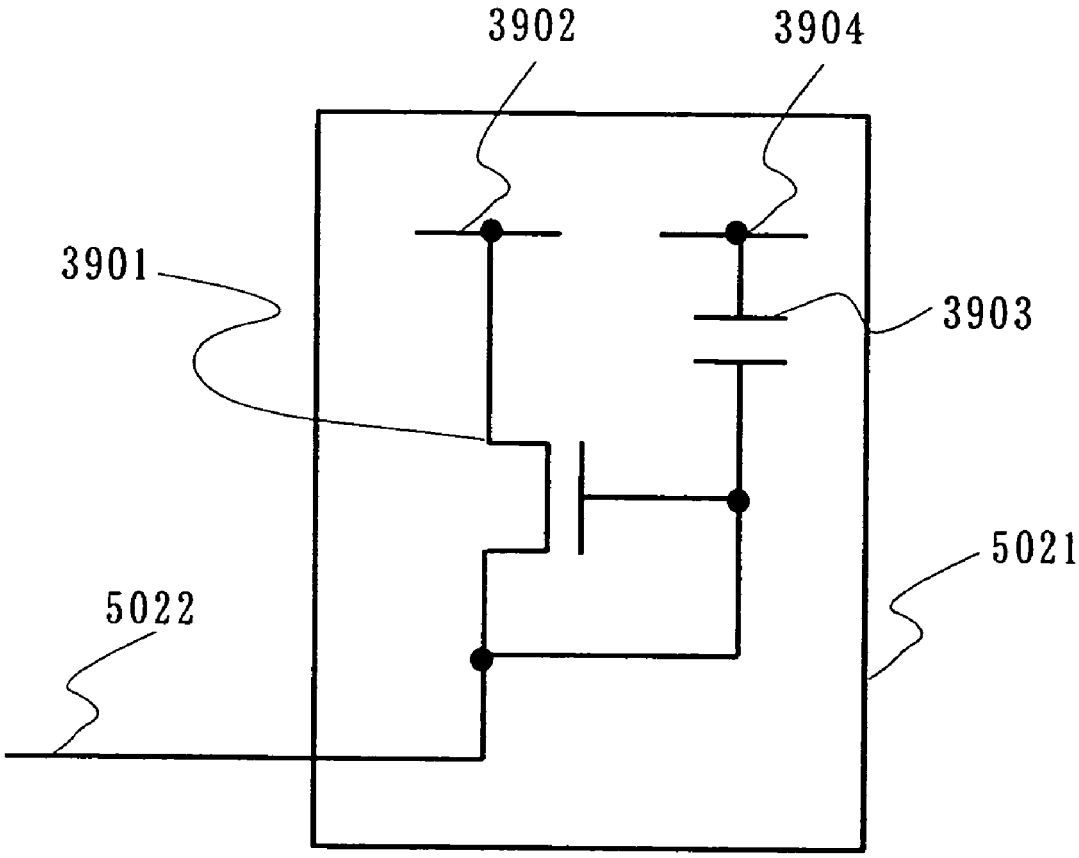
[FIG. 39] diagram illustrating a configuration of a semiconductor device in accordance with the invention
Figure 40:
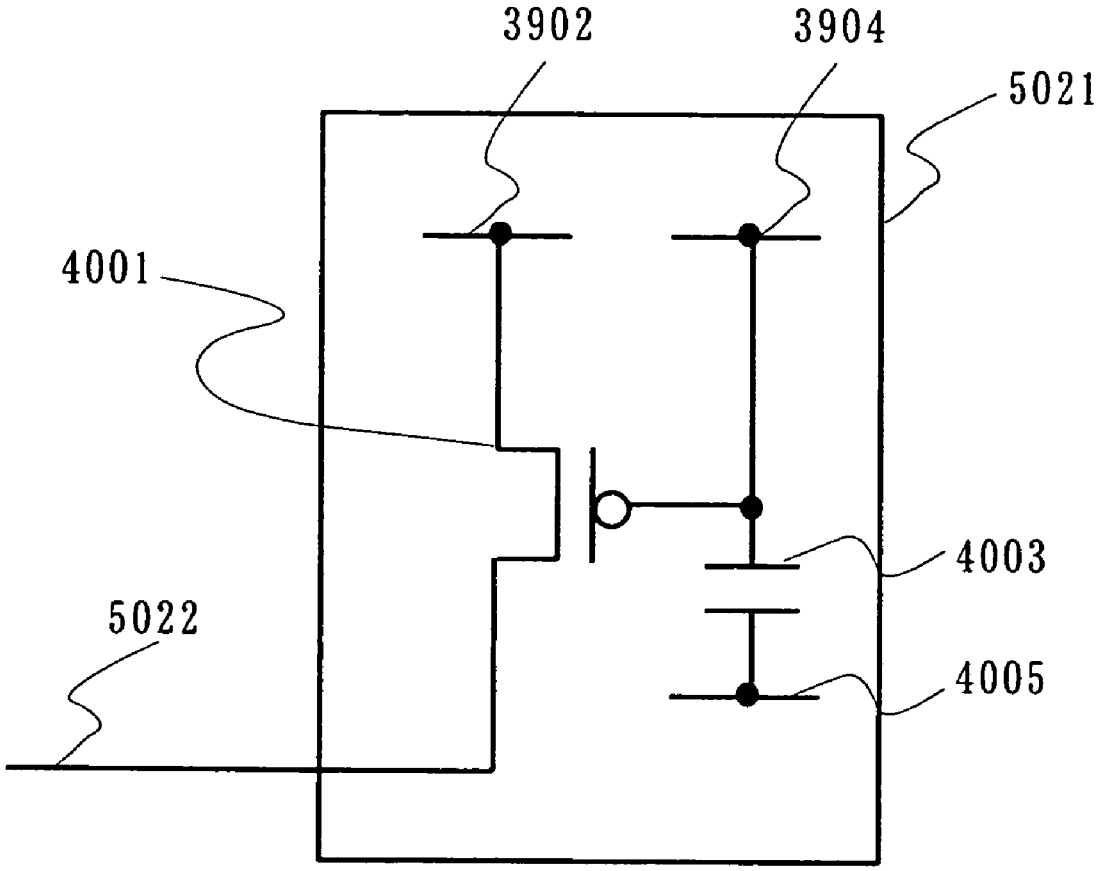
[FIG. 40] diagram illustrating a configuration of a semiconductor device in accordance with the invention
Figure 41:
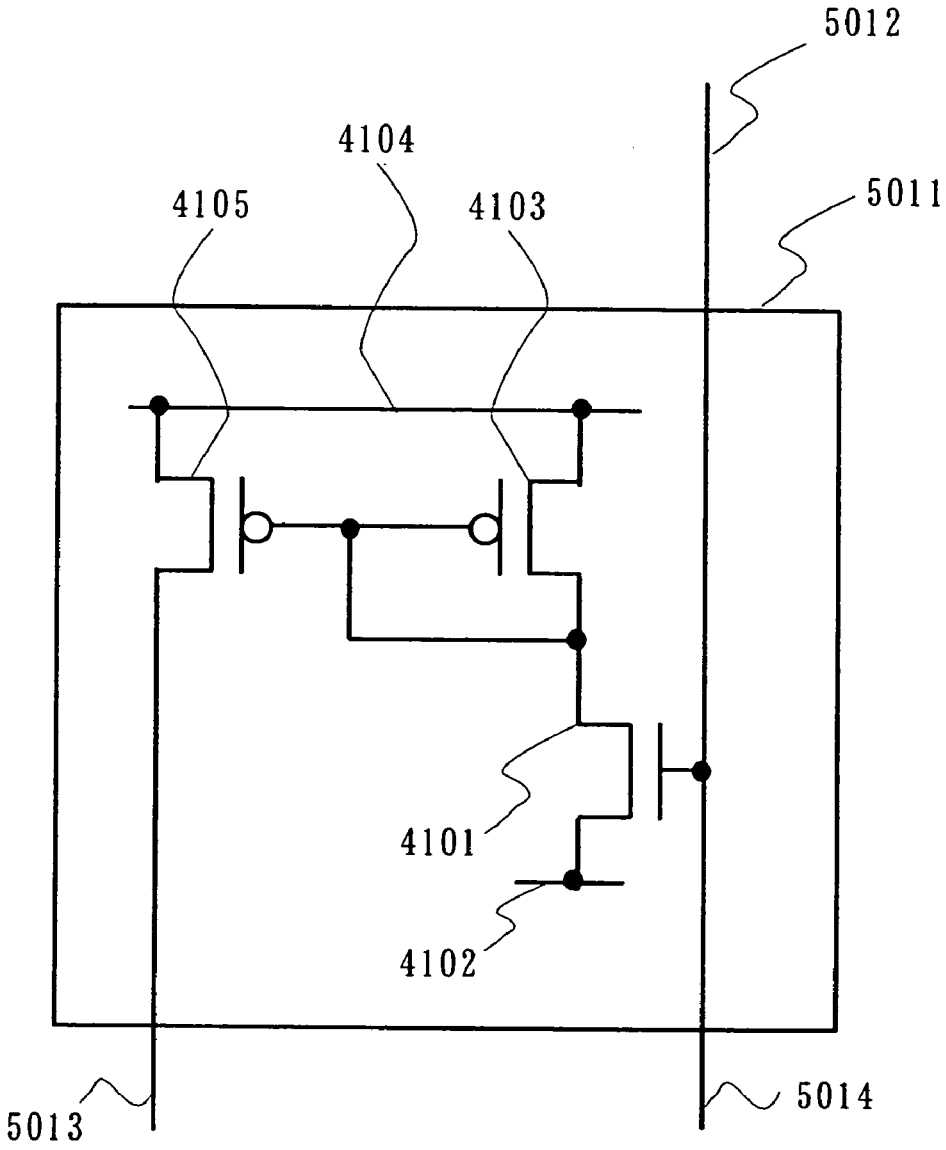
[FIG. 41] diagram illustrating a configuration of a semiconductor device in accordance with the invention
Figure 42:
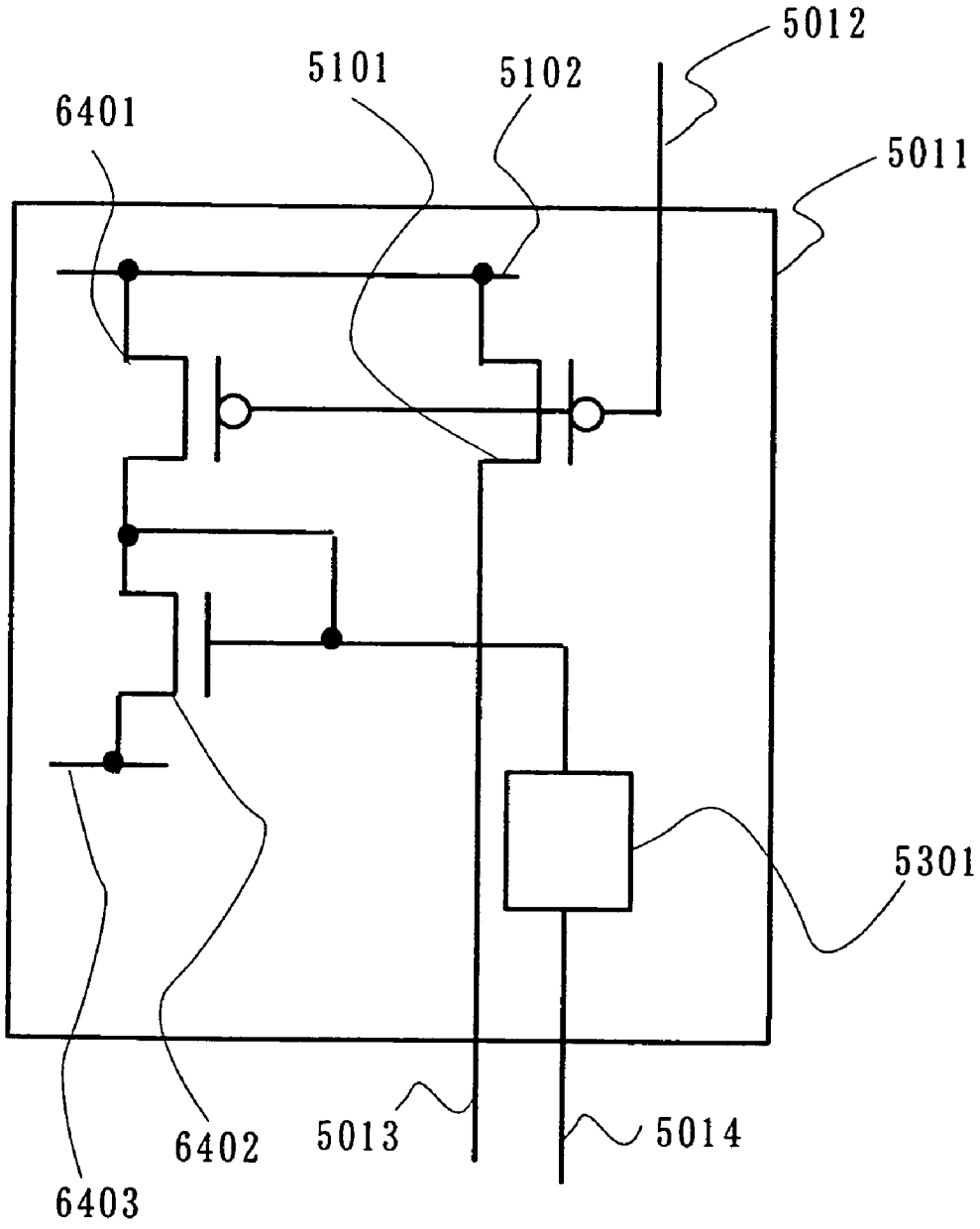
[FIG. 42] diagram illustrating a configuration of a semiconductor device in accordance with the invention
Figure 43:
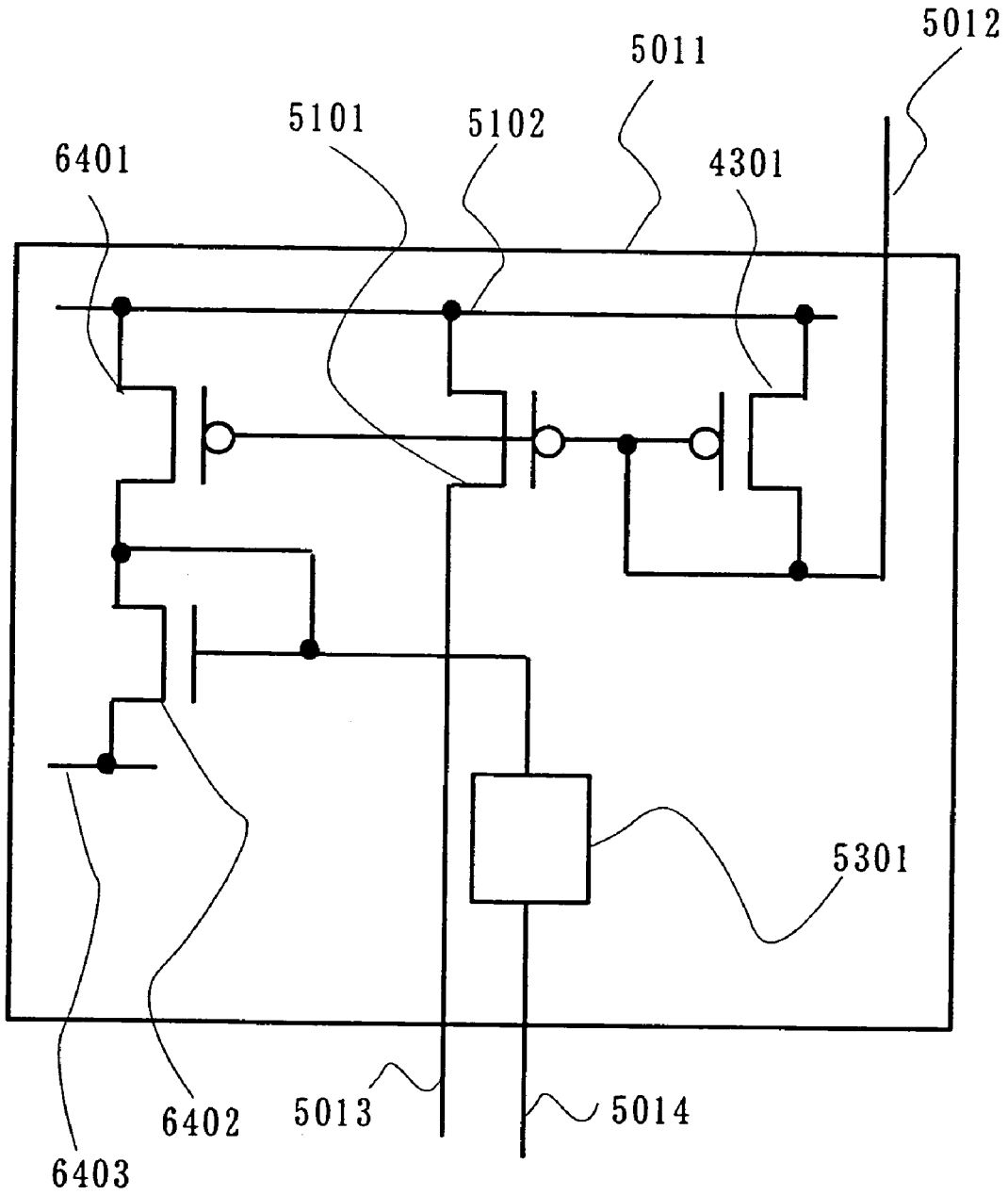
[FIG. 43] diagram illustrating a configuration of a semiconductor device in accordance with the invention
Figure 44:
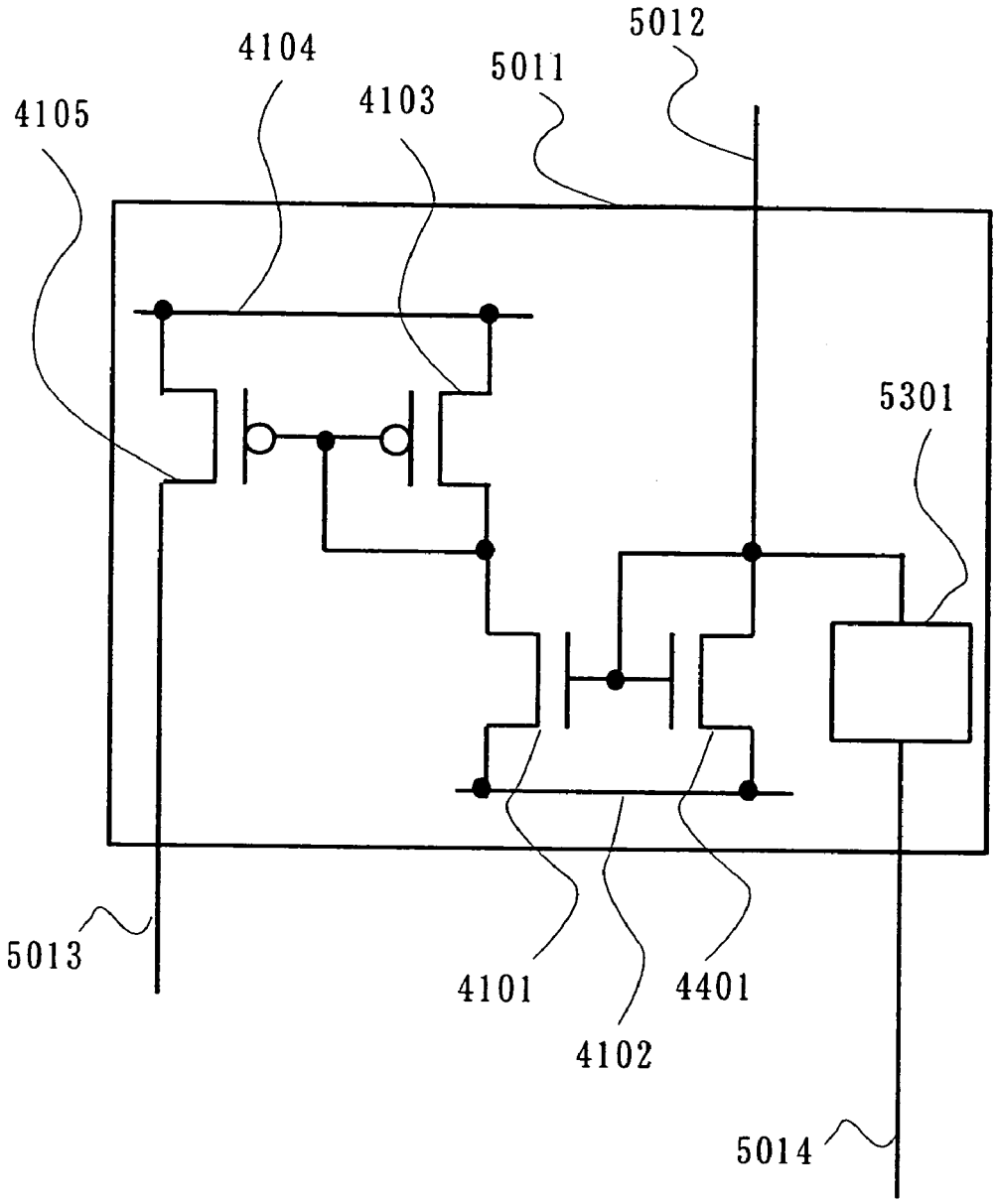
[FIG. 44] diagram illustrating a configuration of a semiconductor device in accordance with the invention
Figure 45:
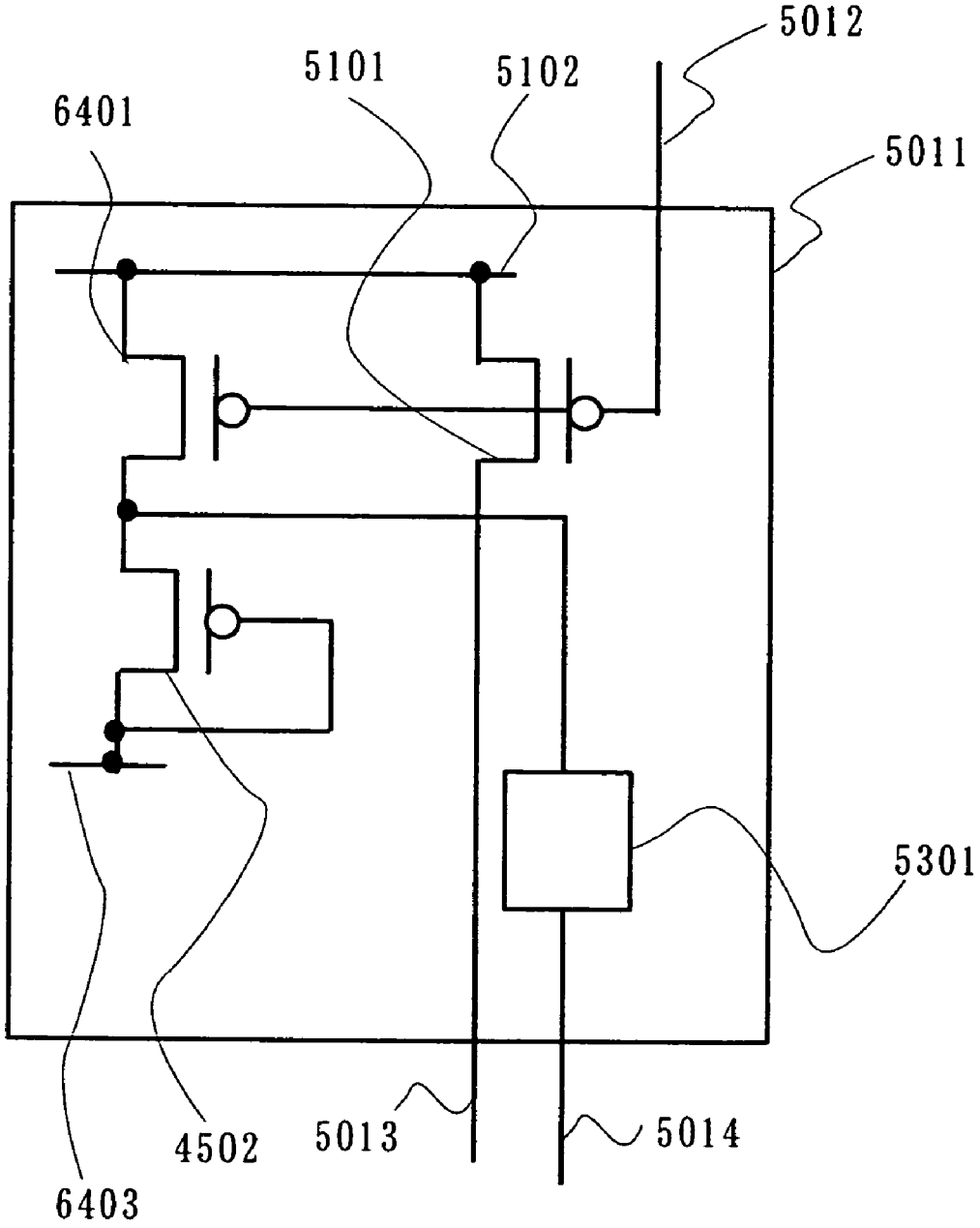
[FIG. 45] diagram illustrating a configuration of a semiconductor device in accordance with the invention
Figure 46:
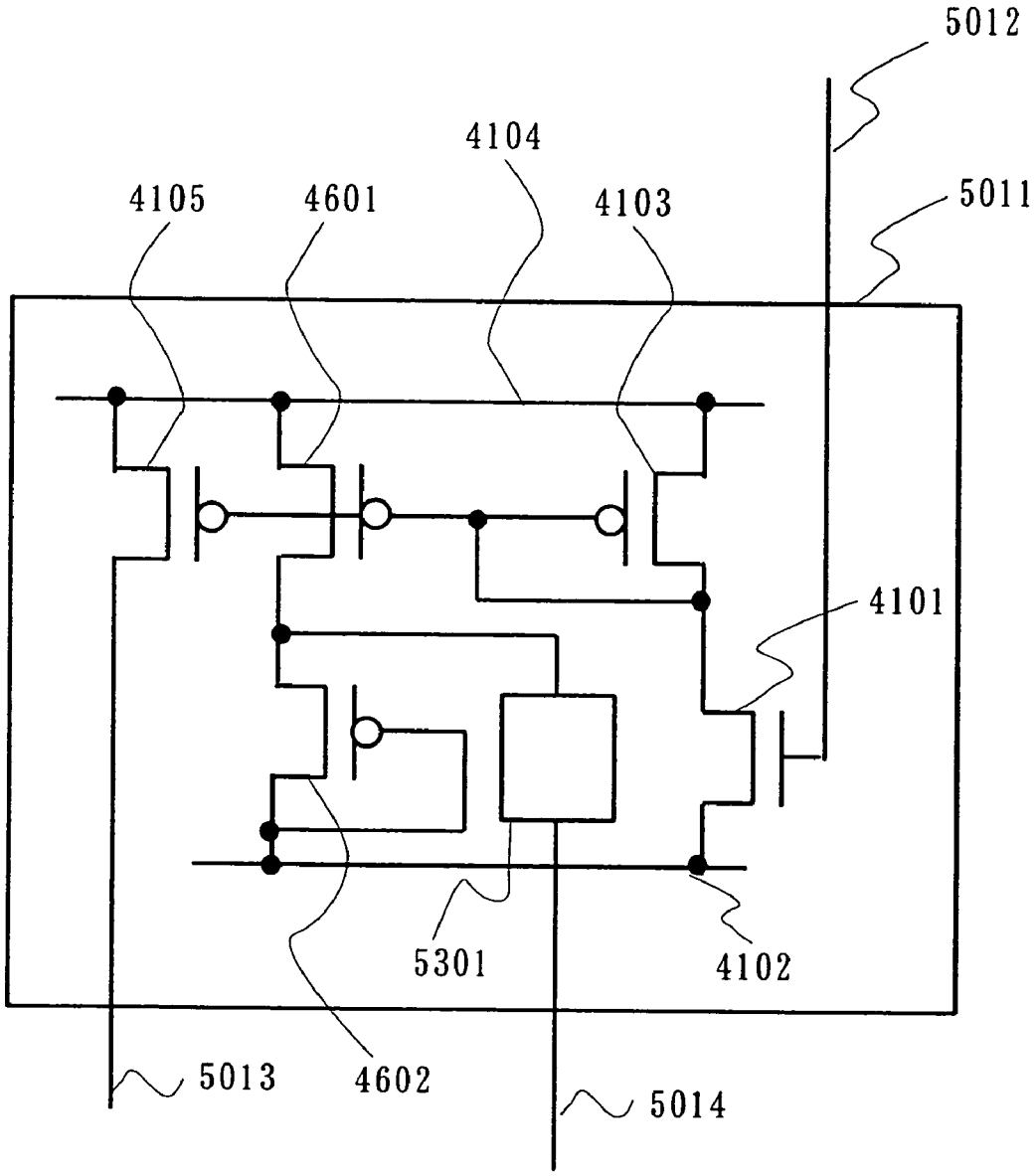
[FIG. 46] diagram illustrating a configuration of a semiconductor device in accordance with the invention
Figure 47:
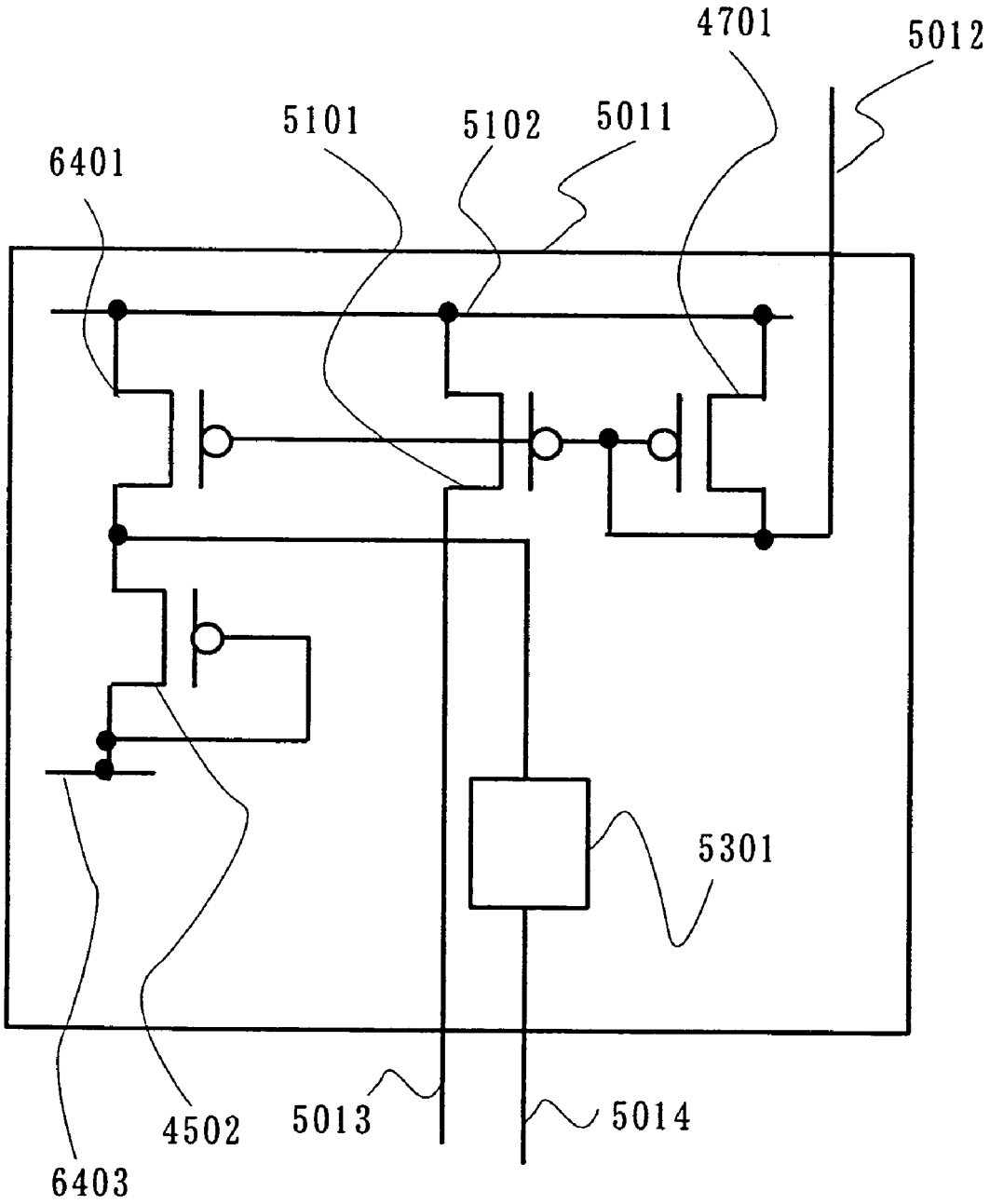
[FIG. 47] diagram illustrating a configuration of a semiconductor device in accordance with the invention
Figure 48:
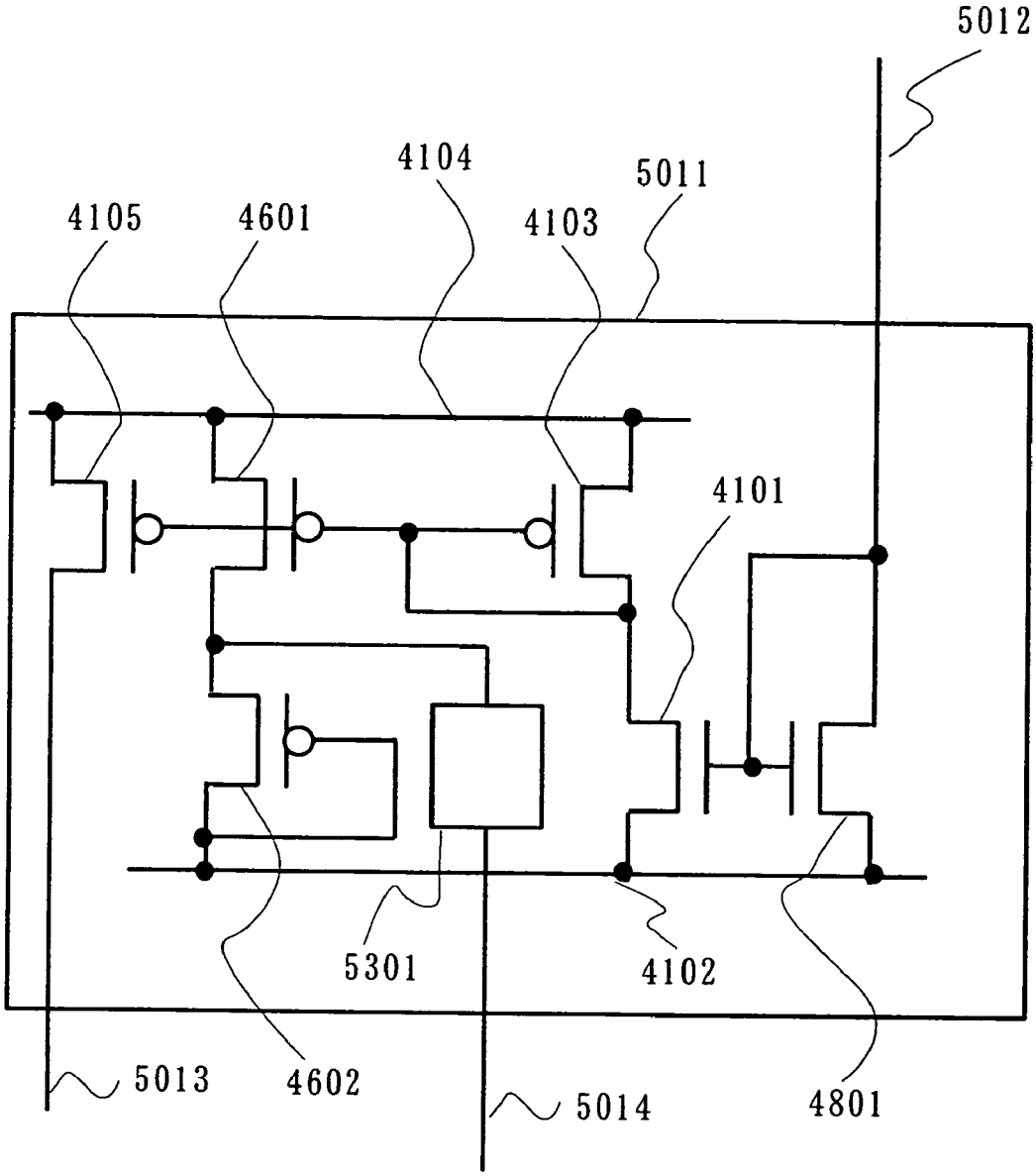
[FIG. 48] diagram illustrating a configuration of a semiconductor device in accordance with the invention
Figure 49:
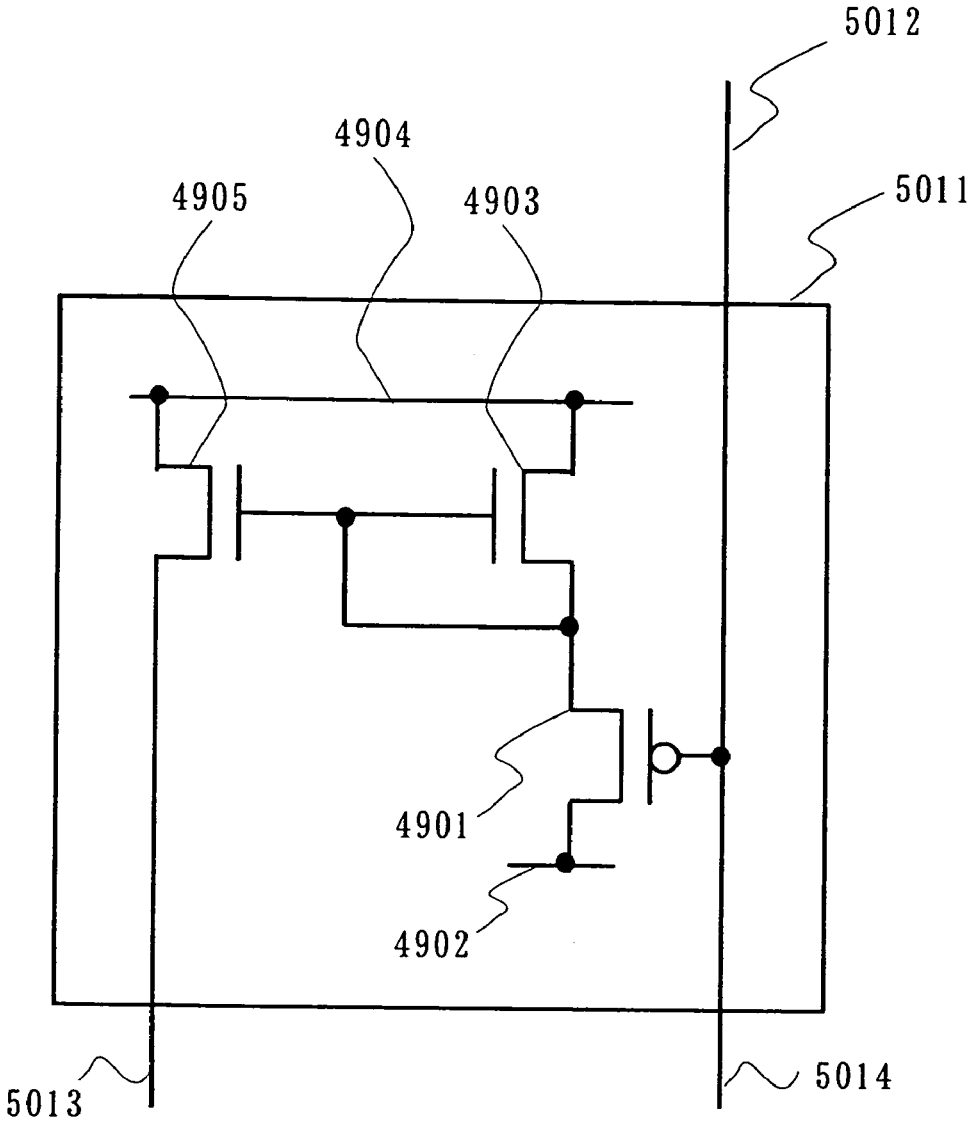
[FIG. 49] diagram illustrating a configuration of a semiconductor device in accordance with the invention
Figure 50:
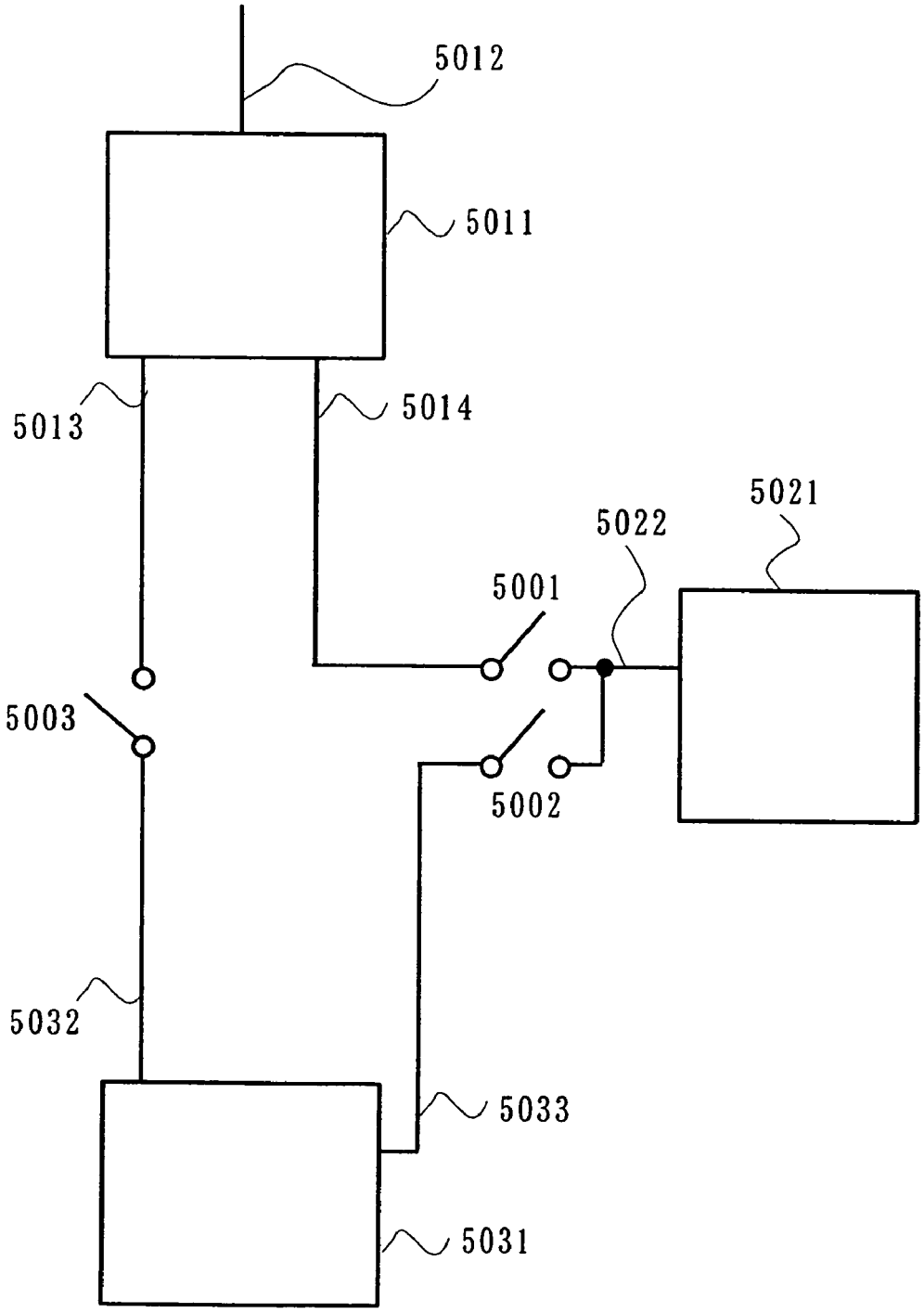
[FIG. 50] diagram illustrating a configuration of a semiconductor device in accordance with the invention
Figure 51:
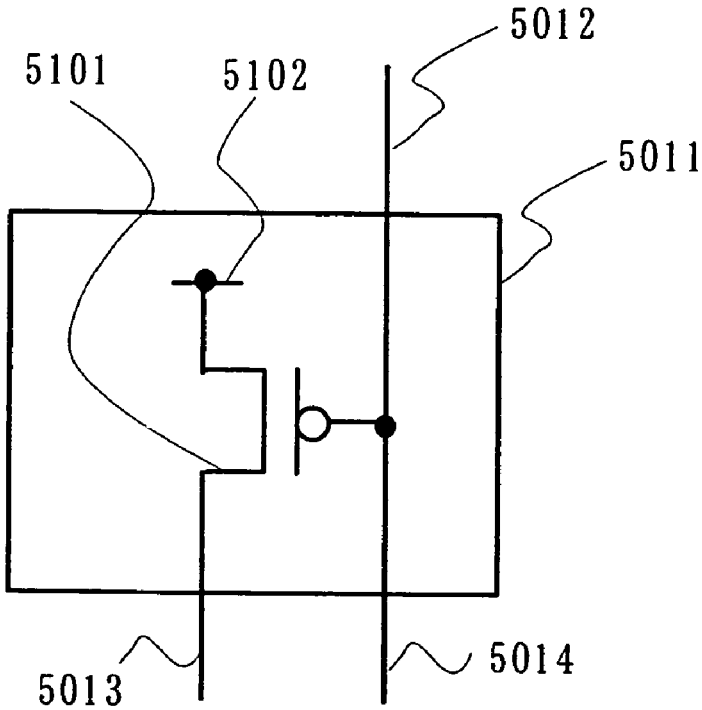
[FIG. 51] diagram illustrating a configuration of a semiconductor device in accordance with the invention
Figure 52:
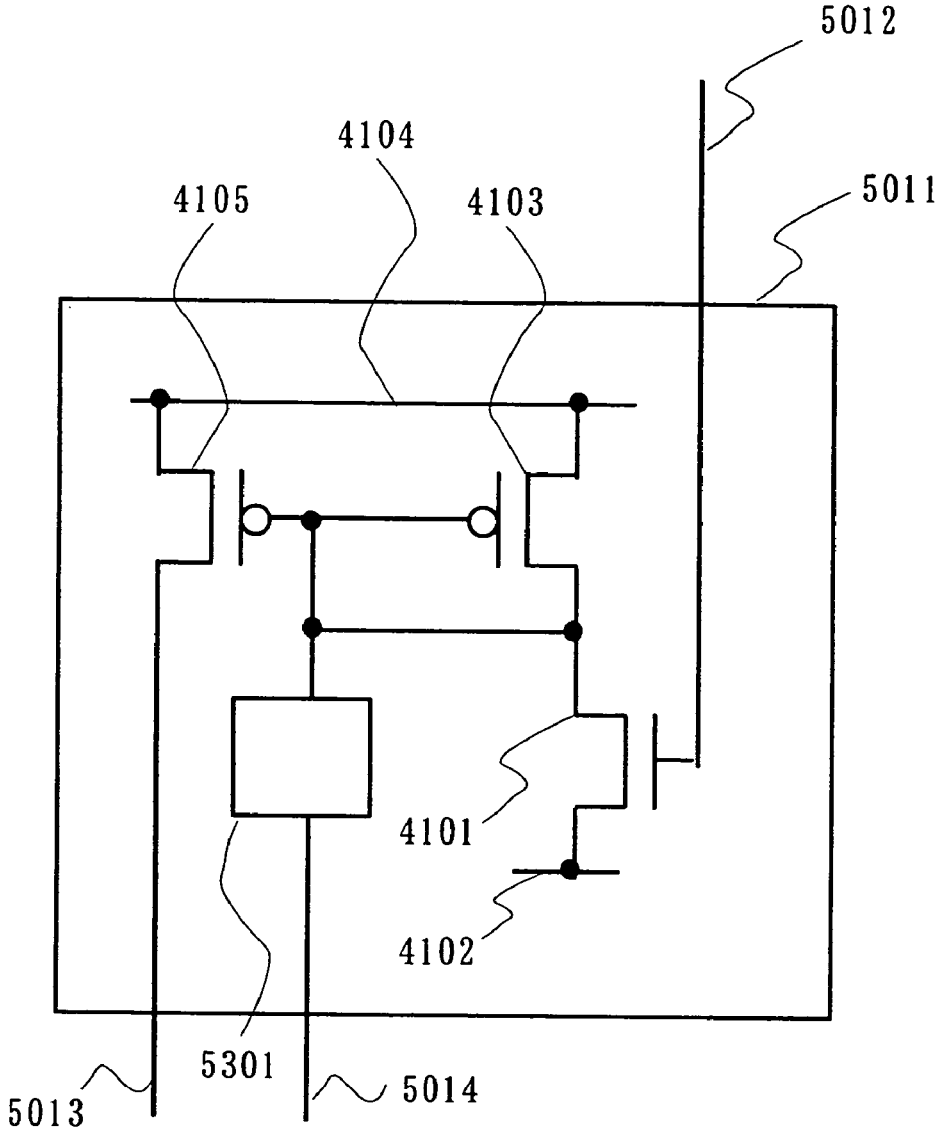
[FIG. 52] diagram illustrating a configuration of a semiconductor device in accordance with the invention
Figure 53:
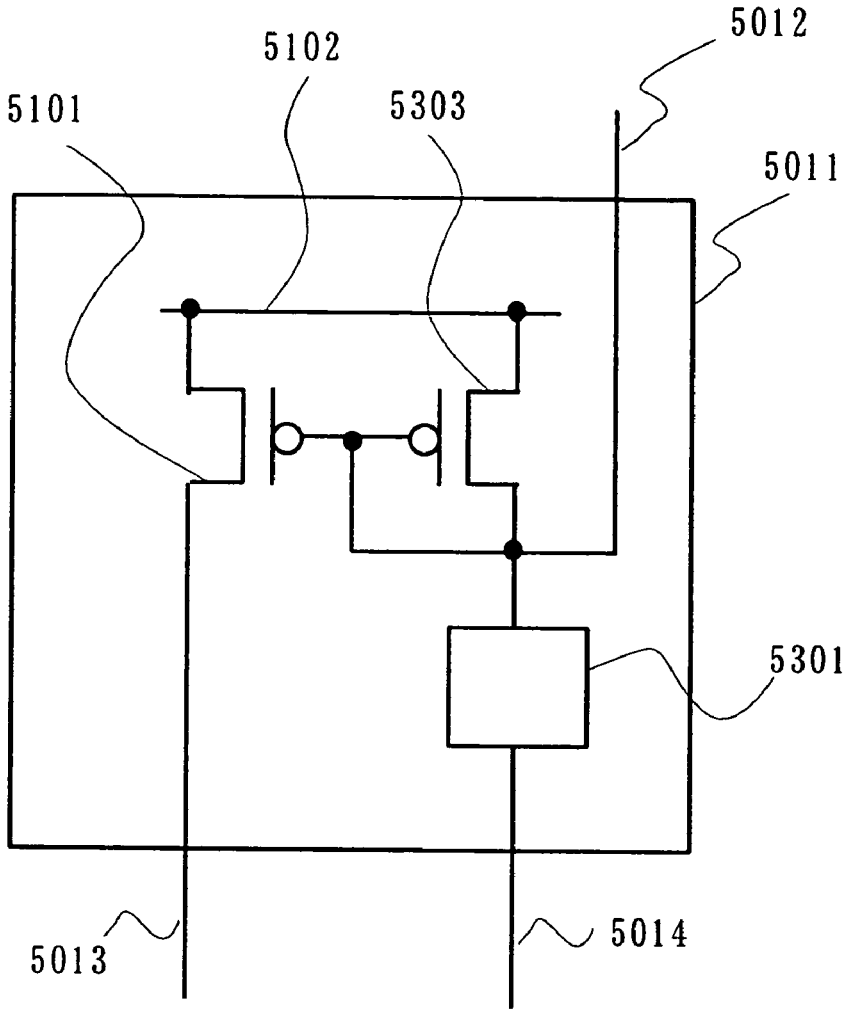
[FIG. 53] diagram illustrating a configuration of a semiconductor device in accordance with the invention
Figure 54:
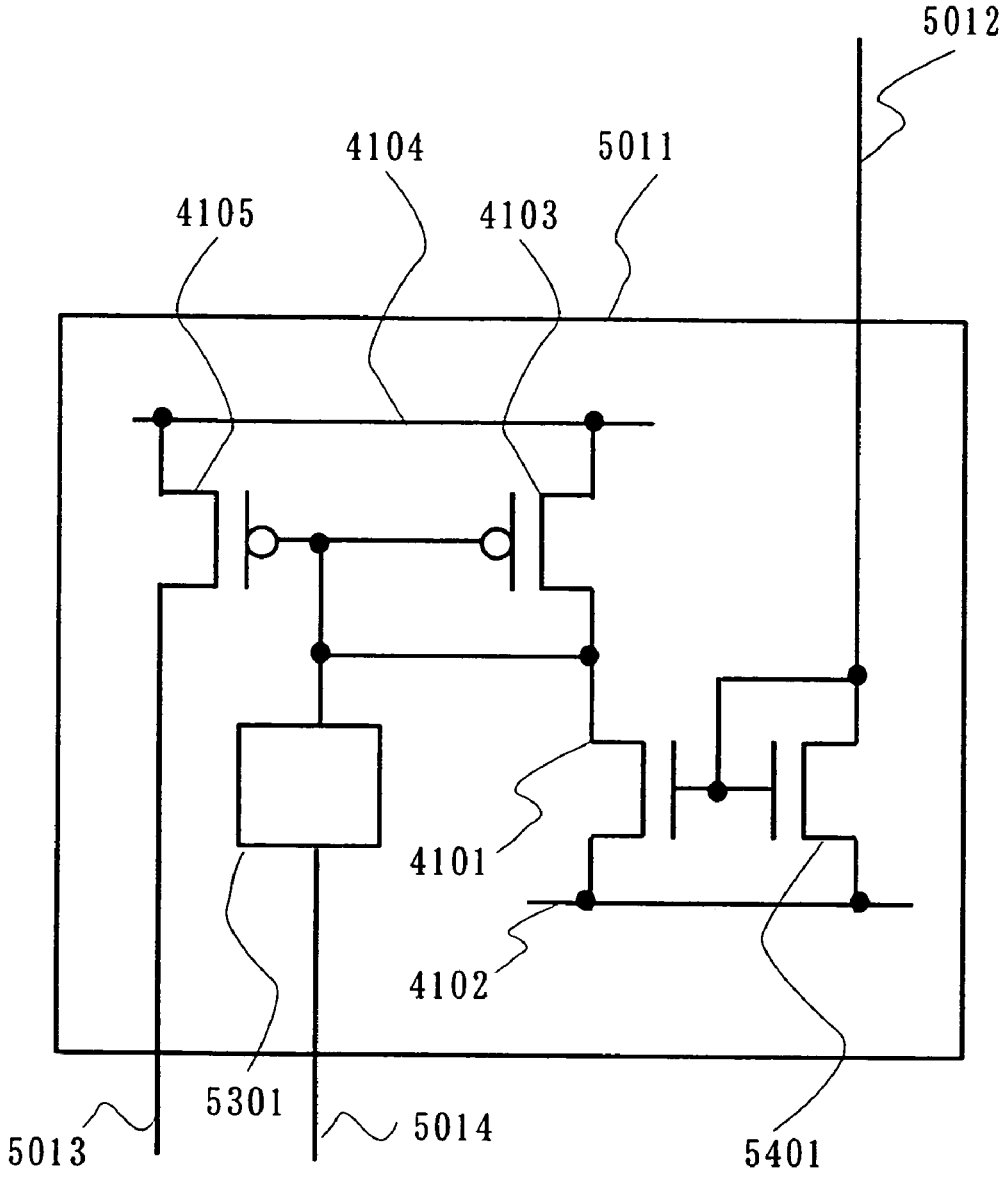
[FIG. 54] diagram illustrating a configuration of a semiconductor device in accordance with the invention
Figure 55:
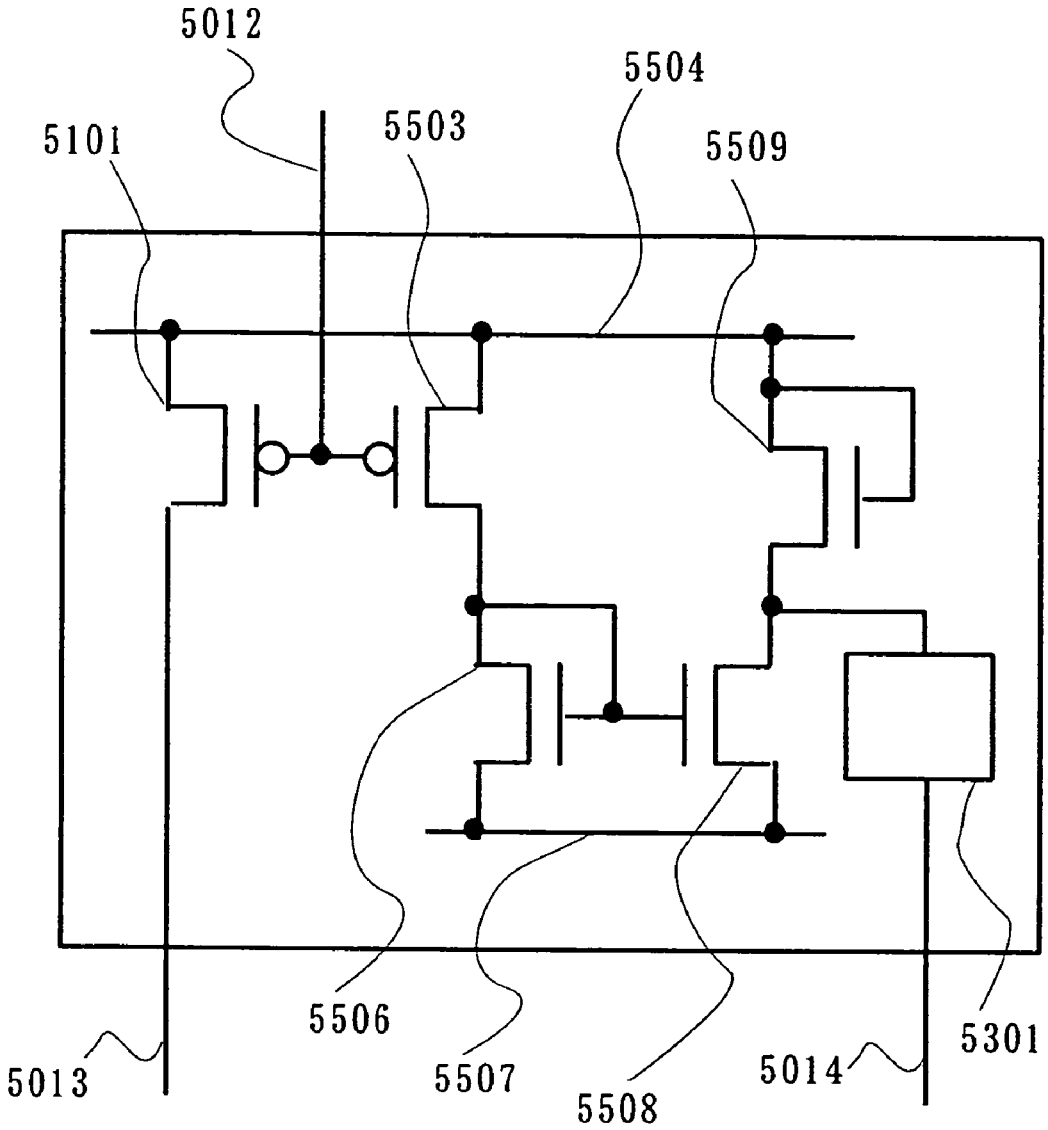
[FIG. 55] diagram illustrating a configuration of a semiconductor device in accordance with the invention
Figure 56:
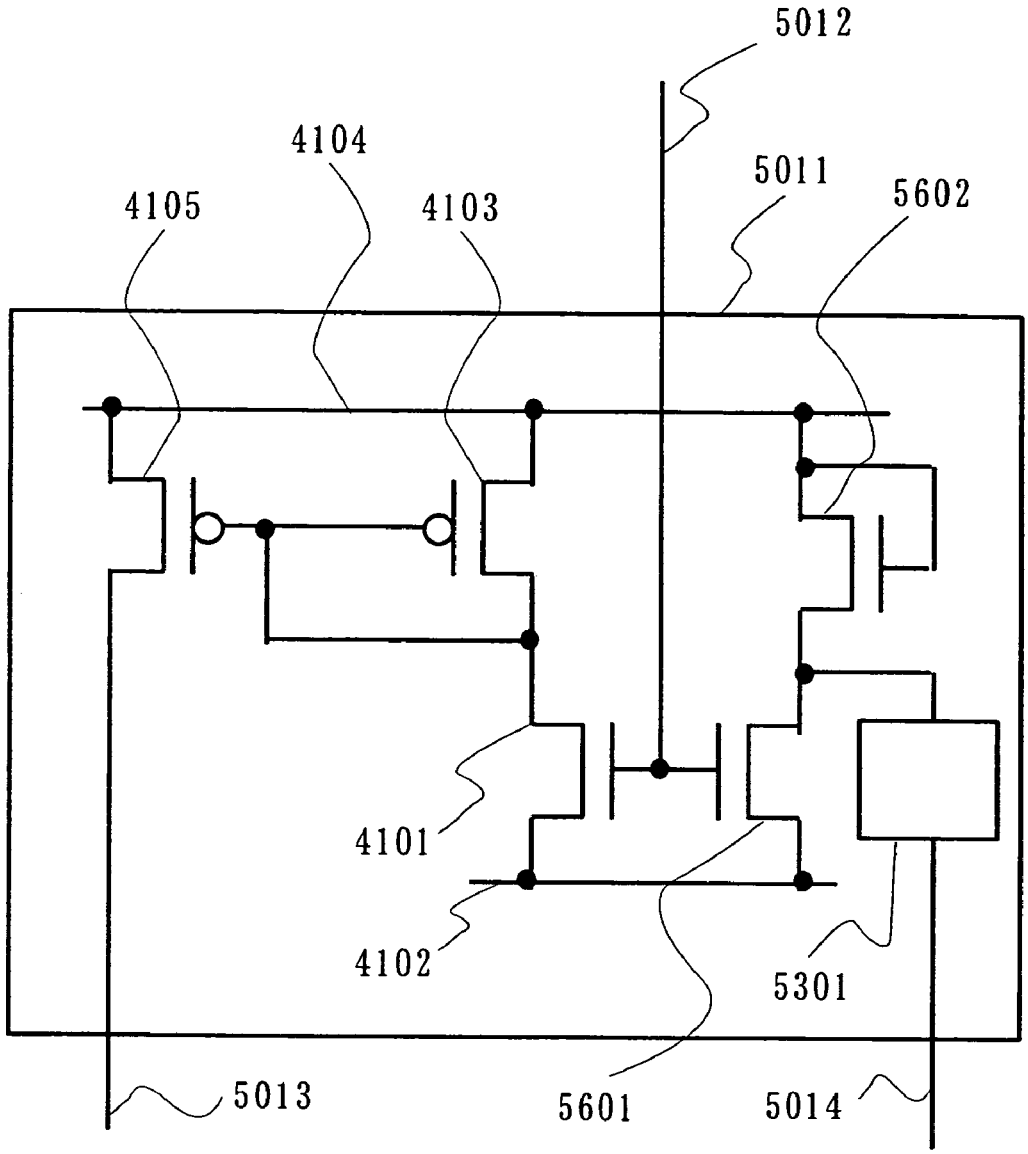
[FIG. 56] diagram illustrating a configuration of a semiconductor device in accordance with the invention
Figure 57:
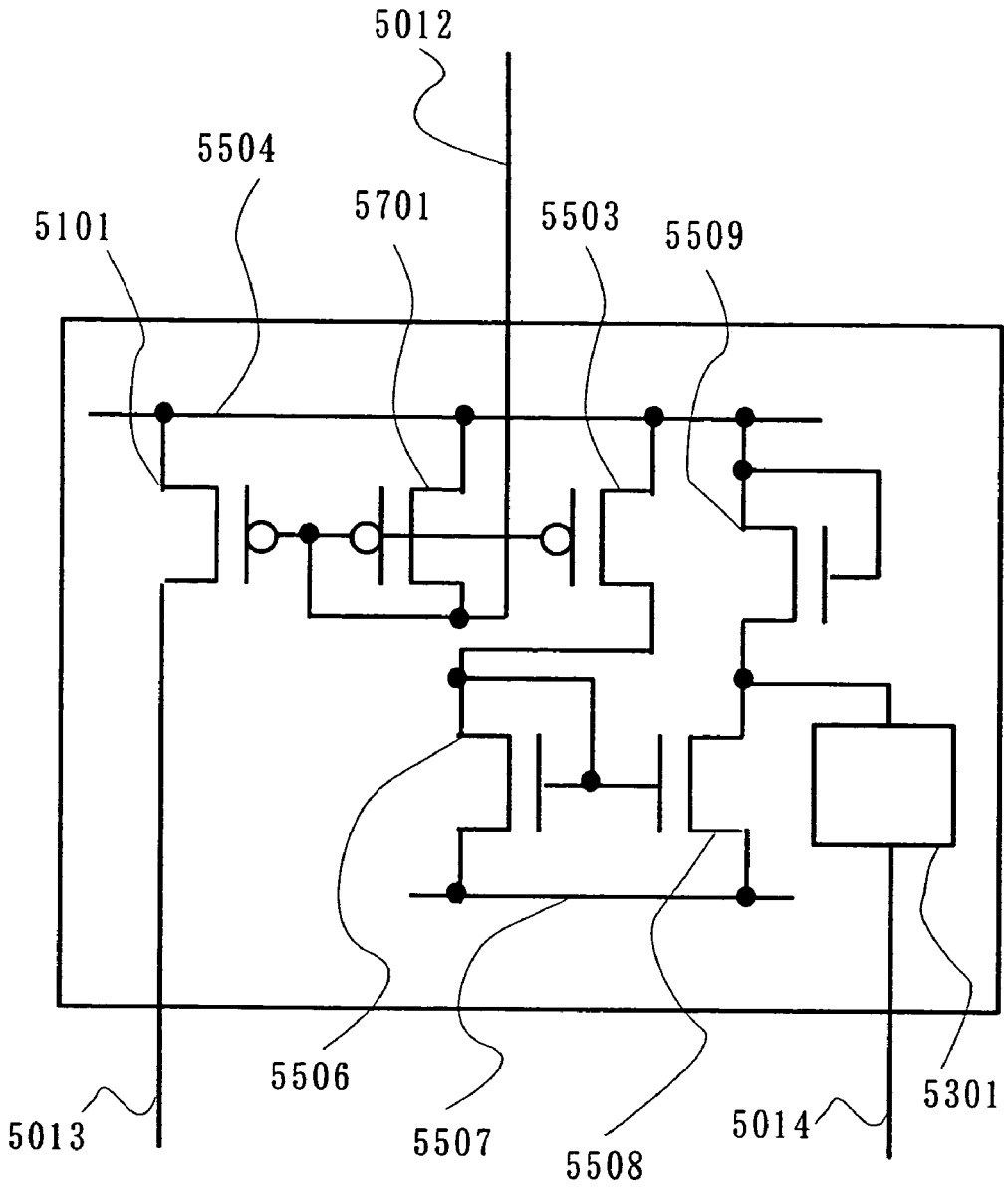
[FIG. 57] diagram illustrating a configuration of a semiconductor device in accordance with the invention
Figure 58:
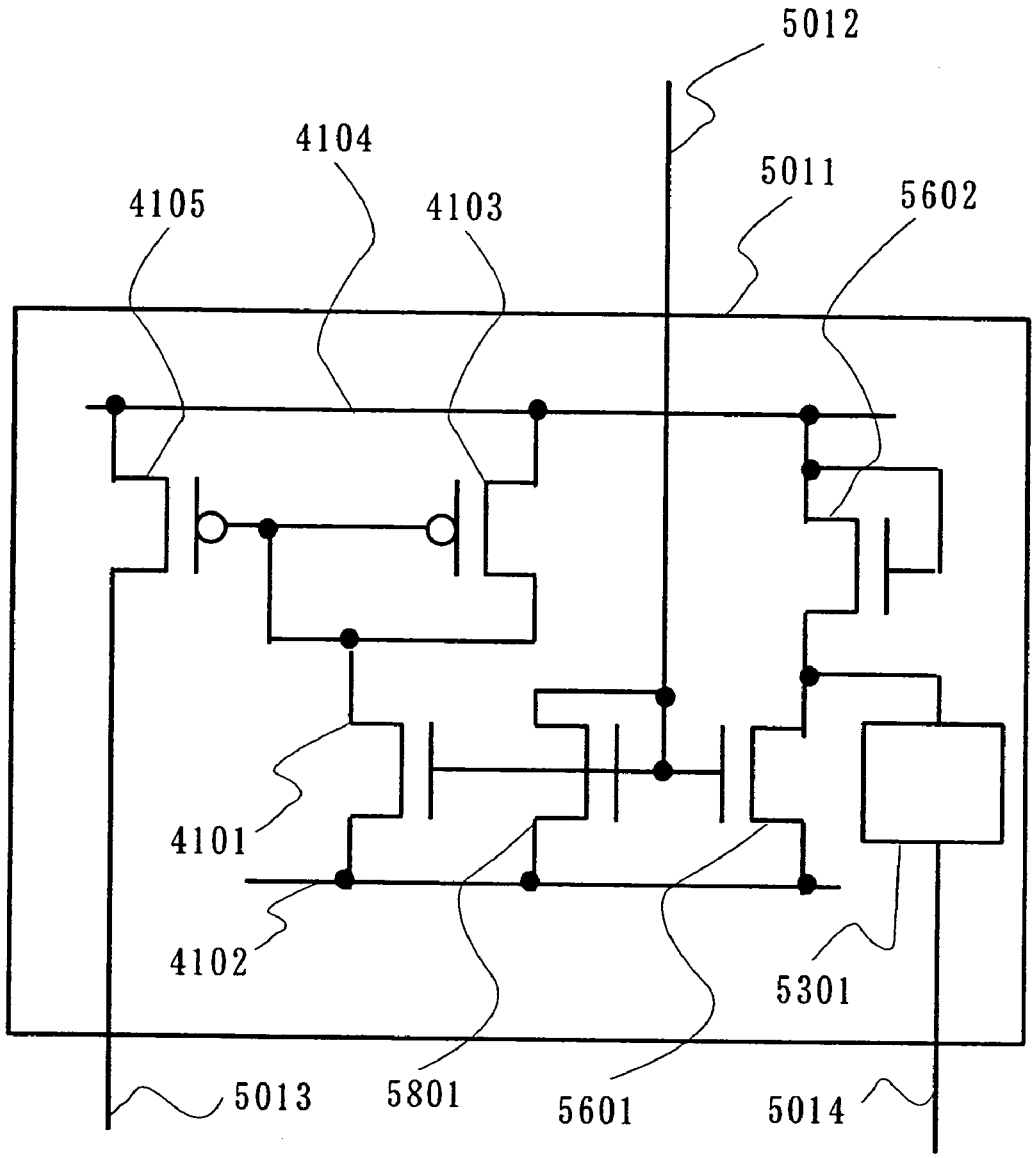
[FIG. 58] diagram illustrating a configuration of a semiconductor device in accordance with the invention
Figure 59:
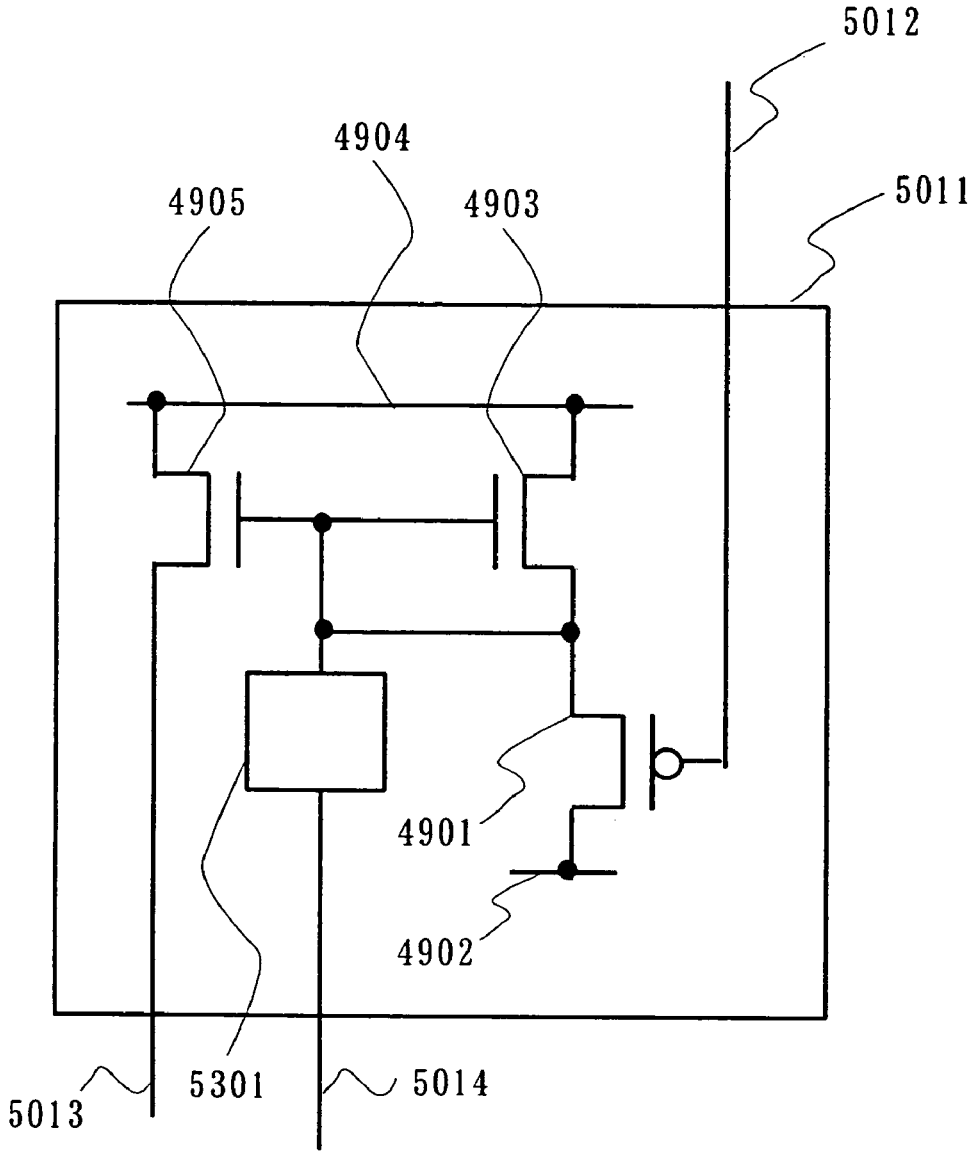
[FIG. 59] diagram illustrating a configuration of a semiconductor device in accordance with the invention
Figure 60:
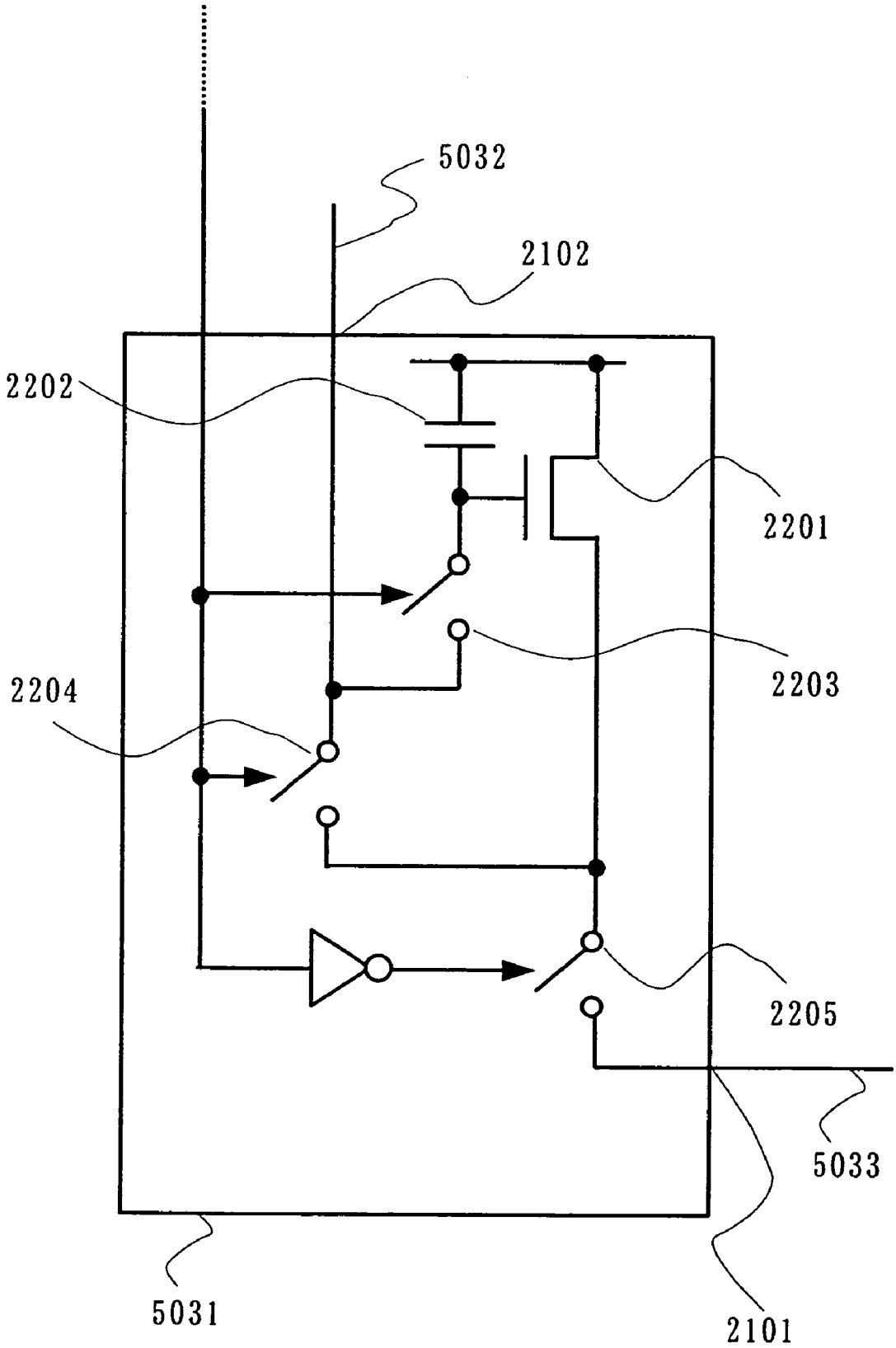
[FIG. 60] diagram illustrating a configuration of a semiconductor device in accordance with the invention
Figure 61:
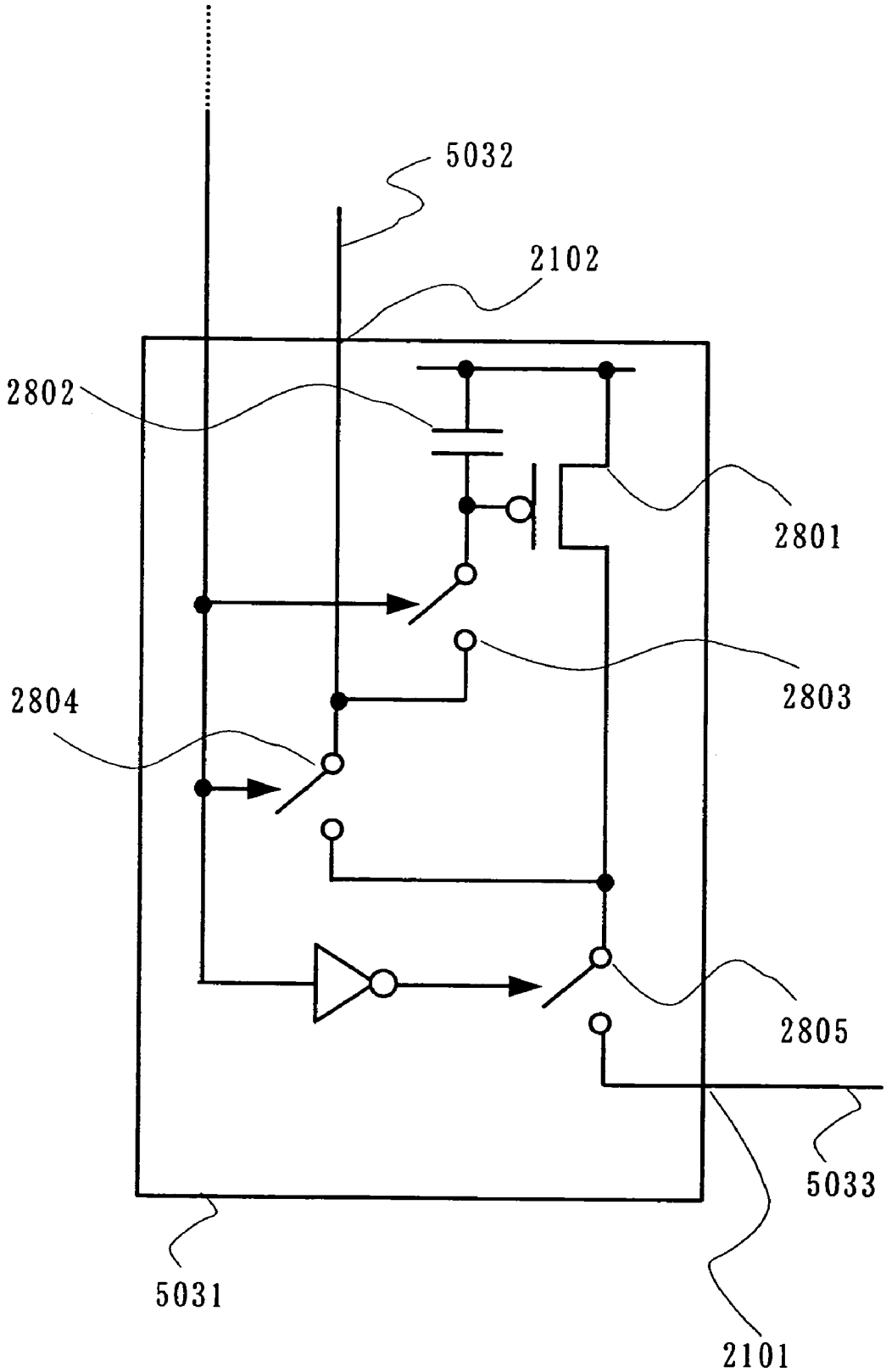
[FIG. 61] diagram illustrating a configuration of a semiconductor device in accordance with the invention
Figure 62:
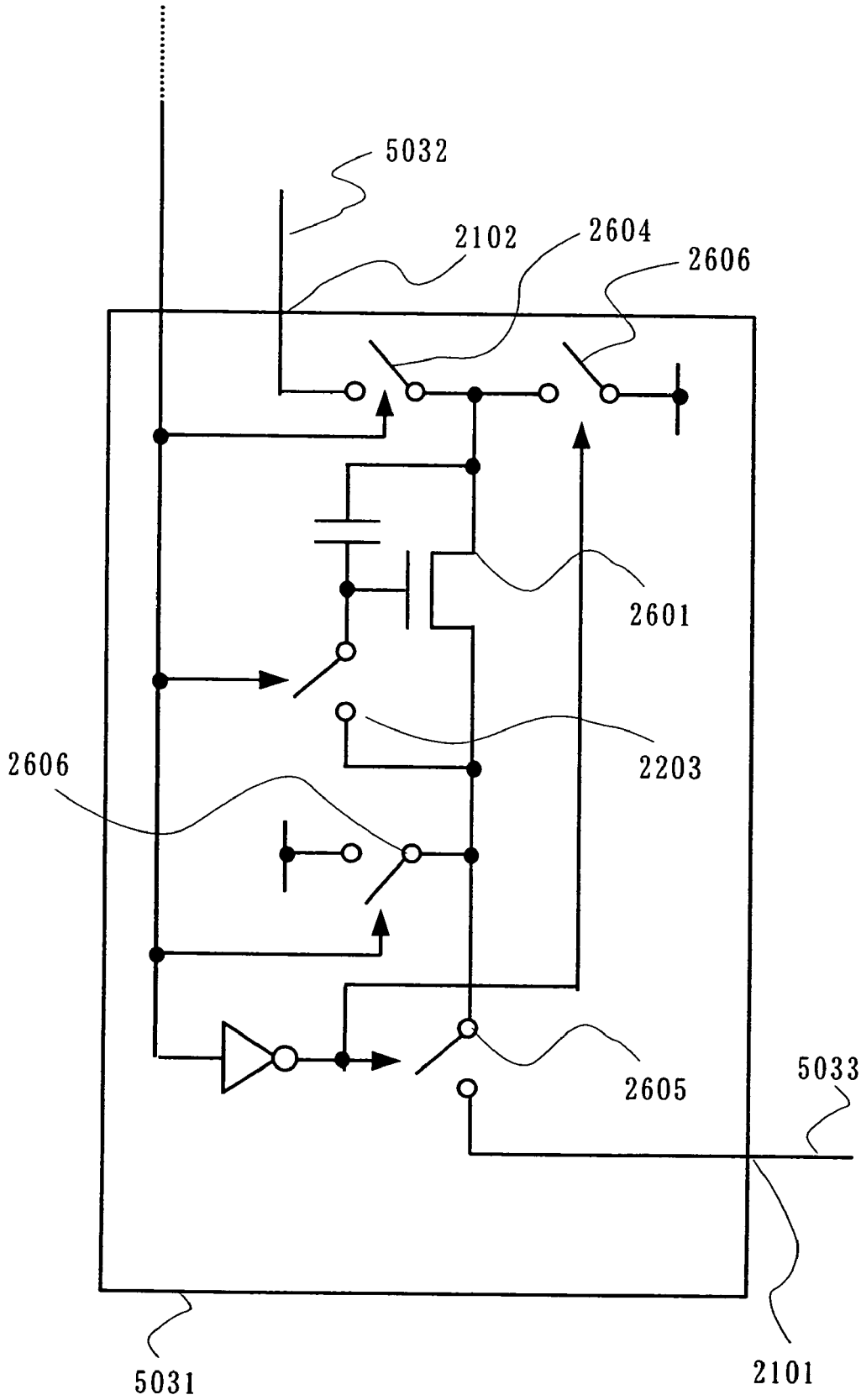
[FIG. 62] diagram illustrating a configuration of a semiconductor device in accordance with the invention
Figure 63:
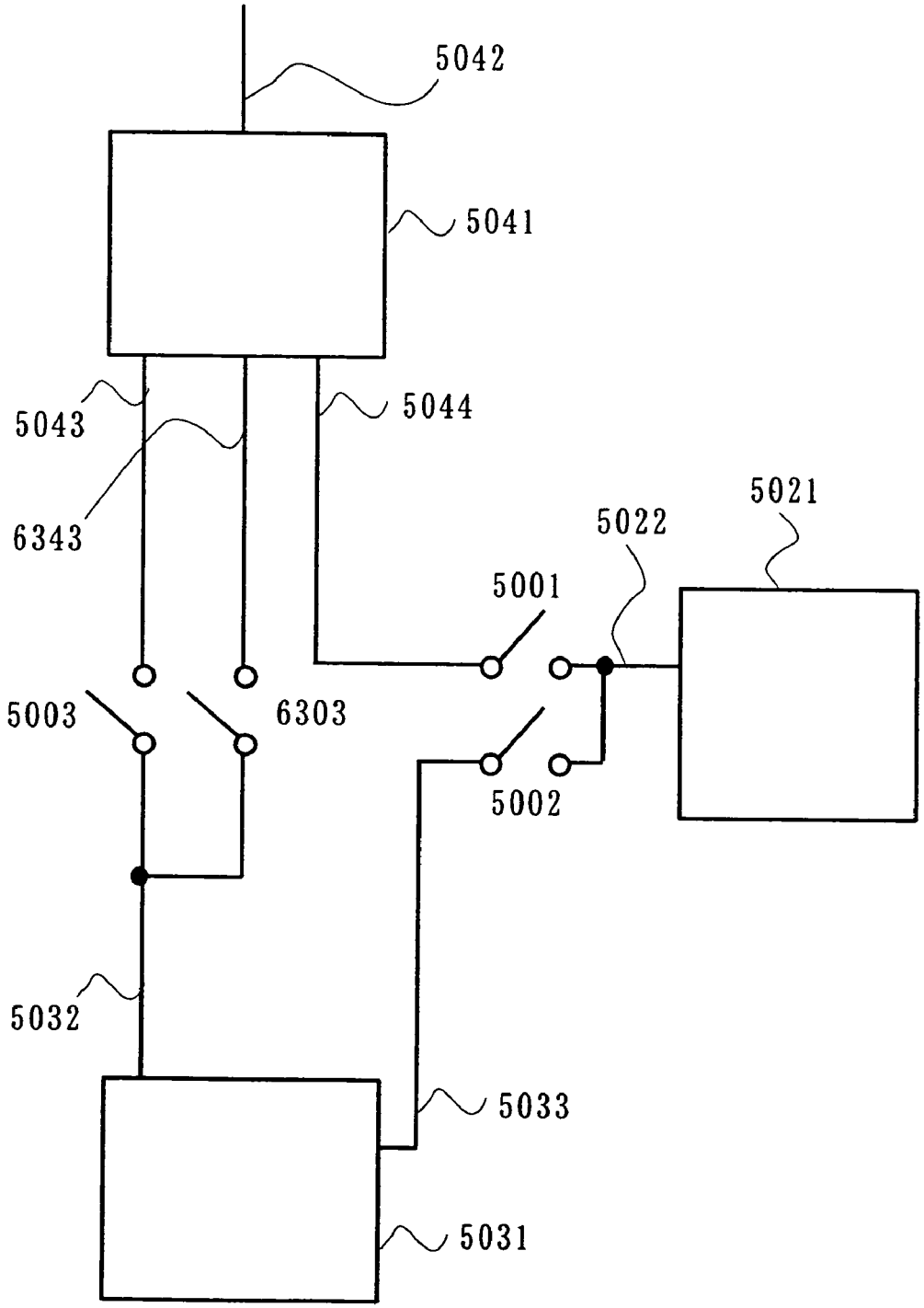
[FIG. 63] diagram illustrating a configuration of a semiconductor device in accordance with the invention
Figure 64:
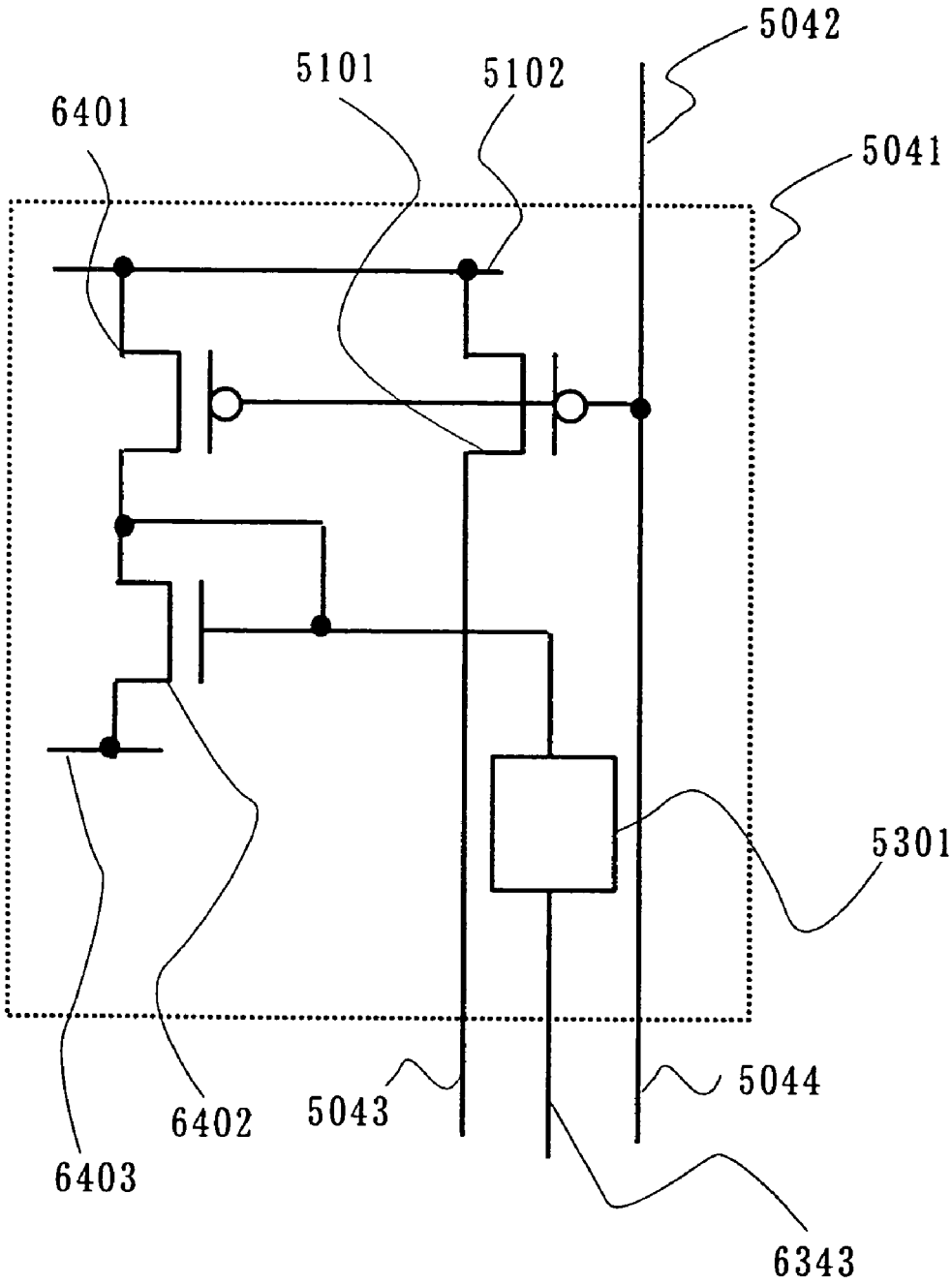
[FIG. 64] diagram illustrating a configuration of a semiconductor device in accordance with the invention
Figure 65:
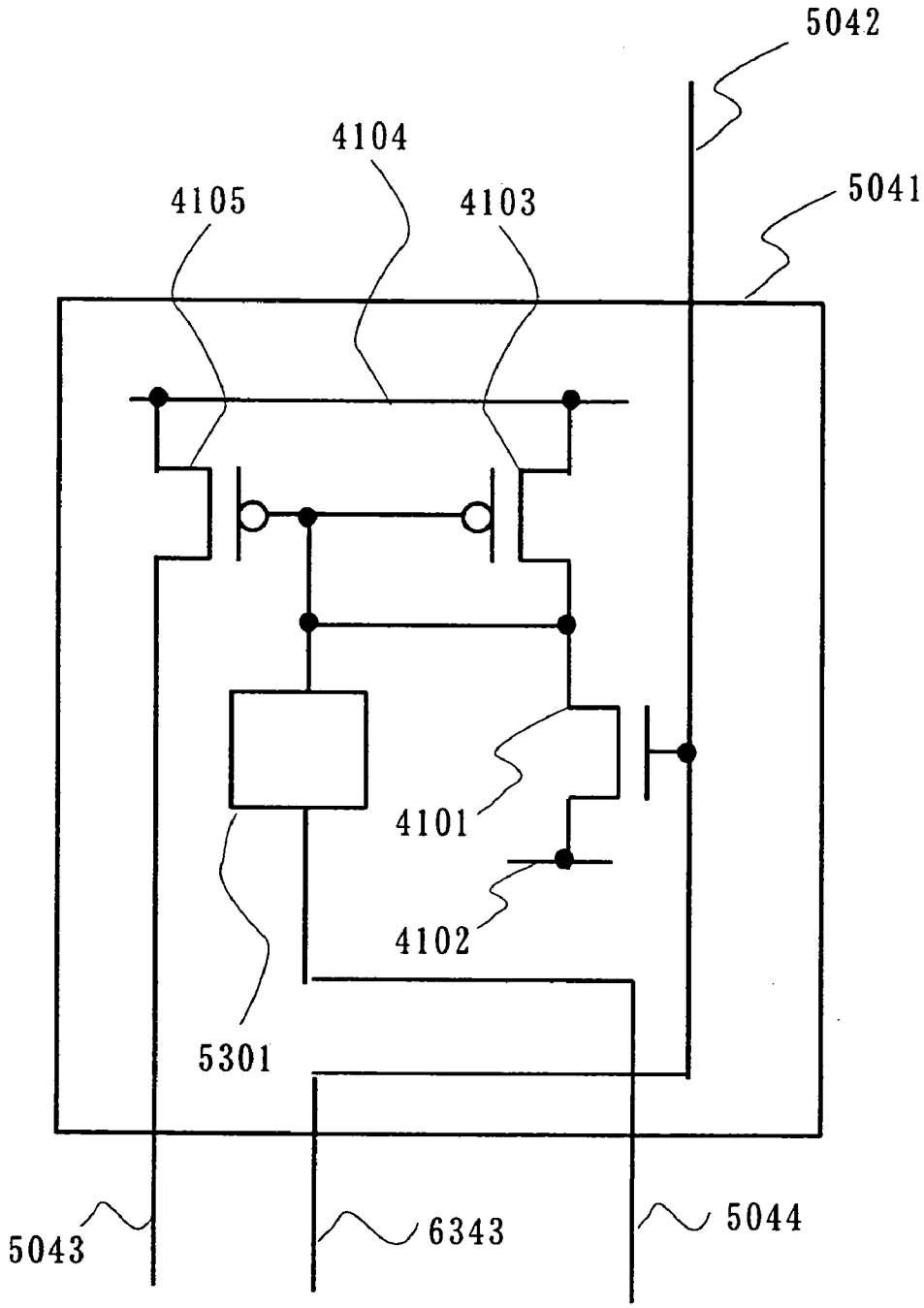
[FIG. 65] diagram illustrating a configuration of a semiconductor device in accordance with the invention
Figure 66:
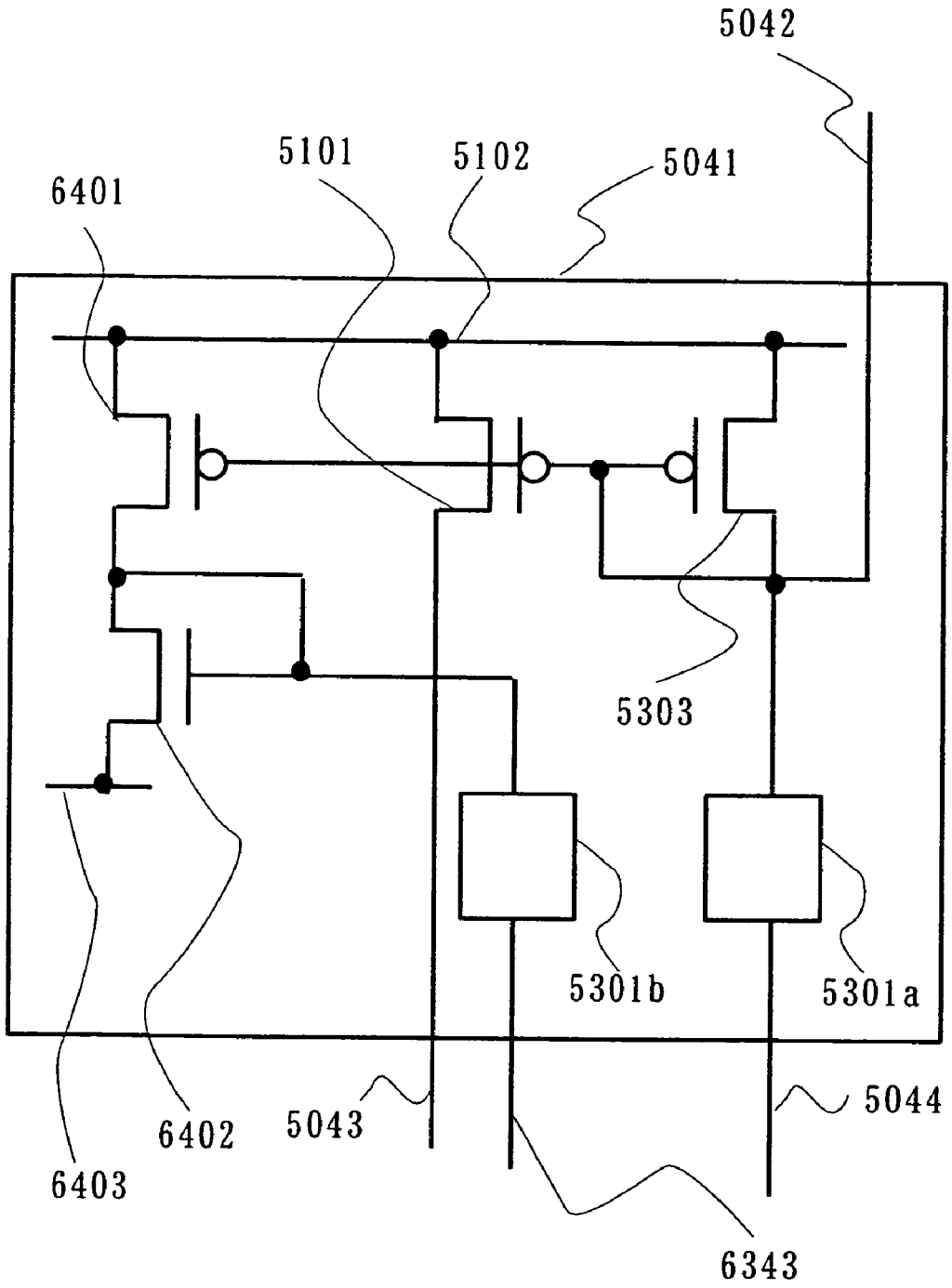
[FIG. 66] diagram illustrating a configuration of a semiconductor device in accordance with the invention
Figure 67:
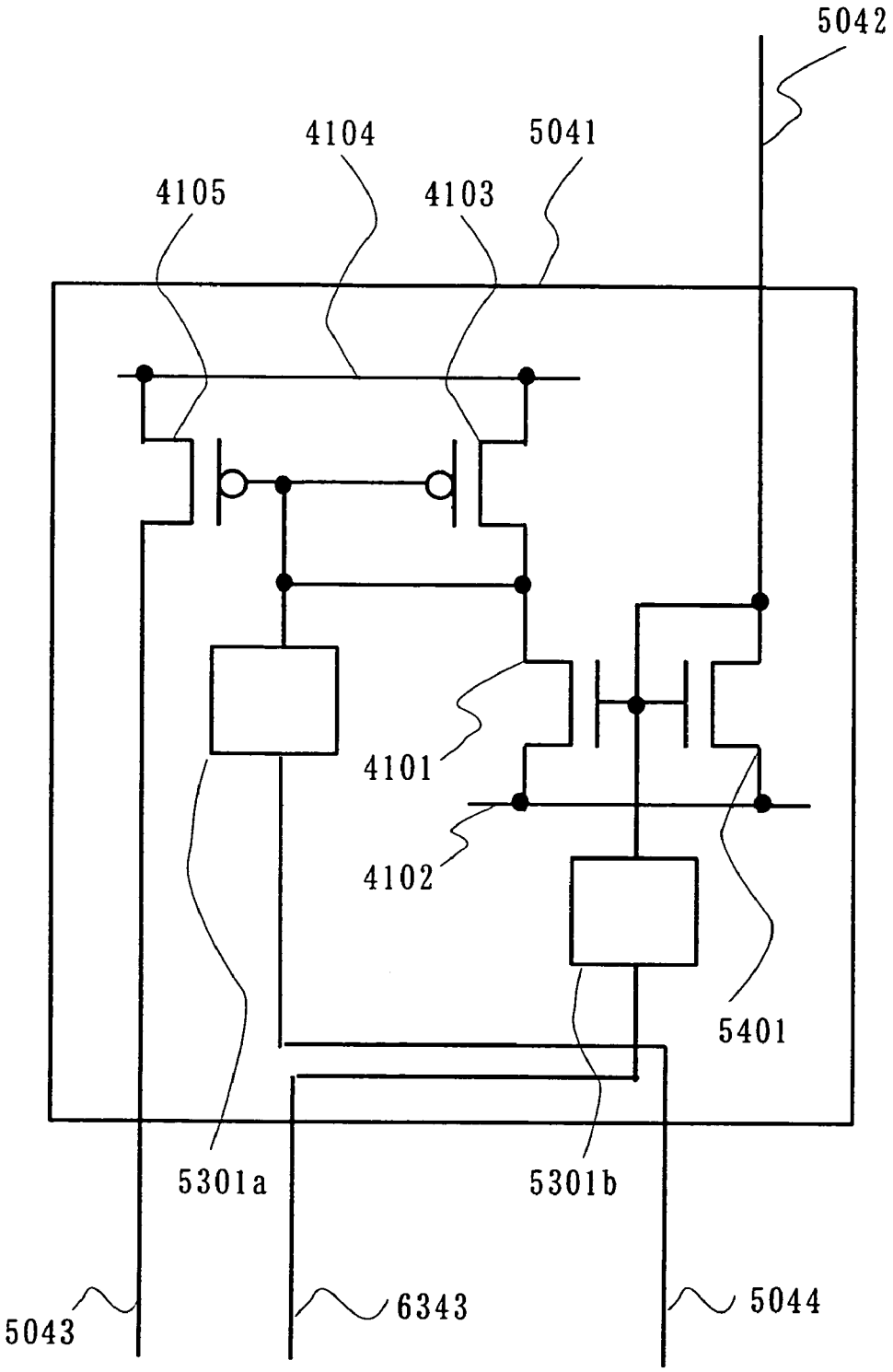
[FIG. 67] diagram illustrating a configuration of a semiconductor device in accordance with the invention
Figure 68:
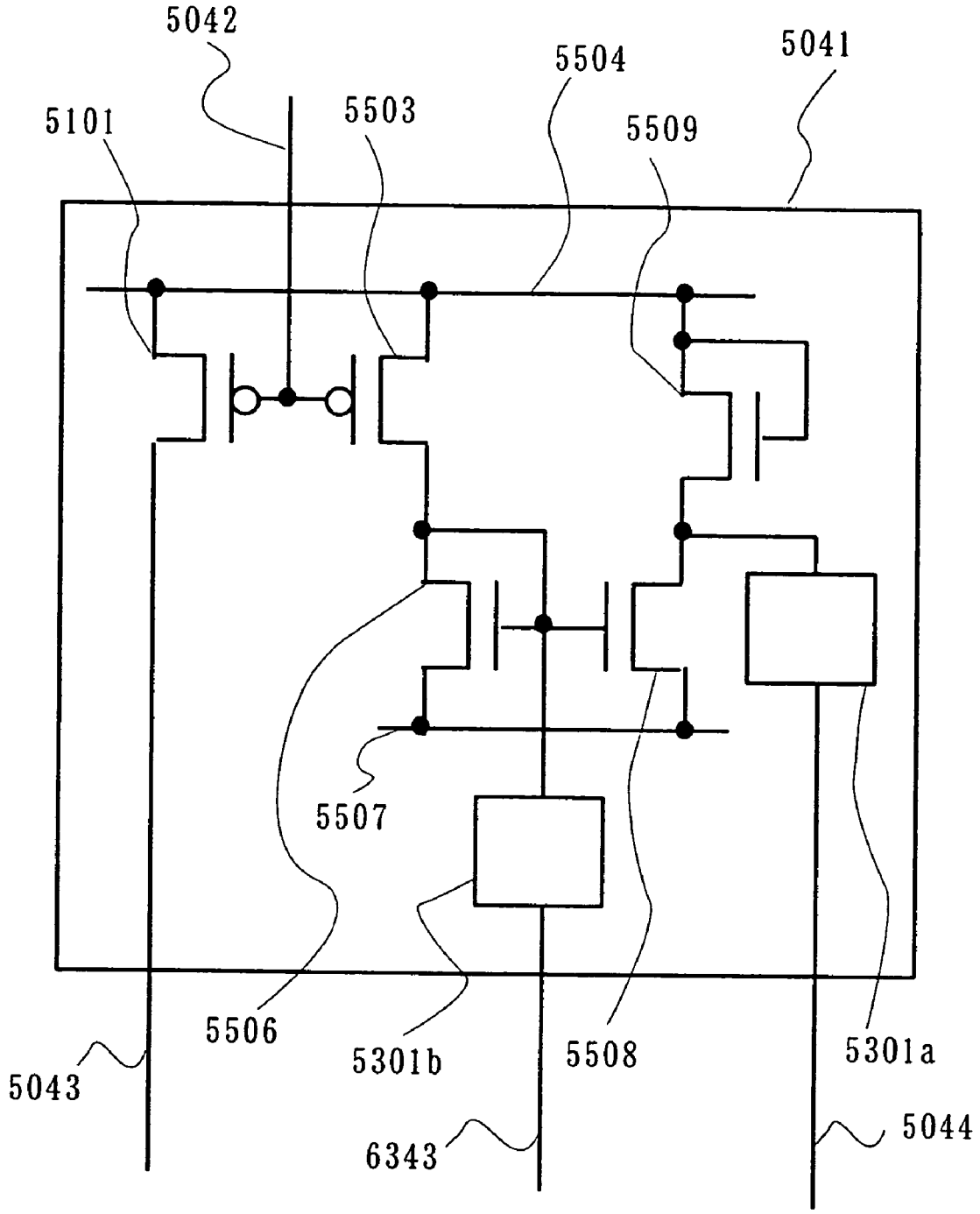
[FIG. 68] diagram illustrating a configuration of a semiconductor device in accordance with the invention
Figure 69:
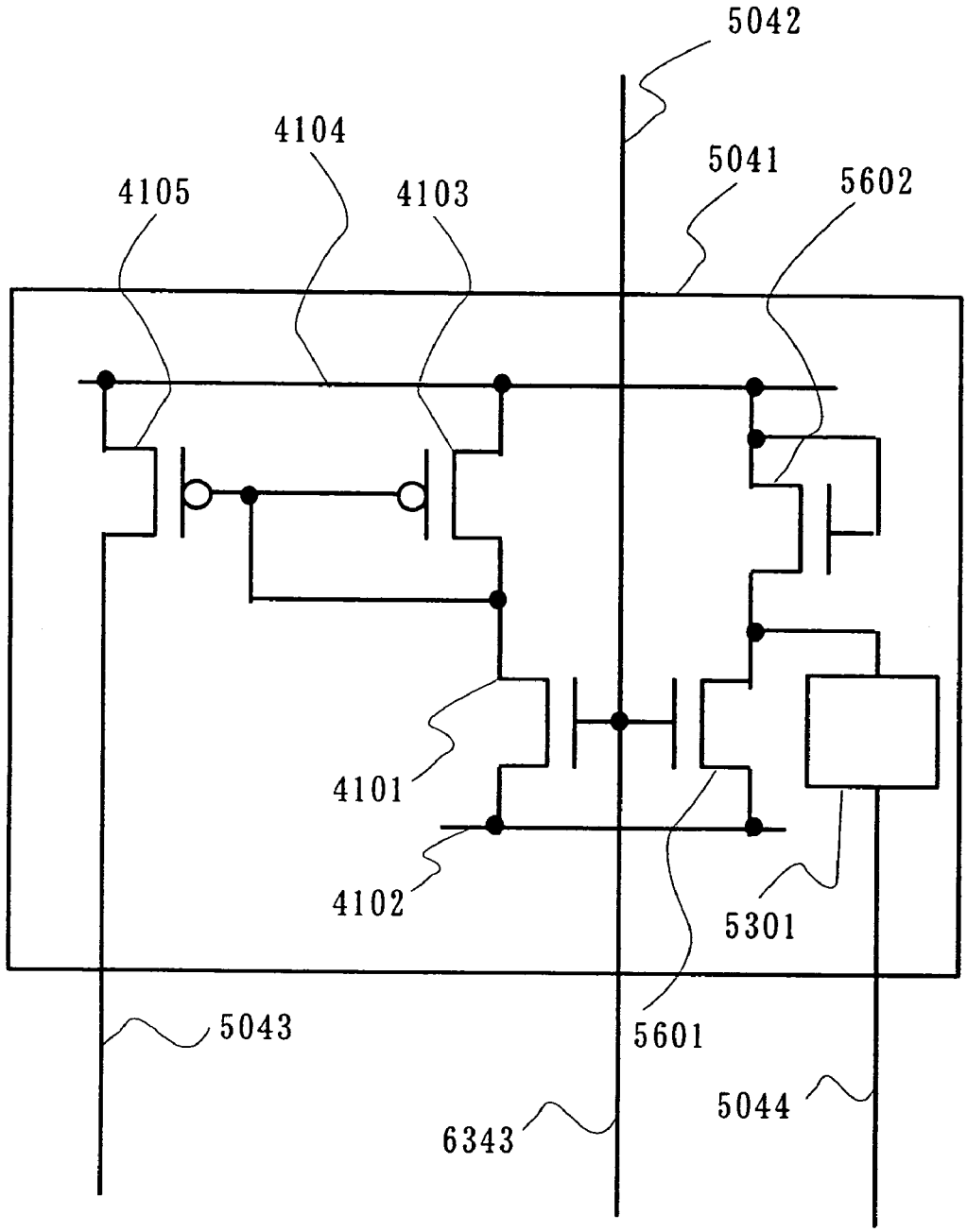
[FIG. 69] diagram illustrating a configuration of a semiconductor device in accordance with the invention
Figure 70:
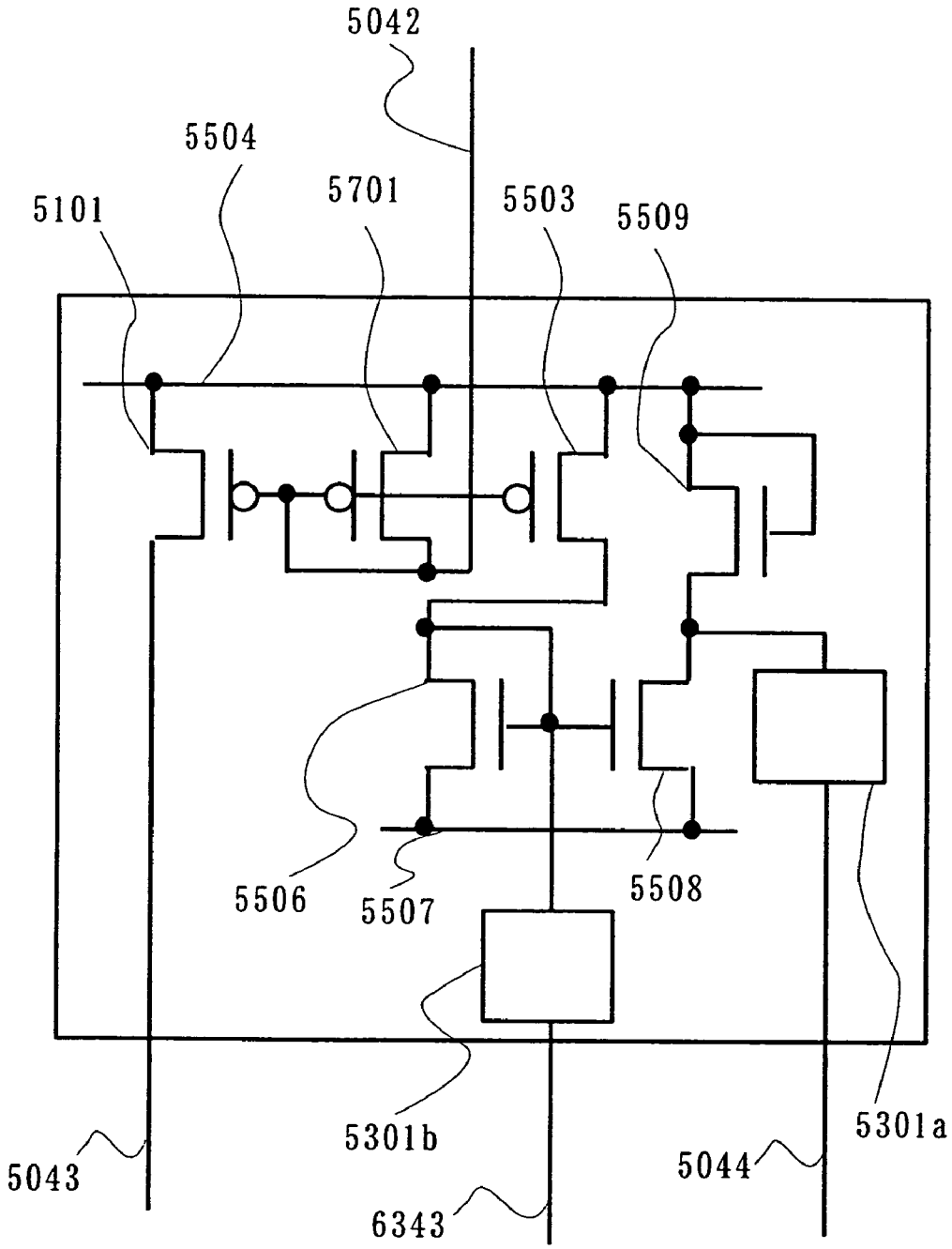
[FIG. 70] diagram illustrating a configuration of a semiconductor device in accordance with the invention
Figure 71:
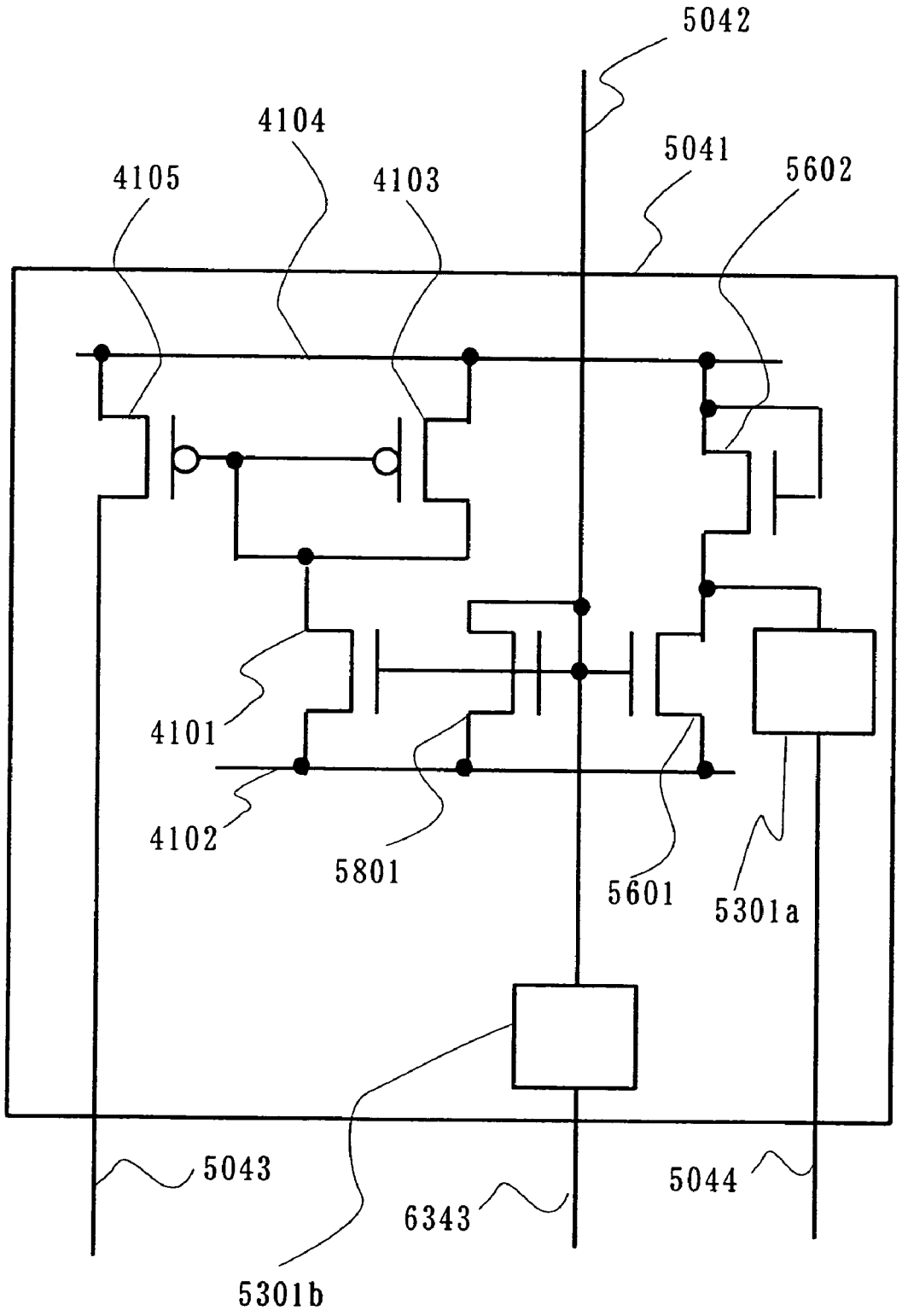
[FIG. 71] diagram illustrating a configuration of a semiconductor device in accordance with the invention
Figure 72:
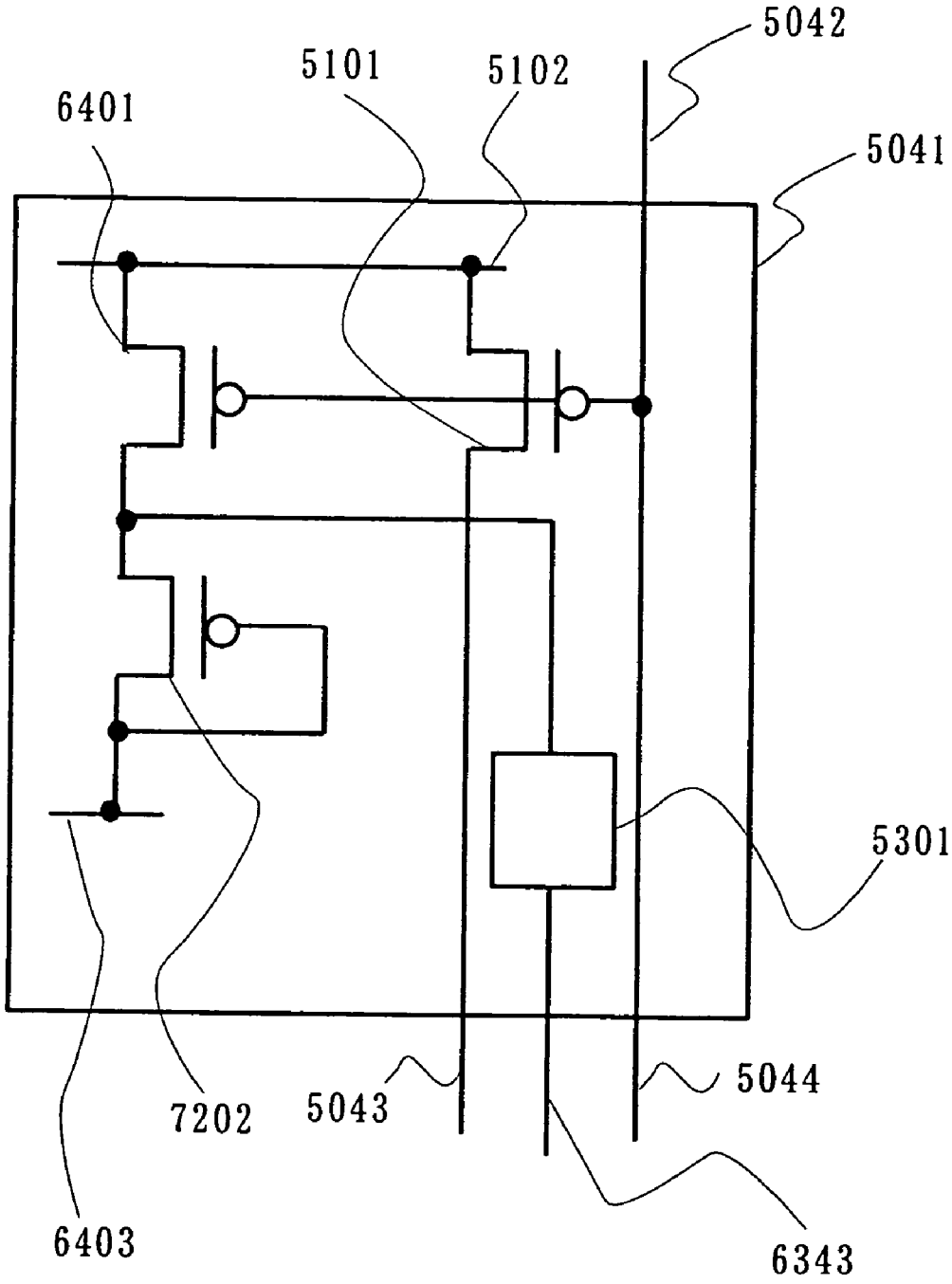
[FIG. 72] diagram illustrating a configuration of a semiconductor device in accordance with the invention
Figure 73:
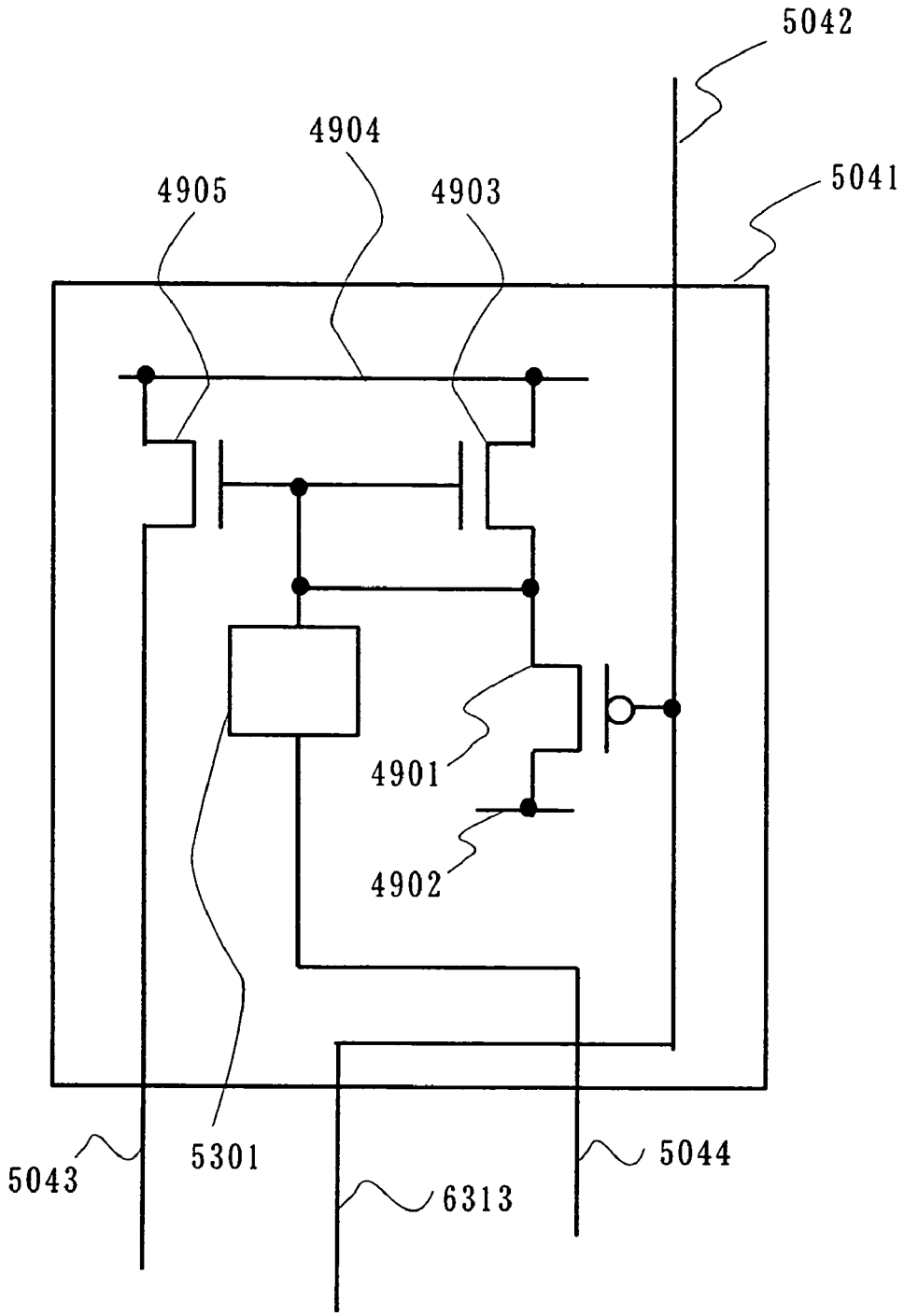
[FIG. 73] diagram illustrating a configuration of a semiconductor device in accordance with the invention
Figure 74:
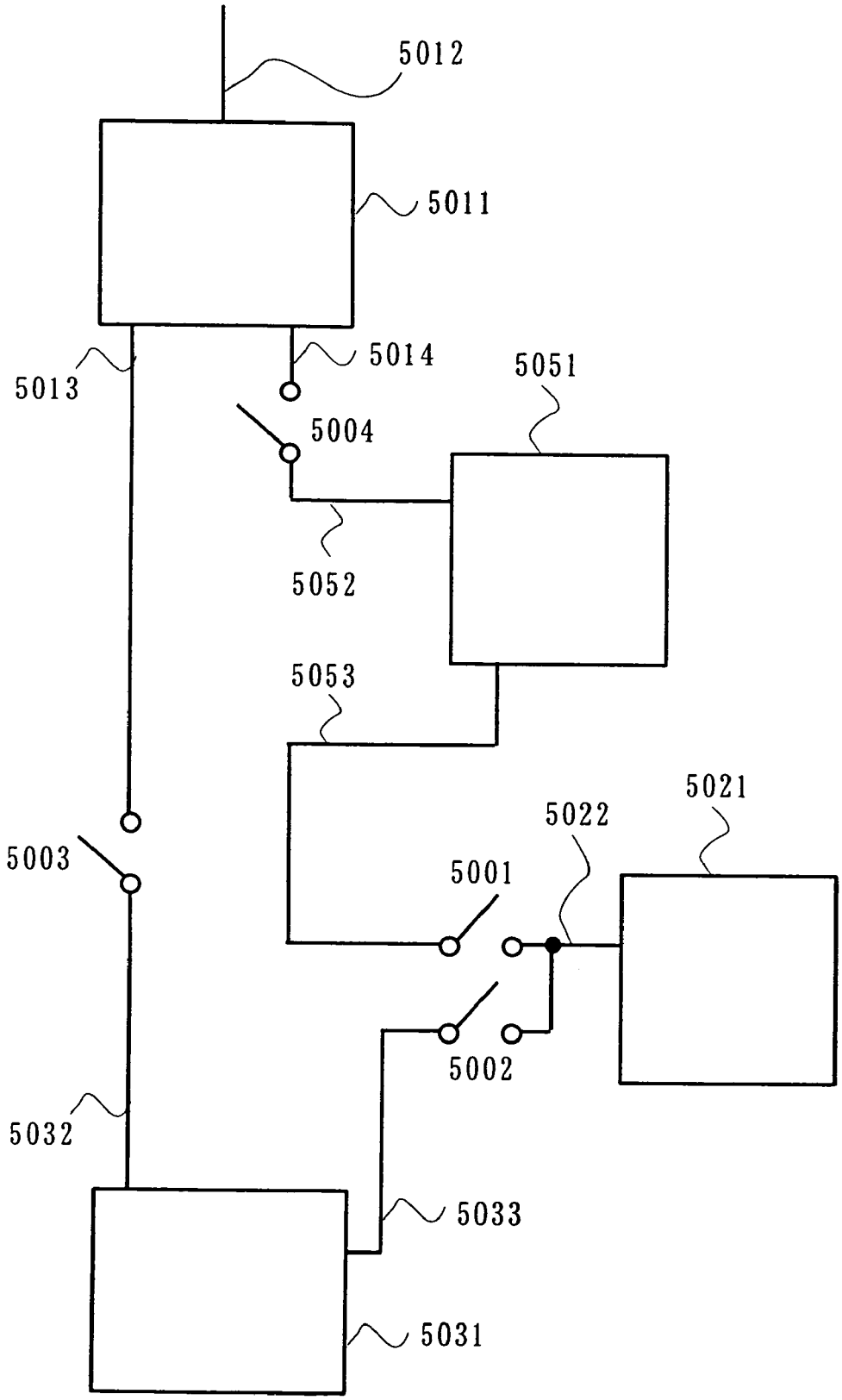
[FIG. 74] diagram illustrating a configuration of a semiconductor device in accordance with the invention
Figure 75:
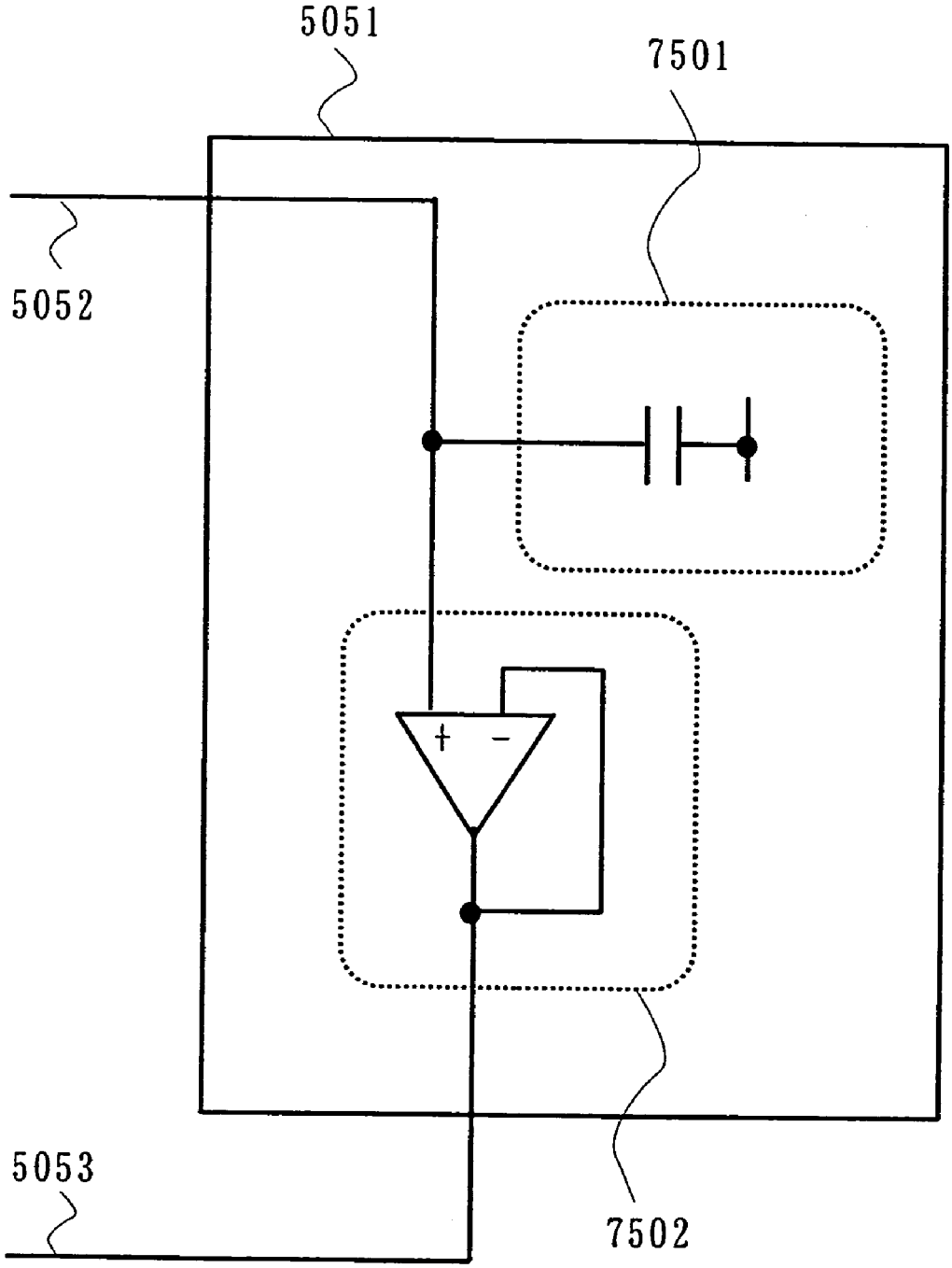
[FIG. 75] diagram illustrating a configuration of a semiconductor device in accordance with the invention
Figure 76:
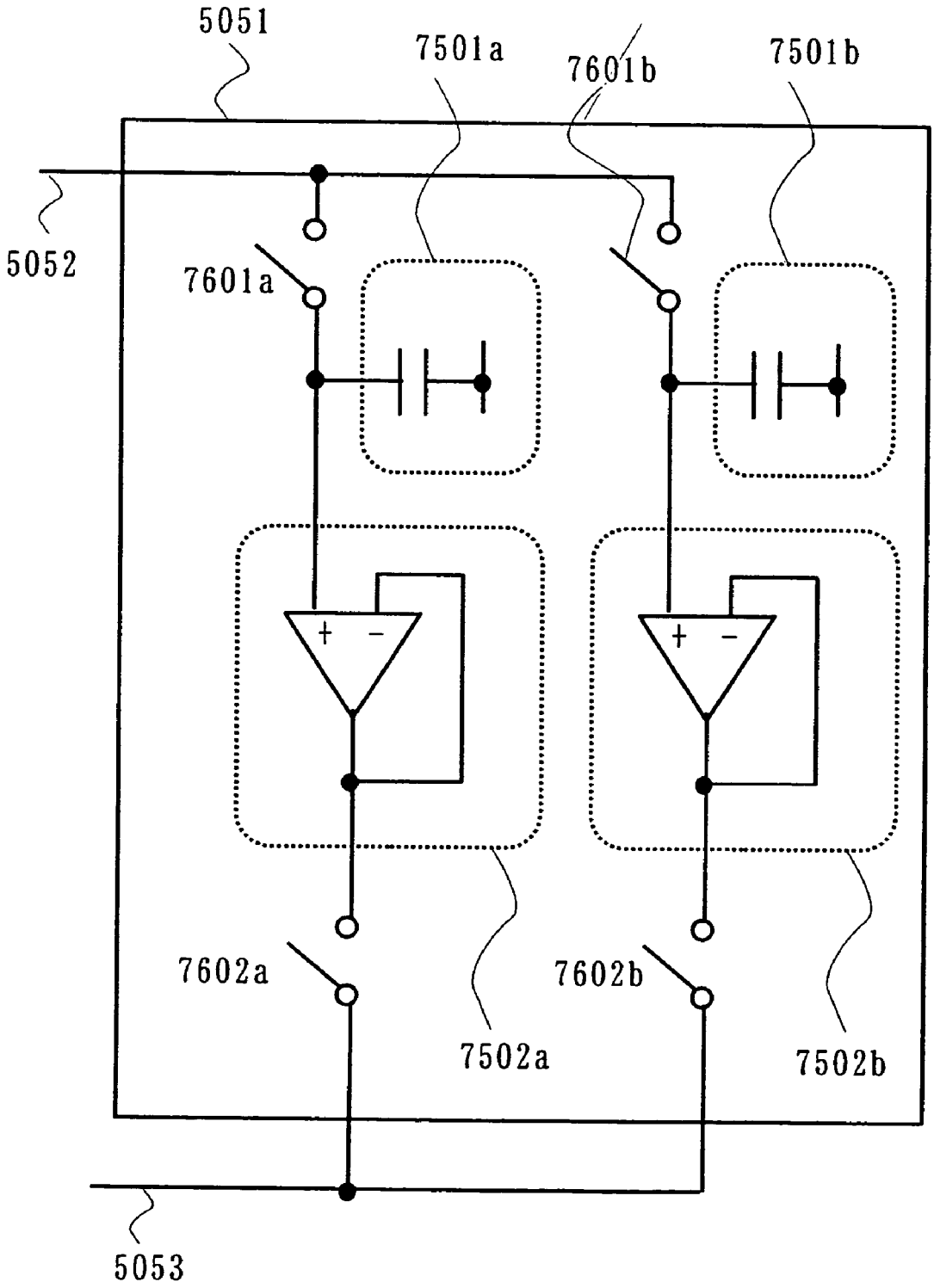
[FIG. 76] diagram illustrating a configuration of a semiconductor device in accordance with the invention
Figure 77:
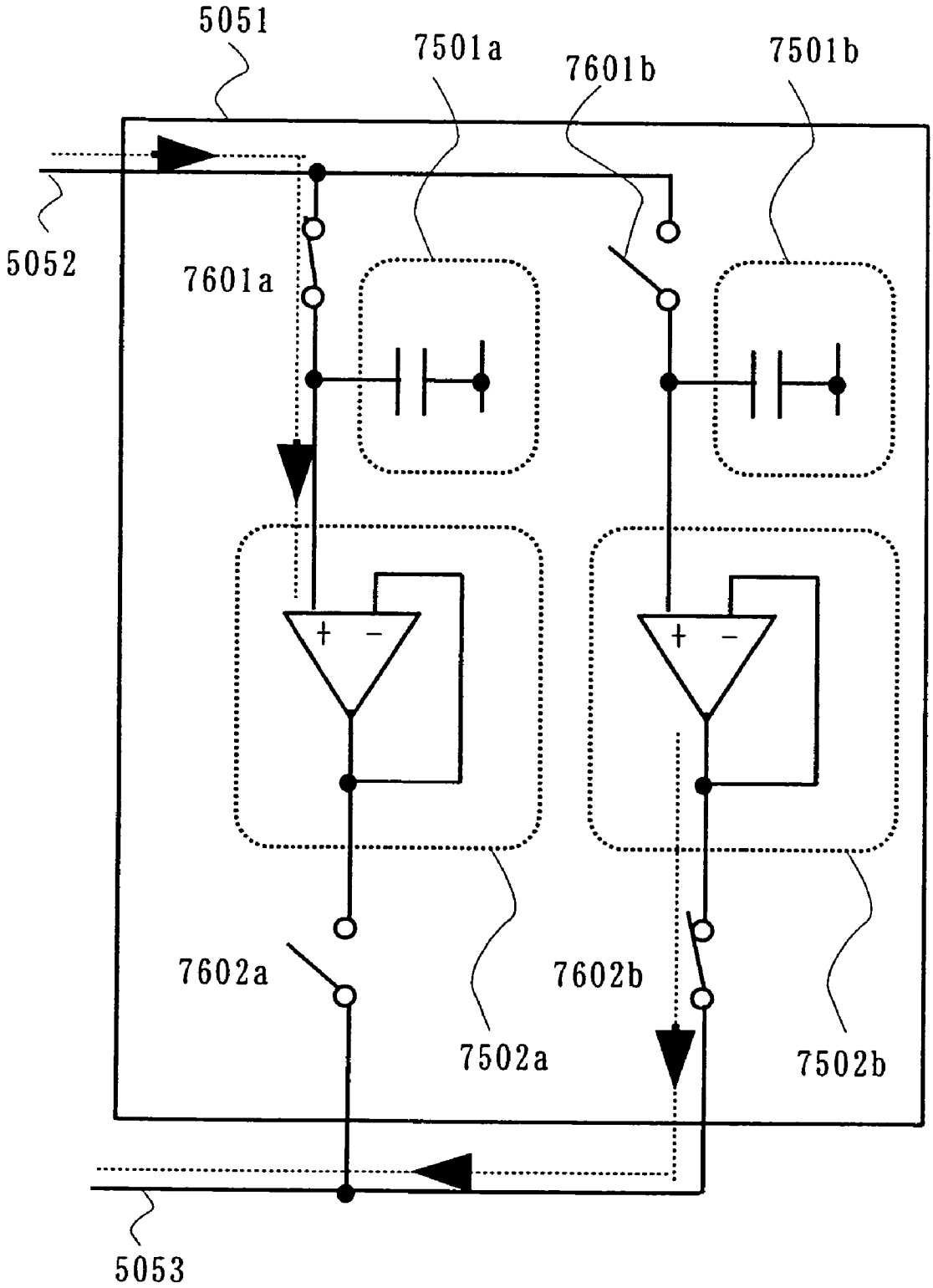
[FIG. 77] diagram illustrating an operation of a semiconductor device in accordance with the invention
Figure 78:
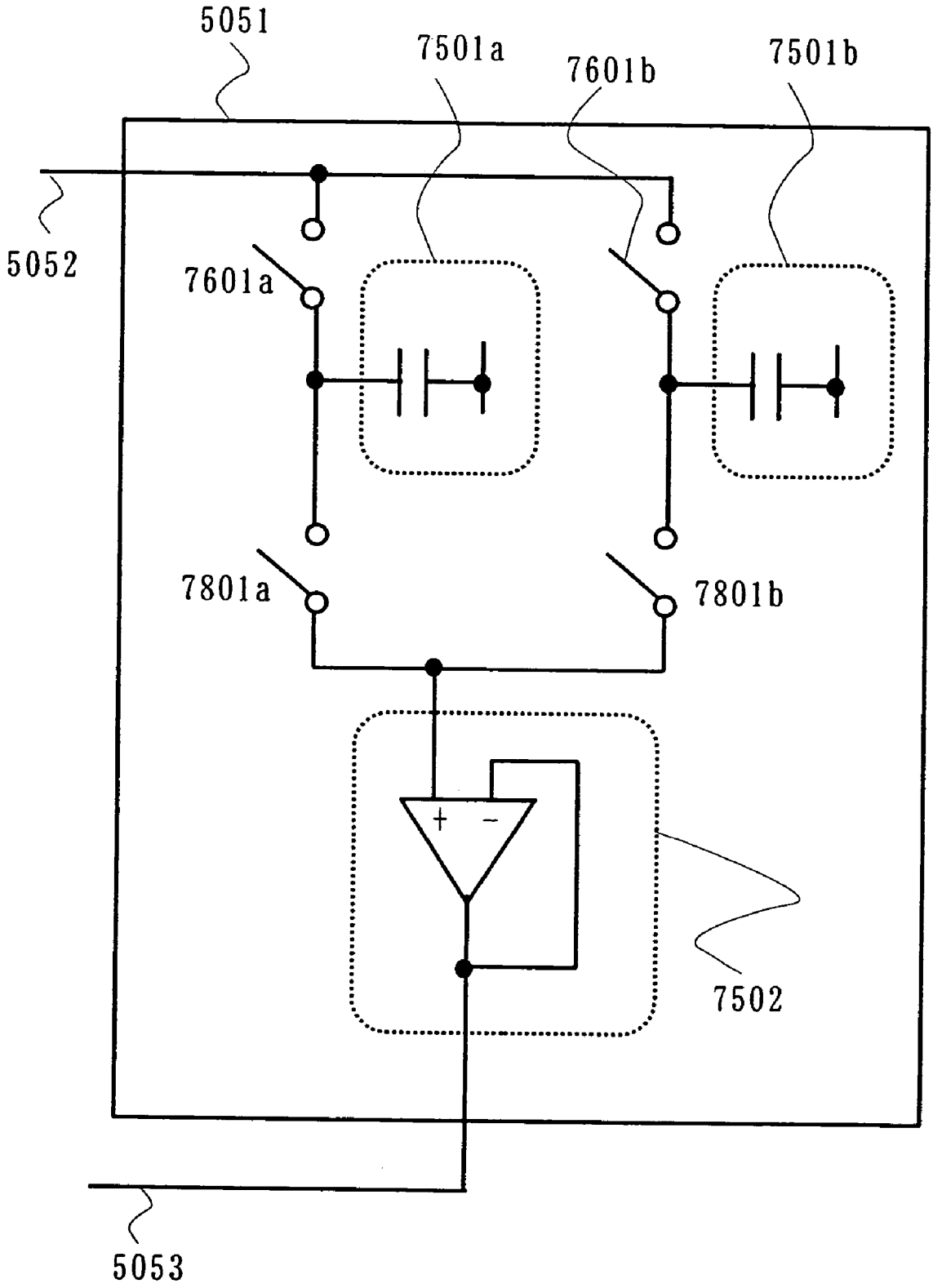
[FIG. 78] diagram illustrating a configuration of a semiconductor device in accordance with the invention
Figure 79:
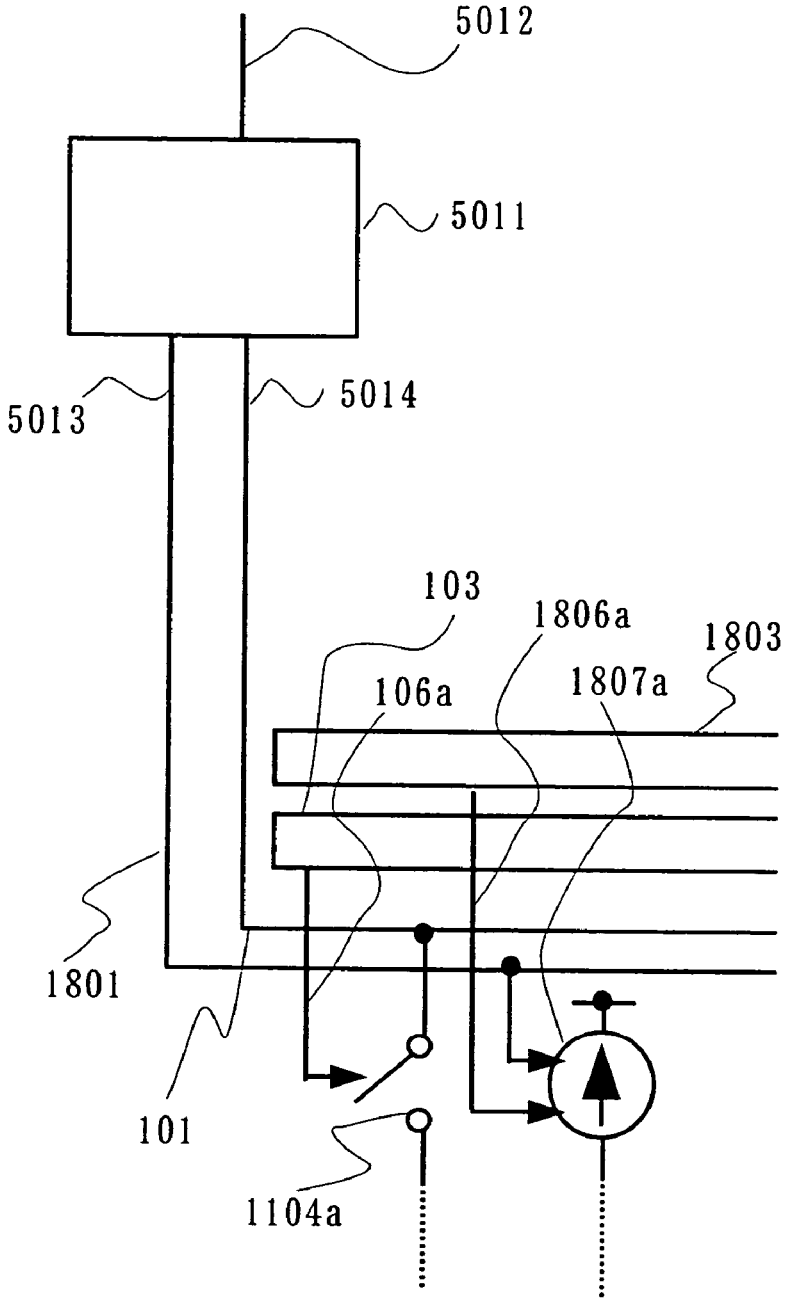
[FIG. 79] diagram illustrating a configuration of a semiconductor device in accordance with the invention
Figure 80:
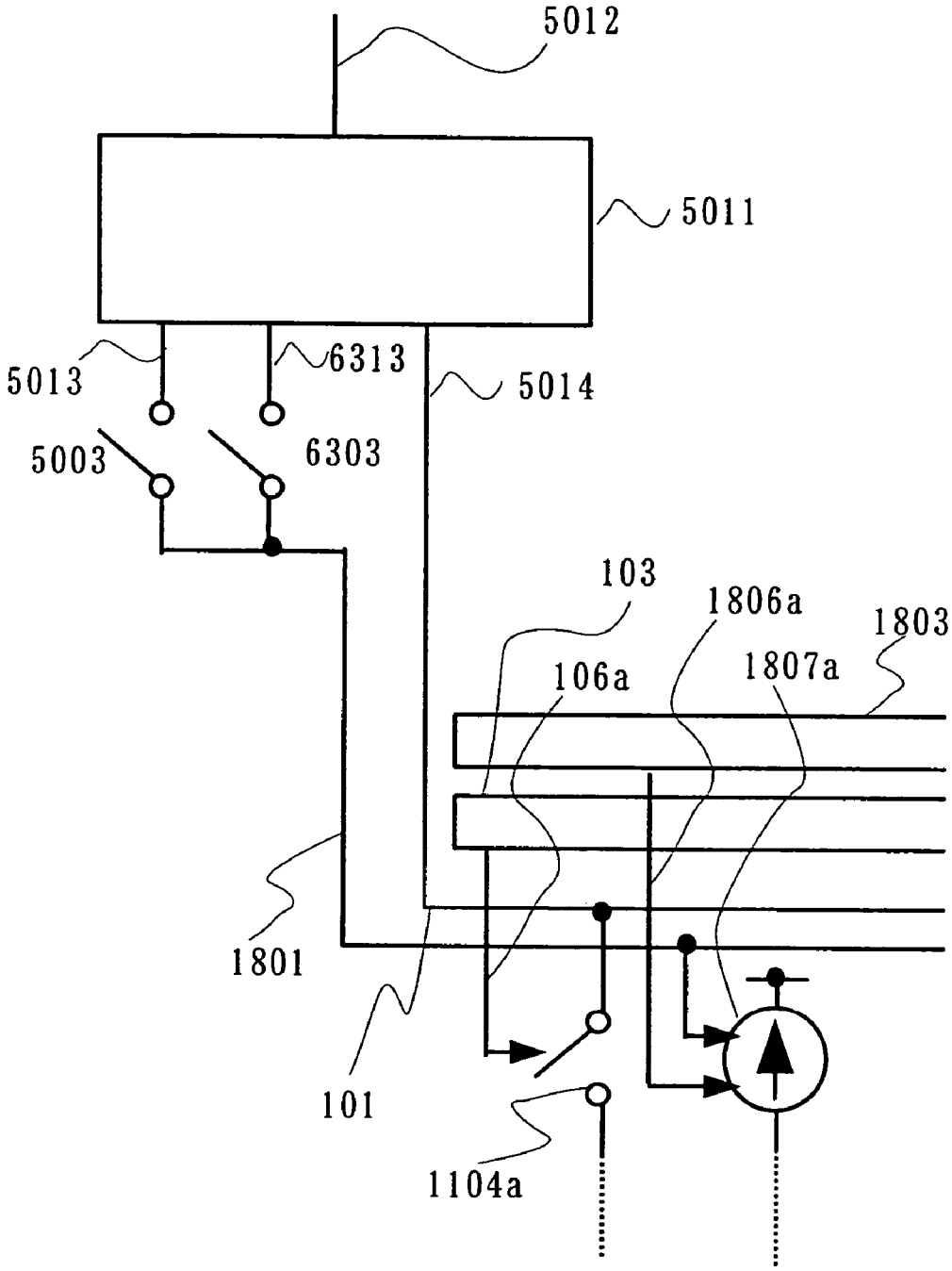
[FIG. 80] diagram illustrating a configuration of a semiconductor device in accordance with the invention
Figure 81:
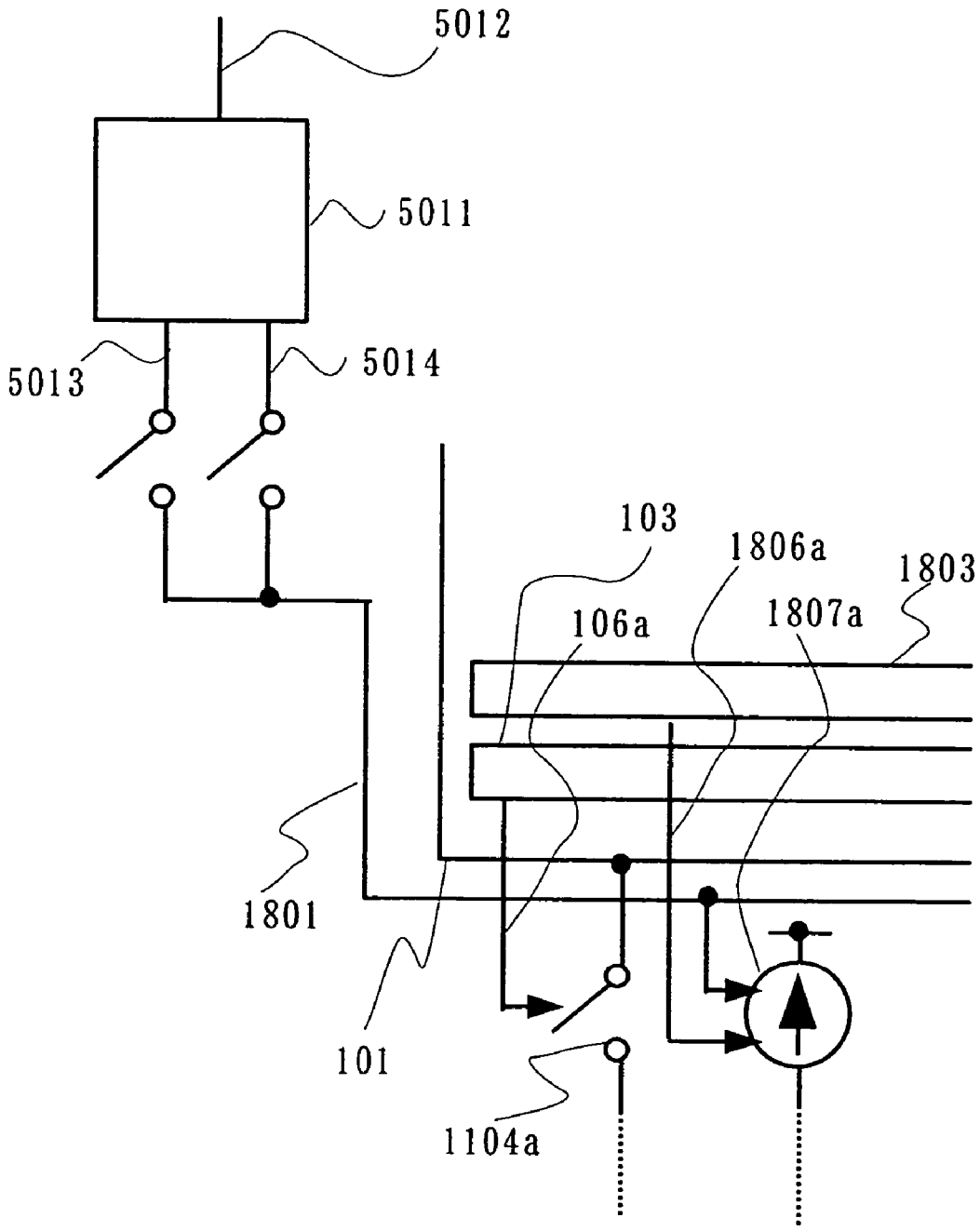
[FIG. 81] diagram illustrating a configuration of a semiconductor device in accordance with the invention
Figure 82:
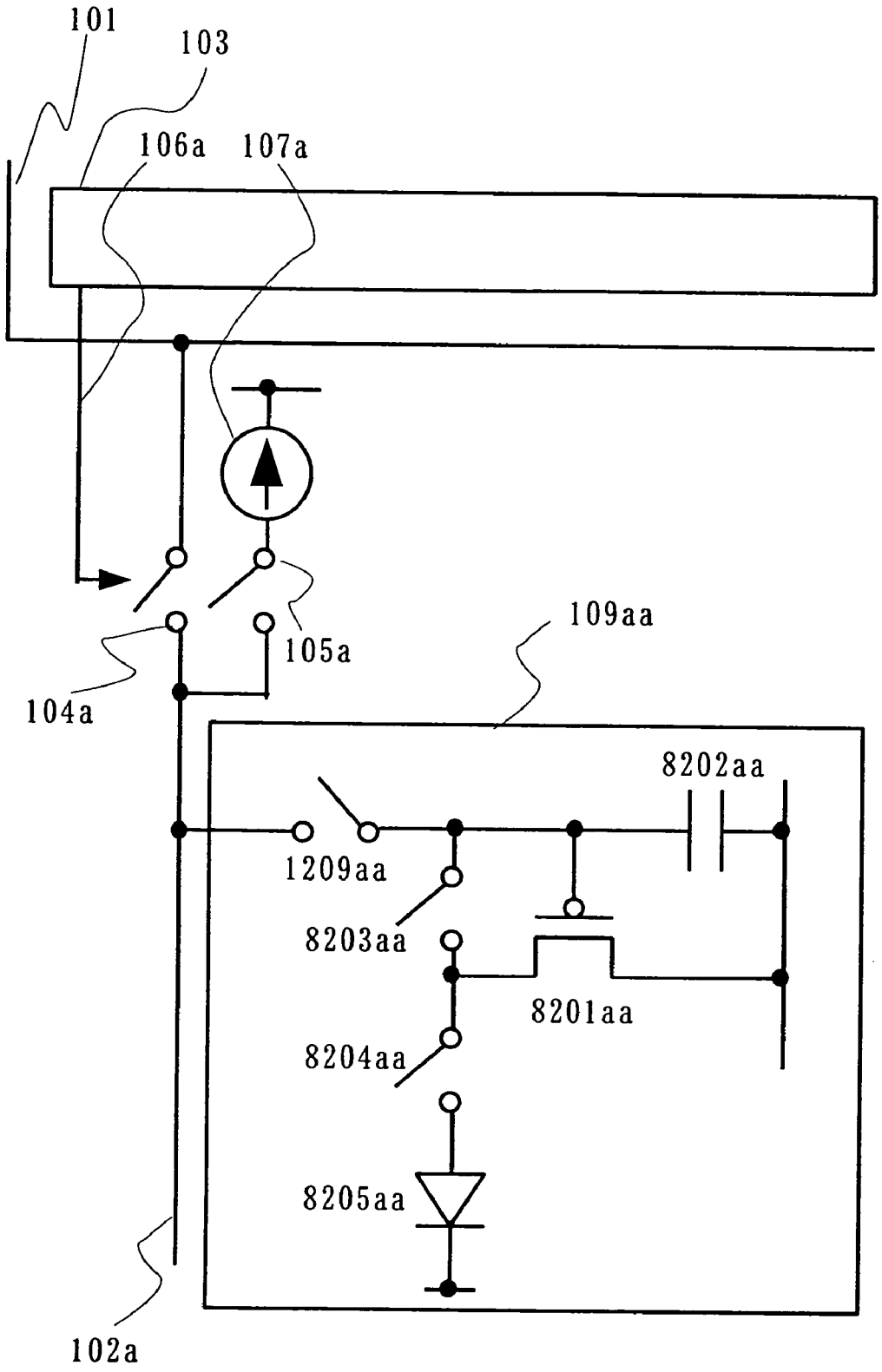
[FIG. 82] diagram illustrating a configuration of a semiconductor device in accordance with the invention
Figure 83:
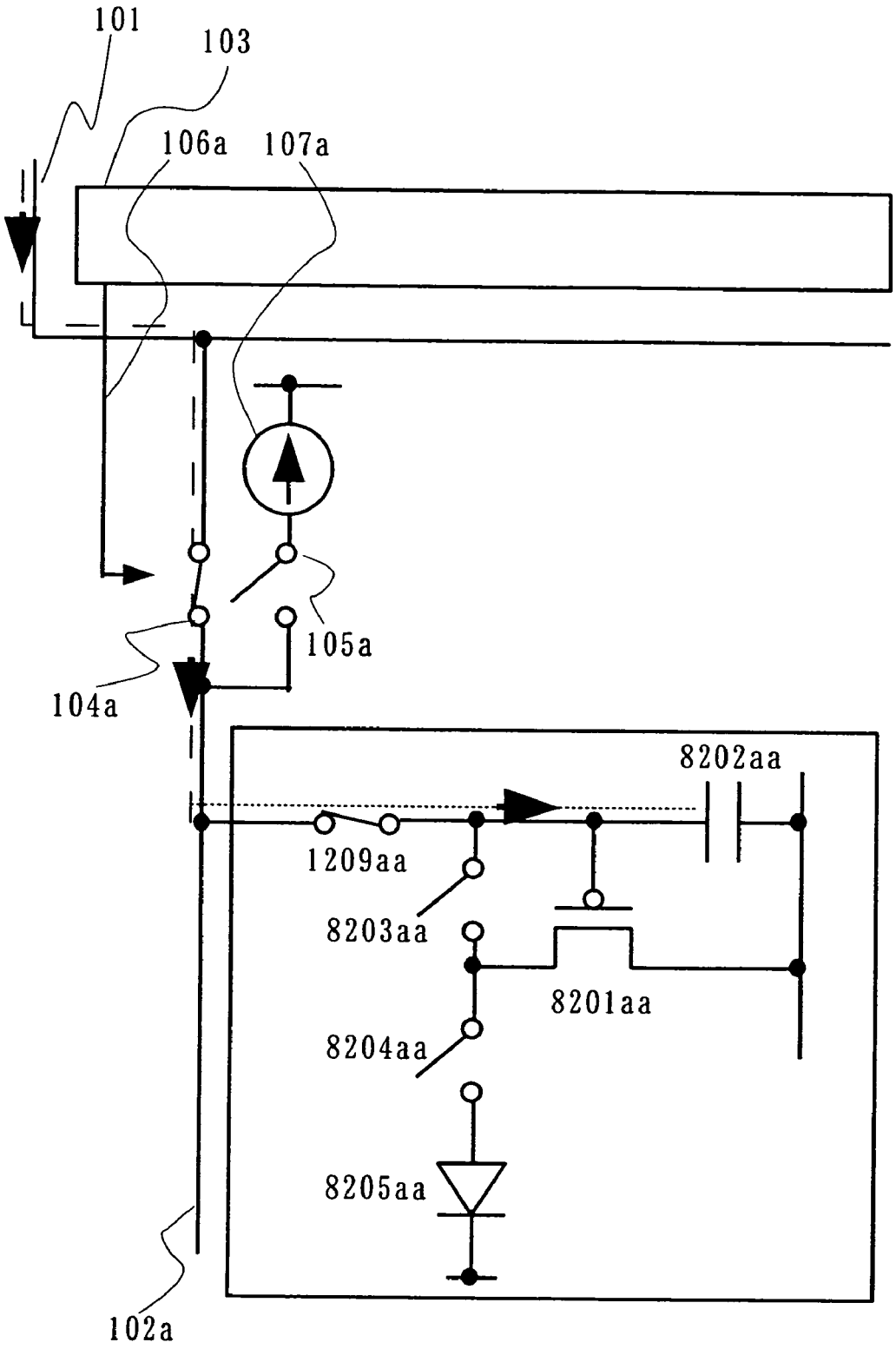
[FIG. 83] diagram illustrating an operation of a semiconductor device in accordance with the invention
Figure 84:
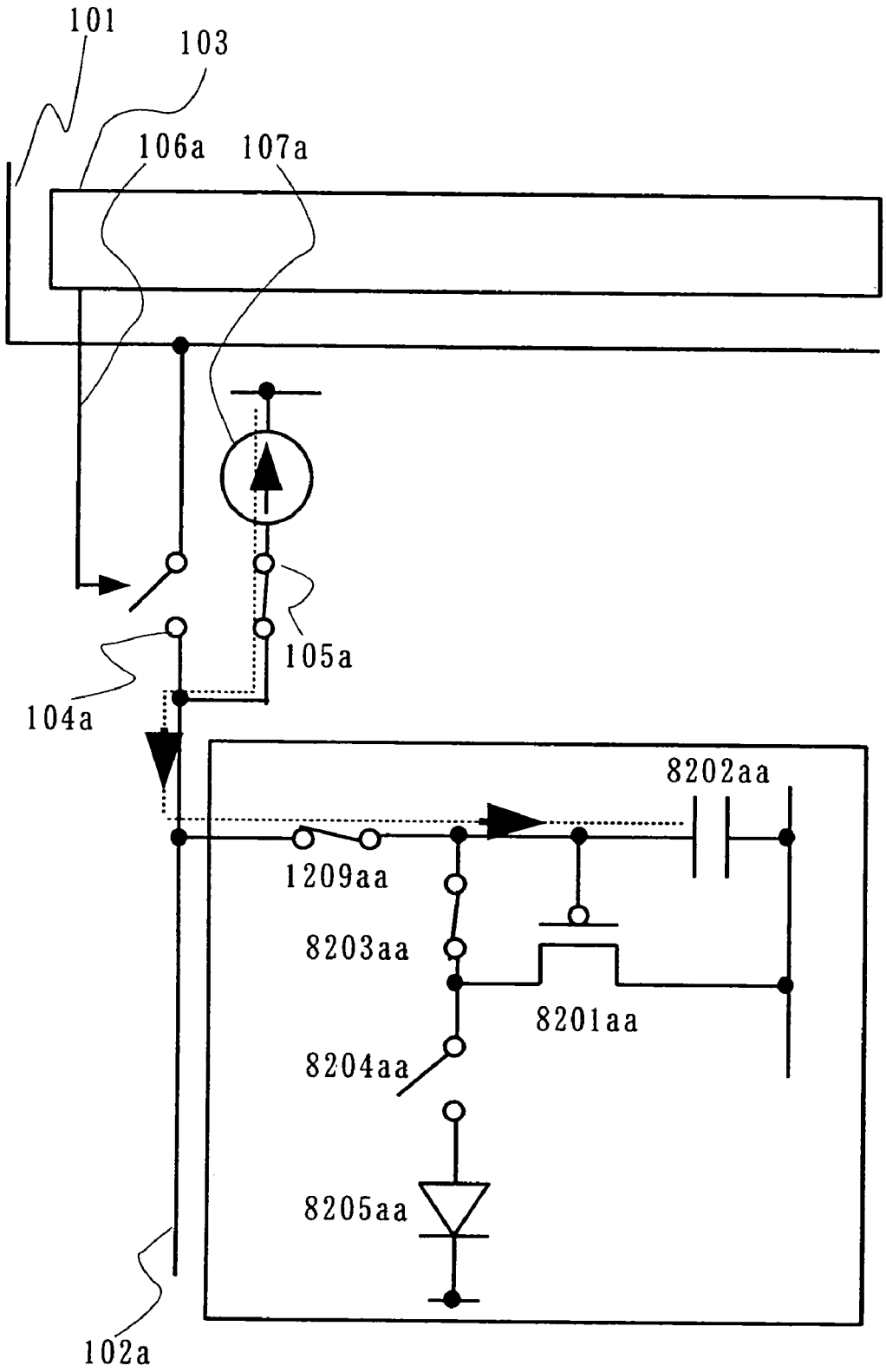
[FIG. 84] diagram illustrating an operation of a semiconductor device in accordance with the invention
Figure 85:
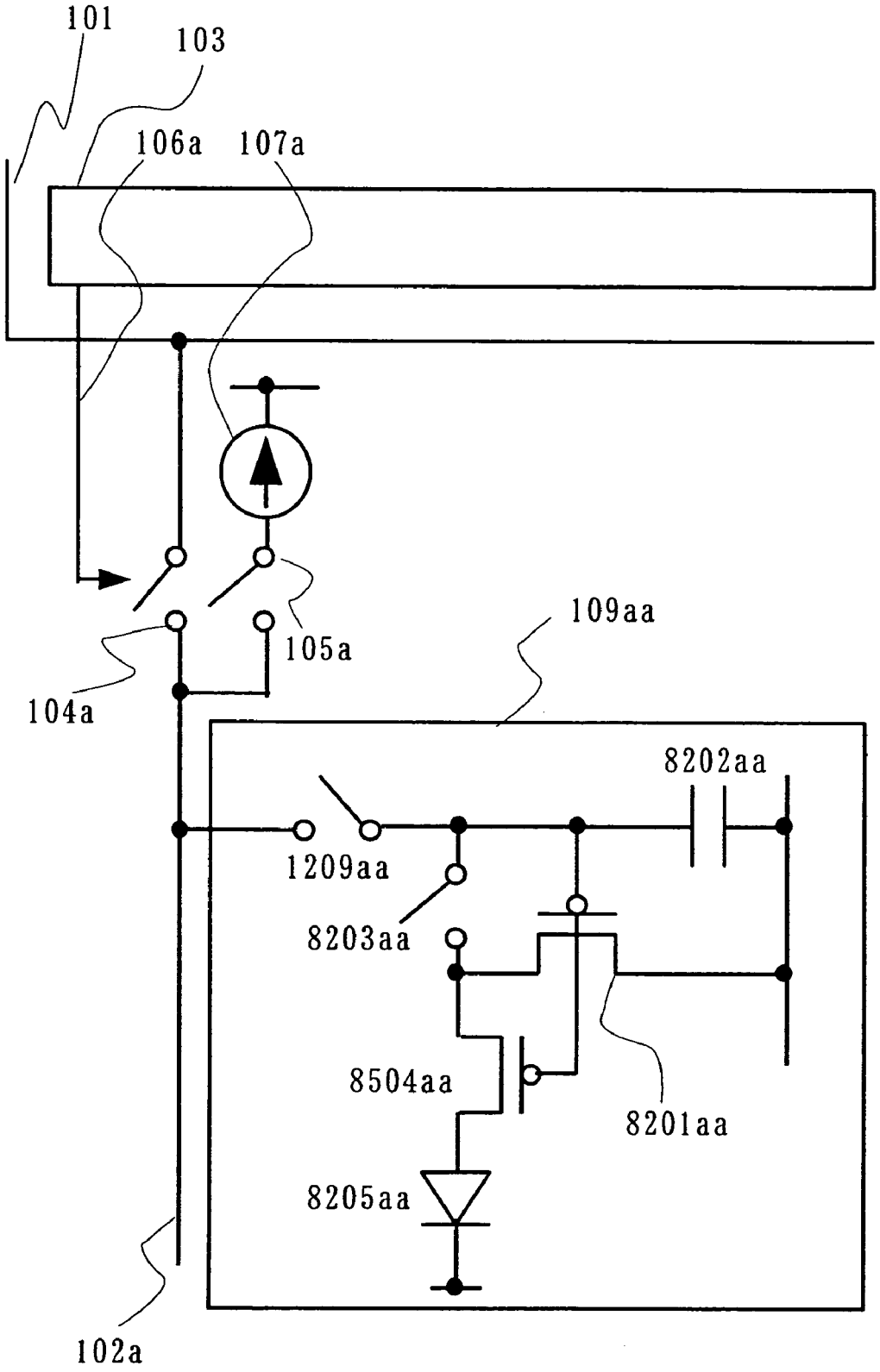
[FIG. 85] diagram illustrating a configuration of a semiconductor device in accordance with the invention
Figure 86:
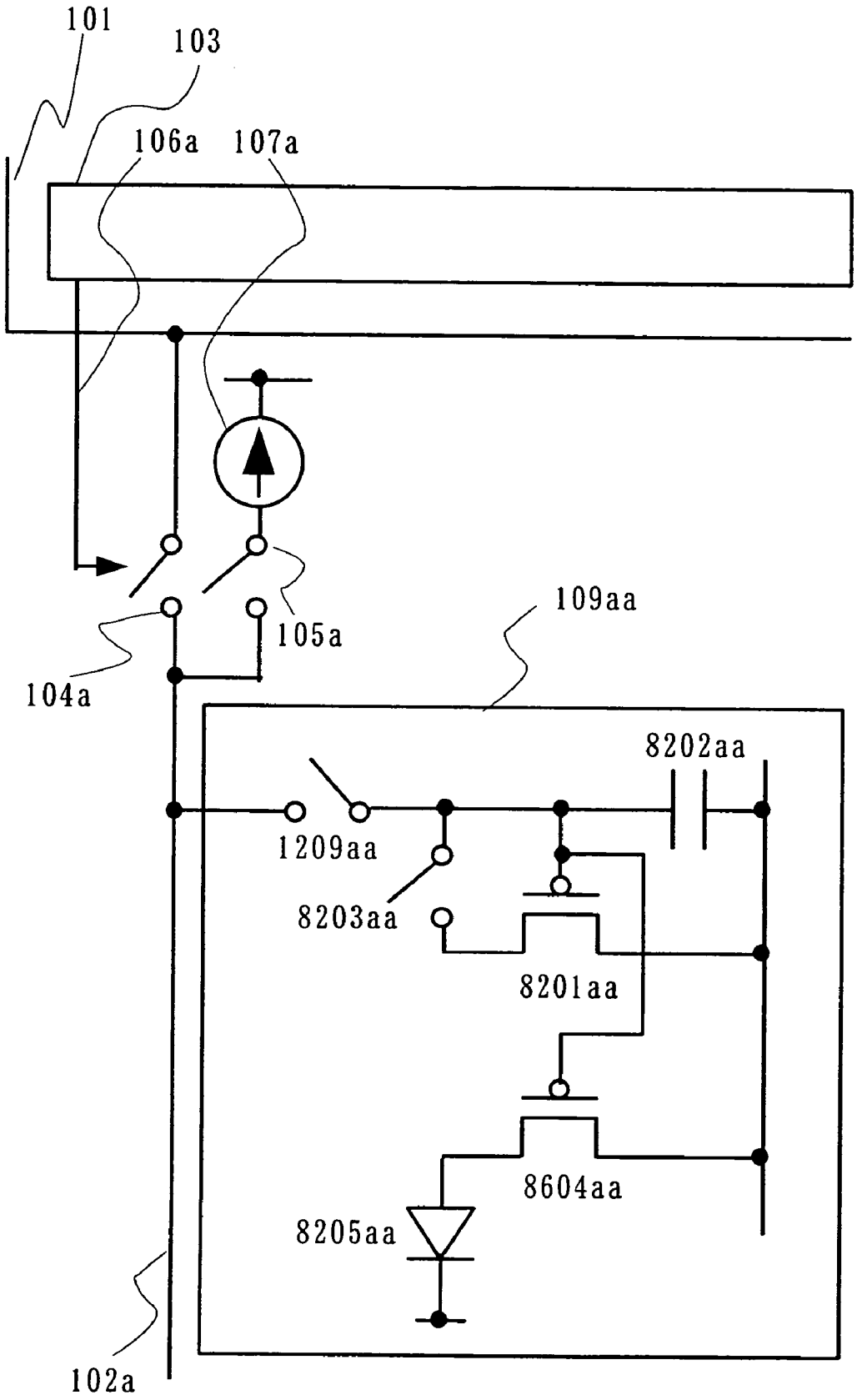
[FIG. 86] diagram illustrating a configuration of a semiconductor device in accordance with the invention
Figure 87A:
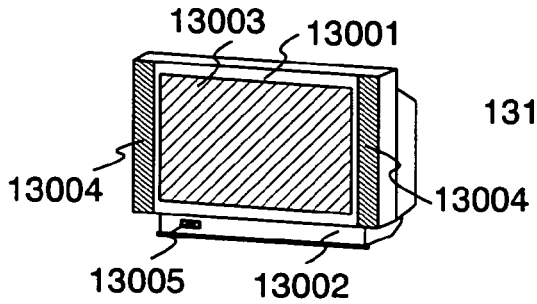
[FIG. 87] diagrams illustrating electronic appliances to which the invention can be applied
Figure 87B:
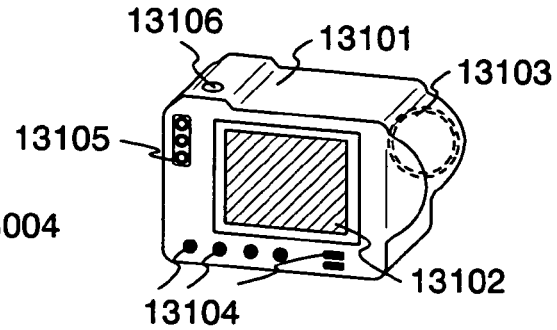
Figure 87C:
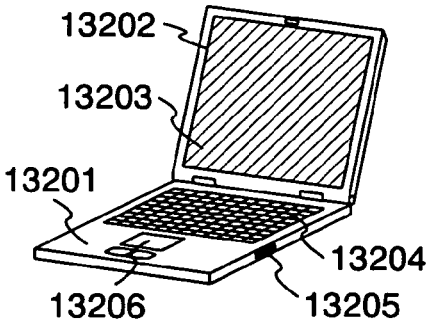
Figure 87D:
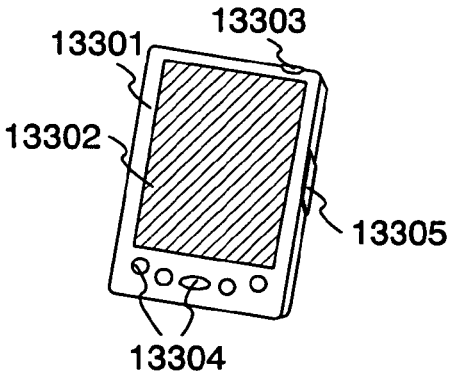
Figure 87E:
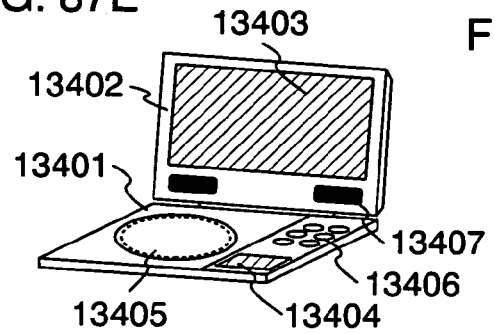
Figure 87F:
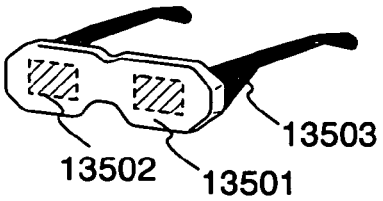
Figure 87G:
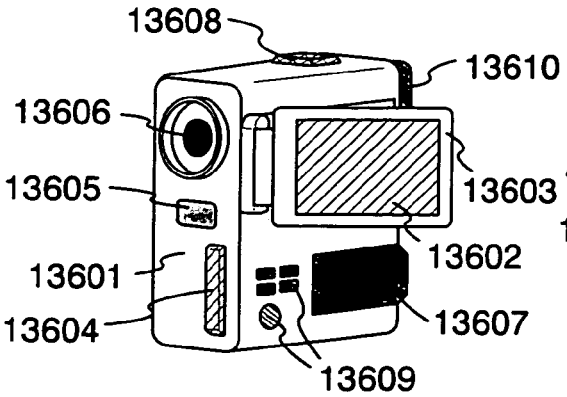
Figure 87H:
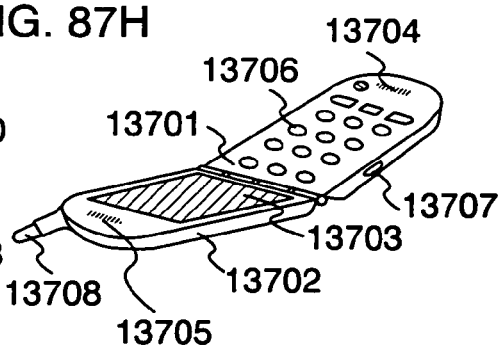
Figure 88:
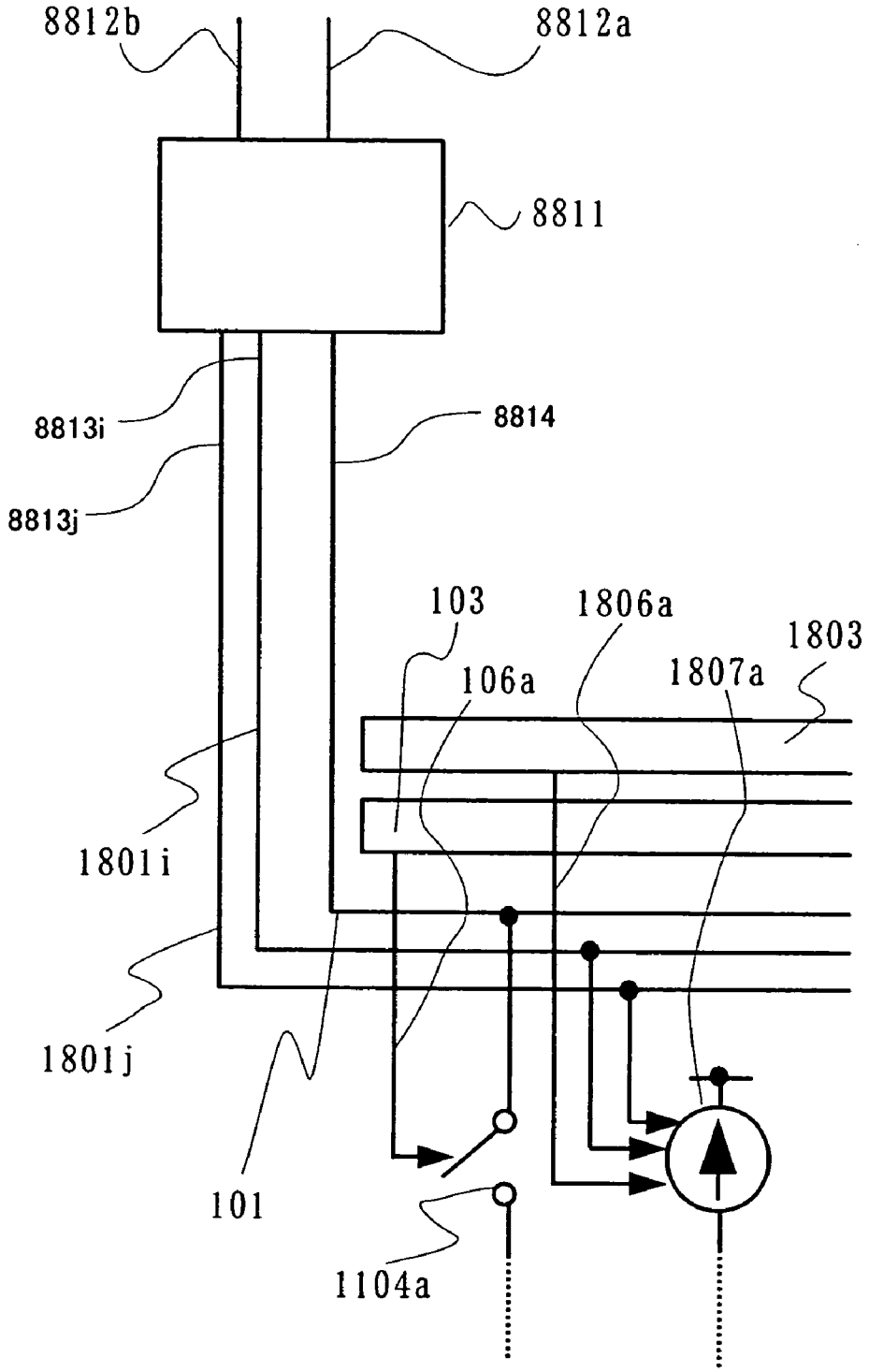
[FIG. 88] diagram illustrating a configuration of a semiconductor device in accordance with the invention
Figure 89:
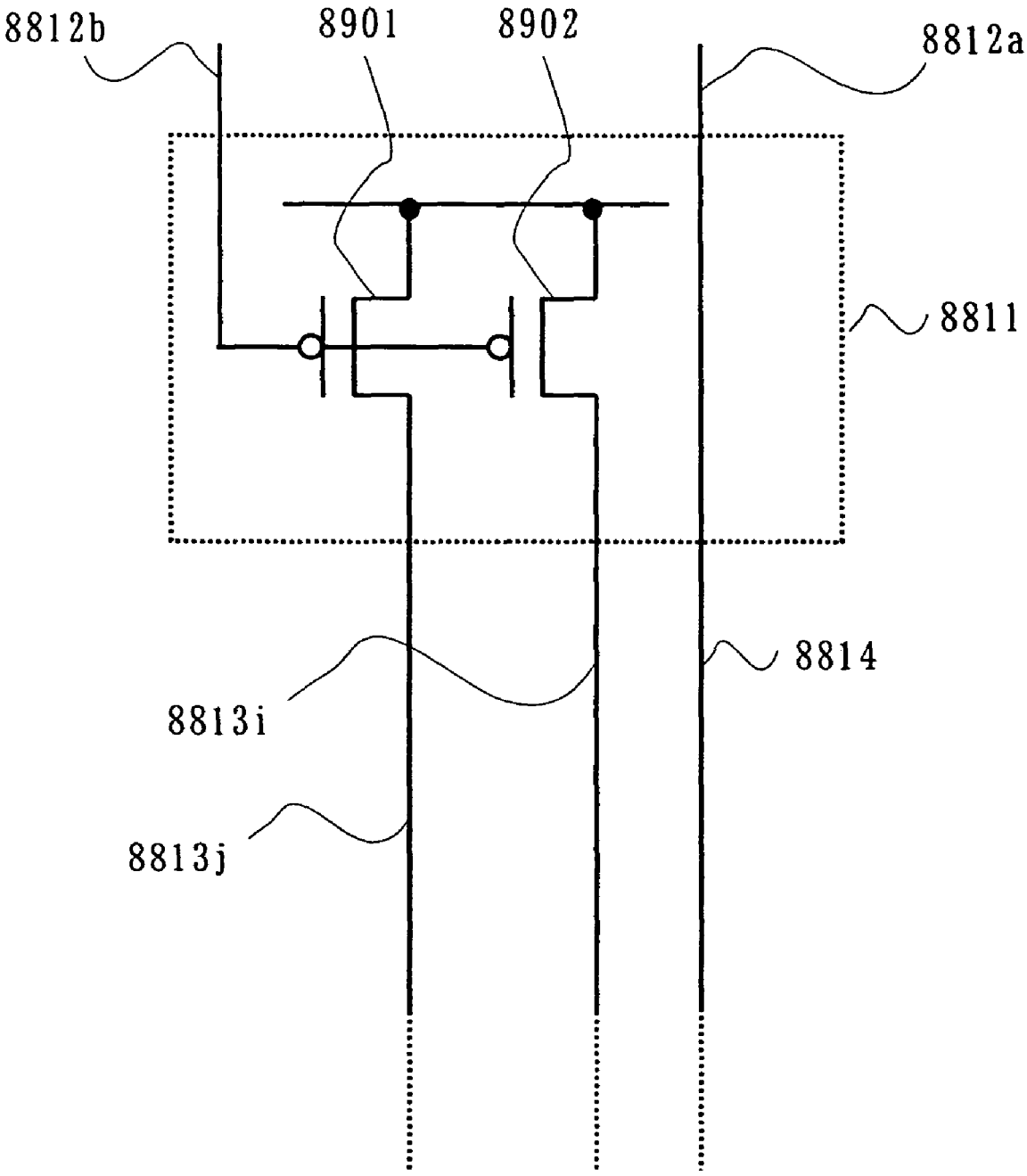
[FIG. 89] diagram illustrating a configuration of a semiconductor device in accordance with the invention.

What is claimed is:

1. A semiconductor device comprising:

a pixel portion including a first pixel, a second pixel and a third pixel;

a first line electrically connected to the first pixel;

a second line electrically connected to the second pixel;

a third line electrically connected to the third pixel;

a first circuit configured to output a first voltage signal corresponding to a first display level, a second voltage signal corresponding to a second display level, and a third voltage signal corresponding to a third display level;

a fourth line electrically connected to an output terminal of the first circuit;

a first current source circuit configured to output a first current signal having a first level that corresponds to the first display level;

a second current source circuit configured to output a second current signal having a second level that corresponds to the second display level;

a third current source circuit configured to output a third current signal having a third level that corresponds to the third display level;

a first switch, wherein the first line and the fourth line are electrically connectable with each other through the first switch;

a second switch, wherein the first current source circuit and the first line are electrically connectable with each other through the second switch;

a third switch, wherein the second line and the fourth line are electrically connectable with each other through the third switch;

a fourth switch, wherein the second current source circuit and the second line are electrically connectable with each other through the fourth switch;

a fifth switch, wherein the third line and the fourth line are electrically connectable with each other through the fifth switch;

a sixth switch, wherein the third current source circuit and the third line are electrically connectable with each other through the sixth switch; and a second circuit configured to select the first, third and fifth switches sequentially, wherein, in a single horizontal display period, the second, fourth and sixth switches are selected concurrently after the first, third and fifth switches are selected sequentially.

2. The semiconductor device according to claim 1, wherein each of the first to third pixels comprises a thin film transistor.

3. The semiconductor device according to claim 1, wherein the first circuit comprises a thin film transistor.

4. The semiconductor device according to claim 1, wherein the first circuit is formed on a single crystalline substrate.

5. A semiconductor device comprising:

a first circuit configured to output a first voltage signal corresponding to a first display level, a second voltage signal corresponding to a second display level, and a third voltage signal corresponding to a third display level;

a first current source circuit configured to output a first current signal having a first level that corresponds to the first display level;

a second current source circuit configured to output a second current signal having a second level that corresponds to the second display level;

a third current source circuit configured to output a third current signal having a third level that corresponds to the third display level;

a first switch, wherein the first circuit and a first line are electrically connectable with each other through the first switch;

a second switch, wherein the first current source circuit and the first line are electrically connectable with each other through the second switch;

a third switch, wherein the first circuit and a second line are electrically connectable with each other through the third switch;

a fourth switch, wherein the second current source circuit and the second line are electrically connectable with each other through the fourth switch;

a fifth switch, wherein a third line and the first circuit are electrically connectable with each other through the fifth switch;

a sixth switch, wherein the third current source circuit and the third line are electrically connectable with each other through the sixth switch; and a second circuit configured to select the first, third and fifth switches sequentially, wherein, in a single horizontal display period, the second, fourth and sixth switches are selected concurrently after the first, third and fifth switches are selected sequentially.

6. The semiconductor device according to claim 5, wherein the first circuit, the second circuit and the first to sixth switches are formed on a glass substrate.

7. The semiconductor device according to claim 5, wherein at least part of the first circuit, the second circuit and the first to sixth switches is formed on a single crystalline substrate.

8. A semiconductor device comprises:

a pixel portion including a first pixel, a second pixel and a third pixel;

a first line electrically connected to the first pixel;

a second line electrically connected to the second pixel;

a third line electrically connected to the third pixel; and a driver circuit electrically connected to the first to third lines, and comprising:

a first circuit configured to output a first voltage signal corresponding to a first display level, a second voltage signal corresponding to a second display level, and a third voltage signal corresponding to a third display level;

a first current source circuit configured to output a first current signal having a first level that corresponds to the first display level;

a second current source circuit configured to output a second current signal having a second level that corresponds to the second display level;

a third current source circuit configured to output a third current signal having a third level that corresponds to the third display level;

a first switch, wherein the first circuit and the first line are electrically connectable with each other through the first switch;

a second switch, wherein the first current source circuit and the first line are electrically connectable with each other through the second switch;

a third switch, wherein the first circuit and the second line are electrically connectable with each other through the third switch;

a fourth switch, wherein the second current source circuit and the second line are electrically connectable with each other through the fourth switch;

a fifth switch, wherein the third line and the first circuit are electrically connectable with each other through the fifth switch;

a sixth switch, wherein the third current source circuit and the third line are electrically connectable with each other through the sixth switch; and a second circuit configured to select the first, third and fifth switches sequentially, wherein, in a single horizontal display period, the second, fourth and sixth switches are selected concurrently after the first, third and fifth switches are selected sequentially.

9. The semiconductor device according to claim 8, wherein each of the first to third pixels comprises a thin film transistor.

10. The semiconductor device according to claim 8, wherein the driver circuit comprises a thin film transistor.

11. The semiconductor device according to claim 8, wherein at least part of the driver circuit is formed on a single crystalline substrate.

* * * * *

UNITED STATES PATENT AND TRADEMARK OFFICE

CERTIFICATE OF CORRECTION

PATENT NO. : 8,378,939 B2
APPLICATION NO. : 10/886374
DATED : February 19, 2013
INVENTOR(S) : Kimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1083 days.

Signed and Sealed this
Second Day of December, 2014

Michelle K. Lee

Michelle K. Lee
*Deputy Director of the United States Patent and Trademark Office*